US006924076B2

(12) United States Patent
Saiki et al.

(10) Patent No.: US 6,924,076 B2
(45) Date of Patent: Aug. 2, 2005

(54) DEVELOPING ASSEMBLY, PROCESS CARTRIDGE AND IMAGE-FORMING METHOD

(75) Inventors: Kazunori Saiki, Kanagawa (JP); Yasuhide Goseki, Kanagawa (JP); Masayoshi Shimamura, Kanagawa (JP); Yasutaka Akashi, Kanagawa (JP); Kenji Fujishima, Kanagawa (JP); Satoshi Otake, Shizuoka (JP); Naoki Okamoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 81 days.

(21) Appl. No.: 10/218,464

(22) Filed: Aug. 15, 2002

(65) Prior Publication Data

US 2003/0215731 A1 Nov. 20, 2003

(30) Foreign Application Priority Data

Aug. 20, 2001 (JP) ..... 2001-248664

(51) Int. Cl.[7] ..... G03G 13/22

(52) U.S. Cl. ..... 430/124; 430/110.3; 399/284; 399/286

(58) Field of Search ..... 430/110.3, 124; 399/284, 286

(56) References Cited

U.S. PATENT DOCUMENTS

| | | | | |
|---|---|---|---|---|
| 5,034,300 A | | 7/1991 | Anno et al. | 430/120 |
| 5,282,007 A | | 1/1994 | Oshiumi | 355/296 |
| 5,283,618 A | | 2/1994 | Hosoya et al. | 355/269 |
| 5,432,037 A | | 7/1995 | Nishikiori et al. | 430/126 |
| 5,721,433 A | | 2/1998 | Kosaka | 250/573 |
| 5,860,050 A | | 1/1999 | Shimamura et al. | 399/276 |
| 5,885,743 A | | 3/1999 | Takayanagi et al. | 430/110 |
| 5,976,755 A | | 11/1999 | Yoshida et al. | 430/126 |
| 5,998,008 A | | 12/1999 | Shimamura et al. | 428/323 |
| 6,033,817 A | * | 3/2000 | Yusa et al. | 430/106.6 |
| 6,060,202 A | | 5/2000 | Ogawa et al. | 430/111 |
| 6,081,681 A | | 6/2000 | Nagase et al. | 399/174 |
| 6,128,456 A | | 10/2000 | Chigono et al. | 399/176 |
| 6,205,314 B1 | | 3/2001 | Tanaka et al. | 399/286 |
| 6,391,511 B1 | * | 5/2002 | Okamoto et al. | 430/120 |

FOREIGN PATENT DOCUMENTS

| | | |
|---|---|---|
| EP | 0 810 492 | 12/1997 |
| EP | 0 869 399 | 10/1998 |
| EP | 0 869 404 | 10/1998 |
| EP | 0 950 928 | 10/1999 |
| EP | 0982 636 | 3/2000 |
| JP | 2-302772 | 12/1990 |
| JP | 5-2287 | 1/1993 |
| JP | 5-2289 | 1/1993 |
| JP | 5-53482 | 3/1993 |
| JP | 5-61383 | 3/1993 |
| JP | 5-150539 | 6/1993 |
| JP | 7-99442 | 10/1995 |
| JP | 8-136439 | 5/1996 |
| JP | 9-146293 | 6/1997 |
| JP | 9-160283 | 6/1997 |
| JP | 10-83096 | 3/1998 |
| JP | 10-307421 | 11/1998 |
| JP | 10-307455 | 11/1998 |
| JP | 10-307456 | 11/1998 |
| JP | 10-307457 | 11/1998 |
| JP | 10-307458 | 11/1998 |
| JP | 11-15206 | 1/1999 |
| JP | 11-95479 | 4/1999 |
| JP | 11-194530 | 7/1999 |
| JP | 11-288125 | 10/1999 |

* cited by examiner

*Primary Examiner*—John L Goodrow
(74) *Attorney, Agent, or Firm*—Fitzpatrick, Cella, Harper & Scinto

(57) ABSTRACT

In a developing assembly, a process cartridge and an image-forming method, a specific developer and a specific developer-carrying member are used in combination. The developer comprises toner particles containing at least a binder resin and a colorant, and conductive fine particles; the toner particles having a Circularity a of less than 0.970 as found from the following expression:

$$\text{Circularity } a = L_0/L$$

where $L_0$ represents the circumferential length of a circle having the same projected area as a particle image, and L represents the circumferential length of a projected image of a particle.

The developer-carrying member has at least a substrate and a resin coat layer formed on the substrate; the resin coat layer containing at least a coat layer binder resin and a positively chargeable material.

64 Claims, 8 Drawing Sheets

DEVELOPING ASSEMBLY, PROCESS CARTRIDGE AND IMAGE-FORMING METHOD

BACKGROUND OF THE INVENTION

1. Field of the Invention

This invention relates to a developing assembly used in an electrophotographic apparatus, an electrostatic recording apparatus, a magnetic recording apparatus or the like, and a process cartridge and an image-forming method which make use of the developing assembly.

More particularly, this invention relates to a developing assembly used in an image-forming apparatus such as a copying machine, a printer, a facsimile machine or a plotter, in which a toner image (developer image) is previously formed on an image-bearing member and thereafter the toner image is transferred to a recording medium such as a transfer material to form an image; a process cartridge having such a developing assembly and detachably mountable to such an image-forming apparatus; and an image-forming method making use of the developing assembly.

2. Related Background Art

In recent years, in image-forming methods carried out by electrophotography, contact charging assemblies have been proposed in large number and have been put into practical use as assemblies used to charge charging objects, such as latent-image-bearing members electrostatically, because of their advantages of lower ozone generation and lower power consumption than corona charging assemblies.

The contact charging assembly is an assembly in which a conductive charging member (contact charging member or contact charging assembly) of a roller type (charging roller), a fur brush type, a magnetic-brush type or a blade type is brought into contact with a charging object member, such as an image-bearing member, and a stated bias voltage is applied to this contact charging member to charge the surface of the charging object member electrostatically to the stated polarity and potential.

The charging roller is formed using a conductive or medium-resistance rubber material or foam. In some rollers, such a rubber material or foam is provided in layers to attain the desired characteristics.

The charging roller is provided with an elasticity in order to ensure the state of uniform contact between it and the charging object member. For this reason, it has a great frictional resistance, and in many cases it is driven to follow-up with, or at some difference in speed from, the rotation of the charging object member. Hence, any attempt to perform direct-injection charging may inevitably cause a decrease in absolute chargeability, a contact unevenness due to a shortage in contact performance and roller shape and a charging unevenness due to any deposits on the charging object member.

FIG. 2 is a graph showing examples of charging efficiency of contact charging in electrophotography. The bias voltage applied to the contact charging member is plotted along the abscissa, and the charge potential of the charging object (hereinafter "photosensitive member"), obtained there, is plotted along the ordinate.

Charge characteristics in the case of roller charging are represented by line A. That is, the surface potential of the photosensitive member begins to rise after the applied voltage exceeds a threshold value of about −500 V, and, at voltages higher than such threshold value, the photosensitive member surface potential increases linearly at a slope of 1 with respect to the applied voltage. This threshold value voltage is defined as the charging start voltage Vth. Accordingly, when the photosensitive member is charged to −500 V, it is common to employ a method in which a DC voltage of −1,000 V is applied, or, in addition to the charging voltage of −500 V, an AC voltage of, e.g., a peak-to-peak voltage of 1,200 V is applied so as to provide a potential difference larger than the discharge threshold value, to converge the photosensitive member potential to the charge potential.

Namely, in order to obtain a photosensitive member surface potential Vd that is required in electrophotography, a DC voltage of "Vd+Vth", what is higher than is necessary, must be applied to the charging roller. The charging performed by applying only a DC voltage to the contact charging member in this way is called "DC charging".

In DC charging, however, it has been difficult to control the potential of the photosensitive member at the desired value because the resistance value of the contact charging member varies depending on environmental variations and also because the Vth varies with changes in layer thickness caused by the abrasion of the photosensitive member.

When the AC charging is performed in order to achieve uniform charging, ozone may be generated, the electric field generated by AC voltage may cause a vibrating noise (AC charging sound) between the contact charging member and the photosensitive member, and any discharging may remarkably cause deterioration or the like of the surface of the photosensitive member. Therefore, this practice has come into question.

The fur brush charging method is one in which, using as a contact charging member a member having a conductive-fiber brush portion (a fur brush charging assembly), the conductive-fiber brush portion is brought into contact with a photosensitive member as the charging object, and a stated charging bias is applied to the conductive-fiber brush portion to charge the surface of the photosensitive member electrostatically to the stated polarity and potential.

For the fur brush charging assembly, a fixed type and a roll type have been put into practical use. The one in which medium-resistance fibers formed in a folded pile on a base cloth have been bonded to an electrode is the fixed type. The roll type is formed by winding pile around a mandrel. Those having a fiber density of about 100 fibers/mm$^2$ are obtained relatively with ease, but are still insufficient for contact performance in order to perform well uniform charging by direct-injection charging. In order to well perform uniform charging by direct-injection charging, the fur brush charging assembly must be made to have a velocity different from that of the photosensitive member; the difference is so large as to make machine construction difficult. This is not realistic.

Charge characteristics of this fur brush charging at the time of application of DC voltage are as shown by line B in FIG. 2. Hence, in the case of fur brush charging, too, in both the fixed type and the roll type, the charging is performed under the application of a high charging bias voltage in many cases to utilize the phenomenon of discharging.

In contrast to these, the magnetic-brush charging method is one in which, using as a contact charging member a member having a magnetic-brush portion (a magnetic-brush charging assembly) formed by confining conductive magnetic particles magnetically by means of a magnet roll, the magnetic-brush portion is brought into contact with a photosensitive member as the charging object, and a stated charging bias is applied to charge the surface of the photosensitive member electrostatically to the stated polarity and potential. In the case of this magnetic-brush charging, its charging mechanism is predominantly governed by a direct-injection charging mechanism.

As the conductive magnetic particles with which the magnetic-brush portion is constituted, those having a particle diameter of from 5 μm to 50 μm may be used, and a sufficient velocity differential from that of the photosensitive member may be provided, whereby almost uniform direct-injection charging can be performed.

Charge characteristics of the magnetic-brush charging at the time of the application of DC voltage are shown by line C in FIG. 2. As shown in FIG. 2, it is possible to attain a charge potential substantially proportional to the applied bias voltage.

Magnetic-brush charging, however, may also cause a difficulty that the conductive magnetic particles constituting the magnetic-brush portion come off to adhere to the photosensitive member. Thus, it is sought to provide an assembly for simple, stable and uniform charging, which can be operated by the direct-injection charging mechanism causing substantially no discharge products, such as ozone, and producing uniform charging at a low applied voltage.

Meanwhile, from the viewpoint of resource saving and waste reduction and in the sense of effective utilization of toners (developers), an image-forming method which does not bring any waste toner is desired. For example, what is called toner reuse has been put into practical use, in which, after a latent image on a latent-image-bearing member is developed with a toner to form a toner image as a visible image and the toner image is transferred to a recording medium such as paper, any toner having remained on the latent-image-bearing member without being transferred to the recording medium is removed by cleaning by various methods, and this toner is circulated into a developing assembly and reused. There, however, has been a problem that pressing a cleaning member against the latent-image-bearing member surface causes the latent-image-bearing member to wear to make the latent-image-bearing member have a short lifetime. Also, when viewed from the standpoint of the apparatus, the image-forming apparatus must be made larger in size in order to provide such a toner reuse assembly and a cleaning assembly. This has been a bottleneck in attempts to make the apparatus compact.

As a countermeasure therefor, as a system which does not bring any waste toner, also proposed is a technique called a cleaning-at-development or cleanerless system. Conventional techniques concerning the cleaning-at-development or cleanerless system are, as disclosed in Japanese Patent Application Laid-open No. 5-2287, focused on positive memory or negative memory appearing on images because of the influence of the transfer residual toner on images. However, in these days where electrophotography is greatly utilized, it has become necessary to transfer toner images to various recording media. In this sense, such techniques have not been satisfactory for various recording media.

The related art discloses techniques concerning the cleanerless system as seen in Japanese Patent Applications Laid-open Nos. 2-302772, 5-2289, 5-53482 and 5-61383. These, however, neither mention any desirable image-forming methods, nor refer to how the toner is constituted.

As developing systems in which the cleaning-at-development or cleanerless system is preferably applied, basically having no cleaning assembly, it has ever been considered essential for the system to be so made up that the latent-image-bearing member surface is rubbed with the toner and the toner-carrying member. Accordingly, studies have largely been made on contact developing systems in which the toner or developer comes into contact with a latent-image-bearing member. This is because, in order to collect the transfer residual toner in a developing means, it is considered advantageous for the system to be so made up that the toner or developer comes into contact with and rubs the latent-image-bearing member. However, in the cleaning-at-development or cleanerless process making use of a contact development system, its long-term service tends to cause deterioration of toner, deterioration of the toner-carrying member surface and deterioration or wear of the latent-image-bearing member surface, but any satisfactory solution has not been made for running performance. Accordingly, it has been sought to provide a cleaning-at-development system according to a non-contact developing system.

In this cleaning-at-development system or cleanerless image-forming method, the point is that the charge polarity and charge quantity of the transfer residual toner on the photosensitive member is controlled so that the transfer residual toner can stably be collected in the step of development and the collected toner may not make the developing performance poor. Accordingly, the charge polarity and charge quantity of the transfer residual toner on the photosensitive member is controlled by means of the charging member. This will be described specifically in the case of a commonly available laser beam printer.

In the case of reverse development making use of a charging member for applying a voltage with negative polarity, a negatively chargeable photosensitive member, and a negatively chargeable toner, in the transfer step thereof, the image rendered visible is transferred to the recording medium by means of a transfer member to which a voltage with positive polarity is applied. The charge polarity of the transfer residual toner varies because of its relation to the type of the recording medium (differences in thickness, resistance, dielectric constant and so forth) and the areas of images to produce a toner having positive charges and also even a toner having negative charges. However, when the photosensitive member is charged with a charging member having a negative polarity, the charge polarity of the transfer residual toner can uniformly be adjusted to the negative polarity together with the photosensitive member surface even if the polarity of the transfer residual toner has been shifted to the positive polarity in the transfer step. Hence, when reversal development is employed as the developing system, the transfer residual toner, which stands negatively charged, remains at light-area potential areas to be developed by toner. On the other hand, the toner present at dark-area potential areas not to be developed by toner is attracted toward the toner carrying member in relation to the development electric field and is collected without remaining on the photosensitive member having a dark-area potential. That is, the cleaning-at-development or cleanerless image-forming method can be established by controlling the charge polarity of transfer residual toner simultaneously with the charging of the photosensitive member by means of the charging member.

However, where the transfer residual toner has adhered to or mingled with the contact charging member beyond the contact charging member's capacity to control toner's charge polarity, it becomes impossible to uniformly adjust the charge polarity of the transfer residual toner, making it difficult to collect the toner in the step of development. Also, even where the transfer residual toner has been collected on the toner-carrying member by mechanical force such as rubbing, the transfer residual toner may adversely affect the triboelectric chargeability of toner on the toner-carrying member, resulting in a lowering of developing performance, unless the charge of the transfer residual toner has not uniformly been adjusted. More specifically, in the cleaning-at-development or cleanerless image-forming method, the charge control performance at the time the transfer residual toner passes the charging member and the manner in which the transfer residual toner adheres to or mingles with the charging member are closely concerned with the running performance and image quality characteristics.

In the cleaning-at-development image-forming method, cleaning-at-development performance can be improved by improving charge control performance required when the transfer residual toner passes the charging member. As a proposal therefor, Japanese Patent Application Laid-open No. 11-15206 discloses an image-forming method making use of a toner having toner particles containing a specific carbon black and a specific azo type iron compound and having inorganic fine powder. It is also proposed, in the cleaning-at-development image-forming method, to improve cleaning-at-development performance by reducing the quantity of transfer residual toner, using a toner having a superior transfer efficiency, the shape factors of which have been specified. However, the contact charging used here also applies the discharge charging mechanism, which is not the direct injection charging mechanism, and has the above problem ascribable to discharge charging. Moreover, these proposals may be effective for keeping the charging performance of the contact charging member from decreasing because of the transfer residual toner, but can not be expected to be effective for actively improving the charging performance.

In addition, among commercially available electrophotographic printers, cleaning-at-development image-forming apparatus are also available in which a roller member, coming into contact with the photosensitive member, is provided between the transfer step and the charging step so that the performance of collecting the transfer residual toner at development can be assisted or controlled. Such image-forming apparatus have good cleaning-at-development performance and the waste toner can sharply be reduced, but involve a high cost and may adversely affect the advantage inherent in the cleaning-at-development system also in view of compact construction.

In order to prevent uneven charging to effect stable and uniform charging, the contact charging member may be coated with a powder on its surface coming into contact with the surface of the member to be charged. Such constitution is disclosed in Japanese Patent Publication No. 7-99442. However, the contact charging member (charging roller) is so constructed as to be follow-up rotated as the charging object member (photosensitive member) is rotated (without no velocity differential drive), and hence may remarkably cause less ozone products compared with corona charging assemblies such as Scorotron. However, the principle of charging is still chiefly the discharge charging mechanism like the case of the roller charging described previously. In particular, a voltage formed by superimposing AC voltage on DC voltage is applied in order to attain more stable charging uniformity, and hence the ozone products caused by discharging may more greatly occur. Accordingly, when the apparatus is used over a long period of time, difficulties, such as smeared images due to ozone products, tend to come out. Moreover, when the above construction is applied in cleanerless image-forming apparatus, any inclusion of the transfer residual toner makes it difficult for the coated powder, to stand adhered uniformly to the charging member, so that the effect of carrying out uniform charging may decrease.

Japanese Patent Application Laid-open No. 5-150539 also discloses that, in an image-forming method making use of contact charging, at least image-developing particles and conductive fine particles having an average particle diameter smaller than that of the image-developing particles are contained in a toner in order to prevent any charging obstruction which may be caused when toner particles or silica particles having not completely been removed by blade cleaning come to adhere to and accumulate on the surface of the charging means during repetition of image formation for a long time. However, the contact charging used here, or proximity charging, applies the discharge charging mechanism, which is not the direct injection charging mechanism, and has the above problem ascribable to discharge charging. Moreover, when this construction is applied in the cleanerless image-forming apparatus, the influence on charging performance of a larger quantity of conductive fine particles and transfer residual toner in the charging step than the apparatus having a cleaning mechanism, the influence on the collection of these large-quantity conductive fine particles and transfer residual toner in the developing step, and the influence on the developer's developing performance that is exercised by the conductive fine particles and transfer residual toner thus collected, is not addressed. Furthermore, when the direct injection charging mechanism is applied in the contact charging, the conductive fine particles can not be fed to the contact charging member in the necessary quantity, thereby causing faulty charging due to the influence of the transfer residual toner.

In proximity charging, it is also difficult to uniformly charge the photosensitive member because of the large-quantity conductive fine particles and transfer residual toner, and the effect of leveling patterns of the transfer residual toner cannot be obtained, to cause a pattern ghost because the transfer residual toner may shut out pattern-imagewise exposure light. In-machine contamination due to developer may further occur when a power source is instantaneously turned off or a paper jam occurs during image formation.

As countermeasures for these, Japanese Patent Application Laid-open No. 10-307456 discloses an image-forming apparatus in which a developer containing toner particles and conductive charge-accelerating particles having a particle diameter, which is ½ or smaller than the particle diameter of toner, is applied in a cleaning-at-development, image-forming method, making use of the direct injection charging mechanism. According to this proposal, a cleaning-at-development, image-forming apparatus can be obtained which can sharply reduce the quantity of waste toner and is advantageous for making the apparatus compact at a low cost, and good images are obtainable without causing any faulty charging and any shut-out or scattering of imagewise exposure light. It, however, is sought to make a further improvement.

Japanese Patent Application Laid-open No. 10-307421 also discloses an image-forming apparatus in which a developer containing conductive particles having a particle diameter which is 1/50 to ½ of the particle diameter of the toner is applied in a cleaning-at-development image-forming method, making use of the direct injection charging mechanism and the conductive particles are made to have a transfer accelerating effect.

Japanese Patent Application Laid-open No. 10-307455 still also discloses that, a conductive fine powder is controlled to have particle diameter not larger than the size of one pixel of constituent pixels, and the conductive fine powder is controlled to have a particle diameter of from 10 nm to 50 μm in order to attain better charging uniformity.

Japanese Patent Application Laid-open No. 10-307457 discloses that, taking account of the characteristics of human visual sensation, conductive fine particles are controlled to have a particle diameter of about 5 μm or less, and preferably from 20 nm to 5 μm, in order to make any influence of faulty charging on images visually recognizable with difficulty.

Japanese Patent Application Laid-open No. 10-307458 also discloses that a conductive fine powder is controlled to have a particle diameter not larger than the particle diameter of a toner to thereby prevent the conductive fine powder from obstructing the development by the toner at the time of development or prevent development bias from leaking through the conductive fine powder. At the same time, it discloses a cleaning-at-development image-forming method which makes use of the direct injection charging mechanism and in which the conductive fine powder is controlled to have a particle diameter larger than 0.1 μm to thereby eliminate a difficulty that the conductive fine powder may become buried in the image-bearing member to shut out imagewise exposure light, thus producing superior image recording. It, however, is sought to make further improvement.

Japanese Patent Application Laid-open No. 10-307456 discloses a cleaning-at-development image-forming apparatus in which a conductive fine powder is externally added to toner particles so that the conductive fine powder contained in the toner may adhere to an image-bearing member in the step of development, at least at a contact zone between a flexible contact charging member and the image-bearing member, and may remain and be carried on the image-bearing member also after the step of transfer so as to stand between them, to thereby obtain good images without causing neither faulty charging, nor shut-off of imagewise exposure light. In this proposal, however, there is room for further improvement in stable performances required when the apparatus is repeatedly used over a long period of time and in performances required when toner particles having a small particle diameter are used in order to achieve a higher resolution.

External addition of conductive particles whose average particle diameter has been specified is also proposed. For example, in Japanese Patent Application Laid-open No. 9-146293, a toner is proposed in which a fine powder A with an average particle diameter of from 5 nm to 50 nm and a fine powder B with an average particle diameter of from 0.1 μm to 3 μm are used as external additives, and have been made to adhere to toner base particles with particle diameters of from 4 μm to 12 μm, more strongly than a specified extent. This practice is designed to make small the proportion of fine powder B standing liberated and those coming off the toner base particles. In Japanese Patent Application Laid-open No.11-95479, also proposed is a toner containing conductive silica particles whose particle diameter has been specified and an inorganic oxide having been made hydrophobic. This is nothing but what aims at the action attributable to the conductive silica particles by which action any electric charges accumulated in the toner in excess are leaked to the outside.

In Japanese Patent Application Laid-open No. 11-194530, a toner is further proposed which has an external-additive fine powder A with a particle diameter of from 0.6 μm to 4 μm and an inorganic fine powder B and whose particle size distribution has been specified. This practice is designed to prevent the toner from deteriorating because of any inorganic fine powder B buried in toner base particles, by virtue of the presence of the external-additive fine powder A between them. Thus, nothing is taken into account with respect to any adhesion of the external-additive fine powder A to, or liberation from, the toner base particles. In Japanese Patent Application Laid-open No. 10-83096, proposed is a toner comprising spherical resin particles in which a colorant has been enclosed and to the particle surfaces of which fine silica particles have been added. This composition is designed to endow toner particle surfaces with conductivity to enable swift movement and exchange of electric charges across the toner particles and to improve the uniformity of triboelectric charging of the toner.

Thus, with respect to developers for use in the image-forming method having the step of injection charging or in the image-forming method having the step of cleaning-at-development or in the cleanerless image-forming method, sufficient studies have not been made on external additives. With respect to proposals on developers, inclusive of those on external additives, sufficient studies have also not been made to adapt to the cleaning-at-development image-forming method or the cleanerless image-forming method.

Now, image-forming apparatus are being increasingly sought that have a higher speed and a lower cost. For example, in prevalent laser printers utilizing an electrophotographic system, personal-use first-step machines called low-end machines, which have a printing speed of 6 to 8 sheets per minute, have been made higher-speed up to a printing speed of 10 to 15 sheets per minute, and also are being made to have a low price. Translating the printing speed into the image-bearing member movement speed (process speed), the speed has been made higher from about 50 mm/sec. to nearly 100 mm/sec., and it is thought that the speed will be made much higher in the future, too.

The collection performance on transfer residual toner in the cleaning-at-development system commonly tends to decrease with an increase in the process speed. The reasons for this are that making the process speed higher makes it difficult to well control the charging of transfer residual toner in primary charging, which tends to result in non-uniform charging of the transfer residual toner sent out from primary charging and directed to the collection at development, and that it tends to become difficult to keep the triboelectric chargeability of developer from being influenced by the inclusion of the transfer residual toner collected at development. This tendency is remarkable especially in non-contact development. This is presumed to be due to the fact that, in the collection of transfer residual toner in contact development, the electrostatic force acts more effectively upon contact of the developer-carrying member with the image-bearing member and also the physical force acts because of rubbing friction, and hence any lowering of collection performance on the transfer residual toner, caused by the increase in process speed, can be compensated for with ease.

The charging performance in direct-injection charging also tends to decrease with an increase in process speed. This is presumed to be due to a decrease in the probability of contact of the image-bearing member with the contact charging member via conductive fine particles and a shortening of the charging time for which electric charges are injected to charge the image-bearing member electrostatically. Moreover, where the ratio of the charging member movement speed to the image-bearing member movement speed is maintained or made higher with an increase in process speed, a great increase in torque may cause a cost increase, and the problem of in-machine contamination tends to occur, which is caused by any scratches of the image-bearing member and the charging member and any scattering of transfer residual toner adhering to or mingling with the charging member. Accordingly, it is sought to provide a developer and an image-forming method by which any faulty pattern recovery and image stain can be prevented from occurring and any lowering of charging performance on the image-bearing member after its repeated use can be made sufficiently small, maintaining a higher process speed and keeping the charging member movement speed low.

SUMMARY OF THE INVENTION

The present invention was made taking into account of the foregoing problems. Accordingly, an object of the present invention is to provide a developing assembly, a process cartridge and an image-forming method which enable formation of developer images by the cleaning-at-development system.

Another object of the present invention is to provide a developing assembly, a process cartridge, and an image-forming method which enable simple, stable and uniform charging by the direct-injection charging mechanism causing substantially no discharge products, such as ozone, to be produced and uniform charging at a low applied voltage.

Still another object of the present invention is to provide a developing assembly, a process cartridge, and an image-forming method which enable a sharp reduction of the quantity of waste toner and enable advantageous cleaning-at-development at a low cost and miniaturization of components.

A further object of the present invention is to provide an image-forming method having the step of cleaning-at-development, which can obtain good images stably even when toner particles with smaller particle diameter are used in order to make resolution higher, and a process cartridge employing such a method.

A still further object of the present invention is to provide a developing assembly, a process cartridge, and an image-forming method which make it hard to cause deterioration of a conductive coat layer at the surface of the developer-carrying member as a result of repeated copying or printing, promise a high running performance, and enable the formation of stable images.

A still further object of the present invention is to provide a developing assembly, a process cartridge, and an image-forming method which enable stable formation of images having a good character line sharpness, a high image density, and a high image quality level to occur over a long period of time without causing any problems such as a decrease in image density, or the production of a sleeve ghost and fog, even under different environmental conditions.

A still further object of the present invention is to provide a developer-carrying member that can control any non-uniform charging of toner on the surface of the developer-carrying member, which may occur when toners or developers with small particle diameter are used, and can quickly and properly impart charge to the toner or developer; and a developing assembly, a process cartridge, and an image-forming method that have or make use of such a developer-carrying member.

To achieve the above objects, the present invention provides a developing assembly, a process cartridge, and an image-forming method in all of which a specific developer and a specific developer-carrying member are used in combination.

The developer comprises toner particles containing at least a binder resin and a colorant, and conductive fine particles; the toner particles having a Circularity a of less than 0.970 as found from the following expression:

$$\text{Circularity } a = L_0/L$$

where $L_0$ represents the circumferential length of a circle having the same projected area as a toner particle image, and L represents the circumferential length of a projected image of a toner particle.

The developer-carrying member has at least a substrate and a resin coat layer formed on the substrate; the resin coat layer contains at least a coat layer binder resin and a positively chargeable material.

DETAILED DESCRIPTION OF THE PREFERRED EMBODIMENTS

Figure 1:
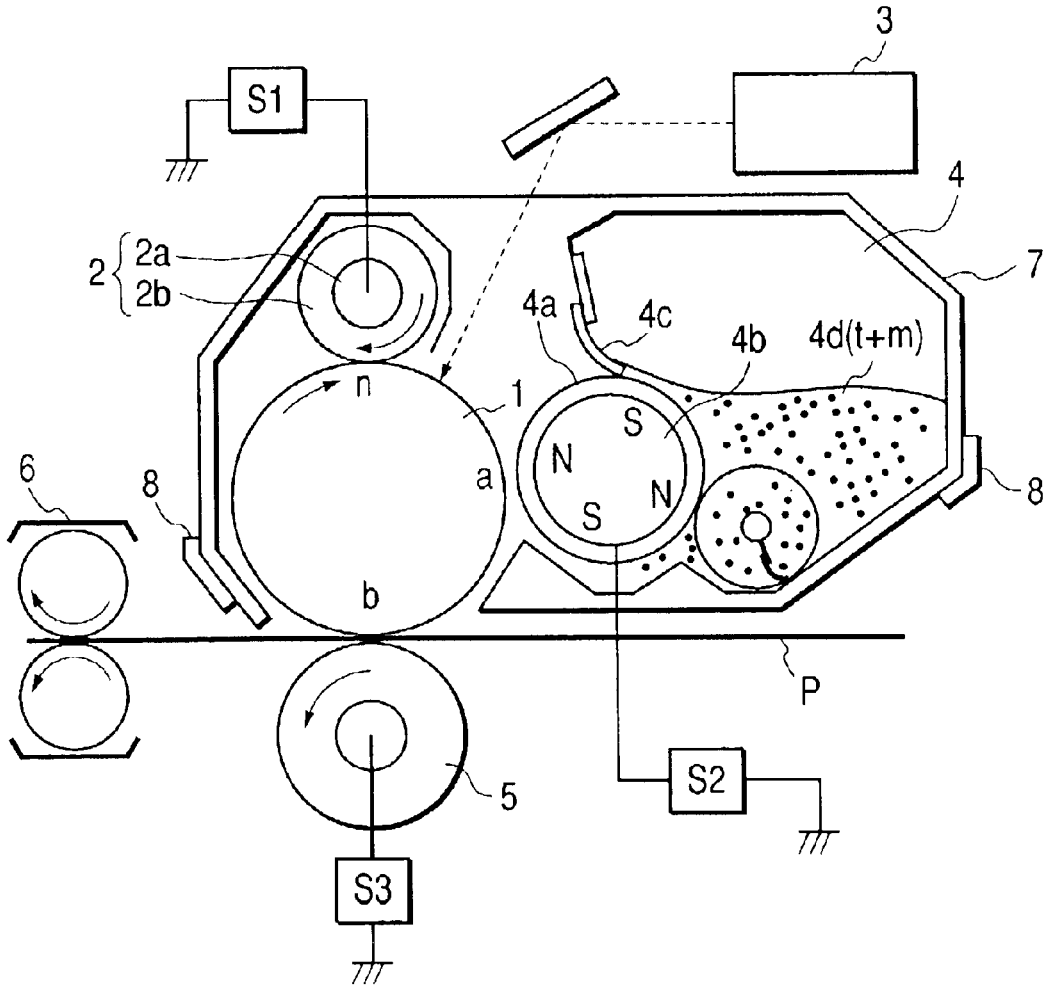
FIG. 1 is a schematic view showing the construction of an image-forming apparatus used in examples of the present invention.
Figure 2:
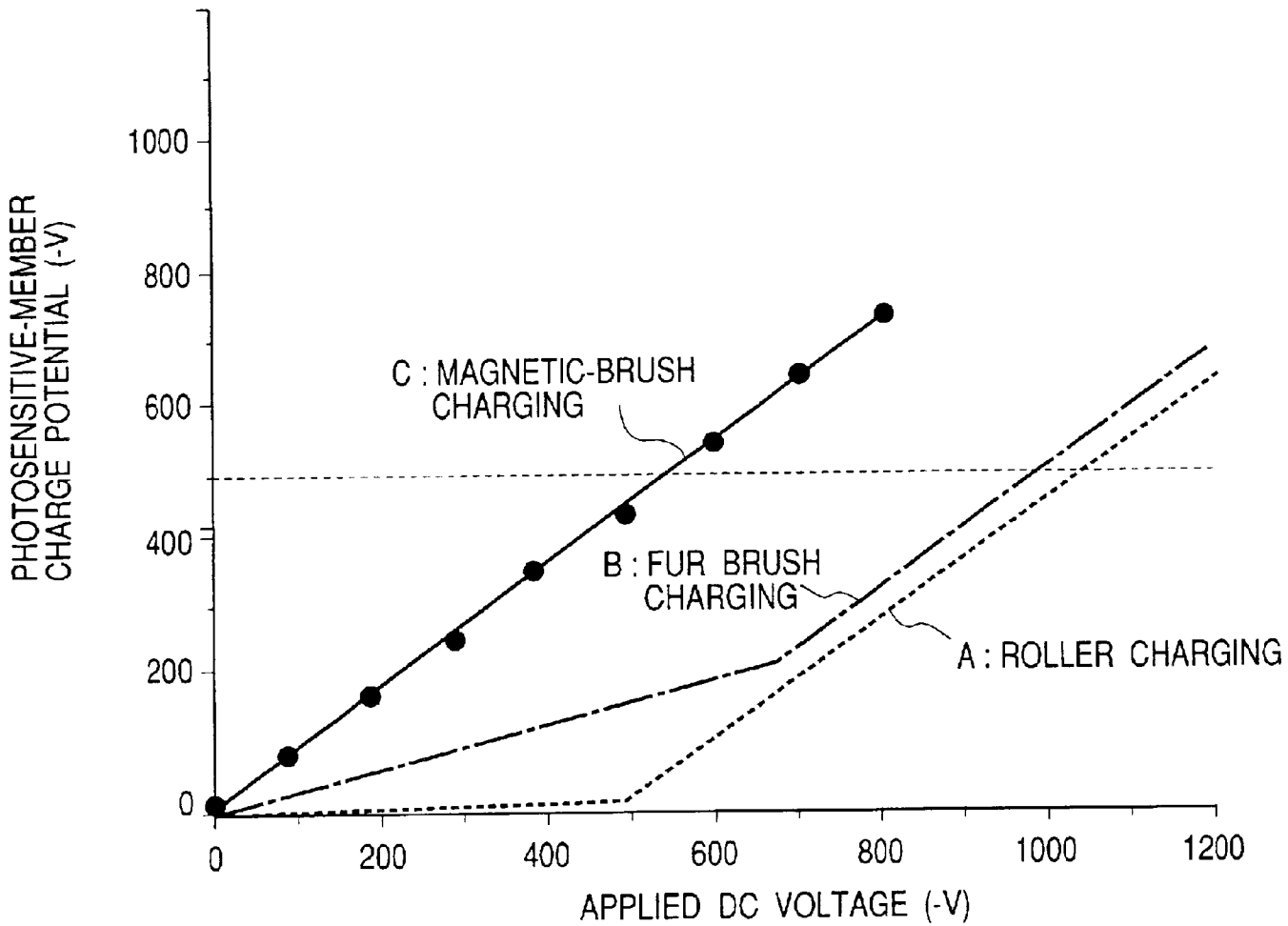
FIG. 2 is a graph showing charge characteristics of charging members.

The present invention is constructed as described below.

The developing assembly of the present invention is a developing assembly having at least a developing container for holding therein a developer, a developer-carrying member for holding thereon the developer held in the developing container and transporting the developer to a developing zone, and a developer layer thickness regulation member for regulating the layer thickness of the developer to be held on the developer-carrying member;

the developer comprising toner particles containing at least a binder resin and a colorant, and conductive fine particles; the toner particles having a Circularity a of less than 0.970 as found from the following expression:

$$\text{Circularity } a = L_0/L$$

where $L_0$ represents the circumferential length of a circle having the same projected area as a toner particle image, and L represents the circumferential length of a projected image of a toner particle; and the developer-carrying member having at least a substrate and a resin coat layer formed on the substrate; the resin coat layer containing at least a coat layer binder resin and a positively chargeable material.

The resin coat layer formed on the substrate of the developer-carrying member may preferably contain the coat layer binder resin and a conductive material.

The resin coat layer formed on the substrate of the developer-carrying member may preferably contain the coat layer binder resin and a lubricating material.

In the above developing assembly, the resin coat layer formed on the substrate of the developer-carrying member may preferably contain a nitrogen-containing heterocyclic compound as the positively chargeable material.

Then, the nitrogen-containing heterocyclic compound may preferably be an imidazole compound.

The imidazole compound may preferably a compound represented by the following Formula (1) or (2).

Formula (1)

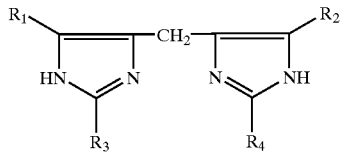

(1)

wherein $R_1$ and $R_2$ each represent a hydrogen atom or a substituent selected from the group consisting of an alkyl group, an aralkyl group and an aryl group, and $R_1$ and $R_2$ may be the same or different; and $R_3$ and $R_4$ each represent a straight-chain alkyl group having 3 to 30 carbon atoms, and $R_3$ and $R_4$ may be the same or different.

Formula (2)

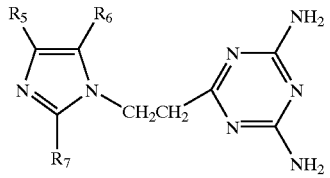

(2)

wherein $R_5$ and $R_6$ each represent a hydrogen atom or a substituent selected from the group consisting of an alkyl group, an aralkyl group and an aryl group, and $R_5$ and $R_6$ may be the same or different; and $R_7$ represents a straight-chain alkyl group having 3 to 30 carbon atoms.

The resin coat layer may preferably further contain, in addition to the conductive material and the nitrogen-containing heterocyclic compound, spherical particles having a number-average particle diameter of from 0.3 $\mu$m to 30 $\mu$m.

The spherical particles may preferably be resin particles.

The spherical particles may preferably be conductive spherical particles having a true density of 3 g/cm$^3$ or less.

In the above developing assembly, the resin coat layer formed on the substrate of the developer-carrying member may also preferably contain as the positively chargeable material a copolymer containing a unit derived from a nitrogen-containing vinyl monomer.

The nitrogen-containing vinyl monomer may preferably have a polymerizable vinyl monomer.

The copolymer may preferably have a weight-average molecular weight (Mw) of from 3,000 to 50,000.

The copolymer may preferably have a ratio of weight-average molecular weight (Mw) to number-average molecular weight (Mn), Mw/Mn, of 3.5 or less.

The nitrogen-containing vinyl monomer may preferably contain at least one monomer selected from the group consisting of an acrylic or methacrylic acid derivative having a nitrogen-containing group, and a nitrogen-containing heterocyclic N-vinyl compound.

The nitrogen-containing vinyl monomer may preferably be a monomer represented by the following Formula (3).

Formula (3)

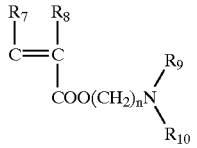

(3)

wherein $R_7$, $R_8$, $R_9$ and $R_{10}$ each represent a hydrogen atom or a saturated hydrocarbon group having 1 to 4 carbon atoms; and n represents an integer of 1 to 4.

In the above developing assembly, the resin coat layer formed on the substrate of the developer-carrying member may still also preferably contain as the positively chargeable material a binder resin and a copolymer of a polymerizable vinyl monomer with a sulfonic-acid-containing acrylamide monomer. Also, the coat layer binder resin may preferably have, partly or in its entirety, at least one of an —$NH_2$ group, an =NH group and an —NH— linkage in its molecular structure.

The copolymer may preferably contain the polymerizable vinyl monomer and the sulfonic-acid-containing acrylamide monomer in a copolymerization ratio (% by weight) of from 98:2 to 80:20, and have a weight-average molecular weight (Mw) of from 2,000 to 50,000.

The copolymer may preferably be a copolymer of a polymerizable vinyl monomer with 2-acrylamido-2-methylpropanesulfonic acid.

The binder resin may respectively contain at least a phenolic resin.

The phenolic resin may preferably be a phenolic resin produced using a nitrogen-containing compound as a catalyst, and have any of an —$NH_2$ group, an =NH group and an —NH— linkage in its structure.

The binder resin may preferably contain at least a polyamide resin.

The binder resin may preferably contain at least a polyurethane resin.

The resin coat layer may preferably contain particles in order to form an unevenness (hills and valleys) at the coat layer surface, and the particles may preferably have a number-average particle diameter of from 0.3 $\mu$m to 30 $\mu$m.

The particles for forming unevenness at the coat layer surface may preferably be spherical, and have a true density of 3 g/cm$^3$ or less.

The particles for forming unevenness at the coat layer surface may preferably be conductive spherical particles.

The developer layer thickness regulation member of the developing assembly of the present invention may preferably be a magnetic blade or an elastic blade.

The developer may preferably be a magnetic developer having magnetic toner particles.

The developer may preferably have a weight-average particle diameter (D4) of from 4 $\mu$m to 10 $\mu$m.

15% to 60% of the total numbers particles of developer preferably range in particle diameter from 1.00 $\mu$m to less than 2.00 $\mu$m and from 15% to 70% of the total number of developer particles range in particle diameter from 3.00 $\mu$m to less than 8.96 $\mu$m, in its number-based particle size distribution of particles having a particle diameter of from 0.60 $\mu$m to less than 159.21 $\mu$m.

The developer may preferably have, as the conductive fine particles, conductive fine particles having a volume-average particle diameter of from 0.1 μm to 10 μm.

The developer may preferably have, as the conductive fine particles, conductive fine particles having a volume resistivity of from $10^0$ Ω·cm to $10^9$ Ω·cm, and more preferably from $10^1$ Ω·cm to $10^6$ Ω·cm.

The conductive fine particles may preferably be non-magnetic.

The conductive fine particles may preferably contain at least one oxide selected from zinc oxide, tin oxide and titanium oxide.

The process cartridge of the present invention is a process cartridge in which an electrostatic latent image formed on a latent-image-bearing member is rendered visible as a developer image by the use of a developer and this visible developer image is transferred to a transfer material to form an image.

Then, the process cartridge of the present invention has at least a latent-image-bearing member for holding thereon an electrostatic latent image, a charging means for charging the latent-image-bearing member electrostatically, and a developing assembly for developing the electrostatic latent image formed on the latent-image-bearing member, by the use of a developer to form a developer image;

the developing assembly and the latent-image-bearing member being set integral as one unit and being so constructed as to be detachably mountable to the main body of an image-forming apparatus;

the developer comprising toner particles containing at least a binder resin and a colorant, and conductive fine particles; the toner particles having a Circularity a of less than 0.970 as found from the following expression:

$$\text{Circularity } a = L_0/L$$

where $L_0$ represents the circumferential length of a circle having the same projected area as a toner particle image, and L represents the circumferential length of a projected image of a toner particle; and the developing assembly having at least a developing container for holding therein the developer, a developer-carrying member for holding thereon the developer held in the developing container and transporting the developer to a developing zone, and a developer layer thickness regulation member for regulating the layer thickness of the developer to be held on the developer-carrying member;

the developer-carrying member having at least a substrate and a resin coat layer formed on the substrate; the resin coat layer containing at least a coat layer binder resin and a positively chargeable material.

In the process cartridge of the present invention, the developing assembly performs development of the electrostatic latent image formed on the latent-image-bearing member, by the use of the developer to render it visible as the developer image, and at the same time collects the developer having remained on the latent-image-bearing member after the developer image has been transferred to a recording medium transfer material.

The charging means may preferably be a charging member which is in contact with the latent-image-bearing member and charges the latent-image-bearing member electrostatically upon application of a voltage to the contact part.

The latent-image-bearing member may preferably be charged by applying the voltage in the state in which the conductive fine particles of the developer stand interposed at least at the contact zone between the charging means and the latent-image-bearing member.

In the above process cartridge, the developing assembly of the present invention as described previously may preferably be used.

The image-forming method of the present invention is an image-forming method having at least:

a charging step of charging a latent-image-bearing member electrostatically;

a latent-image-forming step of writing image information as an electrostatic latent image on the charged surface of the latent-image-bearing member having been charged in the charging step;

a developing step of developing the electrostatic latent image to render it visible as a developer image by means of a developing assembly having a developer-carrying member which, holding thereon a developer, transports the developer to a developing zone facing the latent-image-bearing member;

a transfer step of transferring the developer image to a transfer material; and a fixing step of fixing by a fixing means the developer image having been transferred to the transfer material;

these steps being repeated to form images;

the developer comprising toner particles containing at least a binder resin and a colorant, and conductive fine particles; the toner particles having a Circularity a of less than 0.970 as found from the following expression:

$$\text{Circularity } a = L_0/L$$

where $L_0$ represents the circumferential length of a circle having the same projected area as a toner particle image, and L represents the circumferential length of a projected image of a toner particle; and the developing assembly having at least a developing container for holding therein the developer, a developer-carrying member for holding thereon the developer held in the developing container and transporting the developer to a developing zone, and a developer layer thickness regulation member for regulating the layer thickness of the developer to be held on the developer-carrying member;

the developer-carrying member having at least a substrate and a resin coat layer formed on the substrate; the resin coat layer containing at least a coat layer binder resin and a positively chargeable material.

In the image-forming method of the present invention, the developing step comprises the step of rendering the electrostatic latent image visible, and at the same time collecting the developer having remained on the latent-image-bearing member after the developer image has been transferred to a recording medium transfer material.

In the charging step, a charging means may preferably come into contact with the latent-image-bearing member to charge the latent-image-bearing member electrostatically upon application of a voltage to the contact part.

In the charging step, the latent-image-bearing member may preferably be charged by applying the voltage in the state in which the conductive fine particles of the developer stand interposed at least at the contact zone between the charging means and the latent-image-bearing member.

In the above image-forming method, the developing assembly of the present invention as described previously may preferably be used.

Embodiments of the present invention are described below in detail.

(Developer)

As the developer used in the present invention, a one-component developer having at least toner particles and conductive fine particles is preferred.

The developer used in the present invention has at least i) toner particles containing at least a binder resin and a colorant and ii) conductive fine particles, and 15% to 60% of the total number of particles of the developer preferably range in particle diameter from 1.00 μm to less than 2.00 μm and from 15% to 70% of the total number of particles of the developer preferably range in particle diameter from 3.00 μm to less than 8.96 μm, in a number-based particle size distribution in the range of particle diameter of from 0.60 μm to less than 159.21 μm. It may further preferably contain as an external additive an inorganic fine powder having an average primary particle diameter of from 4 nm to 80 nm.

The use of such a developer can stably provide the developer with good chargeability, enables formation of good images without causing any faulty charging even when the developer is repeatedly used over a long period of time, and also enables the establishment of an image-forming method having the step of cleaning-at-development which can sharply reduce waste toner, can enjoy a low-cost and is advantageous for making the apparatus compact.

The use of such a developer also makes it able, with a simple construction and favorably, to perform charging by making use of the direct-injection charging mechanism, causing substantially no discharge products such as ozone, and uniform charging at a low applied voltage, and also enables the establishment of an image-forming method which can form good images without causing any faulty charging even when the developer is repeatedly used over a long period of time. Also, the use of such a developer enables the establishment of an image-forming method carried out by contact charging, which can keep uniform charging performance from decreasing even when developer components adhere to or mingle with the contact charging member in a large quantity and can keep faulty images from occurring because of any faulty charging for the latent-image-bearing member.

In the cleaning-at-development, image-forming method making use of such a developer, a developer is obtainable which can stably exhibit good triboelectric chargeability, and good images are obtainable without causing any faulty collection of transfer residual toner particles or any faulty images due to an obstruction of uniform charging or latent-image formation even when the developer is repeatedly used over a long period of time, and an image-forming method having the step of cleaning-at-development can be established which can sharply reduce waste toner, can enjoy a low-cost and is advantageous for making apparatus compact.

The conductive fine particles of the developer move from the developer-carrying member to the latent-image-bearing member in a proper quantity together with the toner particles when the electrostatic latent image formed on the latent-image-bearing member is developed. The developer image formed on the latent-image-bearing member as a result of the development of the electrostatic latent image is transferred to a transfer material such as paper in the transfer step. Here, the conductive fine particles on the latent-image-bearing member also adhere partly to the transfer material, but the rest adheres to and is held on the latent-image-bearing member to remain there. In the case of transfer performed under the application of a transfer bias with a polarity reverse to the charge polarity of the toner particles, the toner particles are attracted to the transfer material side to become transferred actively. However, the conductive fine particles on the latent-image-bearing member may transfer with difficulty because they are conductive. Hence, the conductive fine particles adhere partly to the transfer material but the rest adheres to and is held on the latent-image-bearing member to remain there.

In an image-forming method not having any step where the conductive fine particles having adhered to and having been held on the latent-image-bearing member to remain there are removed from the surface of the latent-image-bearing member as in the step of cleaning, the toner particles having remained on the surface of the latent-image-bearing member after the transfer step (hereinafter such toner particles are called "transfer residual toner particles") and the conductive fine particles are carried to the charging zone with movement of the face at which images are held on the latent-image-bearing member (hereinafter this face is called "image-bearing face"). More specifically, where a contact charging member is used in the charging step, the conductive fine particles are carried to the contact zone formed by contact of the latent-image-bearing member with the contact charging member, and adhere to or mingle with in the contact charging member. Hence, the contact charging of the latent-image-bearing member is performed in the state in which the conductive fine particles are interposed at the contact zone between the latent-image-bearing member and the contact charging member.

In the present invention, the conductive fine particles are positively (intentionally) carried to the charging part, whereby the contact resistance of the contact charging member can be maintained although the transfer residual toner particles adhere to or mingle with in the contact charging member to contaminate it. Hence, the latent-image-bearing member can well be charged by the contact charging member.

Where, however, the conductive fine particles do not stand interposed in a sufficient quantity at the charging zone of the contact charging member, the transfer residual toner particles may adhere to or mingle with the contact charging member to easily cause a low charging of the latent-image-bearing member, to cause image stain.

In addition, since the conductive fine particles positively (intentionally) carried to the contact zone formed by contact of the latent-image-bearing member with the contact charging member can maintain close contact performance and contact resistance of the contact charging member on the latent-image-bearing member, the direct-injection charging of the latent-image-bearing member can well be performed by the contact charging member.

The transfer residual toner particles having adhered to or mingled with the contact charging member are little by little sent out from the contact charging member onto the latent-image-bearing member to reach the developing zone with movement of the image-bearing face, where the cleaning-at-development process is performed in the developing step, i.e., the transfer residual toner particles are collected there. The conductive fine particles having adhered to or mingled with the contact charging member are also likewise little by little sent out from the contact charging member onto the latent-image-bearing member to reach the developing zone with movement of the image-bearing face. That is, the conductive fine particles are present on the latent-image-bearing member together with the transfer residual toner particles, and the transfer residual toner particles are collected in the developing step. Where the collection of transfer residual toner particles in the developing step utilizes a developing bias electric field, the transfer residual toner particles are collected by the aid of the developing bias electric field, whereas the conductive fine particles on the latent-image-bearing member are collected with difficulty because they are conductive. Hence, the conductive fine particles are partly collected but the rest adheres to and is held on the latent-image-bearing member to remain there.

According to studies made by the present inventors, it has been found that the feature that the conductive fine particles collected with difficulty in the developing step are present on the latent-image-bearing member brings about the effect of improving the performance of collecting the transfer residual toner particles. More specifically, the conductive fine particles on the latent-image-bearing member act as an assistant for collecting the transfer residual toner particles present on the latent-image-bearing member, to better ensure the collection of transfer residual toner particles in the developing step, so that image defects, such as positive ghost and fog, caused by any faulty collection of transfer residual toner particles, can effectively be prevented.

In the past, the external addition of conductive fine particles to developers has mostly been intended to control the triboelectric chargeability of toner by making conductive fine particles adhere to toner particle surfaces. Conductive fine particles liberated from or coming off the toner particles have been dealt with as a difficulty which causes change or deterioration of developer characteristics. In contrast thereto, the developer of the present invention makes the conductive fine particles liberated positively (intentionally) from the toner particle surfaces. In this point, it differs from the external addition of conductive fine particles to developers, which has conventionally been studied a great deal. Via the latent-image-bearing member surface after transfer, the conductive fine particles are carried to and become interposed at the charging zone which is the contact zone formed by contact of the latent-image-bearing member with the contact charging member, whereby the charging performance on the latent-image-bearing member is actively improved so that stable, even and uniform charging can be performed and any faulty images can be prevented from being caused by a low charging of the latent-image-bearing member. Also, since the conductive fine particles are present on the latent-image-bearing member in the developing step, the conductive fine particles act as an assistant for collecting the transfer residual toner particles present on the latent-image-bearing member, to better ensure the collection of transfer residual toner particles in the developing step, so that image defects such as positive ghost and fog caused by any faulty collection of transfer residual toner particles can effectively be prevented.

In the developer used in the present invention, the conductive fine particles which adhere to toner particle surfaces to behave together with the toner particles may less contribute to the promotion of charging of the latent-image-bearing member and the improvement in cleaning-at-development performance the developer in the present invention can bring out as its effect, so that the quantity of transfer residual toner particles may increase because of a lowering of the developing performance of toner particles, a lowering of the collection performance on the transfer residual toner particles in the cleaning-at-development step and a lowering of the transfer performance. This may cause a difficulty that the uniform charging is obstructed.

The conductive fine particles contained in the developer in the present invention move to the image-bearing face via the charging step and developing step with repetition of image formation, and are further carried again to the charging zone via the transfer step with movement of the image-bearing face. Thus, the conductive fine particles continue being successively fed to the charging zone. Accordingly, the conductive fine particles continue being successively fed to the charging zone even where the conductive fine particles have decreased as a result of, e.g., their coming off in the charging zone or where the ability of conductive fine particles to promote uniform charging performance has deteriorated. Hence, the charging performance on the latent-image-bearing member can be prevented from decreasing even when the apparatus is repeatedly used over a long period of time, and good uniform charging can stably be maintained.

According to studies made by the present inventors on how the particle diameter of the conductive fine particles added to the developer influences the promoting of the charging of the latent-image-bearing member and on the cleaning-at-development performance, those having a very small particle diameter (e.g., those of about 0.1 $\mu$m or less) among conductive fine particles tend to adhere so strongly to toner particle surfaces that the conductive fine particles can not sufficiently be fed to non-image areas on the latent-image-bearing member in the developing step. In the transfer step, too, the conductive fine particles are not liberated from the toner particle surfaces. Hence, the conductive fine particles can not positively (intentionally) be made to remain on the latent-image-bearing member after transfer and can not positively (intentionally) be fed to the charging zone. Hence, the effect of improving the charging performance on the latent-image-bearing member can not be obtained, and faulty images due to a lowering of the charging performance on the latent-image-bearing member may occur when the transfer residual toner particles adhere to or mingle with the contact charging member.

In addition, in the cleaning-at-development step, too, the effect of improving the collection performance on the transfer residual toner particles cannot be obtained because the conductive fine particles cannot be fed onto the latent-image-bearing member, and, even if they have been fed onto the latent-image-bearing member, because the conductive fine particles have too small particle diameter. Thus, image defects, such as positive ghost and fog, caused by any faulty collection of transfer residual toner particles, cannot effectively be prevented.

On the other hand, those having too large a particle diameter (e.g., those of about 4 $\mu$m or more) among conductive fine particles tend to come off from the charging member because of their large particle diameter even if they have been fed to the charging zone. This makes it difficult for the conductive fine particles to continue to be interposed at the charging zone stably and in a sufficient number of particles, and makes it impossible to promote the uniform charging of the latent-image-bearing member. Moreover, since the number of particles of the conductive fine particles per unit weight become smaller, it becomes inevitable to add the conductive fine particles to the developer in a large quantity in order to make the conductive fine particles be interposed at the charging zone in a number large enough for sufficiently obtaining the effect of promoting the uniform charging of the latent-image-bearing member (the conductive fine particles interposed at the charging zone are required to be in a large number of particles because the effect of promoting the uniform charging of the latent-image-bearing member can be made greater by enlarging the number of points of contact between the latent-image-bearing member and the conductive fine particles at the charging zone). However, the addition of the conductive fine particles in too large a quantity lowers the triboelectric chargeability and developing performance of the developer as a whole to cause a decrease in image density and toner scatter. Also, since the conductive fine particles have such a large particle diameter, the effect as an assistant for collecting the transfer residual toner particles in the developing step can not sufficiently be obtained. If the amount of the conductive fine particles present on the latent-image-bearing member is made too large in order to improve the collection of transfer residual toner particles, the conductive fine particles may adversely affect the latent-image-forming step because of their large diameter, e.g., may cause image defects due to shut-out of imagewise exposure light.

The present inventors have put forward their studies from those on the particle diameter of the conductive fine particles to further studies on particle size distribution of the developer containing an external additive, which is directly concerned with the behavior of actual developers. Then, as a result of extensive studies, they have accomplished the present invention.

More specifically, the developer is constructed to have at least toner particles containing at least a binder resin and a colorant, an inorganic fine powder whose primary particles have a number-average particle diameter of from 4 nm to 80 nm, and conductive fine particles, and from 15% to 60% of the total number of particles of the developer range in particle diameter from 1.00 μm to less than 2.00 μm and from 15% to 70% of the total number of particles range in particle diameter from 3.00 μm to less than 8.96 μm, in a number-based particle size distribution in the range of particle diameter of from 0.60 μm to less than 159.21 μm. This enables effective prevention of faulty charging of the latent-image-bearing member by contact charging, and enables improvement in uniform charging performance on the latent-image-bearing member in direct-injection charging. Also, the collection of transfer residual toner particles in the cleaning-at-development can be improved, and image defects, such as positive ghost and fog, caused by any faulty collection of transfer residual toner particles, can effectively be prevented.

To describe the above in greater detail, the inorganic fine powder of the developer in the present invention, whose primary particles have a number-average particle diameter of from 4 nm to 80 nm, adheres to toner particle surfaces to behave together with the toner particles, to improve the fluidity of the developer and make uniform the triboelectric charge characteristics of the toner particles. Hence, the transfer performance of the toner particles can be improved, the transfer residual toner particles can be made to mingle with the contact charging member in a smaller quantity, the charging performance on the latent-image-bearing member can be prevented from decreasing, and any load can be lessened when the transfer residual toner particles are collected in the developing step.

This inorganic fine powder adheres to toner particle surfaces to behave together with the toner particles and its primary particles have a number-average particle diameter of as small as from 4 nm to 80 nm. In the state it adheres to toner particles, it also has a particle diameter of primary particles and has a particle diameter of 0.1 μm or less even as agglomerates. Accordingly, it has substantially no influence on the number-based particle size distribution in the range of particle diameter of from 0.60 μm to less than 159.21 μm of the developer.

In contrast thereto, the conductive fine particles of the developer in the present invention contribute to the incorporation of the developer in which from 15% to 60% of the total number of the developer particles range in particle diameter from 1.00 μm to less than 2.00 μm in the number-based particle size distribution in the range of particle diameter of from 0.60 μm to less than 159.21 μm of the developer. Stated more specifically, the conductive fine particles of the developer of the present invention are those having particles ranging in particle diameter from 1.00 μm to less than 2.00 μm, and such conductive fine particles are so incorporated in the developer that the particles ranging in particle diameter from 1.00 μm to less than 2.00 μm are contained in the developer in the amount falling within the above range, whereby the effect of the present invention can be obtained.

According to studies made by the present inventors, it has been found that the feature that the conductive fine particles ranging in particle diameter from 1.00 μm to less than 2.00 μm are present in the developer is greatly effective for preventing the faulty charging of the latent-image-bearing member which is caused when the transfer residual toner particles adhere to or mingle with the contact charging member in contact charging, for improving the uniform charging performance on the latent-image-bearing member in direct-injection charging, and for effectively preventing the faulty charging and faulty collection of transfer residual toner particles in the image-forming method making use of cleaning-at-development. It has also been found that the particle diameter of the conductive fine particles is greatly concerned with the effect of the conductive fine particles in assisting the collecting of the transfer residual toner particles in the developing step, that there is a range of particle diameter of the conductive fine particles which is optimum in assisting the collecting the transfer residual toner particles, and that the content (% by number) of the conductive fine particles having the particle diameter particularly in the range of particle diameter of from 1.00 μm to less than 2.00 μm is greatly concerned with the effect as of assisting the collecting of the transfer residual toner particles.

The particles of conductive fine particles ranging in particle diameter from 1.00 μm to less than 2.00 μm may hardly strongly adhere to the toner particle surfaces, and are sufficiently fed up to non-image areas on the latent-image-bearing member in the developing step, where they are actively liberated from the toner particle surfaces in the transfer step and then fed to the charging zone with good efficiency via the latent-image-bearing face after transfer. Also, the above conductive fine particles, which can stand interposed in a uniformly dispersed state at the charging zone, has a great effect of promoting the charging of the latent-image-bearing member, and are stably retained at the charging zone. Hence, the charging performance on the latent-image-bearing member can be prevented from decreasing even when the image-forming apparatus is repeatedly used over a long period of time, and good uniform charging is stably maintained. Also, even where the charging member is inevitably contaminated by the transfer residual toner particles as in the cleaning-at-development image-forming method, the charging performance on the latent-image-bearing member can be prevented from decreasing. Moreover, since the conductive fine particles can efficiently be fed to the latent-image-bearing face after transfer to exhibit an especially excellent effect as the assistant for collecting the transfer residual toner particles, the performance of collecting the transfer residual toner particles in the cleaning-at-development step can be improved.

As described above, 15% to 60% of the number of particles of the developer used in the present invention have a particle diameter from 1.00 μm to less than 2.00 μm in a number-based particle size distribution in the range of particle diameter of from 0.60 μm to less than 159.21 μm. Controlling, within the above range, the content of particles ranging in particle diameter from 1.00 μm to less than 2.00 μm the above measurement range of particle diameter enables the improvement in uniform charging performance on the latent-image-bearing member in the charging step. Also, since the conductive fine particles can be made to be present stably at the charging zone in an appropriate quantity, any faulty exposure due to the presence of conductive fine particles in excess on the latent-image-bearing member can be prevented in the subsequent exposure step.

If the particles ranging in particle diameter from 1.00 μm to less than 2.00 μm are contained in the developer in an amount too small below the above range, the uniform charging performance on the latent-image-bearing member by contact charging can not sufficiently be improved, and the effect of effectively preventing the faulty collection of transfer residual toner particles in the cleaning-at-development cannot well be obtained. If, on the other hand, the particles ranging in particle diameter from 1.00 μm to less than 2.00 μm are contained in the developer in an amount too large beyond the above range, the conductive fine particles are fed to the charging zone in excess, and hence any conductive fine particles not completely retained at the charging zone may be sent out onto the latent-image-bearing member to such an extent that they shut out the exposure light, to cause image defects due to faulty exposure, or tend to scatter to greatly cause a difficulty such as in-machine contamination.

In the developer used in the present invention, the particles ranging in particle diameter from 1.00 μm to less than 2.00 μm in its number-based particle size distribution in the range of particle diameter of from 0.60 μm to less than 159.21 μm may preferably comprise 20% to 50%, and more preferably from 20% to 45%, of the number of developer particles. Controlling the content of the above particles within this range brings about more improvement in uniform charging performance on the latent-image-bearing member by contact charging, and also brings about a greater effect of effectively preventing the faulty collection of transfer residual toner particles in the cleaning-at-development image-forming method. Moreover, the conductive fine particles can be prevented from being fed to the charging zone in excess, and the image defects due to faulty exposure caused when any conductive fine particles not completely retained at the charging zone are sent out in a large quantity onto the latent-image-bearing member, can more surely be kept from occurring.

As described previously, in order for 15% to 60% of the particles of the developer in the present invention to range in particle diameter from 1.00 μm to less than 2.00 μm in the number-based particle size distribution in the range of particle diameter of from 0.60 μm to less than 159.21 μm of the developer, the conductive fine particles may be so incorporated in the developer that the particles ranging in particle diameter from 1.00 μm to less than 2.00 vm are contained in the developer in the amount falling within the above range. However, the particles ranging in particle diameter from 1.00 μm to less than 2.00 μm in the number-based particle size distribution in the range of particle diameter of from 0.60 μm to less than 159.21 μm of the developer are by no means limited only to the above conductive fine particles. Instead, the toner particles or other particles to be added to the developer may be so contained.

The toner particles contained in the developer used in the present invention, which contain at least a binder resin and a colorant, may be obtained by known production processes. The quantity of the particles ranging in particle diameter from 1.00 μm to less than 2.00 μm may change depending on toner production processes and production conditions (e.g., average particle diameter of toner, and pulverization conditions when produced by pulverization) However, if, in the number-based particle size distribution in the range of particle diameter of from 0.60 μm to less than 159.21 μm of the developer, particles ranging in particle diameter from 1.00 μm to less than 2.00 μm which are ascribable to the toner particles comprise more than 10% of the total number of particles, the triboelectric chargeability of the particles ranging in particle diameter from 1.00 μm to less than 2.00 μm may greatly differ from the triboelectric chargeability of any toner particles having a particle diameter close to the average particle diameter. Hence, a broad triboelectric charge distribution may result, so that the developing performance tends to decrease.

That is, in the number-based particle size distribution in the range of particle diameter of from 0.60 μm to less than 159.21 μm of the developer, the particles ranging in particle diameter from 1.00 μm to less than 2.00 μm which are ascribable to the conductive fine particles, may preferably comprise from 5% to 60% of the total number of particles.

The developer used in the present invention is also characterized in that the particles ranging in particle diameter from 3.00 μm to less than 8.96 μm in its number-based particle size distribution in the range of particle diameter of from 0.60 μm to less than 159.21 μm comprise from 15% to 70% of the total number of particles.

In the developer in the present invention, the particles ranging in particle diameter from 3.00 μm to less than 8.96 μm must be in the stated content in order to develop the electrostatic latent image formed on the latent-image-bearing member, to form a developer image, which developer image is transferred to a transfer material to form the developer image on the transfer material. Also, the particles ranging in particle diameter from 3.00 μm to less than 8.96 μm may be endowed with triboelectric charge characteristics suited for the particles to electrostatically be attracted to the electrostatic latent image formed on the latent-image-bearing member and develop the electrostatic latent image faithfully as the developer image.

Particles with a particle diameter smaller than 3.00 μm may retain excessive charge or attenuate triboelectric-charge electric charges in excess, making it difficult for the particles to be endowed with stable triboelectric charge characteristics. Hence, such particles tend to adhere in a large quantity to areas having no electrostatic latent image on the latent-image-bearing member (corresponding to white background areas of an image), making it difficult to develop the electrostatic latent image faithfully as the developer image. Also, such particles with a particle diameter smaller than 3.00 μm make it difficult to maintain good transfer performance on transfer materials having an uneven surface (e.g., paper having surface unevenness due to fibers), resulting in an increase in transfer residual toner particles. Hence, the latent-image-bearing member may be brought to the charging step in the state the transfer residual toner particles have adhered thereto in a large quantity. Moreover, the transfer residual toner particles may adhere to or mingle with the contact charging member in a large quantity, and hence the charging of the latent-image-bearing member may be obstructed, tending to obstruct the effect of the present invention that the charging performance on the latent-image-bearing member is improved due to the contact charging member having close contact to the latent-image-bearing member via the conductive fine particles. Also, as the transfer residual toner particles have smaller particle diameter, the mechanical, electrostatic and, in the case of magnetic toners, magnetic collection force acting on the transfer residual toner particles in the developing step becomes smaller, and hence the force of adhesion between the transfer residual toner particles and the latent-image-bearing member becomes relatively larger, so that the collection performance on the transfer residual toner particles in the developing step may decrease to tend to cause image defects, such as positive ghost and fog caused by any faulty collection of transfer residual toner particles.

Particles with a particle diameter of 8.96 μm or more also make it difficult for the particles to be endowed with sufficiently high triboelectric charge characteristics. In general, the larger the particle diameter of developers, the lower the resolution of the resultant developer images. However, in the developer used in the present invention in which the conductive fine particles have been so incorporated that particles ranging in particle diameter from 1.00 μm to less than 2.00 μm are contained in the developer in the amount falling within the stated range, the developer contains the particles of the conductive fine particles in so large a quantity that the triboelectric charge quantity of toner particles having a particularly large particle diameter tends to decrease. Thus, it is difficult for the particles with a particle diameter of 8.96 μm or more to be endowed with triboelectric charge characteristics high enough for developing the electrostatic latent image faithfully as the developer image, making it more difficult to obtain developer images having good resolution.

Accordingly, the particles ranging in particle diameter from 3.00 μm to less than 8.96 μm in the number-based particle size distribution in the range of particle diameter of from 0.60 μm to less than 159.21 μm are contained in the amount falling within the above range so that the toner particles endowed with triboelectric charge characteristics suited for developing the electrostatic latent image faithfully as the developer image can be ensured. Thus, using the developer in the present invention, in which the conductive fine particles have been so incorporated that the particles ranging in particle diameter from 1.00 μm to less than 2.00 μm are also contained in the developer in the amount falling within the stated range, images can be obtained which have high image density and superior resolution.

In the present invention, if the particles ranging in particle diameter from 3.00 μm to less than 8.96 μm are contained in the developer in an amount too small below the above range, it is difficult to ensure that the toner particles are endowed with triboelectric charge characteristics suited for developing the electrostatic latent image faithfully as the developer image. Hence, the images obtained may have much fog, a low image density, or a low resolution.

On the other hand, if the particles ranging in particle diameter from 3.00 μm to less than 8.96 μm are contained in the developer in an amount too large beyond the above range, it is difficult to control the number of the particles ranging in particle diameter from 1.00 μm to less than 2.00 μm described previously, within the range specified in the present invention. Also, even when the number of the particles ranging in particle diameter from 1.00 μm to less than 2.00 μm are within the range specified in the present invention, the number of particles ranging in particle diameter from 1.00 μm to less than 2.00 μm become relatively small with respect to the particles ranging in particle diameter from 3.00 μm to less than 8.96 μm. Hence, the uniform charging performance on the latent-image-bearing member by contact charging cannot well be improved, and the effect of effectively preventing the faulty collection of transfer residual toner particles in the cleaning-at-development cannot well be obtained.

The particles ranging in particle diameter from 3.00 μm to less than 8.96 μm in the number-based particle size distribution in the range of particle diameter of from 0.60 μm to less than 159.21 μm of the developer in the present invention may preferably comprise from 20% to 65% of the total number of particles, and more preferably from 25% to 60% of the total number of particles. Controlling the number of the above particles within this range brings about more improvement in uniform charging performance on the latent-image-bearing member by contact charging, and also brings about a greater effect of effectively preventing the faulty collection of transfer residual toner particles in the cleaning-at-development image-forming method, also making it possible to obtain images having high image density, less fog, and superior resolution.

As described above, in order to ensure that the toner particles are endowed with triboelectric charge characteristics suited for developing the electrostatic latent image faithfully as the developer image and to obtain images having high image density, less fog, and superior resolution, 15% to 70% of the total number of the developer particles range in particle diameter from 3.00 μm to less than 8.96 μm in its number-based particle size distribution in the range of particle diameter of from 0.60 μm to less than 159.21 μm. Accordingly, the particles ranging in particle diameter from 3.00 μm to less than 8.96 μm, contained in the developer may preferably be ascribable to the toner particles. However, the particles ranging in particle diameter from 3.00 μm to less than 8.96 μm in the number-based particle size distribution in the range of particle diameter of from 0.60 μm to less than 159.21 μm of the developer are by no means limited only to the toner particles. Instead, the conductive fine particles or other particles to be added to the developer may be so contained in the developer.

It may be preferably that 0% to 20% of the total number of developer particles with particle diameter of from 8.96 μm or more in its number-based particle size distribution in the range of particle diameter of from 0.60 μm to less than 159.21 μm.

As described previously, in the developer used in the present invention in which the conductive fine particles have been so incorporated that particles ranging in particle diameter from 1.00 μm to less than 2.00 μm are contained in the developer in the amount specified in the present invention, the developer contains the particles of the conductive fine particles in so large a quantity that it is difficult for the particles with particle diameter of 8.96 μm or more to be endowed with triboelectric charge characteristics high enough for developing the electrostatic latent image faithfully as the developer image. If such particles with particle diameter of 8.96 μm or more in the above measurement range of particle diameter are contained in the developer in an amount too large beyond the above range, it is difficult for the developer as a whole to be endowed with triboelectric charge characteristics high enough for developing the electrostatic latent image faithfully as the developer image. Thus, the images obtained tend to have a low resolution.

The particles with a particle diameter of 8.96 μm or more also tend to retain locally high triboelectric charge characteristics at toner particle surfaces. If the conductive fine particles adhere to such portions, the conductive fine particles may behave together with the toner particles without becoming liberated from the toner particles, so that the conductive fine particles to be fed onto the latent-image-bearing member after transfer tend to decrease.

Hence, the effect of promoting the charging of the latent-image-bearing member that is attributable to the conductive fine particles standing interposed at the charging zone cannot sufficiently be obtained in some cases. Also, since the conductive fine particles to be fed onto the latent-image-bearing member after transfer tend to decrease, the effect of improving the collection performance on transfer residual toner particles can not obtained in some cases.

Moreover, if toner particles having such a large particle diameter are carried to the charging zone as transfer residual toner particles, the contact performance of the contact charging member on the latent-image-bearing member may be damaged to tend to cause faulty charging of the latent-image-bearing member. That is, the effect of the present invention that the uniform charging performance on the latent-image-bearing member is improved due to the contact charging member having close contact to the latent-image-bearing member via the conductive fine particles can not obtained in some cases. Also when it is attempted to collect in the developing step any transfer residual toner particles having a large particle diameter, such transfer residual toner particles having a large particle diameter are not collected to cause images defects or may shut out exposure light in the latent-image-forming step to cause images defects in some cases.

Accordingly, it may be preferable for 0% to 10%, and more preferably from 0% to 7%, of the total number of developer particles to have a particle diameter of 8.96 μm or more in its number-based particle size distribution in the range of particle diameter of from 0.60 μm to less than 159.21 μm. Controlling the number of the above particles within this range enables formation of images having higher image density, less fog, and superior resolution. Also, this is more advantageous in order to improve the uniform charging performance on the latent-image-bearing member on account of the contact charging member having close contact to the latent-image-bearing member via the conductive fine particles, and is advantageous in order to prevent the faulty collection of transfer residual toner particles at development and the image defects due to shut-out of exposure light in the latent-image-forming step.

The developer in the present invention may also preferably satisfy the relationship of A>B, where, in its number-based particle size distribution in the range of particle diameter of from 0.60 μm to less than 159.21 μm, the perecentage of the total number of developer particles ranging in particle diameter from 1.00 μm to less than 2.00 μm is represented by A % and the percentage of the total number of developer the particles ranging in particle diameter from 2.00 μm to less than 3.00 μm is represented by B %. It may more preferably satisfy the relationship of A>2B.

More specifically, B %, i.e., the percentage of the total number of developer particles ranging in particle diameter from 2.00 μm to less than 3.00 μm, may preferably be smaller than the A % i.e., the percentage of the total number of developer particles ranging in particle diameter from 1.00 μm to less than 2.00 μm. Where the number-based particle size distribution in the range of particle diameter of from 0.60 μm to less than 159.21 μm of the developer in the present invention satisfies the above relationship, the conductive fine particles can stand interposed in a uniformly dispersed state at the charging zone, and good uniform charging performance can be achieved.

If A and B do not satisfy the relationship of A>B, the uniform dispersion of the conductive fine particles standing interposed at the charging zone may decrease, or the conductive fine particles may poorly be retained on the contact charging member, so that the effect of making uniform the charging of the latent-image-bearing member tends to decrease. Also, the conductive fine particles may poorly be fed to the charging zone, so that, as a result of repeated use over a long period of time, the effect of promoting the charging of the latent-image-bearing member may decrease and the latent-image-bearing member tends to be unstably charged. Also, if the relationship of A>B is not established, the particles ranging in particle diameter from 2.00 μm to less than 3.00 μm, having a relatively low transfer performance, are fed to and retained at the charging zone in a larger quantity. Hence, the retention of the conductive fine particles at the charging zone may decrease relatively, and the uniform charging of the latent-image-bearing member may be obstructed during repeated use of the image-forming method over a long period of time. Also, fine particles of the toner particles in the transfer residual toner particles may increase, and this may lower the collection performance on the transfer residual toner particles to tend to cause positive ghost and fog.

Namely, conductive fine particles among the particles ranging in particle diameter from 2.00 μm to less than 3.00 μm are greatly inferior to the conductive fine particles having the particle diameter in the range of particle diameter of from 1.00 μm to less than 2.00 μm, in the effect of promoting charging that is obtainable because of the conductive fine particles standing interposed at the charging zone. The former is also inferior to the latter in the effect of improving the collection of transfer residual toner particles at development. Toner particles among the particles ranging in particle diameter from 2.00 μm to less than 3.00 μm have unstable triboelectric charge characteristics, and hence they tend to cause fog and also have a low transfer performance. Thus, it follows that the transfer residual toner particles are fed to the charging zone in a larger quantity, tending to obstruct the uniform charging of the latent-image-bearing member. Also, since the transfer residual toner particles may increase and the transfer residual toner particles have unstable triboelectric chargeability, the collection performance on transfer residual toner particles at development tends to decrease. Accordingly, the number of particles having the particle diameter in the range of particle diameter of from 2.00 μm to less than 3.00 μm may preferably be small. More specifically, the particles having the particle diameter in the range of particle diameter of from 2.00 μm to less than 3.00 μm may preferably be contained in a small proportion in the whole particle size distribution of the developer.

From these viewpoints, A %, i.e., the percentage of the total number of developer particles ranging in particle diameter from 1.00 μm to less than 2.00 μm, may preferably be larger than B %, i.e., the percentage of the total number of developer particles ranging in particle diameter from 2.00 μm to less than 3.00 μm. The A %, i.e., the percentage of the total number of developer particles ranging in particle diameter from 1.00 μm to less than 2.00 μm, may more preferably be larger by more than two times than B %, i.e., the percentage of the total number of developer particles ranging in particle diameter from 2.00 μm to less than 3.00 μm.

Where the percentage of the total number of developer particles ranging in particle diameter from 3.00 μm to less than 8.96 μm is represented by C %, this C % may preferably be larger by more than two times, and more preferably more than three times, than B %, i.e., the percentage of the total number of developer particles ranging in particle diameter from 2.00 μm to less than 3.00 μm.

In the number-based particle size distribution in the range of particle diameter of from 0.60 μm to less than 159.21 μm, B %, i.e., the percentage of the total number of developer particles ranging in particle diameter from 2.00 μm to less than 3.00 μm, may preferably be 20% or less, more preferably 10% or less, and particularly preferably 5% or less.

The developer in the present invention may also preferably have, in the number-based particle size distribution in the range of particle diameter of from 0.60 μm to less than 159.21 μm, a coefficient of variation of number distribution (number-based particle size distribution), $K_n$, represented by the following equation, in the range of particle diameter of from 3.00 μm to less than 15.04 μm which may preferably be from 5 to 40.

The coefficient of variation of the number-based particle size distribution, $K_n=(S_n/D_1)\times 100$, where $S_n$ represents the standard deviation of number distribution in the range of particle diameter of from 3.00 μm to less than 15.04 μm, and $D_1$ represents the number-based average circle-equivalent diameter (μm) in the range of particle diameter of from 3.00 μm to less than 15.04 μm.

Controlling the coefficient of variation $K_n$ to be in the range of 5 to 40 can achieve uniform mixing performance of the toner particles and the conductive fine particles, and the conductive fine particles can more uniformly be fed onto the latent-image-bearing member. This enables more improvement of the effect of making uniform the charging of the latent-image-bearing member. Also, the charge quantity distribution of the toner particles can be made sharp, and the toner particles and transfer residual toner particles which can cause fog can be lessened, and thus the charging of the latent-image-bearing member can more stably be kept from being obstructed. Still also, the transfer residual toner particles can more stably be collected at the developing step, and hence any image defects caused by faulty collection can more surely be kept from occurring. In order to make sharper the charge quantity distribution of the toner particles, the coefficient of variation $K_n$ may more preferably be from 5 to 30.

The developer in the present invention may also preferably have a weight-average particle diameter (D4) of from 4 μm to 10 μm, as determined from a volume-based particle size distribution in the range of particle diameter of from 0.60 μm to less than 159.21 μm, and may preferably have a coefficient of variation of a volume-based particle size distribution, $K_v$, represented by the following equation, in the range of particle diameter of from 3.00 μm to less than 15.04 μm, which may preferably be from 10 to 30.

The coefficient of variation of volume-based particle size distribution, $K_v=(S_v/D_4)\times 100$, where $S_v$ represents the standard deviation of the volume distribution in the range of particle diameter of from 3.00 μm to less than 15.04 μm, and $D_4$ represents the volume-based volume-average particle diameter (μm) in the range of particle diameter of from 3.00 μm to less than 15.04 μm.

Inasmuch as the coefficient of variation of the volume-based particle size distribution, $K_v$, is from 10 to 30, the charge quantity distribution of the toner particles ranging in particle diameter from 3.00 μm to less than 15.04 μm of the developer can be made sharp, and the toner particles and transfer residual toner particles which cause fog can be lessened, and thus the charging of the latent-image-bearing member can more stably be kept from being obstructed. Also, the collection performance on transfer residual toner particles in the cleaning-at-development step can be improved, and hence any image defects caused by faulty collection can effectively be prevented. Accordingly, the coefficient of variation $K_v$ may preferably be from 10 to 25.

If the coefficient of variation $K_n$ or $K_v$ is too small below the above range, the toner particles may be produced with difficulty. If the coefficient of variation $K_n$ or $K_v$ is too large beyond the above range, any uniform mixing performance of the toner particles, the inorganic fine powder and the conductive fine particles may be achieved with difficulty, and the effect of promoting the stable charging of the latent-image-bearing member may be obtained with difficulty. Also, the developer may come to have a broad charge quantity distribution as a whole to cause a lowering of image quality due to a decrease in image density and an increase in fog. Moreover, the quantity of transfer residual toner particles may increase to obstruct charging performance, and the percentage of collecting the transfer residual toner particles in the cleaning-at-development step may decrease.

The coefficient of variation $K_v$ may be controlled to 15 to 30, whereby the charge quantity distribution of the toner particles ranging in particle diameter from 3.00 μm to less than 15.04 μm of the developer can be made sharper, and the toner particles and transfer residual toner particles which cause fog can be further decreased, and thus the charging of the latent-image-bearing member can still more stably be kept from being obstructed. Also, the collection performance on transfer residual toner particles in the cleaning-at-development step can further be improved, and hence any image defects caused by faulty collection can more effectively be prevented. Also, the coefficient of variation $K_v$ may more preferably be from 15 to 25.

The developer in the present invention may further preferably have a circularity (average circularity) of less than 0.970 as found from the following expression:

$$\text{Circularity } a=L_0/L$$

where $L_0$ represents the circumferential length of a circle having the same projected area as a particle image, and L represents the circumferential length of a projected image of a particle.

If the developer has an average circularity of 0.970 or more, the external additive may be retained on the toner particle surfaces with difficulty, so that the charging may become non-uniform to tend to cause fog. Also, any external additive may come buried in the toner particle surfaces because of developer agitation and temperature rise during running service, to deteriorate the toner particle surfaces greatly, bringing about problems with running performance and so forth.

The developer in the present invention may preferably have, in the range of particle diameter of from 3.00 μm to less than 15.04 μm, a standard deviation SD of circularity distribution of 0.045 or less as found from the following equation:

$$\text{Standard deviation } SD=\{\Sigma(a_i-a_m)^2/n\}^{1/2}$$

where $a_i$ represents the circularity of each particle ranging in particle diameter from 3.00 μm to less than 15.04 μm, $a_m$ represents the average circularity of particles ranging in particle diameter from 3.00 μm to less than 15.04 μm, and n represents the number of all particles with particle diameter of from 3.00 μm to less than 15.04 μm.

Inasmuch as the developer has the standard deviation SD of circularity distribution of 0.045 or less, the liberation performance of the conductive fine particles from the toner particles can be stable, and the conductive fine particles can more stably be fed onto the latent-image-bearing member. Hence, the charging of the latent-image-bearing member can more stably be kept from being obstructed, and the collection performance on transfer residual toner particles in the step of performing development and cleaning (i.e., the cleaning-at-development step) can be stabler.

In the present invention, the particle diameter, the particle size distribution and the circularity distribution of the developer are values found using the number-based particle size distribution and circularity distribution in the range of particle diameter of from 0.60 μm to less than 159.21 μm, defining as "particle diameter" the circle-equivalent diameter measured with a flow type particle image analyzer FPIA-1000 (manufactured by Toa Iyou Denshi K.K.).

The measurement with the flow type particle image analyzer is made in the following way: A few drops of a diluted surface-active agent (preferably one prepared by diluting an alkylbenzenesulfonate to about 1/10 with water from which fine dust has been removed) are added to 10 ml of water from which fine dust has been removed through a filter and which consequently contains 20 or less particles falling within the measurement range (e.g., with circle-equivalent diameter of from 0.60 μm to less than 159.21 μm), in $10^3$ $cm^3$. To the resultant dispersion, a measuring sample is added in an appropriate quantity (e.g., 0.5 to 20 mg) and dispersed by means of an ultrasonic homogenizer (output: 50 W; a step-type chip of 6 mm diameter) for 3 minutes, and the particle concentration of the measuring sample is adjusted to 7,000 to 10,000 particles/$10^{-3}$ $cm^3$ (with respect to particles ranging in circle-equivalent diameters measured) to prepare a sample dispersion. Using this sample dispersion, the particle size distribution and circularity distribution of particles having circle-equivalent diameters of from 0.60 μm to less than 159.21 μm are measured.

The summary of measurement is described in a catalog of FPIA-1000 (an issue of June, 1995), published by Toa Iyou Denshi K.K., and in an operation manual of the measuring apparatus and Japanese Patent Application Laid-open No. 8-136439, and is as follows:

The sample dispersion is passed through channels (extending along the flow direction) of a flat transparent flow cell (thickness: about 200 μm). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area as this area of the two-dimensional image is calculated as the circle-equivalent diameter.

The circumferential length of each particle is found from the two-dimensional image of each particle, and its ratio to the circumferential length of a circle having the same area as the area of the two-dimensional image is calculated to find the circularity distribution.

Results (frequency % and cumulative % of particle size distribution and circularity distribution) can be obtained by dividing the range of from 0.06 μm to 400 μm into 226 channels (divided into 30 channels for one octave) as shown in Table 1 below. In actual measurement, particles are measured in the range of circle-equivalent diameters of from 0.60 μm to less than 159.21 μm.

In the following Table 1, the upper-limit numeral in each particle diameter range does not include that numeral itself to mean that it is indicated as "less than".

TABLE 1

| Particle diameter ranges (μm) |
|---|
| 0.60–0.61 |
| 0.61–0.63 |
| 0.63–0.65 |
| 0.65–0.67 |
| 0.67–0.69 |
| 0.69–0.71 |
| 0.71–0.73 |
| 0.73–0.75 |
| 0.75–0.77 |
| 0.77–0.80 |
| 0.80–0.82 |
| 0.82–0.84 |
| 0.84–0.87 |
| 0.87–0.89 |
| 0.89–0.92 |
| 0.92–0.95 |
| 0.96–0.97 |
| 0.97–1.00 |
| 1.00–1.03 |
| 1.03–1.06 |
| 1.06–1.09 |
| 1.09–1.12 |
| 1.12–1.16 |
| 1.16–1.19 |
| 1.19–1.23 |
| 1.23–1.26 |
| 1.26–1.30 |
| 1.30–1.34 |
| 1.34–1.38 |
| 1.38–1.42 |
| 1.42–1.46 |
| 1.46–1.50 |
| 1.50–1.55 |
| 1.55–1.59 |
| 1.59–1.64 |
| 1.64–1.69 |
| 1.69–1.73 |
| 1.73–1.79 |
| 1.79–1.84 |
| 1.84–1.89 |
| 1.89–1.95 |
| 1.95–2.00 |
| 2.00–2.06 |
| 2.06–2.12 |
| 2.12–2.18 |
| 2.18–2.25 |
| 2.25–2.31 |
| 2.31–2.38 |
| 2.38–2.45 |
| 2.45–2.52 |
| 2.52–2.60 |
| 2.60–2.67 |
| 2.67–2.75 |
| 2.75–2.83 |
| 2.83–2.91 |
| 2.91–3.00 |
| 3.00–3.09 |
| 3.09–3.18 |
| 3.18–3.27 |
| 3.27–3.37 |
| 3.37–3.46 |
| 3.46–3.57 |
| 3.57–3.67 |
| 3.67–3.78 |
| 3.78–3.89 |
| 3.89–4.00 |
| 4.00–4.12 |
| 4.12–4.24 |
| 4.24–4.36 |
| 4.36–4.49 |
| 4.49–4.62 |

TABLE 1-continued

| Particle diameter ranges (μm) |
|---|
| 4.62–4.76 |
| 4.76–4.90 |
| 4.90–5.04 |
| 5.04–5.19 |
| 5.19–5.34 |
| 5.34–5.49 |
| 5.49–5.65 |
| 5.65–5.82 |
| 5.82–5.99 |
| 5.99–6.16 |
| 6.16–6.34 |
| 6.34–6.53 |
| 6.53–6.72 |
| 6.72–6.92 |
| 6.92–7.12 |
| 7.12–7.33 |
| 7.33–7.54 |
| 7.54–7.76 |
| 7.76–7.99 |
| 7.99–8.22 |
| 8.22–8.46 |
| 8.46–8.71 |
| 8.71–8.96 |
| 8.96–9.22 |
| 9.22–9.49 |
| 9.49–9.77 |
| 9.77–10.05 |
| 10.05–10.35 |
| 10.35–10.65 |
| 10.65–10.96 |
| 10.96–11.28 |
| 11.28–11.61 |
| 11.61–11.95 |
| 11.95–12.30 |
| 12.30–12.66 |
| 12.66–13.03 |
| 13.03–13.41 |
| 13.41–13.80 |
| 13.80–14.20 |
| 14.20–14.62 |
| 14.62–15.04 |
| 15.04–15.48 |
| 15.48–15.93 |
| 15.93–16.40 |
| 16.40–16.88 |
| 16.88–17.37 |
| 17.37–17.88 |
| 17.88–18.40 |
| 18.40–18.94 |
| 18.94–19.49 |
| 19.49–20.06 |
| 20.06–20.65 |
| 20.65–21.25 |
| 21.25–21.87 |
| 21.87–22.51 |
| 22.51–23.16 |
| 23.16–23.84 |
| 23.84–24.54 |
| 24.51–25.25 |
| 25.25–25.99 |
| 25.99–26.75 |
| 26.75–27.53 |
| 27.53–28.33 |
| 28.33–29.16 |
| 29.16–30.01 |
| 30.01–30.89 |
| 30.89–31.79 |
| 31.79–32.72 |
| 32.72–33.67 |
| 33.67–34.65 |
| 34.65–35.67 |
| 35.67–36.71 |
| 36.71–37.78 |
| 37.78–38.88 |
| 38.88–40.02 |

TABLE 1-continued

| Particle diameter ranges (μm) |
|---|
| 40.02–41.18 |
| 41.18–42.39 |
| 42.39–43.62 |
| 43.62–44.90 |
| 44.90–46.21 |
| 46.21–47.56 |
| 47.56–48.94 |
| 48.94–50.37 |
| 50.37–51.84 |
| 51.84–53.36 |
| 53.36–54.91 |
| 54.91–56.52 |
| 56.52–58.17 |
| 58.17–59.86 |
| 59.86–61.61 |
| 61.61–63.41 |
| 63.41–65.26 |
| 65.26–67.16 |
| 67.16–69.12 |
| 69.12–71.14 |
| 71.14–73.22 |
| 73.22–75.36 |
| 75.36–77.56 |
| 77.56–79.82 |
| 79.82–82.15 |
| 82.15–84.55 |
| 84.55–87.01 |
| 87.01–89.55 |
| 89.55–92.17 |
| 92.17–94.86 |
| 94.86–97.63 |
| 97.63–100.48 |
| 100.48–103.41 |
| 103.41–106.43 |
| 106.43–109.53 |
| 109.53–112.73 |
| 112.73–116.02 |
| 116.02–119.41 |
| 119.41–122.89 |
| 122.89–126.48 |
| 126.48–130.17 |
| 130.17–133.97 |
| 133.97–137.88 |
| 137.88–141.90 |
| 141.90–146.05 |
| 146.05–150.31 |
| 150.31–154.70 |
| 154.70–159.21 |
| 159.21–163.86 |
| 163.86–168.64 |
| 168.64–173.56 |
| 173.56–178.63 |
| 178.63–183.84 |
| 183.84–189.21 |
| 189.21–194.73 |
| 194.73–200.41 |
| 200.41–206.26 |
| 206.26–212.28 |
| 212.28–218.48 |
| 218.48–224.86 |
| 224.86–231.42 |
| 231.42–238.17 |
| 238.17–245.12 |
| 245.12–252.28 |
| 252.28–259.64 |
| 259.64–267.22 |
| 267.22–275.02 |
| 275.02–283.05 |
| 283.05–291.31 |
| 291.31–299.81 |
| 299.81–308.56 |
| 308.56–317.56 |
| 317.56–326.83 |
| 326.83–336.37 |
| 336.37–346.19 |

TABLE 1-continued

| Particle diameter ranges (μm) |
|---|
| 346.19–356.29 |
| 356.29–366.69 |
| 366.69–377.40 |
| 377.40–388.41 |
| 388.41–400.00 |

The measuring device "FPIA-1000" used in the present invention employs a calculation method in which, in calculating the circularity of each particle and thereafter calculating the average circularity, particles are grouped into classes, which are divided into 61 ranges as from 0.40 to 1.00, and the average circularity is calculated using the center values and frequencies of divided points. However, between the values of the average circularity calculated by this calculation method and the average circularity calculated by the arithmetic mean of the circularity of each particle, there is only a very small accidental error, which is at a level that is substantially negligible. Accordingly, in the present invention, such a calculation method may be used for the reasons of handling data, e.g., making the calculation time short and making the operational equation for the calculation simple.

The developer in the present invention may preferably contain particles of the conductive fine particles, having a particle diameter of from 0.1 to 10 μm, in a number of from 5 particles to 500 particles per 100 particles of the toner particles. The particles of the conductive fine particles, having a particle diameter of from 0.1 to 10 μm, tend to behave in such a manner as to stand liberated from the toner particles, and they adhere to the contact charging member uniformly and are retained thereon stably. Hence, inasmuch as the developer has the particles of the conductive fine particles, having particle diameter of from 0.1 to 10 μm, in a number of from 5 particles to 500 particles per 100 particles of the toner particles, the feeding of the conductive fine particles onto the latent-image-bearing member is more promoted in the developing step and transfer step, and the charging performance on the latent-image-bearing member can more stably be made uniform. Also, inasmuch as the developer has the particles of the conductive fine particles, having particle diameter of from 0.1 to 10 μm, in a number of from 5 particles to 500 particles per 100 particles of the toner particles, the collection performance on transfer residual toner particles in the cleaning-at-development step can be stabler.

If, in the developer in the present invention, the particles of the conductive fine particles, having a particle diameter of from 0.1 to 10 μm, are in a number of less than 5 particles per 100 particles of the toner particles, it is difficult to incorporate, in the content of from 5% by number to 60% by number, the particles ranging in particle diameter from 1.00 μm to less than 2.00 μm which are ascribable to the conductive fine particles. In some cases, the effects of the present invention lessens greatly, e.g., the effect of promoting the charging of the latent-image-bearing member, attributable to the incorporation of from 15% by number to 60% by number of the above particles ranging in particle diameter from 1.00 μm to less than 2.00 μm, and the effect of improving the collection performance on transfer residual toner particles in the cleaning-at-development process.

On the other hand, if in the developer in the present invention, the particles of the conductive fine particles, having particle diameter of from 0.1 to 10 μm, are in a number greatly more than 500 particles per 100 particles of the toner particles, the proportion of such particles to the toner particles is so high that the triboelectric charging of the toner particles may be obstructed to lower the developing performance and transfer performance as the developer, to tend to cause a decrease in image density, an increase in fog, a lowering of uniform charging performance due to an increase in transfer residual toner particles, and faulty collection of transfer residual toner particles in the cleaning-at-development process.

From the foregoing viewpoints, the developer may preferably contain the particles of the conductive fine particles, having a particle diameter of from 0.1 to 10 μm, in a number of from 5 particles to 300 particles, and more preferably from 10 particles to 200 particles, per 100 particles of the toner particles.

The number of the conductive fine particles having a particle diameter of from 0.1 to 10 μm, per 100 particles of the toner particles in the developer is the value found by measurement made in the following way. That is, it is the value obtained by i) comparing a photograph of the developer, magnified with a scanning electron microscope, with a photograph further taken, of a developer mapped with elements the conductive fine particles contain, by an elemental analysis means such as XMA (X-ray microanalyzer) attached to the scanning electron microscope, ii) specifying conductive fine particles which are present in the state they adhere to or stand liberated from toner particle surfaces, with respect to 100 toner particles, and iii) counting, among the conductive fine particles thus specified, the number of particles of the conductive fine particles, having a circle-equivalent diameter of 0.1 μm to 10 μm, which number is found by means of an image processor (for example, image information magnified 3,000 to 10,000 times is introduced from a field-emission scanning electron microscope FE-SEMS-800, manufactured by Hitachi Ltd., into, e.g., an image analyzer LUZEX-III, manufactured by Nireko Co., through an interface to make analysis).

In the developer used in the present invention, the conductive fine particles may preferably be in a content of from 0.1% by weight to 10% by weight of the whole developer. Controlling the content of the conductive fine particles within the above range makes it able to feed the conductive fine particles to the charging zone in a quantity appropriate for promoting the charging of the latent-image-bearing member, and to feed the conductive fine particles onto the latent-image-bearing member in a quantity necessary for improving the collection performance on transfer residual toner particles in the cleaning-at-development process.

If the conductive fine particles of the developer are in a content too small below the above range, the conductive fine particles fed to the charging zone tend to become short, so that the effect of promoting the stable charging of the latent-image-bearing member may be obtained with difficulty. In this case, in the image-forming method making use of the cleaning-at-development process, too, the conductive fine particles present on the latent-image-bearing member together with the transfer residual toner particles at the time of development tend to become short, and in some cases the collection performance on transfer residual toner particles is not sufficiently be improved.

If, on the other hand, the conductive fine particles of the developer are in a content too large beyond the above range, the conductive fine particles tend to be fed to the charging zone in excess, and hence any conductive fine particles not completely retained at the charging zone may be sent out onto the latent-image-bearing member in a large quantity to tend to cause faulty exposure. Also, this may lower, or disturb, the triboelectric charge characteristics of the toner particles, or may cause a decrease in image density or an increase in fog.

From such a viewpoint, the conductive fine particles in the developer may preferably be in a content of from 0.1% by weight to 10% by weight, and more preferably from 0.2% by weight to 5% by weight.

The conductive fine particles may also preferably have a resistivity of $10^9$ Ω·cm or less in order to provide the developer with the effect of promoting the charging of the latent-image-bearing member and the effect of improving the collection performance on transfer residual toner particles. If the conductive fine particles have too high a resistivity beyond the above range, the effect of promoting the charging of the latent-image-bearing member for achieving good and uniform charging performance thereon may be small even when the conductive fine particles are made to be interposed at the contact zone between the contact charging member and the latent-image-bearing member or at the charging region in the vicinity thereof and when the close contact performance of the contact charging member on the latent-image-bearing member via the conductive fine particles is maintained. In the cleaning-at-development process, too, the conductive fine particles tend to have electric charges with the same polarity as that of the transfer residual toner particles. If the electric charges of the conductive fine particles become large under the same polarity as that of the transfer residual toner particles, the effect of improving the collection performance on transfer residual toner particles may sharply lower.

In order to bring out the effect of promoting the charging of the latent-image-bearing member that is attributable to the conductive fine particles and to stably obtain the good and uniform charging performance on the latent-image-bearing member, the conductive fine particles may preferably have a resistivity smaller than the resistivity of the contact charging member at its surface portion or that of the contact zone between it and the latent-image-bearing member, and may more preferably have a resistivity of 1/100 or less of the resistivity of this contact charging member.

The conductive fine particles may further have a resistivity of $10^6$ Ω·cm or less. This is preferable in order for the latent-image-bearing member to be better uniformly charged resisting any charging obstruction due to insulative transfer residual toner particles having adhered to or mingled with the contact charging member, and also in order to more stably obtain the effect of improving the collection performance on transfer residual toner particles in the cleaning-at-development process. The conductive fine particles may more preferably have a resistivity of from $10^0$ Ω·cm to $10^5$ Ω·cm.

In the present invention, the resistivity of the conductive fine particles may be measured by the tablet method and normalizing measurements to determine it. More specifically, about 0.5 g of a powder sample is put in a hollow cylinder of 2.26 cm in bottom area. Then, a pressure of 147 N (15 kg) is applied across upper and lower electrodes provided on the top and bottom of the powder sample, and at the same time a voltage of 100 V is applied thereto to measure the resistance value. Thereafter, the measurements are normalized to calculate the specific resistance (resistivity).

The conductive fine particles may also be transparent, white or pale-colored conductive fine particles. This is preferable because the conductive fine particles transferred to transfer materials do not become conspicuous as fog. The conductive fine particles may preferably be transparent, white or pale-colored conductive fine particles also in view of preventing them from obstructing exposure light in the latent-image-forming step. The conductive fine particles may further preferably have a transmittance of 30% or more to imagewise exposure light with which the electrostatic latent image is formed. This transmittance may more preferably be 35% or more.

An example of how to measure the light transmittance of the conductive fine particles is given below. The transmittance is measured in the state the conductive fine particles have been attached for one layer, to an adhesive layer of a transparent film having the adhesive layer on one side. The light is applied to the film in its vertical direction. The light having passed through the film up to its back is converged to measure the amount of the light. Light transmittance is calculated as the net amount of light, on the basis of a difference in the amount of light between a case in which the film is used alone and a case in which the conductive fine particles have been attached thereto. In practice, it may be measured with a transmission type densitometer 310T, manufactured by X-Rite Co.

The conductive fine particles may also preferably be non-magnetic. Inasmuch as the conductive fine particles are non-magnetic, the transparent, white or pale-colored conductive fine particles can be obtained with ease. On the contrary, conductive fine particles having magnetic properties can be made transparent, white or pale-colored with difficulty. Also, in an image-forming method in which the developer is transported and retained by magnetic force in order to hold thereon the developer, the conductive fine particles having magnetic properties may hardly participate in development. Hence, such conductive fine particles may insufficiently be fed onto the latent-image-bearing member, or the conductive fine particles may accumulate on the surface of the developer-carrying member to tend to cause a difficulty such that they obstruct the development the toner particles perform. Moreover, where the conductive fine particles having magnetic properties are added to magnetic toner particles, the conductive fine particles tend to become liberated from toner particles because of a magnetic cohesive force, tending to result in a lowering of the performance of feeding the conductive fine particles onto the latent-image-bearing member.

The conductive fine particles in the present invention may include, e.g., fine carbon powders, such as carbon black and graphite powder; fine metal powders such as copper, gold, silver, aluminum and nickel powders; metal oxide powders such as zinc oxide, titanium oxide, tin oxide, aluminum oxide, indium oxide, silicon oxide, magnesium oxide, barium oxide, molybdenum oxide, iron oxide and tungsten oxide powders; metal compound powders such as molybdenum sulfide, cadmium sulfide and potassium titanate powders; and compound oxides of these; any of which may be used optionally with the adjustment of the particle diameter and the particle size distribution.

Among these, the conductive fine particles may preferably contain at least one selected from zinc oxide, tin oxide and titanium oxide. Further, particularly preferred are fine particles having at least on their surfaces an inorganic oxide such as zinc oxide, tin oxide and titanium oxide. These oxides are preferred because they can have a resistivity set low as the conductive fine particles and are non-magnetic, white or pale-colored, and the conductive fine particles to be transferred on the transfer material do not become conspicuous as fog.

Where the conductive fine particles are comprised of a conductive inorganic oxide or contain a conductive inorganic oxide, a metal oxide incorporated with an element such as antimony or aluminum, which is different from the chief metallic element of the conductive inorganic oxide, or a conductive material may also be used for the purpose of, e.g., controlling the resistance value. For example, they are zinc oxide containing aluminum, fine stannous oxide particles containing antimony, and fine particles obtained by treating titanium oxide, barium sulfate or aluminum borate particle surfaces with tin oxide containing antimony. The conductive inorganic oxide may preferably be incorporated with the element such as antimony or aluminum in an amount of from 0.05% by weight to 20% by weight, more preferably from 0.05% by weight to 10% by weight, and particularly preferably from 0.1% by weight to 5% by weight.

Conductive inorganic oxides obtained by making the above conductive inorganic oxides into an oxygen-deficient type may also preferably be used.

Commercially available conductive fine titanium oxide particles treated with tin oxide or antimony may include, e.g., EC-300 (available from Titan Kogyo K.K.); ET-300, HJ-1 and HI-2 (all available from Ishihara Sangyo Kaisha, Ltd.); and W-P (available from Mitsubishi Material Co., Ltd.).

Commercially available antimony-doped conductive tin oxide particles may include, e.g., T-1 (available from Mitsubishi Material Co., Ltd.) and N-100P (available from Ishihara Sangyo Kaisha, Ltd.). Also, commercially available stannous oxide particles may include, e.g., SH-S (available from Nihon Kagaku Sangyo Co., Ltd.).

Particularly preferred ones may include metal oxides such as zinc oxide containing aluminum, metal oxides such as oxygen-deficient type zinc oxide, tin oxide and titanium oxide, and fine particles having any of these at least on the particle surfaces.

The conductive fine particles may also preferably have a volume-average particle diameter of from 0.1 to 10 $\mu$m. If the conductive fine particles have a volume-average particle diameter too small below this range, the content of the conductive fine particles with respect to the developer must be set small in order to prevent developing performance from decreasing. If the content of the conductive fine particles is set too small, the effective quantity of the conductive fine particles cannot be ensured. Thus, any conductive fine particles in a quantity sufficient for the latent-image-bearing member to be well charged resisting any charging obstruction due to insulative transfer residual toner particles having adhered to or mingled with the contact charging member in the charging step cannot be made to be interposed at the contact zone between the contact charging member and the latent-image-bearing member or at the charging region in the vicinity thereof. From this viewpoint, the conductive fine particles may have a volume-average particle diameter of 0.1 $\mu$m or more, preferably 0.15 $\mu$m or more, and more preferably 0.2 $\mu$m or more.

On the other hand, if the conductive fine particles have a volume-average particle diameter too large beyond the above range, any conductive fine particles having come off from the contact charging member may shut out or scatter the exposure light with which the electrostatic latent image is formed, and hence defects may occur in the electrostatic latent image to cause a lowering of image quality level, undesirably. Moreover, if the conductive fine particles have a volume-average particle diameter too large beyond the above range, the number of particles of the conductive fine particles per unit weight decreases, so that the improvement in the collection performance on transfer residual toner particles can not sufficiently be achieved. Also, since the number of particles of the conductive fine particles decreases, and taking account of the fact that the conductive fine particles standing interposed at the contact charging member and in the vicinity thereof may decrease and deteriorate because of coming off of the conductive fine particles from the contact charging member, the content of the conductive fine particles with respect to the developer must be set large in order to make the conductive fine particles continue being successively fed to the contact zone between the contact charging member and the latent-image-bearing member or the charging region in the vicinity thereof and also in order to maintain the close contact performance of the contact charging member on the latent-image-bearing member via the conductive fine particles to achieve good and uniform charging performance stably. However, if the content of the conductive fine particles is set too large, the chargeability and developing performance of the whole developer may decrease especially in an environment of high humidity to cause decrease in image density and toner scatter. From such viewpoints, the conductive fine particles may preferably have a volume-average particle diameter of 10 $\mu$m or less, and most preferably 5 $\mu$m or less.

An example of how to measure the volume-average particle diameter and particle size distribution of the conductive fine particles is given below. A liquid module is attached to a laser diffraction particle size distribution measuring instrument Model LS-230, manufactured by Coulter Electronics Inc. Setting the particle diameter from 0.04 to 2,000 $\mu$m as a measurement range, the volume-average particle diameter of the conductive fine particles is calculated from the volume-based particle size distribution obtained. As a procedure of measurement, a very small amount of a surface-active agent is added to 10 cc of pure water, and 10 mg of a sample of the conductive fine particles is added thereto, which is then dispersed for 10 minutes by means of an ultrasonic dispersion machine (ultrasonic homogenizer) Thereafter, a measurement is made for a measurement time of 90 seconds and is performed once.

In the measurement from a toner or developer, a very small amount of a surface-active agent is added to 100 g of pure water, and 2 to 10 g of the toner or developer is added thereto, which is then dispersed for 10 minutes by means of an ultrasonic dispersion machine (ultrasonic homogenizer). Thereafter, the toner particles and the conductive fine particles are separated by means of a centrifugal separator or the like. In the case of a magnetic toner or developer, a magnet may also be used. A dispersion of the conductive fine particles thus separated is put to measurement for a measurement time of 90 seconds and the measuring is performed once.

In the present invention, as methods of adjusting the particle diameter and the particle size distribution of the conductive fine particles, a method may be used in which a production process and production conditions are so set that the desired particle diameter and particle size distribution can be obtained when primary particles of the conductive fine particles are produced, and besides a method in which small particles of primary particles are made to agglomerate, a method in which large particles of primary particles are pulverized, or a method making use of pulverization. Further usable are a method in which conductive particles are made to adhere or fix to part or the whole of the surfaces of base-material particles having the desired particle diameter and particle size distribution, and a method making use of conductive particles having such a form that a conductive component has been dispersed in particles having the desired particle diameter and particle size distribution. Any of these methods may also be used in combination to adjust the particle diameter and particle size distribution of the conductive fine particles.

The particle diameter in a case in which the particles of the conductive fine particles are formed as agglomerates is defined as the average particle diameter of those as agglomerates. The conductive fine particles maybe present not only in the state of primary particles but also in the state of agglomerates of the secondary particles without any problem. Whatever the state of the agglomeration of the particles, their form does not matter as long as they stand interposed as agglomerates at the contact zone between the contact charging member and the latent-image-bearing member or at the charging region in the vicinity thereof, and the function to assist or promote the charging can be materialized.

The developer in the present invention further has, as mentioned previously, an inorganic fine powder whose primary particles have a number-average particle diameter of from 4 nm to 80 nm.

If the primary particles of the inorganic fine powder have a number-average particle diameter too large beyond the above range, or if the inorganic fine powder ranging in particle diameter within the above range is not added, the transfer residual toner particles tend to cling to the contact charging member when they adhere to the contact charging member, making it difficult to obtain good and uniform charging performance on the latent-image-bearing member. It may also difficult to disperse the conductive fine particles uniformly over the toner particles in the developer to tend to cause uneven feeding of the conductive fine particles onto the latent-image-bearing member. Where such uneven feeding has occurred onto the contact charging member, faulty charging of the latent-image-bearing member may occur at its part corresponding to the part where the feeding of the environment has come short, tending to cause image defects. Also, where the amount of interposition of the conductive fine particles on the latent-image-bearing member becomes uneven at the time of the cleaning-at-development process, faulty collection may occur because of a temporary or local lowering of the collection performance on transfer residual toner particles. Moreover, any good fluidity of the developer can not be achieved, and the triboelectric charging to the toner particles tends to become non-uniform. Hence, the problems of an increase in fog, a decrease in image density, and toner scatter tend to occur.

If the primary particles of the inorganic fine powder have a number-average particle diameter smaller than 4 nm, the inorganic fine powder may become strongly agglomerative, and tends to behave not as primary particles but as agglomerates having a broad particle size distribution which are so strongly agglomerative as to come loose with difficulty even by disintegration treatment. This tends to cause image blank areas due to development of such agglomerates of the inorganic fine powder, and image defects due to the scratching or the like of the latent-image-bearing member, the developer-carrying member or the contact charging member.

From these viewpoints, the primary particles of the inorganic fine powder may preferably have a number-average particle diameter of from 6 nm to 50 nm, and more preferably from 8 nm to 35 nm.

That is, in the present invention, the inorganic fine powder having the above primary-particle average particle diameter is added not only in order to make it adhere to the surfaces of the toner particles to improve the fluidity of the developer and make uniform the triboelectric charging of the toner particles, but also in order to afford at the same time the effect of making the conductive fine particles dispersed in the developer uniformly with respect to the toner particles and making the conductive fine particles fed uniformly onto the latent-image-bearing member.

In the present invention, the number-average particle diameter of the primary particles of the inorganic fine powder is the value found by measurement made in the following way. That is, comparing a photograph of the developer, magnified with a scanning electron microscope, with a photograph further taken, of a developer mapped with elements the inorganic fine powder contains, by an elemental analysis means such as XMA (X-ray microanalyzer) attached to the scanning electron microscope, at least 100 primary particles of the inorganic fine powder which are present in the state they adhere to or stand liberated from toner particle surfaces are measured to determine their number-average particle diameter.

In the present invention, the inorganic fine powder may preferably contain at least one selected from fine powders of silica, titania and alumina whose primary particles have a number-average particle diameter of from 4 nm to 80 nm. For example, as the fine silica powder, usable are fine silica powder which is what is called dry-process silica or fumed silica produced by vapor phase oxidation of silicon halides and fine silica powder which is what is called wet-process silica produced from water glass or the like, either of which may be used. The dry-process silica is preferred, as having less silanol groups on the surface and inside of the fine silica powder and leaving less production residues such as $Na_2O$ and $SO_3^{2-}$. In the dry-process silica, it is also possible to use, in its production step, other metal halide compounds such as aluminum chloride or titanium chloride together with the silicon halide to give a composite fine powder of silica with other metal oxide. The fine silica powder includes these, too.

In the present invention, the inorganic fine powder may preferably be one having been hydrophobic-treated. The hydrophobic treatment of the inorganic fine powder prevents the charging performance on the inorganic fine powder from decreasing in an environment of high humidity, and improves environmental stability of triboelectric charge characteristics of the toner particles to the surfaces of which the inorganic fine powder stands adhered. This enables more improvement in environmental stability of developing performances concerning image density, fog and so forth required as the developer. Since the charging performance on the inorganic fine powder and the triboelectric charge quantity of the toner particles to the surfaces of which the inorganic fine powder stands adhered are kept from varying depending on environment, the readiness for the conductive fine particles to be liberated from the toner particles can be prevented from varying, the quantity of feed of the conductive fine particles onto the latent-image-bearing member can be made stable, and the environmental stability of the charging performance on the latent-image-bearing member and that of the collection performance of transfer residual toner particles can be improved.

As a treating agent used for such hydrophobic treatment, usable are a silicone varnish, a modified silicone varnish of various types, a silicone oil, a modified silicone oil of various types, a silane compound, a silane coupling agent, other organic silicon compound and an organic titanium compound, any of which may be used alone or in combination for the treatment. In particular, it is especially preferable for the inorganic fine powder to have been treated with a silicone oil.

The silicone oil may preferably be those having a viscosity at 25° C. of from 10 $mm^2/s$ to 200,000 $mm^2/s$, and more preferably from 3,000 $mm^2/s$ to 80,000 $mm^2/s$. If its viscosity is too low below the above range, the inorganic fine powder may have no stability, and the image quality tends to decrease because the treated silicone oil may come off, dislocate or deteriorate due to thermal and mechanical stress. If, on the other hand, its viscosity is too high beyond the above range, the inorganic fine powder tends to be difficult to make uniform treatment.

As the silicone oil used, particularly preferred are, e.g., dimethylsilicone oil, methylphenylsilicone oil, α-methylstyrene-modified silicone oil, chlorophenylsilicone oil and fluorine-modified silicone oil.

As a method for treating the inorganic fine powder with the silicone oil, for example the inorganic fine powder having been treated with a silane compound and the silicone oil may directly be mixed by means of a mixer such as a Henschel mixer, or a method may be used in which the silicone oil is sprayed on the inorganic fine powder. Alternatively, a method may be used in which the silicone oil is dissolved or dispersed in a suitable solvent and thereafter the inorganic fine powder is added and mixed, followed by removal of the solvent. In view of an advantage that agglomerates of the inorganic fine powder may occur less often, the method making use of a sprayer is preferred.

The silicone oil may be used for the treatment in an amount of from 1 part by weight to 23 parts by weight, and preferably from 5 parts by weight to 20 parts by weight, based on 100 parts by weight of the inorganic fine powder. If the silicone oil is in a quantity too small below the above range, the inorganic fine powder can not be made sufficiently hydrophobic. If it is in a too large quantity, difficulties such as fogging tend to occur.

In the present invention, it is also preferable for the inorganic fine powder to have been treated with a silicone oil simultaneously with at least a silane compound or after treatment with it. Use of the silane compound is particularly preferred in order to improve the adhesion of silicone oil to inorganic fine powder and make uniform the hydrophobic properties and chargeability of the inorganic fine powder.

As a method for such treatment of the inorganic fine powder, for example the inorganic fine powder may be subjected, as a first-stage reaction, to a silylation reaction to cause silanol groups to disappear by chemical coupling, and thereafter, as a second-stage reaction, treated with the silicone oil to form hydrophobic thin films on particle surfaces.

In the developer in the present invention, the inorganic fine powder may preferably be in a content of from 0.1% by weight to 3.0% by weight of the whole developer. If the inorganic fine powder is in a content too small below the above range, the effect attributable to the addition of the inorganic fine powder can not sufficiently be obtained. If, on the other hand, it is in a content too large beyond the above range, any inorganic fine powder present in excess to the toner particles may cover the conductive fine particles, so that the conductive fine particles may behave as if they have a high resistance, resulting in loss of the effect of the present invention, e.g., a lowering of the performance of feeding the conductive fine particles onto the latent-image-bearing member, a lowering of the effect of promoting the charging of the latent-image-bearing member and a lowering of the collection performance on transfer residual toner particles. The inorganic fine powder may more preferably be in a content of from 0.3% by weight to 2.0% by weight, and still more preferably from 0.5% by weight to 1.5% by weight, of the whole developer.

The inorganic fine powder used in the present invention, having a number-average primary-particle diameter of from 4 nm to 80 nm may preferably be one having a specific surface area ranging from 20 $m^2/g$ to 250 $m^2/g$, and more preferably from 40 $m^2/g$ to 200 $m^2/g$, as measured by the BET method utilizing nitrogen absorption. The specific surface area may be measured according to the BET method, where nitrogen gas is adsorbed on sample surfaces using a specific surface area measuring device AUTOSOBE 1 (manufactured by Yuasa Ionics Co.), and the specific surface area may be calculated by the BET multiple point method.

In the present invention, the toner particles are colored resin particles containing at least a binder resin and a colorant. The toner particles may preferably have a resistivity of $10^{10}$ Ω·cm or more, and more preferably $10^{12}$ Ω·cm or more. It is difficult to achieve both the developing performance and the transfer performance unless the toner particles show insulating properties substantially. Also, the injection of electric charges into the toner particles tends to be caused by development electric fields, and this may disorder the charging of the developer to cause fog.

As types of the binder resin the toner particles used in the present invention, usable are, e.g., styrene resins, styrene copolymer resins, polyester resins, polyvinyl chloride resins, phenolic resins, natural-resin-modified phenolic resins, natural-resin-modified maleic acid resins, acrylic resins, methacrylic resins, polyvinyl acetate resins, silicone resins, polyurethane resins, polyamide resins, furanresins, epoxy resins, xylene resins, polyvinyl butyral, terpene resins, cumarone indene resins, and petroleum resins.

Comonomers copolymerizable with styrene monomers in the styrene copolymers may include, e.g., styrene derivatives such as vinyltoluene; acrylic acid or acrylates such as methyl acrylate, ethyl acrylate, butyl acrylate, dodecyl acrylate, octyl acrylate, 2-ethylhexyl acrylate and phenyl acrylate; methacrylic acid or methacrylates such as methyl methacrylate, ethyl methacrylate, butyl methacrylate and octyl methacrylate; dicarboxylic acids having a double bond or esters thereof such as maleic acid or butyl maleate, methyl maleate and dimethyl maleate; acrylamide, acrylonitrile, methacrylonitrile and butadiene, vinyl chloride; vinyl esters such as vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more types.

Here, as a cross-linking agent, a compound having at least two polymerizable double bonds may chiefly be used. For example, it may include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The binder resin may preferably have a glass transition temperature (Tg) of from 50° C. to 70° C. If its glass transition temperature is too low below the above range, the developer may have a low storage stability. If it is too high, the developer may have a poor fixing performance.

The developer used in the present invention may preferably have a maximum endothermic peak in the range of temperature of from 70° C. to less than 120° C., in the endothermic curve of a DSC chart prepared using a differential thermal analyzer (differential scanning calorimeter DSC). In order for the developer to have a maximum endothermic peak in such temperature ranges, a wax component may preferably be incorporated in the toner particles.

The wax to be incorporated in the toner particles used in the present invention may include aliphatic hydrocarbon waxes such as low-molecular weight polyethylene, low-molecular weight polypropylene, polyolefins, polyolefin copolymers, microcrystalline wax, paraffin wax and Fischer-Tropsch wax; oxides of aliphatic hydrocarbon waxes, such as polyethylene oxide wax, or block copolymers of these; waxes composed chiefly of a fatty ester, such as carnauba wax and montanate wax; and those obtained by subjecting part or the whole of fatty esters to deoxidizing treatment, such as deoxidized carnauba wax. It may further include saturated straight-chain fatty acids such as palmitic acid, stearic acid, montanic acid and long-chain alkylcarboxylic acids having a still longer-chain alkyl group; unsaturated fatty acids such as brassidic acid, eleostearic acid and parinaric acid; saturated alcohols such as stearyl alcohol, aralkyl alcohols, behenyl alcohol, carnaubyl alcohol, ceryl alcohol, melissyl alcohol and long-chain alkyl alcohols having a still longer-chain alkyl group; polyhydric alcohols such as sorbitol; fatty acid amides such as linolic acid amide, oleic acid amide and lauric acid amide; saturated fatty acid bisamides such as methylenebis (stearic acid amide), ethylenebis (capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as m-xylenebisstearic acid amide and N,N'-distearylisophthalic acid amide; fatty metal salts (what is called metal soap) such as calcium stearate, calcium laurate, zinc stearate and magnesium stearate; grafted waxes obtained by grafting vinyl monomers such as styrene and acrylic acid to fatty acid hydrocarbon waxes; partially esterified products of polyhydric alcohols with fatty acids, such as monoglyceride behenate; and methyl esterified products having a hydroxyl group, obtained by hydrogenation of vegetable fats and oils.

In the present invention, the wax may be used in an amount ranging from 0.5 part by weight to 20 parts by weight, and preferably from 0.5 part by weight to 15 parts by weight, based on 100 parts by weight of the binder resin.

As the colorant of the toner particles used in the present invention, usable are conventionally known dyes and pigments such as carbon black, lamp black, black iron oxide, ultramarine blue, Nigrosine dyes, aniline blue, Phthalocyanine Blue, Phthalocyanine Green, Hanza Yellow G, Rhodamine 6G, Chalcooil Blue, chrome yellow, quinacridone, BenzidineYellow, RoseBengale, triarylmethanedyes, monoazo dyes and disazo dyes, any of which may be used alone or in the form of a mixture.

The developer in the present invention may preferably be a magnetic developer having a magnetization intensity of from 10 $Am^2/kg$ to 40 $Am^2/kg$ under application of a magnetic field of 79.6 kA/m. The developer may more preferably have a magnetization intensity of from 20 $Am^2/kg$ to 35 $Am^2/kg$.

In the present invention, the reason why the magnetization intensity under application of a magnetic field of 79.6 kA/m is specified is as follows: Usually, the magnetization intensity at magnetic saturation (saturation magnetization) is used as the quantity expressing magnetic properties of magnetic materials. In the present invention, however, what is important is the magnetization intensity of a magnetic developer in a magnetic field which acts actually on the magnetic developer in the image-forming apparatus. When a magnetic developer is used in the image-forming apparatus, in most commercially available image-forming apparatus the magnetic field which acts on the magnetic developer is tens of kA/m to hundred and tens of kA/m. Accordingly, as a typical value of the magnetic field which acts actually on the magnetic developer in the image-forming apparatus, the magnetic field of 79.6 kA/m (1,000 oersteds) is selected, and the magnetization intensity in the magnetic field of 79.6 kA/m is specified.

If the magnetization intensity in the magnetic field of 79.6 kA/m is too small below the above range, it is difficult to transport the developer by the aid of the magnetic force, making it impossible to make the developer hold uniformly on the developer-carrying member. Also, when the developer is transported by the aid of the magnetic force, the rise of ears of one-componet magnetic developer can not uniformly be formed, and hence the performance of feeding the conductive fine particles to the latent-image-bearing member may decrease, also resulting in a lowering of the collection performance on transfer residual toner particles.

If the magnetization intensity in the magnetic field of 79.6 kA/m is too large beyond the above range, the toner particles may have higher magnetic cohesive properties to make it difficult for the conductive fine particles to be uniformly dispersed in the developer and to be fed to the latent-image-bearing member. Thus, the effect of promoting the charging of the latent-image-bearing member and the effect of improving the collection performance on transfer residual toner particles may be damaged, which are the effects attributable to the present invention.

As a means for obtaining such a magnetic developer, a magnetic material may be incorporated in the toner particles. The magnetic material to be incorporated in the toner particles in order to make the developer into the magnetic developer may include magnetic iron oxides such as magnetite, maghematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

As magnetic characteristics of these magnetic materials, those having a saturation magnetization of from 10 to 200 $Am^2/kg$, a residual magnetization of from 1 to 100 $Am^2/kg$ and a coercive force of from 1 to 30 kA/m under application of a magnetic field of 795.8 kA/m may be used. These magnetic materials may be used in an amount of from 20 parts by weight to 200 parts by weight based on 100 parts by weight of the binder resin. Of these magnetic materials, those composed chiefly of magnetite are particularly preferred.

In the present invention, the magnetization intensity of the magnetic developer may be measured with a vibrating-sample type magnetometer VSMP-1-10 (manufactured by Toei Kogyo K.K.) under an external magnetic field of 79.6 kA/m. The magnetic properties of the magnetic material may be measured at a temperature of 25° C. under an external magnetic field of 796 kA/m.

In the present invention, the developer may preferably have a triboelectric charge quantity of from 20 to 100 mC/kg in absolute value, as triboelectricity to a spherical iron powder with such particle diameter that it can pass a sieve with a mesh of 149 $\mu$m and can not pass a sieve with a mesh of 74 $\mu$m (149 $\mu$m mesh-pass and 74 $\mu$m mesh-on). If the triboelectric charge quantity of the developer is too small below the above range in absolute value, the transfer performance of toner particles may decrease to cause an increase in transfer residual toner particles. Hence, the charging performance on the latent-image-bearing member tends to decrease, and the load on the collection of the transfer residual toner particles may increase to tend to cause faulty collection. If the triboelectric charge quantity of the developer is too large beyond the above range in absolute value, the developer may have higher electrostatic cohesive properties to make it difficult for the conductive fine particles to be uniformly dispersed in the developer and to be fed to the latent-image-bearing member. Thus, the effect of promoting the charging of the latent-image-bearing member and the effect of improving the collection performance on transfer residual toner particles, which are the effects attributable to the present invention, may be damaged.

Especially in the case of the magnetic developer, the developer has magnetic cohesive properties at the same time, and hence the electrostatic cohesive properties must be further controlled. Accordingly, the developer may more preferably have a triboelectric charge quantity of from 25 to 50 mC/kg in absolute value, as triboelectricity to the 149 μm mesh-pass and 74 μm mesh-on spherical iron powder.

Figure 4:
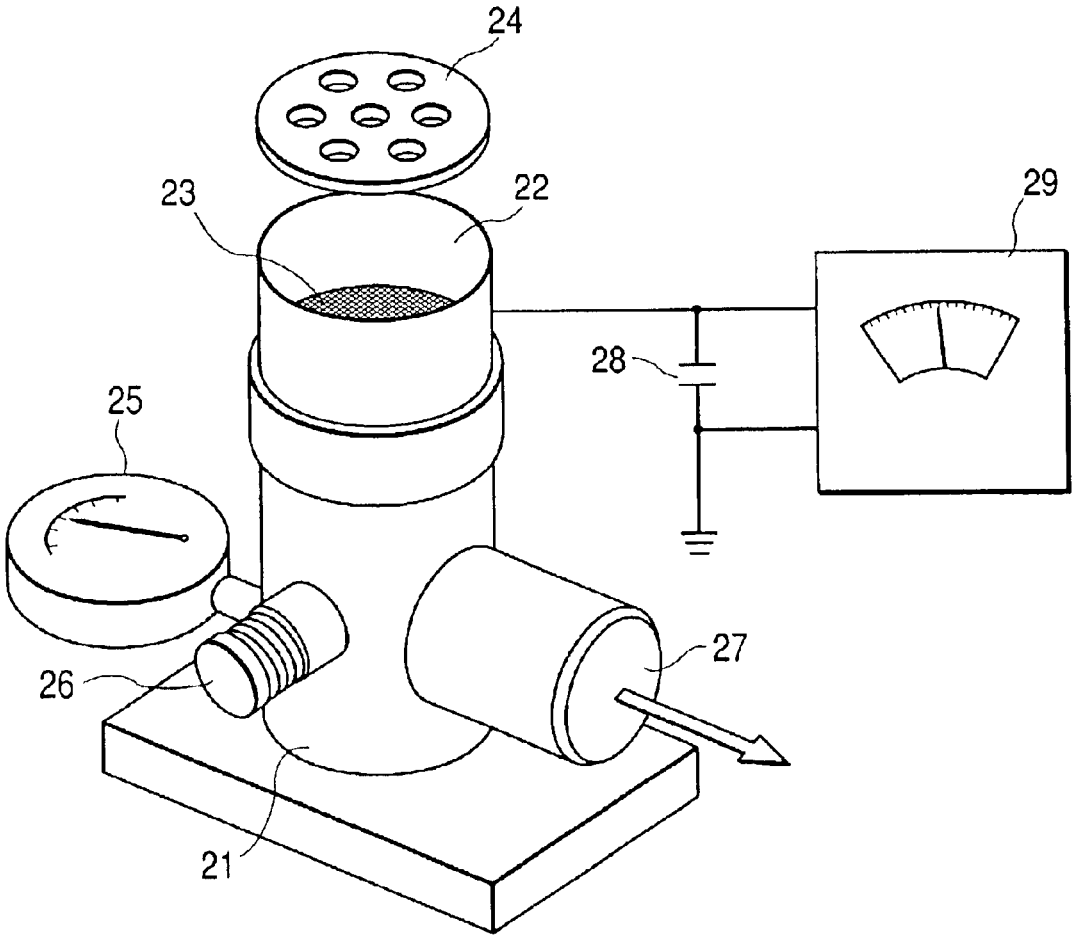
FIG. 4 is a diagrammatic view schematically showing a device for measuring the triboelectric charge quantity of developers used in the present invention.

A method of measuring the triboelectric charge quantity of the developer in the present invention is described with reference to a drawing. FIG. 4 illustrates a device for measuring the triboelectric charge quantity of developers used in the present invention. In an environment of 23° C. and 60% RH (relative humidity), first a mixture of the developer the triboelectric charge quantity of which is to be measured and a spherical iron powder carrier with particle diameter of 149 μm mesh-pass and 74 μm mesh-on (e.g., spherical iron powder DSP138, available from Dowa Teppun K.K., may be used) in a weight ratio of 5:95 (e.g., 0.5 g of the developer and 9.5 g of the iron carrier) is put in a bottle with a volume of 50 to 100 ml made of polyethylene, and is shaken 100 times. Then, about 0.5 g of the above mixture is put in a measuring container 22 made of a metal at the bottom of which a conductive screen 23 with a mesh of 31 μm is provided, and the container is covered with a plate 24 made of a metal. The total weight of the measuring container 22 at this time is weighed and is expressed as W1 (g). Next, in a suction device 21 (made of an insulating material at least at the part coming into contact with the measuring container 22), air is sucked from a suction opening 27 and an air-flow control valve 26 is operated to control the pressure indicated by a vacuum indicator 25, to be 2,450 Pa. In this state, suction is well carried out (for about 1 minute) to remove the toner by suction. The potential indicated by a potentiometer 29 at this time is expressed as V (volt). Here, reference numeral 28 denotes a capacitor, whose capacitance is expressed as C (μF). The total weight of the measuring container after completion of the suction is also weighed and is expressed as W2 (g). The triboelectric charge quantity (quantity of triboelectricity) of the developer is calculated as shown by the following expression.

$$\text{Quantity of triboelectricity (mC/kg)} = (C \times V)/(W1 - W2)$$

In the present invention, the developer may preferably contain a charge control agent. Among charge control agents, those capable of controlling the developer to be positively chargeable may include, e.g., the following materials.

Nigrosine and nigrosine products modified with a fatty acid metal salt; quaternary ammonium salts such as tributylbenzylammonium 1-hydroxy-4-naphthosulfonate and tetrabutylammonium tetrafluoroborate, and analogues of these, i.e., onium salts such as phosphonium salts, and lake pigments of these; triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds; and imidazole compounds. Any of these may be used alone or in combination of two or more kinds. Of these, triphenylmethane dyes compounds and quaternary ammonium salts whose counter ions are not halogens may preferably be used. Homopolymers of monomers represented by the following general formula (4), and copolymers with the polymerizable monomers such as styrene, acrylates or methacrylates described previously may also be used as positive charge control agents. In this case, these charge control agents function as binder resins (as a whole or in part).

(4)

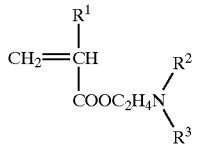

In the formula, $R^1$, $R^2$ and $R^3$ each represent a hydrogen atom or a saturated hydrocarbon group having 1 to 4 carbon atoms.

In the construction of the present invention, compounds represented by the following general formula (5) are particularly preferred as positive charge control agents.

(5)

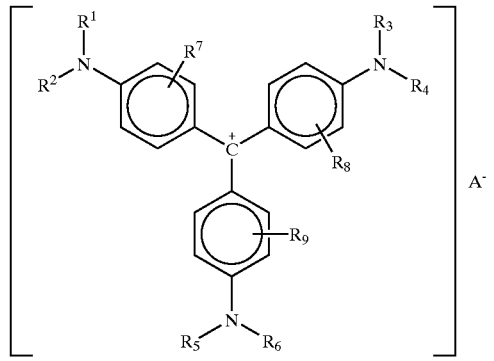

In the formula, $R^1$, $R_2$, $R_3$, $R_4$, $R_5$ and $R_6$ may be the same or different from one another and each represents a hydrogen atom, a substituted or unsubstituted alkyl group or a substituted or unsubstituted aryl group. $R^7$, $R_8$ and $R_9$ may be the same or different from one another and each represents a hydrogen atom, a halogen atom, an alkyl group or an alkoxyl group. A– represents an anion such as a sulfate ion, a nitrate ion, a borate ion, a phosphate ion, a hydride ion, an organosulfate ion, an organosulfonate ion, an organophosphate ion, a carboxylate ion, an organoborate ion or a tetrafluoroborate ion.

A charge control agent capable of controlling the developer to be negatively chargeable may include the following materials: For example, organic metal complex salts and chelate compounds are effective, including monoazo metal complexes, acetylacetone metal complexes, aromatic hydroxycarboxylic acid and aromatic dicarboxylic acid type metal complexes. Besides, they may also include aromatic hydroxycarboxylic acids, aromatic mono- and polycarboxylic acids, and metal salts, anhydrides or esters thereof, and phenol derivatives such as bisphenol.

In particular, azo type metal complexes represented by the following general formula (6) shown below are preferred.

(6)

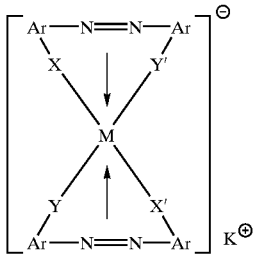

In the formula, M represents a central metal of coordination, including Sc, Ti, V, Cr, Co, Ni, Mn or Fe. Ar represents an aryl group as exemplified by a phenyl group or a naphthyl group, which may have a substituent. In such a case, the substituent includes anitro group, a halogen atom, a carboxyl group, an anilido group, and an alkyl group having 1 to 18 carbon atoms or an alkoxyl group having 1 to 18 carbon atoms. X, X', Y and Y' each represents —O—, —CO—, —NH— or —NR—(R is an alkyl group having 1 to 4 carbon atoms). K represents a hydrogen, sodium, potassium, ammonium or aliphatic ammonium ion.

As the central metal, Fe or Cr is particularly preferred. As the substituent, a halogen atom, an alkyl group or an anilido group is preferred. As the counter ion, hydrogen, ammonium or aliphatic ammonium ion is preferred.

Besides, basic organic acid metal complex salts represented by the following general formula (7) are also capable of imparting negative chargeability, and are usable in the present invention (7)

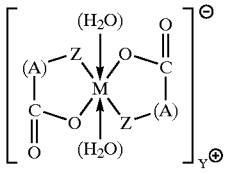

In the formula, M represents a central metal of coordination, including Cr, Co, Ni, Mn, Fe, Zn, Al, Si, Bor Zr. A represents;

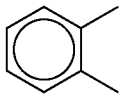

(which may have a substituent such as an alkyl group)

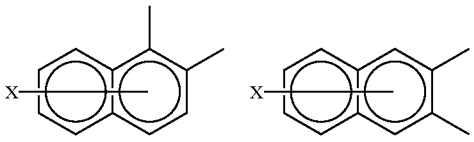

-continued

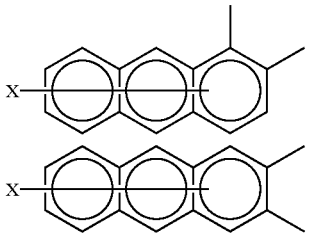

(X represents a hydrogen atom, a halogen atom, a nitro group or an alkyl group), and

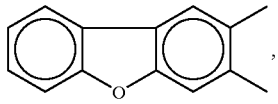

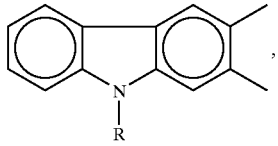

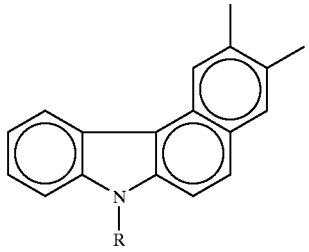

(R represents a hydrogen atom, an alkyl group having 1 to 18 carbon atoms or an alkenyl group having 2 to 18 carbon atoms);

$Y^+$ represents hydrogen, sodium, potassium, ammonium or aliphatic ammonium. Z represents

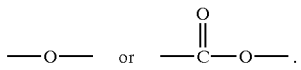

In the general formula (7), as the central metal, Fe, Al, Zn, Zr or Cr is particularly preferred. As the substituent, a halogen atom, an alkyl group or an anilido group is preferred. As the counter ion, hydrogen, alkali metal, ammonium or aliphatic ammonium ion is preferred. A mixture of complex salts having different counter ions may also preferably be used.

As methods for incorporating the charge control agent in the developer, there are a method of adding it internally into the toner particles and a method of adding it externally to the toner particles. The amount of the charge control agent used depends on the type of the binder resin, the presence of any other additives, and the manner by which the toner is produced, including the manner of dispersion, and can not absolutely be specified. Preferably, the charge control agent may be used in an amount ranging from 0.1 to 10 parts by weight, and more preferably from 0.1 to 5 parts by weight, based on 100 parts by weight of the binder resin.

In producing the toner particles according to the present invention, it is preferable to use a method in which the component materials as described above are thoroughly mixed by means of a ball mill or any other mixer, thereafter the mixture obtained is well kneaded by means of a heat kneading machine such as a heat roll, a kneader or an extruder, and the kneaded product is cooled to solidify, followed by pulverization, classification and optionally surface treatment such as shape control of toner particles, to obtain the toner particles.

As the treatment for shape control of toner particles, available are a method in which toner particles obtained by pulverization are dispersed in water or in an organic solvent to heat or swell them, a heat treatment method in which the toner particles are passed through hot-air streams, and a mechanical-impact method in which mechanical energy is applied to the toner particles. As a means for applying mechanical impact force, available is a method in which toner particles are pressed against the inner wall of a casing by centrifugal force by means of a high-speed rotating blade to impart mechanical impact force to the toner particles by a force such as a compression force or a frictional force, as in an apparatus such as a mechanofusion system manufactured by Hosokawa Micron Corporation, and a hybridization system manufactured by Nara Kikai Seisakusho.

In the present invention, when the treatment to impart mechanical impact is made, the atmospheric temperature at the time of treatment may be set to a temperature around the glass transition temperature Tg of the toner particles (Tg plus or minus 30° C.). This is preferable from the viewpoint of the prevention of agglomeration and productivity. More preferably, treatment to make toner particles spherical by thermomechanical impact may be made at a temperature of Tg plus or minus 20° C. This is preferable in order to make the conductive fine particles function effectively.

An example of a method of carrying out treatment to make the toner particles spherical (hereinafter often "spherical treatment") by imparting thermomechanical impact repeatedly is specifically described with reference to FIGS. 6 and 7.

Figure 6:
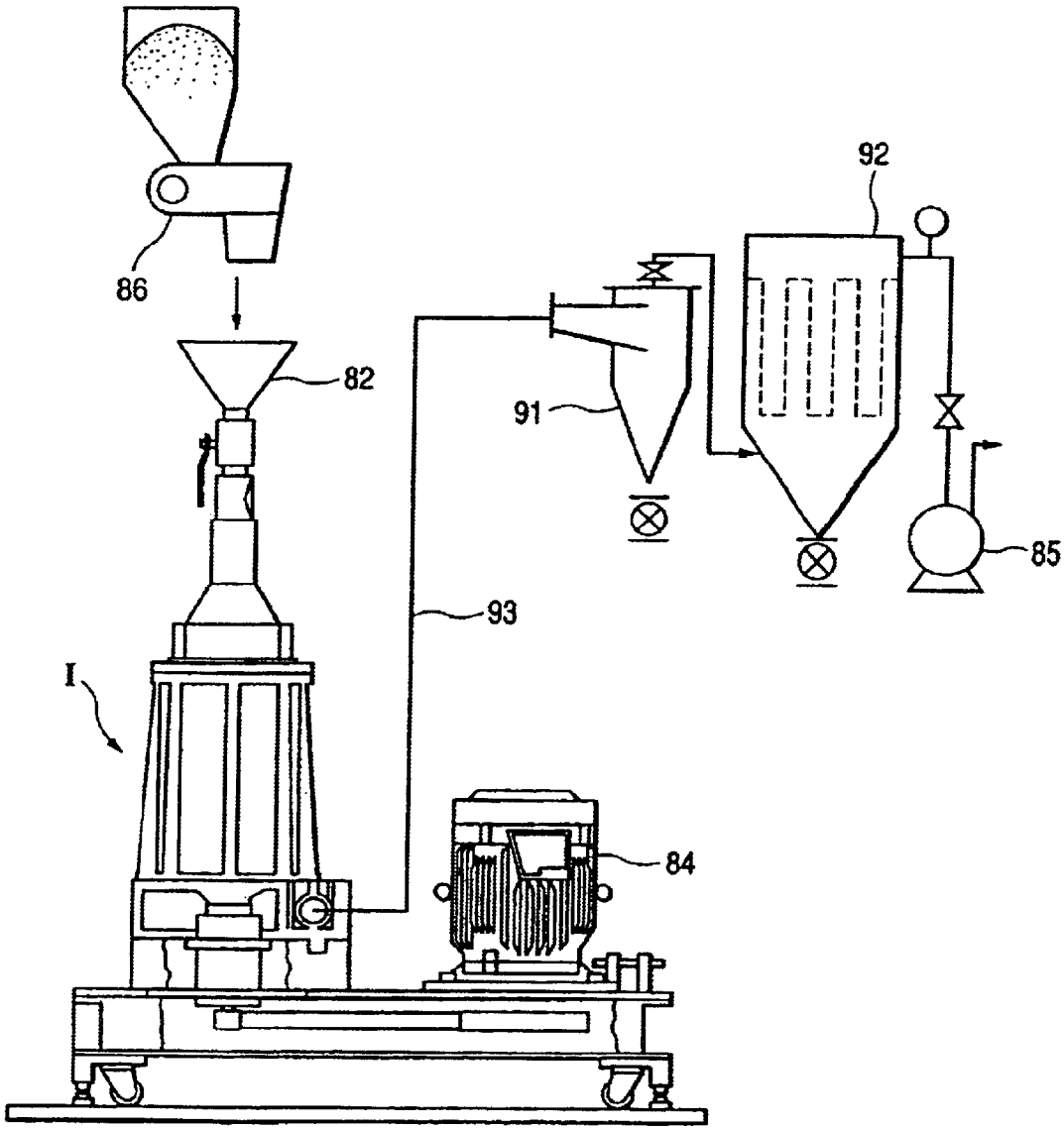
FIG. 6 is a schematic view showing the construction of an apparatus for making toner particle spherical, used in examples of the present invention.

FIG. 6 is a diagrammatic schematic view showing the construction of a treatment apparatus for making toner particle spherical, used in Toner Production Examples 2 to 4 given layer. FIG. 7 is a diagrammatic partial sectional view showing the construction of a treatment section I shown in FIG. 6.

This treatment apparatus for making toner particle spherical is an apparatus in which toner particles are pressed against the inner wall of a casing by centrifugal force by means of a high-speed rotating blade to impart thermomechanical impact to the toner particles at least by a compression force and a frictional force. As shown in FIG. 7, the treatment section 1 is provided with four rotors 72*a*, 72*b*, 72*c* and 72*d* set in the vertical direction. These rotors 72*a*, 72*b*, 72*c* and 72*d* are rotated by rotating a rotating drive shaft 73 by means of an electric motor 84 in such a way that the peripheral speed at their outermost edges comes to 100 m/second. Here, the number of revolutions of the rotors 72*a*, 72*b*, 72*c* and 72*d* is, e.g., 130 $s^{-1}$. Then, a suction blower 85 (see FIG. 6) is operated to suck air at an air-flow rate substantially equal to, or larger than, the rate of air streams produced by the rotation of blades 79*a* to 79*d* provided integrally with the rotors 72*a*, 72*b*, 72*c* and 72*d*, respectively. The toner particles are suction led into a hopper 82 from a feeder 86 together with the air, and the toner particles led thereinto are led into the center of a first cylindrical treating chamber 89*a*. These toner particles undergo spherical treatment in the first cylindrical treating chamber 89*a* by means of the blade 79*a* and a sidewall 77. Then, the toner particles having been spherical-treated are led into the center of a second cylindrical treating chamber 89*b* through a first powder discharge opening 90*a* provided at the center of a guide plate 78*a*, and further undergo spherical treatment by means of the blade 79*b* and the sidewall 77.

The toner particles having been spherical-treated in the second cylindrical treating chamber 89*b* are led into the center of a third cylindrical treating chamber 89*c* through a second powder discharge opening 90*b* provided at the center of a guide plate 78*b*, and further undergo spherical treatment by means of the blade 79*c* and the sidewall 77. The toner particles thus treated are further led into the center of a fourth cylindrical treating chamber 89*d* through a third powder discharge opening 90*c* provided at the center of a guide plate 78*c*, and undergo spherical treatment by means of the blade 79*d* and the sidewall 77. Further, the particles thus treated are taken out by a delivery tube 93 through a fourth powder discharge opening 90*d* provided at the center of a guide plate 78*d*. The air which is transporting the toner particles is passed through the first to fourth cylindrical treating chambers 89*a* to 89*d* and then discharged out of the apparatus system through the delivery tube 93, a cyclone 91, a bag filter 92 and the suction blower 85.

The toner particles led into the cylindrical treating chambers 89*a* to 89*d* undergo mechanical impact action instantaneously by means of the blades 79*a* to 79*d*, respectively, and further collide against the side wall 77 to receive the mechanical impact force. The rotation of the blades 79*a* to 79*d* each having a stated size, set to the rotors 72*a*, 72*b*, 72*c* and 72*d*, respectively, causes convection currents circulating from the center to the circumference and from the circumference to the center, in the upper space on the rotor faces. The toner particles stagnate in the cylindrical treating chambers 89*a* to 89*d* to undergo spherical treatment there. By virtue of the heat generated by this mechanical impact force, the toner particles are made spherical by the mechanical impact force when the toner particle surfaces are heated nearly to the glass transition temperature of the binder resin constituting the toner particles. Passing through the respective cylindrical treating chambers 89*a* to 89*d*, the toner particles are continuously made spherical with good efficiency.

The degree of sphericity of the toner particles can be controlled by, e.g., the residence time and temperature of the toner particles at the spherical treatment section. Stated specifically, it is controlled by the rotational speed and number of revolutions of the rotors, the height, width and number of the blades, the clearance between the blade circumference and the side wall and the suction air-flow rate of the suction blower, as well as the temperature of the toner particles at the time they are led into the spherical treatment section, the temperature of the air transporting the toner particles, and so forth.

As a batch type apparatus, it is one of the preferred examples to use the hybridization system having been made commercially available, manufactured by Nara Kikai Seisakusho K.K.

To control the shape of the toner particles obtained by a pulverization process, toner particle constituent materials, such as the binder resin, may be selected and the conditions at the time of pulverization may appropriately be set. However, since the productivity tends to decrease in an attempt to make the circularity of toner particles higher by means of an air grinding machine, it is preferable to use a mechanical grinding machine and set conditions under which the circularity of toner particles can be made higher.

In the present invention, in order to keep low the coefficient of variation of the particle size distribution of toner particles, it is preferable in view of productivity to use a multi-division classifier in the step of classification. Also, in order to decrease the number of ultrafine particles of the toner particles ranging in particle diameter from 1.00 μm to less than 2.00 μm, it is preferable to use the mechanical grinding machine in the step of pulverization.

To the toner particles thus obtained, the external additive is added, and then these are blended by means of a mixing machine, optionally further followed by sieving. Thus the developer used in the present invention can be produced.

As a production apparatus used when the toner particles are produced by the pulverization process, a mixing machine may include a Henschel Mixer (manufactured by Mitsui Mining and Smelting Co., Ltd.); a Super Mixer (manufactured by Kawata K.K.); a Ribocone (manufactured by Ohkawara Seisakusho K.K.); a Nauta Mixer, a Turbulizer and a Cyclomix (manufactured by Hosokawa Micron Corporation); a Spiral Pin Mixer (manufactured by Taiheiyo Kiko K.K.); and a Rhedige Mixer (manufactured by Matsubo K.K.). As a kneading machine, it may include a KRC Kneader (manufactured by Kurimoto Tekkosho K.K.); a Buss Co-kneader (manufactured by Buss Co.); a TEM-type Extruder (manufactured by Toshiba Machine Co., Ltd.); a TEX Twin-screw Extruder (manufactured by Nippon Seiko K.K.); a PCM Kneader (manufactured by Ikegai Tekkosho K.K.); a Three-Roll Mill, a Mixing Roll Mill, and a Kneader (manufactured by Inoue Seisakusho K.K.); a Kneadex (manufactured by Mitsui Mining and Smelting Co., Ltd.); a MS-Type Pressure Kneader, a Kneader Ruder (manufactured by Moriyama Seisakusho K.K.); and a Banbury Mixer (manufactured by Kobe Seikosho K.K.). As a grinding machine, it may include a Counter Jet Mill, a Micron Jet and Inomizer (manufactured by Hosokawa Micron Corporation); an IDS-Type Mill and a PJM Jet Grinding Mill (manufactured by Nippon Pneumatic Kogyo K.K.); a Cross Jet Mill (manufactured by Kurimoto Tekkosho K.K.); an Ulmax (manufactured by Nisso Engineering K.K.); a SK Jet O-Mill (manufactured by Seishin Kigyo K.K.); a Criptron (manufactured by Kawasaki Heavy Industries, Ltd); and a Turbo Mill (manufactured by Turbo Kogyo K.K.). Of these, it is more preferable to use the mechanical grinding machine such as a Criptron and a Turbo Mill. As a classifier, it may include a Classyl, a Micron Classifier and a Spedic Classifier (manufactured by Seishin Kigyo K.K.); a Turbo Classifier (manufactured by Nisshin Engineering K.K.); a Micron Separator, a Turboprex (ATP) and a TSP Separator (manufactured by Hosokawa Micron Corporation); an Elbow Jet (manufactured by Nittestsu Kogyo K.K.); a Dispersion Sparator (manufactured by Nippon Pneumatic Kogyo K.K.); and a YM Microcut (manufactured by Yasukawa Shoji K.K.). As a sifter used to sieve coarse powder and so forth, it may include an Ultrasonic (manufactured by Koei Sangyo K.K.); a Rezona Sieve and Gyrosifter (manufactured by Tokuju Kosakusho K.K.); a Vibrasonic System (manufactured by Dulton Co.); a Soniclean (manufactured by Shinto Kogyo K.K.); a Turbo Screener (manufactured by Turbo Kogyo K.K.); a Microsifter (manufactured by Makino Sangyo K.K.); and circular vibrating screens.

As additives to the developer which are used in the present invention and intended to impart various properties, the following may be used, for example.

(1) As abrasives, metal oxides such as cerium oxide, aluminum oxide, magnesium oxide and chromium oxide, nitrides such as silicon nitride, carbides such as silicon carbide, and metal salts such as strontium titanate, calcium sulfate, barium sulfate and calcium carbonate may be used.

(2) As lubricants, fluorine resin powders such as vinylidene fluoride and polytetrafluoroethylene, silicone resin powder and fatty acid metal salts such as zinc stearate and calcium stearate may be used.

Any of these additives may be used in an amount of from 0.05 part to 10 parts by weight, and preferably from 0.1 part to 5 parts by weight, based on 100 parts by weight of the toner particles. These additives may be used alone or in combination.

(Developing Assembly, Process Cartridge and Image-forming Method)

The developing assembly and image-forming method of the present invention in which the developer in the present invention can favorably be used are described below. The process cartridge of the present invention is also described below.

The developing assembly of the present invention is a developing assembly having at least (I) a developing container for holding therein the developer, (II) a developer-carrying member for holding thereon the developer held in the developing container and transporting the developer to a developing zone, and (III) a developer layer thickness regulation member for regulating the layer thickness of the developer to be held on the developer-carrying member.

The image-forming method of the present invention has (I) a charging step of charging a latent-image-bearing member electrostatically, (II) a latent-image-forming step of writing image information as an electrostatic latent image on the charged surface of the latent-image-bearing member having been charged in the charging step, (III) a developing step of developing the electrostatic latent image to render it visible as a developer image by means of a developing assembly having a developer-carrying member which, holding thereon the developer, transports the developer to a developing zone facing the latent-image-bearing member, (IV) a transfer step of transferring the developer image to a transfer material, and (V) a fixing step of fixing by a fixing means the developer image having been transferred to the transfer material. These steps are repeated to form images.

Then, a first embodiment of the image-forming method of the present invention is a method making use of contact charging in which the charging step is the step of charging the latent-image-bearing member electrostalically, keeping a charging means in contact with the latent-image-bearing member, and the latent-image-bearing member is charged by applying a voltage to the charging means in the state the conductive fine particles of the developer stand interposed at the contact zone between the charging means and the latent-image-bearing member.

In a second embodiment of the image-forming method of the present invention, the developing step is the step of rendering the electrostatic latent image visible, and at the same time collecting the developer having remained on the latent-image-bearing member after the developer image has been transferred to a recording medium transfer material.

More specifically, the image-forming method according to this second embodiment is a method making use of what is called the cleaning-at-development system, in which the developing step serves also as the step of collecting the developer having remained on the latent-image-bearing member after the developer image has been transferred to a recording medium transfer material.

The process cartridge of the present invention has at least a latent-image-bearing member for holding thereon an electrostatic latent image, a charging means for charging the latent-image-bearing member electrostatically, and a developing assembly for developing the electrostatic latent image formed on the latent-image-bearing member, by the use of the developer to form a developer image; where the developing assembly and the latent-image-bearing member are set integral as one unit and are so constructed as to be detachably mountable to the main body of an image-forming apparatus.

A first embodiment of the process cartridge of the present invention is an embodiment making use of contact charging in which the charging means is in contact with the latent-image-bearing member, and the latent-image-bearing member is charged by applying a voltage in the state the conductive fine particles of the developer stand interposed at the contact zone between the charging means and the latent-image-bearing member.

In a second embodiment of the process cartridge of the present invention, the developing assembly performs development of the electrostatic latent image formed on the latent-image-bearing member, by the use of the developer to render it visible as the developer image, and at the same time collects the developer having remained on the latent-image-bearing member after the developer image has been transferred to a recording medium transfer material.

The developing assembly of the present invention may preferably be a developing assembly having at least i) a developer-carrying member provided opposingly to the latent-image-bearing member and ii) a developer layer thickness regulation member for forming a developer layer in a thin layer on this developer-carrying member, where the developer is moved from the developer layer formed on the developer-carrying member, to the latent-image-bearing member to form the developer image.

The developing assembly, the process cartridge and the image-forming method of the present invention are described below in detail.

First, the charging step in the image-forming method of the present invention is carried out using a charging assembly of a non-contact type, such as a corona charging assembly as a charging means, or using a contact charging assembly in which a conductive charging member (contact charging member or contact charging assembly) of a roller type (charging roller), a fur brush type, a magnetic-brush type or a blade type is kept in contact with a charging object member latent-image-bearing member and a stated charging bias is applied to this contact charging member (herein "contact charging member") to charge the surface of the charging object member electrostatically to the stated polarity and potential. In the present invention, it is preferable to use the contact charging assembly because it has the advantages of lower ozone generation and lower power consumption than the charging assembly of a non-contact type, such as the corona charging assembly.

The transfer residual toner particles on the latent-image-bearing member are considered to include those corresponding to a pattern of images to be formed and those ascribable to what is called fogging toner at areas where no image is formed. As to the transfer residual toner particles corresponding to a pattern of images to be formed, it is difficult for them to be completely collected in the cleaning-at-development step. If their collection is inadequate, transfer residual toner particles not well collected may appear as they are, on images formed subsequently, to cause a pattern ghost. On such transfer residual toner particles corresponding to an image pattern, the collection performance in the cleaning-at-development step can sharply be improved by leveling the pattern of transfer residual toner particles. For example, where the developing step is a contact development process, a relative difference in speed may be provided between the movement speed of the developer-carrying member holding thereon the developer and the movement speed of the latent-image-bearing member standing in contact with the developer-carrying member, whereby the pattern of transfer residual toner particles can be leveled and at the same time the transfer residual toner particles can be collected with good efficiency. However, where transfer residual toner particles remain on the latent-image-bearing member in a large quantity as in the case when a power source is suddenly switched off in the course of image formation or at the time of a paper jam, a pattern ghost may appear because the pattern of transfer residual toner particles having remained on the latent-image-bearing member obstructs latent-image formation by imagewise exposure. As a countermeasure therefor, where the contact charging assembly is used, the pattern of transfer residual toner particles may be leveled by means of the contact charging member. Thus, the transfer residual toner particles can be collected with good efficiency even when the developing step is a non-contact development process, and the pattern ghost due to faulty collection can be prevented from occurring. Also, in the case when the transfer residual toner particles remain on the latent-image-bearing member in a large quantity, too, the contact charging member first dams up the transfer residual toner particles, then levels the pattern of transfer residual toner particles, and sends out the transfer residual toner particles gradually onto the latent-image-bearing member. Thus, the pattern ghost due to any obstruction of latent-image formation can be prevented. With regard to the lowering of charging performance on the latent-image-bearing member because of any contamination of the contact charging member when a large quantity of transfer residual toner particles are damed up by the contact charging member, the lowering of uniform charging performance on the latent-image-bearing member can be lessened to a level of no problem in practical use by using the specific developer in the present invention. From this point of view, it is preferable in the present invention to use the contact charging assembly.

In the present invention, a relative difference in speed may be provided between the movement speed at the surface of the contact charging member and the movement speed at the surface of the latent-image-bearing member. The relative difference in speed provided between the movement speed at the surface of the contact charging member and the movement speed at the surface of the latent-image-bearing member may cause a great increase in torque between the contact charging member and the latent-image-bearing member and a remarkable scrape of the surfaces of the contact charging member and latent-image-bearing member. However, a lubricating effect (friction reduction effect) can be obtained where the components of the developer are made to be interposed at the contact zone between the contact charging member and the latent-image-bearing member. This makes it possible to provide the difference in speed without causing any great increase in torque and any remarkable scrape.

The components of the developer which are interposed at the contact zone between the contact charging member and the latent-image-bearing member and may preferably contain at least the conductive fine particles descried previously. More preferably, the proportion of the conductive fine particles with respect to the whole developer components interposed at the contact zone may be higher than the proportion of the conductive fine particles contained in the developer in the present invention (i.e., the conductive fine particles in the developer before it is used in the image formation of the present invention). Inasmuch as the components of the developer which are interposed at the contact zone contain at least the conductive fine particles, conduction paths between the latent-image-bearing member and the contact charging member can be ensured and the uniform charging performance on the latent-image-bearing member can be kept from decreasing where the transfer residual toner particles adhere to or mingle with the contact charging member. Also, inasmuch as the proportion of the conductive fine particles with respect to the whole developer components interposed at the contact zone is higher than the proportion of the conductive fine particles contained in the developer in the present invention, the uniform charging performance on the latent-image-bearing member can be kept from decreasing where the transfer residual toner particles adhere to or mingle with the contact charging member. In addition, even where a relatively large difference in relative-movement speed is provided between the contact charging member and the latent-image-bearing member, the contact charging member and the latent-image-bearing member can be kept from being scraped or scratched, because the conductive fine particles containing in a large number the particles ranging in particle diameter from 1.00 $\mu$m to less than 2.00 $\mu$m, which exhibit superior lubricating properties, are fed to the charging zone.

The charging bias applied to the contact charging member may be only DC voltage. Even by such voltage, good charging performance on the latent-image-bearing member can be achieved. It may also be a voltage formed by superimposing an alternating voltage (AC voltage) on DC voltage. As waveforms of such alternating voltage, any of sinusoidal waveform, rectangular waveform and triangular waveform may appropriately be used. The alternating voltage may also be a voltage of pulse waves formed by periodic turning on/off of a DC power source. Thus, as the alternating voltage, a bias may be used which has such a waveform that its voltage value changes periodically.

In the present invention, the charging bias applied to the contact charging member may preferably be applied within the range that any discharge products are not formed. More specifically, it may preferably be lower than the voltage at which the discharge starts occurring between the contact charging member and the charging object member (latent-image-bearing member). Also, a charging system predominantly governed by a direct-injection charging mechanism is preferred.

In the cleaning-at-development method, insulative transfer residual toner particles remaining on the latent-image-bearing member may come into contact with the contact charging member and adhere to or mingle with it to cause a lowering of the charging performance on the latent-image-bearing member. In the case of the charging system predominantly governed by a discharge charging mechanism, the charging performance on the latent-image-bearing member tends to decrease abruptly around the time when a toner layer having adhered to the contact charging member surface comes to have a resistance which may obstruct the discharge voltage. On the other hand, in the case of the charging system predominantly governed by a direct-injection charging mechanism, the uniform charging performance on the charging object member (latent-image-bearing member) may decrease where the transfer residual toner particles having adhered to or mingled with the contact charging member has lowered the probability of contact between the contact charging member surface and the charging object member. This may lower the contrast and uniformity of electrostatic latent images to cause a decrease in image density and make fog occur seriously.

According to the mechanism of the lowering of charging performance in the discharge charging mechanism and that in the direct-injection charging mechanism, the effect of preventing the charging performance on the latent-image-bearing member from decreasing and the effect of promoting the charging of the latent-image-bearing member which are attributable to the conductive fine particles made to be interposed at least at the contact zone between the latent-image-bearing member and the charging member kept in contact with the latent-image-bearing member are more remarkable in the direct-injection charging mechanism. Accordingly, the developer in the present invention may preferably be applied in the direct-injection charging mechanism.

More specifically, in the discharge charging mechanism, in order that the toner layer formed by the transfer residual toner particles adhering to or mingling with the contact charging member may be made not come to have the resistance which may obstruct the discharge voltage fed from the contact charging member to the latent-image-bearing member, by making at least the conductive fine particles be interposed at the contact zone between the latent-image-bearing member and the charging member kept in contact with the latent-image-bearing member, the proportion of the conductive fine particles must be made higher with respect to the whole developer components interposed at the contact zone between the latent-image-bearing member and the charging member kept in contact with the latent-image-bearing member and at the charging region in the vicinity thereto. Accordingly, much more transfer residual toner particles must be sent out onto the latent-image-bearing member in order that the quantity of transfer residual toner particles thus adhering or mingling is restricted so that the toner layer having adhered to or mingled with the contact charging member may not come to have the resistance which may obstruct the discharge voltage. This tends to obstruct the formation of latent images.

On the other hand, in the direct-injection charging mechanism, contact points between the contact charging member and the charging object member can be ensured with ease via the conductive fine particles by making at least the conductive fine particles be interposed at the contact zone between the latent-image-bearing member and the charging member kept in contact with the latent-image-bearing member. Thus, the transfer residual toner particles having adhered to or mingled with the contact charging member can be prevented from lowering the probability of contact between the contact charging member surface and the charging object member, and the charging performance on the latent-image-bearing member can be kept from decreasing.

In particular, in the case when the relative difference in speed is provided between the movement speed at the surface of the contact charging member and the movement speed at the surface of the latent-image-bearing member, the quantity of the whole developer components interposed at the contact zone between the latent-image-bearing member and the contact charging member can be restricted by the rubbing friction between the contact charging member and the latent-image-bearing member. This can more surely keep the latent-image-bearing member from its charging obstruction, and also can remarkably increase the opportunities of contact of the conductive fine particles with the latent-image-bearing member at the contact zone between the contact charging member and the latent-image-bearing member. Thus, the direct-injection charging to the latent-image-bearing member via the conductive fine particles can further be promoted. On the other hand, in the discharge charging, the discharge takes place not at the contact zone between the latent-image-bearing member and the contact charging member, but at a region where the latent-image-bearing member and the contact charging member are not in contact and have a minute gap. Hence, the effect of preventing the charging obstruction can not be expected, which is attributable to the fact that the quantity of the whole developer components interposed at the contact zone is restricted.

From these viewpoints, too, it is preferable in the present invention to use a charging system predominantly governed by the direct-injection charging mechanism. The charging system predominantly governed by the direct-injection charging mechanism not relying on the discharge charging is preferred.

To implement such a charging system, the charging bias applied to the contact charging member may preferably be lower than the voltage at which the discharge starts taking place between the contact charging member and the charging object member (latent-image-bearing member).

The relative difference in speed provided between the movement speed at the surface of the contact charging member and the movement speed at the surface of the latent-image-bearing member is provided by driving the contact charging member rotatably.

The direction of the movement at the surface of the contact charging member and the direction of the movement speed at the surface of the latent-image-bearing member may preferably be opposite to each other. More specifically, the contact charging member and the latent-image-bearing member may move in a direction opposite to each other. In order that the transfer residual toner particles left on the latent-image-bearing member and carried to the contact charging member are temporarily collected in the contact charging member and are leveled there, the contact charging member and the latent-image-bearing member may preferably be moved in a direction opposite to each other. For example, the contact charging member may preferably be so constructed that it is rotatably driven and, in addition, as its rotational direction is opposite to the direction of movement of the latent-image-bearing member surface at the contact zone between them. That is, the charging is performed in the state that the transfer residual toner particles left on the latent-image-bearing member are first drawn apart by the rotation in the opposite direction. This makes it possible to perform the direct-injection charging mechanism predominantly and to keep the latent-image formation from being obstructed. In addition, improving the effect of leveling the pattern of transfer residual toner particles makes it possible to improve the collection performance on transfer residual toner particles and to more surely prevent a pattern ghost from occurring because of faulty collection.

The relative difference in speed may also be provided by moving the contact charging member in the same direction as the direction of movement of the latent-image-bearing member surface. However, the charging performance in the direct-injection charging depends on the ratio of the movement speed of the latent-image-bearing member to the relative movement speed of the contact charging member. Hence, in order to attain the same relative movement ratio as that in the case of opposite direction rotation, the movement speed of the contact charging member rotated in the same direction must be made larger than in the case of opposite direction rotation. Thus, in view of the movement speed, it is more advantageous to move the charging member in the opposite direction. In terms of the effect of leveling the pattern of transfer residual toner particles, too, it is more advantageous to move the charging member in the direction opposite to the movement direction of the latent-image-bearing member surface.

In the present invention, the ratio of the movement speed of the latent-image-bearing member to the relative movement speed of the contact charging member (relative movement speed ratio) may preferably be from 10% to 500%, and more preferably from 20% to 400%.

If the relative movement speed ratio is too small below the above range, the probability of contact between the contact charging member surface and the latent-image-bearing member cannot sufficiently be made higher to make it difficult in some cases to maintain the charging performance on the latent-image-bearing member by direct-injection charging. Moreover, the restricting of the quantity of the conductive fine particles interposed at the contact zone between the latent-image-bearing member and the contact charging member by the rubbing friction between the contact charging member and the latent-image-bearing member and the leveling of the pattern of transfer residual toner particles to improve the collection performance on the developer in the cleaning-at-development step can not be obtained in some cases.

If the relative movement speed ratio is too large beyond the above range, it follows that the movement speed of the contact charging member is made higher. Hence, the developer components carried to the contact zone between the latent-image-bearing member and the contact charging member may scatter to tend to cause in-machine contamination, and also the latent-image-bearing member and the contact charging member tend to wear or tend to be scratched, tending to shorten their life.

Where the movement speed of the contact charging member is 0 (in the state the contact charging member stands still), the point of contact of the contact charging member with the latent-image-bearing member comes to the fixed point. Hence, the part of contact of the contact charging member with the latent-image-bearing member tends to wear or deteriorate, and the effect of keeping the latent-image-bearing member from its charging obstruction and the effect of leveling the pattern of transfer residual toner particles to improve the collection performance on the developer in the cleaning-at-development step tend to decrease undesirably.

The relative movement speed ratio indicating the relative difference in speed described here can be represented by the following equation.

$$\text{Relative movement speed ratio } (\%) = |[(Vc - Vp)/Vp] \times 100|.$$

In the equation, Vc is the movement speed of the contact charging member surface, Vp is the movement speed of the latent-image-bearing member surface, and the movement speed Vc of the contact charging member surface is the value to be represented by the same letter symbol as the movement speed Vp of the latent-image-bearing member surface when the contact charging member surface moves in the same direction as the latent-image-bearing member surface at their contact zone.

In the present invention, the contact charging member may preferably have an elasticity in order to temporarily collect in the contact charging member the transfer residual toner particles left on the latent-image-bearing member and also to hold the conductive fine particles on the contact charging member and provide the contact zone between the latent-image-bearing member and the contact charging member to perform the direct-injection charging predominantly. The contact charging member may preferably have an elasticity also in order to level the pattern of transfer residual toner particles by the aid of the contact charging member to improve the collection performance on transfer residual toner particles.

In the present invention, the latent-image-bearing member is charged by applying a voltage to the charging member, and hence the charging member may also preferably be conductive. Accordingly, the charging member may preferably be a magnetic brush contact charging member having a conductive elastic roller and a magnetic brush portion having magnetic particles bound magnetically to the roller, which magnetic brush portion is brought into contact with the charging object member, or a brush member comprised of conductive fibers. In view of the advantage that the construction of the charging member can be made simple, the charging member may preferably be an conductive elastic roller or a brush roller having conductivity. In view of an advantage that the developer components (e.g., the transfer residual toner particles and the conductive fine particles) adhering to or mingling with the charging member can stably be retained with ease without scattering, the charging member may preferably be the conductive elastic roller.

With regard to the hardness of the conductive elastic roller as a roller member, too low a hardness may make the shape of the roller member so unstable as to come into poor contact with the charging object member. Also, the conductive fine particles standing interposed at the contact zone between the roller member and the latent-image-bearing member may scrape or scratch the conductive elastic roller surface, so that no stable charging performance may be attained. On the other hand, too high a hardness not only may make it impossible to ensure the charging contact zone between the roller member and the charging object member, but also may make poor the micro-contact with the surface of the charging object member (latent-image-bearing member). Hence, any stable charging performance on the latent-image-bearing member can not be achieved. Moreover, the effect of leveling the pattern of transfer residual toner particles may decrease to make it impossible to improve the collection performance on the transfer residual toner particles. Accordingly, one may contemplate making higher the pressure of contact of the conductive elastic roller with the latent-image-bearing member. This, however, tends to cause scraping, scratching, or the like of the roller contact charging member or the latent-image-bearing member. From these viewpoints, the conductive elastic roller as the roller member may preferably have an Asker-C hardness ranging from 20 to 50, and more preferably from 25 to 50, and most preferably from 25 to 40. Here, the Asker-C hardness is the hardness measured with a spring type hardness meter Asker-C (manufactured by Kohbunshi Keiki K.K.), prescribed in JIS K-6301. In the present invention, it is measured under a load of 9.8 N and in the form of a roller.

In the present invention, the surface of the roller member as a contact charging member may preferably have minute cells or unevenness so that the conductive fine particles can stably be retained thereon.

It is also important for the conductive elastic roller member to have an elasticity to attain a sufficient state of contact with the latent-image-bearing member and at the same time to function as an electrode having a resistance low enough to charge the moving latent-image-bearing member. On the other hand, it is necessary to prevent voltage from leaking when any defective portions, such as pinholes, are present in the latent-image-bearing member. In the case when the latent-image-bearing member, such as an electrophotographic photosensitive member, is used as the charging object member, the conductive elastic roller member may have a resistivity of from $10^3$ to $10^8$ Ω·cm, and preferably from $10^4$ to $10^7$ Ω·cm, in order to achieve sufficient charging performance and anti-leak performance.

The volume resistivity of the conductive elastic roller member may be measured in the following way: A roller is kept in pressure contact with a cylindrical aluminum drum of 30 mm in diameter in such a way that a contact pressure of 49 N/m is applied to the roller, in the state of which a voltage of 100 V is applied across its mandrel and the aluminum drum to make a measurement.

The conductive elastic roller may be produced by, e.g., forming on its mandrel a medium-resistance layer of a rubber or foam as a flexible member. The medium-resistance layer may be comprised of a resin (e.g., urethane), conductive particles (e.g., carbon black), a curing agent, a blowing agent and so forth, and is formed on the mandrel to provide the form of a roller. Thereafter, the roller formed may optionally be cut, and its surface maybe ground to be shaped as desired, and thus the conductive elastic roller can be produced.

Materials for the conductive elastic roller are by no means limited to elastic foams. As elastic materials, they may include rubber materials such as ethylene-propylene-diene polyethylene (EPDM), urethane, butadiene acrylonitrile rubber (NBR), silicone rubber and isoprene rubber. In order to control resistivity, a conductive material, such as carbon black or a metal oxide, may also be dispersed. Those obtained by blowing these may also be used. Also, the resistivity may be controlled using an ion-conductive material, without dispersing the conductive material or using the former in combination with the conductive material.

The conductive elastic roller is provided in contact with the charging object member, i.e., the latent-image-bearing member, resisting the elasticity and at a stated pressing force. There are no particular limitations on the width at this charging contact zone. It may preferably be a width of 1 mm or more, and more preferably 2 mm or more, in order to attain stable and close contact between the conductive elastic roller and the latent-image-bearing member.

The charging member used in the charging step in the present invention may be one with which the latent-image-bearing member is charged by applying a voltage to a brush comprised of conductive fibers (brush member). Such a charging brush as a contact charging member may be comprised of fibers commonly used and a conductive material dispersed therein to perform resistance control. As the fibers, commonly known fibers may be used, including, e.g., nylon, acrylic, rayon, polycarbonate or polyester. As the conductive material, commonly known conductive materials may be used, including, e.g., metals such as nickel, iron, aluminum, gold and silver; metal oxides such as iron oxide, zinc oxide, tin oxide, antimony oxide and titanium oxide; and also conductive powders such as carbon black. These conductive powders may optionally previously be subjected to surface treatment for the purpose of performing hydrophobic or resistance control. When used, these conductive powders are selected taking account of dispersibility in fibers and productivity.

The charging brush serving as the contact charging member includes a fixed type and a rotatable roll type. Such a roll type charging brush includes, e.g., a roll brush obtained by winding in a spiral form a tape having conductive fibers made into pile fabric, around a mandrel made of a metal. The conductive fibers may have a fiber thickness of from 1 denier to 20 deniers (a fiber diameter of from about 10 μm to 500 μm), a brush fiber length of from 1 mm to 15 mm, and a brush density of from 10,000 to 300,000 threads per square inch (1.5×107 to 4.5×108 threads per square meter). Such a brush may preferably be used.

As the charging brush, a brush having a brush density as high as possible may preferably be used, and one fiber may also preferably be formed of few to hundreds of fine fibers. For example, as in 300 deniers/50 filaments, 50 fine fibers of 300 deniers may be bundled and may be set as one fiber. In the present invention, however, what determines the charging points of direct-injection charging depends chiefly on the density of interposition of conductive fine particles at the contact charging zone between the latent-image-bearing member and the contact charging member and its vicinity. Hence, the scope of selection for the contact charging member is widened.

The charging brush may preferably have, like the case of the conductive elastic roller, a resistivity of from $10^3$ Ω·cm to $10^8$ Ω·cm, and more preferably from $10^4$ Ω·cm to $10^7$ Ω·cm in order to achieve sufficient charging performance and anti-leak performance.

Materials for the charging brush may include conductive Rayon fibers REC-B, REC-C, REC-M1 and REC-M10, available from Unichika. Ltd.; and also SA-7, available from Toray Industries, Inc.; Thunderon, available from Nihon Sanmo K.K.; Belltron, available from Kanebo, Ltd.; Clacarbo, available from Claray Co., Ltd., a product obtained by dispersing carbon in Rayon; and Roabal, available from Mitsubishi Rayon Co., Ltd. In view of environmental stability, REC-B, REC-C, REC-M1 and REC-M10 may particularly preferably be used.

The contact charging member may also have flexibility. This is preferable in view of an advantage that opportunities of contact of the conductive fine particles with the latent-image-bearing member can be made larger at the contact zone between the contact charging member and the latent-image-bearing member to achieve a high contact performance and bring about an improvement in direct-injection charging performance. Namely, the contact charging member comes into close contact with the latent-image-bearing member via the conductive fine particles, and the conductive fine particles present at the contact zone between the contact charging member and the latent-image-bearing member rub the latent-image-bearing member surface closely. Thus, the charging of the latent-image-bearing member by the contact charging member is predominantly governed by safe and stable direct-injection charging performed via the conductive fine particles, not making use of any discharge phenomena. Accordingly, a high charging efficiency that has not been achievable by roller charging or the like performed by conventional discharge charging can be achieved by the employment of direct-injection charging performed via the conductive fine particles, and a potential substantially equal to the voltage applied to the contact charging member can be imparted to the latent-image-bearing member. In addition, inasmuch as the contact charging member has flexibility, the effect of damming up the transfer residual toner particles temporarily and the effect of leveling the pattern of transfer residual toner particles can be made higher when a large quantity of transfer residual toner particles are fed to the contact charging member. Thus, any faulty images can more surely be prevented from occurring because of the obstruction of latent-image formation and the faulty collection of transfer residual toner particles.

As to the amount of interposition of the conductive fine particles at the contact zone between the latent-image-bearing member and the contact charging members, too small an amount of interposition can not sufficiently provide the effect of lubrication attributable to the conductive fine particles, resulting in a large friction between the latent-image-bearing member and the contact charging member, and hence it may become difficult for the contact charging member to be rotatably driven with a difference in speed with respect to the latent-image-bearing member. Namely, any small amount of interposition of the conductive fine particles may make the drive torque excessive, so that the surface of the contact charging member or latent-image-bearing member tends to scrape if rotated forcibly. Moreover, the effect of increasing the opportunities of contact attributable to the conductive fine particles can not sufficiently be obtained in some cases, and no good charging performance on the latent-image-bearing member may be achievable. On the other hand, any too large amount of interposition of the conductive fine particles at the contact zone may make the conductive fine particles themselves come off from the contact charging member in a very large quantity. This may cause the obstruction of latent-image formation, such as shut-out of imagewise exposure light, to tend to adversely affect image formation.

According to studies made by the present invention, the amount of interposition of the conductive fine particles at the contact zone between the latent-image-bearing member and the contact charging member may preferably be 1,000 particles/$mm^2$ or more, and more preferably be 10,000 particles/$mm^2$ or more. Inasmuch as the amount of interposition of the conductive fine particles is 1,000 particles/$mm^2$ or more, the drive torque may by no means become excessive, and the effect of lubrication attributable to the conductive fine particles can sufficiently be obtained. If the amount of interposition is greatly smaller than 1,000 particles/$mm^2$, the desired effect of increasing the opportunities of contact can not sufficiently be obtained to tend to cause a lowering of the charging performance on the latent-image-bearing member.

In the case when the direct-injection charging system is used to perform the uniform charging of the latent-image-bearing member in the cleaning-at-development image-forming method, there is also a possibility of lowering of the charging performance on the latent-image-bearing member where the transfer residual toner particles adhere to or mingle with the contact charging member. In order to perform good direct-injection charging by keeping the transfer residual toner particles from adhering to or mingling with the contact charging member or by resisting any charging obstruction on the latent-image-bearing member which may be caused where the transfer residual toner particles adhere to or mingle with the contact charging member, the amount of interposition of the conductive fine particles at the contact zone between the latent-image-bearing member and the contact charging member may preferably be 10,000 particles/$mm^2$ or more. If the amount of interposition is greatly smaller than 10,000 particles/$mm^2$, the charging performance on the latent-image-bearing member tends to decrease when the transfer residual toner particles are in a large quantity.

The proper range of the amount of the conductive fine particles present on the latent-image-bearing member in the charging step depends also on what effect of uniform charging performance on the latent-image-bearing member is obtainable by a given density coating of the conductive fine particles on the latent-image-bearing member.

Figure 3:
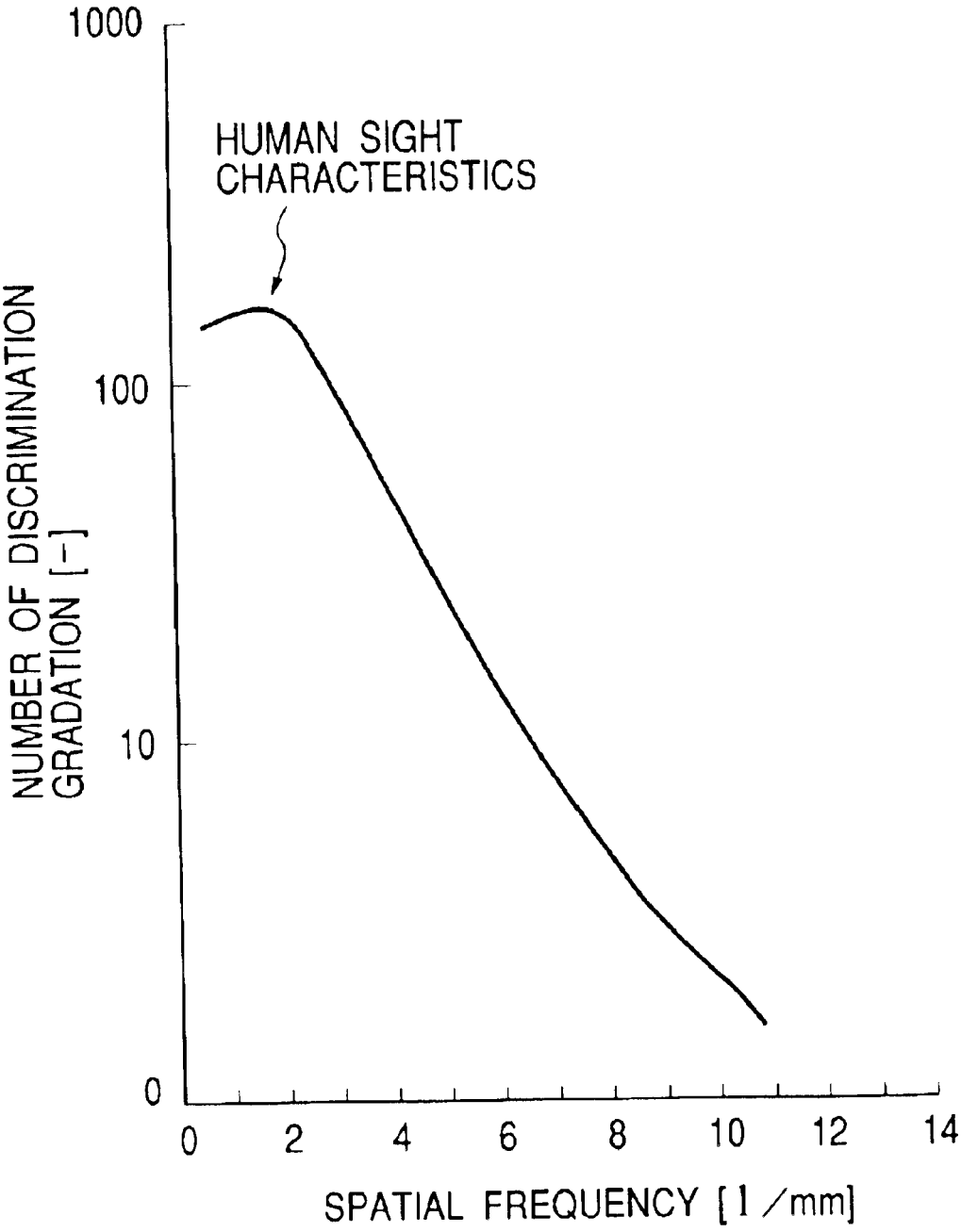
FIG. 3 is a graph showing the characteristics of human visual sensation (sight) according to spatial frequency.

Needless to say, contact charging which is more uniform than at least recording resolution is necessary at the time of the charging of the latent-image-bearing member. However, as shown in FIG. 3 as a graph showing the characteristics of human visual sensation (sight), the number of discrimination gradations of images approaches limitlessly to 1 at spatial frequencies of 10 cycles/mm or more, that is, any density unevenness becomes not discriminable. Utilizing such characteristics positively, it follows that, when the conductive fine particles are made to adhere onto the latent-image-bearing member, the conductive fine particles may be made present at least on the latent-image-bearing member in a density of 10 cycles/mm and in this state the direct-injection charging may be performed. Even if any microscopic faulty charging has occurred on the latent-image-bearing member at its part where the conductive fine particles are not present, it follows that the density unevenness of images which is caused by such faulty charging causes no image problem because it occurs in the spatial frequency region beyond the characteristics of human visual sensation.

As to whether or not the faulty charging appearing as density unevenness on images is recognizable when the density of coating of the conductive fine particles on the latent-image-bearing member changes, an effect can be seen in keeping any uneven charging from occurring, as long as even a small number of conductive fine particles is coated thereon (e.g., 10 particles/mm$^2$), but such an effect is still insufficient with respect to whether or not the density unevenness on images is tolerable for human beings. However, where 100 particles/mm$^2$ or more of conductive fine particles are coated, it comes to pass abruptly that favorable results are obtained in the objective evaluation of images. With a further increase in coating quantity to 1,000 particles/mm$^2$ or more, there is no image problem caused by faulty charging.

In the charging performed by the direct-injection charging system, as being fundamentally different from the discharge charging system, the charging is performed in the state the contact charging member is surely in contact with the charging object member. However, even if the conductive fine particles are coated on the latent-image-bearing member in excess, there exists necessarily any part not able to come into contact. This problem, however, can be solved in practical use by coating the conductive fine particles under positive utilization of the characteristics of human visual sensation according to the present invention.

The upper-limit value of the amount of the conductive fine particles present on the latent-image-bearing member is up to the amount in which the conductive fine particles are uniformly coated on the latent-image-bearing member in one layer. Even if coated more than that, it does not follow that the effect is improved. Conversely, any excess conductive fine particles may be sent out after the charging step to cause difficulties that the particles shut out or scatter exposure light.

The upper-limit value of coating density may differ depending on, e.g., the particle diameter of the conductive fine particles and the retention of the conductive fine particles on the contact charging member, and can not sweepingly be specified. What can be said is that the amount in which the conductive fine particles are uniformly coated on the latent-image-bearing member in one layer may be regarded as the upper limit.

If the amount of the conductive fine particles present on the latent-image-bearing member is more than 500,000 particles/mm$^2$, depending on the particle diameter and so forth of the conductive fine particles, the conductive fine particles tend to come off from the latent-image-bearing member in a very large quantity to contaminate the interior of the image-forming apparatus and also in some cases cause a shortage in the amount of exposure on the latent-image-bearing member without regard to the light transmitting properties of the conductive fine particles themselves. As long as this amount is not more than 500,000 particles/mm$^2$, the particles coming off can be controlled to be a small quantity, so that the in-machine contamination due to the scattering of the conductive fine particles can be made to occur less and also the exposure obstruction can better be prevented.

An experiment has also been made on the effect of improving the collection performance of transfer residual toner particles that is concerned with the amount of the conductive fine particles present on the latent-image-bearing member to find the following: Where the amount of the conductive fine particles present on the latent-image-bearing member after charging and before development is more than 100 particles/mm$^2$, the collection performance on transfer residual toner particles is clearly improved compared with an instance in which any conductive fine particles are not present on the latent-image-bearing member, and images formed by the cleaning-at-development step and free of any image defects are obtained up to a level where the conductive fine particles are uniformly coated on the latent-image-bearing member in one layer. Like the case of the amount of the conductive fine particles present on the latent-image-bearing member after transfer and before charging, there is seen a tendency that the coming off of the conductive fine particles from the latent-image-bearing member becomes remarkable gradually at the level where the amount of the conductive fine particles present is more than 500,000 particles/mm$^2$, to affect the latent-image formation to cause an increase in fog.

More specifically, the amount of interposition of the conductive fine particles at the contact zone between the latent-image-bearing member and the contact charging member may be set to be 1,000 particles/mm$^2$ or more and the amount of the conductive fine particles present on the latent-image-bearing member may be so set as to be 100 particles/mm$^2$ or more and not to be greatly more than 500,000 particles/mm$^2$. This is preferable to form images with in good charging performance on the latent-image-bearing member, with good collection performance on transfer residual toner particles and without any image defects due to in-machine contamination or exposure obstruction. The amount of interposition of the conductive fine particles at the contact zone between the latent-image-bearing member and the contact charging member may preferably be set to be 10,000 particles/mm$^2$ or more.

The relationship between the amount of interposition of the conductive fine particles at the contact zone between the latent-image-bearing member and the contact charging member and the amount of the conductive fine particles present on the latent-image-bearing member can not sweepingly be specified because there are factors such as (1) the feed (quantity) of the conductive fine particles to the contact zone between the latent-image-bearing member and the contact charging member, (2) the adhesion of the conductive fine particles to the latent-image-bearing member and the contact charging member, (3) the retention of the contact charging member for the conductive fine particles and (4) the retention of the latent-image-bearing member for the conductive fine particles and (4). Experimentally, it has been found that, in measuring the amount of particles having come off on the latent-image-bearing member (the amount of the conductive fine particles present on the latent-image-bearing member in the latent-image-forming step), it is 100 to 100,000 particles/mm$^2$ within the range that the amount of interposition of the conductive fine particles at the contact zone between the latent-image-bearing member and the contact charging member is 1,000 to 1,000,000 particles/$mm^2$.

A method of measuring the amount of interposition of the conductive fine particles at the contact zone and the amount of conductive fine particles present on the latent-image-bearing member is described below.

To know the amount of interposition of the conductive fine particles at the contact zone, it is preferable to directly measure the value at the contact zone between the contact charging member and the latent-image-bearing member. However, where the movement direction of the surface of the contact charging member which forms the contact zone is opposite to the movement direction of the surface of the latent-image-bearing member, most of the particles having been present on the latent-image-bearing member before its contact with the contact charging member are taken off by the contact charging member coming into contact while moving in the opposite direction. Accordingly, in the present invention, the quantity of particles on the contact charging member surface immediately before their reaching the contact zone is regarded as the amount of interposition.

Stated specifically, the rotation of the latent-image-bearing member and the conductive elastic roller (contact charging member) is stopped in the state any charging bias is not applied thereto, and the surfaces of the latent-image-bearing member and the conductive elastic roller are photographed using a videomicroscope (OVM100N, manufactured by Olympus) and a digital still recorder (SR-3100, manufactured by Deltis). As to the conductive elastic roller, the conductive elastic roller is brought into contact with a slide glass under the same conditions for bringing the conductive elastic roller into contact with the latent-image-bearing member, and the contact area is photographed on the back of the slide glass at 10 spots or more, using the videomicroscope and through an objective lens of 1,000 magnifications. In order to separate individual particles regionally from the digital image obtained, the data are binarized with a certain threshold value, and the number of regions where the particles are present is measured using a desired image-processing software. As to the amount of particles on the latent-image-bearing member, too, the surface of the latent-image-bearing member is photographed with the like video microscope, and the like processing is performed to make a measurement.

The amount of the conductive fine particles present on the latent-image-bearing member is measured by photographing the surface of the latent-image-bearing member after transfer and before charging, and after charging and before development, by the same means as the above, using an image-processing software.

In the present invention, the latent-image-bearing member may have an outermost surface layer having a volume resistivity of from $1\times10^{9}$ Ω·cm to $1\times10^{14}$ Ω·cm, and preferably from $1\times10^{10}$ Ω·cm to $1\times10^{14}$ Ω·cm. This is preferable because better charging performance can be provided on the latent-image-bearing member. In the charging system employing the direct-injection of electric charges, electric charges can be delivered and received with good efficiency where the resistivity on the side of the charging object member is controlled to be low. For such a purpose, the outermost surface layer may preferably have a volume resistivity of $1\times10^{14}$ Ω·cm or less. Meanwhile, in order to retain electrostatic latent images for a stated time as the role of the latent-image-bearing member, the outermost surface layer may preferably have a volume resistivity of $1\times10^{9}$ Ω·cm or more. In order to retain electrostatic latent images without causing any disorder of even minute latent images in high humidity, it may preferably have a volume resistivity of $1\times10^{10}$ Ω·cm or more.

The latent-image-bearing member may further be an electrophotographic photosensitive member and the outermost surface layer of the electrophotographic photosensitive member may have a volume resistivity of from $1\times10^{9}$ Ω·cm to $1\times10^{14}$ Ω·cm. This is more preferable because sufficient charging performance can be provided on the electrophotographic photosensitive member even in the apparatus with a high process speed.

The latent-image-bearing member may also preferably be a photosensitive drum or photosensitive belt having a photoconductive insulating material layer formed of a photoconductive insulating material such as amorphous selenium, CdS, $ZnO_2$ or amorphous silicon. A photosensitive member having an amorphous silicon photosensitive layer or an organic photosensitive layer may particularly preferably be used.

The organic photosensitive layer may be of a single-layer type in which the photosensitive layer contains a charge-generating material and a charge-transporting material in the same layer, or may be a function-separated photosensitive layer comprised of a charge transport layer and a charge generation layer. A multi-layer type photosensitive layer comprising a conductive substrate and superposingly formed thereon the charge generation layer and the charge transport layer in this order is one of preferred examples.

Adjustment of surface resistance of the latent-image-bearing member enables more stable performance of the uniform charging of the latent-image-bearing member.

In order to make charge injection more efficient or accelerate it by adjusting the surface resistance of the latent-image-bearing member, it is also preferable to provide a charge injection layer on the surface of the electrophotographic photosensitive member. The charge injection layer may preferably have a form in which conductive fine particles are dispersed in a resin.

The form of providing the charge injection layer may include, e.g., forms in which:

(i) the charge injection layer is provided on a selenium or amorphous-silicon inorganic photosensitive member or on a single-layer type organic photosensitive member;

(ii) one having a surface layer having a charge-transporting agent and a resin as a charge transport layer of a function-separated organic photosensitive member is made to serve also as the charge injection layer (for example, as the charge transport layer, a charge-transporting agent and conductive fine particles are dispersed in a resin, or the charge transport layer is made to function as the charge injection layer, by a charge-transporting agent itself or by the state of its presence); and (iii) the charge injection layer is provided as an outermost surface layer on a function-separated organic photosensitive member;

provided that it is important that the outermost surface layer has a volume resistivity within the preferable range.

The charge injection layer may be comprised of, e.g., an inorganic-material layer such as a metal-deposited film, or a conductive-power-dispersed resin layer with conductive fine particles dispersed in a binder resin. The deposited film may be formed by vacuum deposition, and the conductive-power-dispersed resin layer may be formed by coating by a suitable coating process such as dip coating, spray coating, roll coating and beam coating.

It may also be comprised of a mixture or copolymer of an insulating binder with a ion-conductive resin having high light transmission properties, or may be comprised of a resin single material having medium resistance and photoconductivity.

In particular, the outermost surface layer of the latent-image-bearing member is a resin layer in which conductive fine particles comprised of at least a metal oxide (hereinafter termed "oxide conductive fine particles") have been dispersed. More specifically, constituting the outermost surface layer of the latent-image-bearing member in this way is preferable because the electrophotographic photosensitive member can be made to have a low surface resistance so that electric charges can be delivered and received with better efficiency, and also because, as having a low surface resistance, any blurred or smeared latent images can be kept from being caused by the scattering of latent-image electric charges while the latent-image-bearing member retains electrostatic latent images.

In the case of the above resin layer in which the oxide conductive fine particles have been dispersed, the oxide conductive fine particles may preferably have a particle diameter smaller than the wavelength of incident light in order to prevent the incident light from being scattered by the dispersed particles. Accordingly, the oxide conductive fine particles to be dispersed may preferably have a particle diameter of 0.5 $\mu$m or less. The oxide conductive fine particles may preferably be in a content of from 2% by weight to 90% by weight, and more preferably from 5% by weight to 70% by weight, based on the total weight of the outermost layer. If the oxide conductive fine particles are in a content too small below the above range, the desired volume resistivity may be achieved with difficulty. If, on the other hand, they are in a content too large beyond the above range, a low film strength may result. Hence, the charge injection layer tends to be scraped off to tend to shorten the lifetime of the photosensitive member. Also, the resistance having lowered too much tends to cause faulty images due to the flowing of latent-image potential.

The charge injection layer may also preferably have a layer thickness of from 0.1 $\mu$m to 10 $\mu$m, and more preferably it may be 5 $\mu$m or less in order to ensure the sharpness of contours of latent images. In view of the durability of the charge injection layer, a layer thickness is preferably 1 $\mu$m or less.

The binder of the charge injection layer may be the same as a binder of an underlying layer. In such a case, however, there is a possibility that it disturbs the coating surface of the underlying layer (e.g., the charge transport layer), and hence it is necessary to select coating methods especially.

Here, the volume resistivity of the outermost surface layer of the latent-image-bearing member in the present invention is measured in the following way: A layer having the same composition as the outermost surface layer of the latent-image-bearing member is formed on a polyethylene terephthalate (PET) film on the surface of which gold has been deposited, and the volume resistivity of this layer is measured with a volume resistivity measuring instrument (4140BpAMATER, manufactured by Hewlett-Packard Corp.) in an environment of temperature 23° C. and humidity 65% under application of a voltage of 100 V.

In the present invention, the latent-image-bearing member surface may preferably be endowed with a releasability, and the latent-image-bearing member surface may preferably have a contact angle to water of 85 degrees or more. More preferably, the latent-image-bearing member surface may have a contact angle to water of 90 degrees or more.

The fact that the latent-image-bearing member surface has a large contact angle shows that the latent-image-bearing member surface has a high releasability. Because of this effect, the efficiency of collection of the developer is improved in the cleaning-at-development step. Also, the quantity of the transfer residual toner particles can be lessened very much, and hence the charging performance on the latent-image-bearing member can be kept from being lowered by the transfer residual toner particles.

As a means for endowing the latent-image-bearing member surface with the releasability, it may include the following:

(i) a resin with a low surface energy is used in the resin itself that constitutes the outermost layer;

(ii) an additive capable of imparting water repellency or lipophilic properties is added to the outermost surface layer; and (iii) a material having a high releasability is dispersed in the outermost layer in the form of powder.

As the case (i), the object can be achieved by introducing a fluorine-containing group or a silicon-containing group into the structure of the resin. As the case (ii), a surface active agent may be added as an additive. As the case (iii), a compound containing fluorine atoms, such as polyethylene tetrafluoride, polyvinylidene fluorideandcarbon fluoride, a silicone resin or a polyolefin resin may be used.

These means can make the latent-image-bearing member surface have the contact angle to water of 85 degrees or more.

Of these, the outermost surface layer of the latent-image-bearing member may preferably be a layer in which lubricant fine particles comprised of at least one material selected from fluorine resins, silicone resins and polyolefin resins have been dispersed. In particular, it is preferable to use a fluorine-containing resin such as polyethylene tetrafluoride or polyvinylidene fluoride. In the present invention, in the case when the fluorine-containing resin is used as the powder of the item (3), it can favorably be dispersed in the outermost surface layer.

In order to incorporate such powder in the surface layer, a layer comprising a binder resin with the powder dispersed therein may be provided at the outermost surface layer of the latent-image-bearing member. Alternatively, in the case of an organic photosensitive member originally chiefly comprised of a resin, the powder may merely be dispersed in the outermost surface layer without anew providing any surface layer.

The above powder having releasability may be added to the surface layer of the latent-image-bearing member in an amount of from 1% by weight to 60% by weight, and more preferably from 2% by weight to 50% by weight, based on the total weight of the surface layer. If it is added in an amount too small below the above range, the number of transfer residual toner particles can not sufficiently be decreased, and the efficiency of collection of the developer in the cleaning-at-development system can not be sufficient. Its addition in an amount too large beyond the above range is not preferable because the film may have a low strength and the amount of light incident on the latent-image-bearing member may be very small to damage the charging performance on the latent-image-bearing member. As to the particle diameter of the powder, it may preferably be 1 $\mu$m or less, and more preferably 0.5 $\mu$m or less, in view of image quality. If its particle diameter is too large beyond the above range, line images tend to have a poor sharpness because of the scattering of incident light to tend to damage resolution.

In the present invention, to measure the contact angle, pure water is used and as an instrument a contact angle meter Model CA-DS, manufactured by Kyowa Kaimen Kagaku K.K., is used.

One of preferred embodiments of a photosensitive member as the latent-image-bearing member used in the present invention is described below.

It basically comprises a conductive substrate, and a photosensitive layer functionally separated into a charge generation layer and a charge transport layer.

As the conductive substrate, a cylindrical member or a film is used, which comprises a metal such as aluminum or stainless steel, a plastic having a coat layer formed of an aluminum alloy or an indium oxide-tin oxide alloy, a paper or plastic impregnated with conductive particles, or a plastic having a conductive polymer.

On the conductive substrate, a subbing layer may be provided for the purpose of improving adhesion of the photosensitive layer, improving coating properties, protecting the substrate, covering defects on the substrate, improving the performance of charge injection from the substrate or protecting the photosensitive layer from electrical breakdown.

The subbing layer may be formed of a material such as polyvinyl alcohol, poly-N-vinylimidazole, polyethylene oxide, ethyl cellulose, methyl cellulose, nitrocellulose, an ethylene-acrylic acid copolymer, polyvinyl butyral, phenol resin, casein, polyamide, copolymer nylon, glue, gelatin, polyurethane or aluminum oxide. The subbing layer may usually be in a thickness of from 0.1 $\mu$m to 10 $\mu$m, and preferably from 0.1 $\mu$m to 3 $\mu$m.

The charge generation layer is formed by coating a dispersion prepared by dispersing a charge-generating material in a suitable binder, or by vacuum deposition of the charge-generating material. The charge-generating material includes azo pigments, phthalocyanine pigments, indigo pigments, perylene pigments, polycyclic quinone pigments, squarilium dyes, pyrylium salts, thiopyrylium salts, triphenylmethane dyes, and inorganic substances such as selenium and amorphous silicon. In particular, phthalocyanine pigments are preferred in order to control the sensitivity of the photosensitive member to the sensitivity suited for the present invention. The binder may include, e.g., resins such as polycarbonate resin, polyesterresin, polyvinylbutyral resin, polystyrene resin, acrylic resin, methacrylic resin, phenol resin, silicone resin, epoxy resin and vinyl acetate resin. The binder contained in the charge generation layer may be in an amount not more than 80% by weight, and preferably from 0% by weight to 40% by weight. The charge generation layer may preferably have a thickness of 5 $\mu$m or less, and particularly from 0.05 $\mu$m to 2 $\mu$m.

The charge transport layer has the function to receive charge carriers from the charge generation layer and transport them. The charge transport layer is formed by coating a solution prepared by dissolving a charge-transporting material in a solvent optionally together with a binder resin, and may usually have a layer thickness of from 5 $\mu$m to 40 $\mu$m. The charge-transporting material may include polycyclic aromatic compounds having in the main chain or side chain a structure such as biphenylene, anthracene, pyrene or phenanthrene; nitrogen-containing cyclic compounds such as indole, carbazole, oxadiazole and pyrazoline; hydrazone compounds; styryl compounds; and selenium, selenium-tellurium, amorphous silicone, and cadmium sulfide.

The binder resin in which the charge-transporting material is to be dispersed may include resins such as polycarbonate resin, polyester resin, polymethacrylate, polystyrene resin, acrylic resin and polyamide resin; and organic photoconductive polymers such as poly-N-vinyl carbazole and polyvinyl anthracene.

As a surface layer, a layer may be provided in which conductive fine particles have been disperse in a resin in order to make charge injection more efficient or accelerate it. As resins for the surface layer, resins such as polyester, polycarbonate, acrylic resin, epoxy resin and phenol resin, as well as a curing agent for these resins, may be used alone or in combination of two or more types. As examples of the conductive fine particles, they include particles of metals or metal oxides. Preferably, they may include ultrafine particles of zinc oxide, titaniumoxide, tin oxide, antimony oxide, indium oxide, bismuth oxide, tin oxide-coated titanium oxide, tin-coated indium oxide, antimony-coated tin oxide or zirconium oxide. These may be used alone or may be used in the form of a mixture of two or more types.

Figure 5:
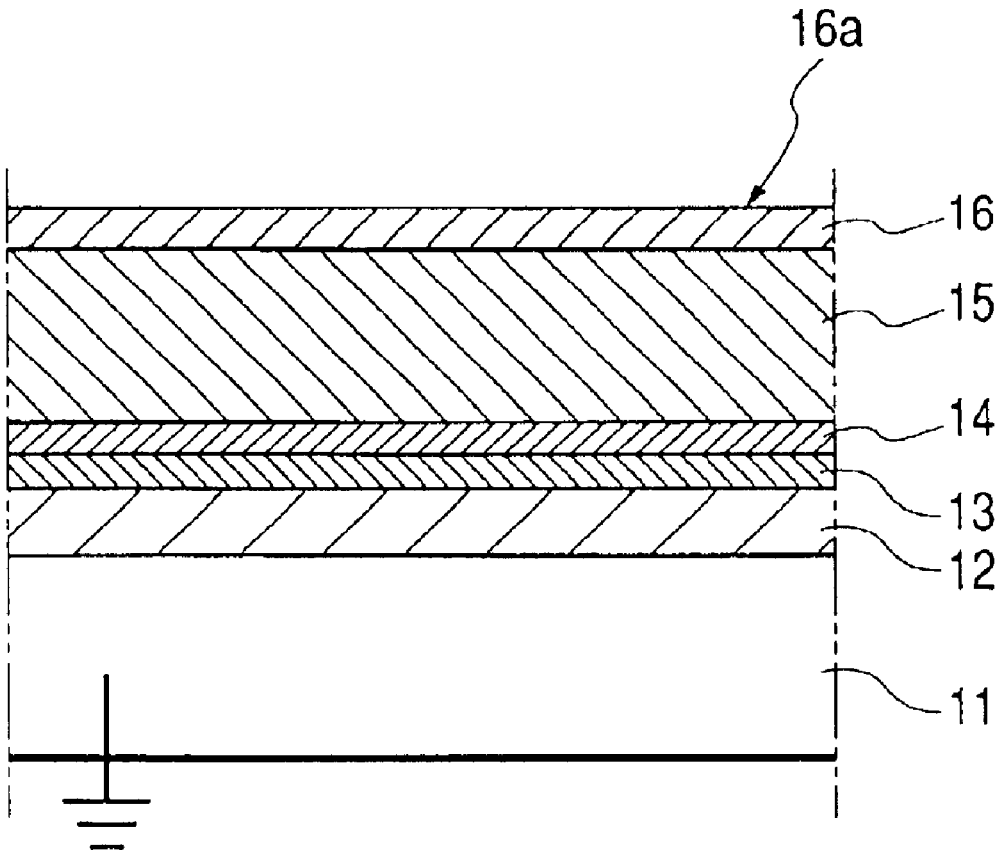
FIG. 5 is a diagrammatic view showing the layer construction of a photosensitive member used as an image-bearing member in the present invention.

FIG. 5 is a diagrammatic view showing the layer construction of a latent-image-bearing member (photosensitive member) provided with a charge injection layer as a surface layer. More specifically, the photosensitive member is a common organic photosensitive drum comprising a conductive substrate (aluminum drum substrate) 11 and, provided superposingly thereonby coating, a conductive layer 12, a positive-charge injection preventive layer 13, a charge generation layer 14 and a charge transport layer 15 in this order, on which a charge injection layer 16 is further formed by coating to improve the charging performance attributable to the injection of electric charges.

What is important as the charge injection layer 16 formed at the outermost surface layer of the latent-image-bearing member is that the surface layer has a volume resistivity of from $1\times10^{9}$ Ω·cm to $1\times10^{14}$ Ω·cm. Even where the charge injection layer 16 as constructed in this way is not provided, the same effect is obtainable when, e.g., the charge transport layer 15, which may serve as the outermost surface layer, has a volume resistivity within the above range. For example, good charging performance attributable to the injection of electric charges is likewise obtainable also when an amorphous-silicon photosensitive member whose surface layer has a volume resistivity of about $1\times10^{13}$ Ω·cm is used.

In the present invention, the latent-image-forming step of forming an electrostatic latent image on the charged surface of the latent-image-bearing member and the latent-image-forming means may preferably be the step of writing image information as an electrostatic latent image on the latent-image-bearing member surface by imagewise exposure and an imagewise exposure means, respectively. As the imagewise exposure means, it is by no means limited to laser scanning exposure means by which digital latent images are formed, and may also be another light-emitting device, such as a usual analog imagewise exposure means or LED. It may still also be a means having in combination a light-emitting device, such as a fluorescent lamp, and a liquid-crystal shutter or the like. Any of these will do as long as electrostatic latent images corresponding to the image information can be formed.

The latent-image-bearing member maybe an electrostatic recording dielectric member. In this case, a dielectric surface as the latent-image-bearing member surface is uniformly primarily charged to the stated polarity and potential and thereafter destaticized selectively by a distaticizing means, such as a destaticization stylus head or an electron gun, to write and form the intended electrostatic latent image.

As described previously, in the developer in the present invention, the toner particles may preferably have a circularity (average circularity) of less than 0.970. However, toner particles having a low circularity may provide an insufficient charge quantity to tend to cause a lowering of transfer efficiency. Moreover, even if the particle diameter of the conductive fine particles added to the toner particles has well been controlled, the lowering of triboelectric charge characteristics of the toner particles can not still completely be prevented in many cases. Accordingly, in the case when the toner particles having such an average circularity of less than 0.970 and also having the conductive fine particles added thereto, it is necessary to improve the charge-providing performance attributable to the developer-carrying member.

Accordingly, in the present invention, a member having a substrate and a resin coat layer formed on the substrate, which resin coat layer has been incorporated with a positively chargeable material, is used as the developer-carrying member. In order to prevent the developer from being excessively charged and make it have a proper charge quantity, the resin coat layer may preferably be further incorporated therein with at least conductive fine particles as a conductive material to make the resin coat layer into a conductive resin coat layer.

As a coat layer binder resin (i.e., binder resin used for the resin coat layer), any of commonly known resins may be used. For example, usable are thermoplastic resins such as styrene resins, vinyl resins, styrene-diene resins, polyether sulfone resins, polycarbonate resins, polyphenylene oxide resins, polyamide resins, fluorine resins, cellulose resins and acrylic resins; and thermosetting or photosetting resins such as epoxy resins, polyester resins, alkyd resins, phenolic resins, melamine resins, polyurethane resins, urea resins, silicone resins and polyimide resins. In particular, those having a superior releasability, such as silicone resins and fluorine resins, or those having a superior mechanical strength, such as polyether sulfone resins, polycarbonate resins, polyphenylene oxide resins, polyamide resins, phenolic resins, polyester resins, polyurethane resins, styrene resins and acrylic resins may more preferably be use.

A positively chargeable material may preferably be added to these resins.

The positively chargeable material may be any of those capable of being charged to the positive polarity when mixed alone with iron powder and triboelectrically charged. Also, as long as it shows positive charge in the coat layer binder resin in which it is dispersed, and where it is used in combination with such a resin, it may not necessarily be limited to those positively chargeable when mixed alone with iron powder and triboelectrically charged.

Such a positively chargeable material may include those commonly used as positive charge control agents such as Nigrosine dyes, triphenylmethane dyes, quaternary ammonium salts, guanidine derivatives, imidazole derivatives, amine compounds and polyamine compounds; inorganic powders such as synthetic silica, quartz powder, alumina powder and hydrotalcite compounds; and copolymers having as a constituent monomer an acrylamide containing a sulfonic acid group. A method is also available in which these inorganic powders are used after they have been treated with an aminosilane coupling agent.

In particular, compounds shown below may preferably be used in order to charge the developer favorably.

(1) As the positively chargeable material, the resin may preferably be incorporated with a nitrogen-containing heterocyclic compound.

As the nitrogen-containing heterocyclic compound used here, those having a number-average particle diameter of 20 μm or less, and preferably from 0.1 μm to 15 μm may be used. A nitrogen-containing heterocyclic compound having a number average particle diameter larger than 20 μm is not preferable because the nitrogen-containing heterocyclic compound may poorly be dispersed in the conductive resin coat layer, constituting a developing sleeve serving as the developer-carrying member, to make it difficult to effectively improve the charging performance.

The nitrogen-containing heterocyclic compound usable in the present invention may include compounds such as imidazole, imidazoline, imidazolone, pyrazoline, pyrazole, pyrazolone, oxazoline, oxazole, oxazolone, thiazoline, thiazole, thiazolone, selenazoline, selenazole, selenazolone, oxadiazole, thiadiazole, tetrazole, benzoimidazole, benzotriazole, benzoxazole, benzothiazole, benzoselenazole, pyrazine, pyrimidine, pyridazine, triazine, oxazine, thiazine, tetrazine, polyazaine, pyridazine, pyrimidine, pyrazine, indole, isoindole, indazole, carbazole, quinoline, pyridine, isoquinoline, cinnoline, quinazoline, quinoxaline, phthalazine, purine, pyrrole, triazole and phenazine. In the present invention, imidazole compounds are particularly preferred in order to promote the effect attributable to the mutual action of the developer-carrying member and developer used in the present invention.

In the present invention, among the imidazole compounds, an imidazole compound represented by the following Formula (1) or (2) may be used in the conductive resin coat layer of the developer-carrying member. This is more preferable because the developer can be endowed with the ability to be quickly and uniformly charged and also the strength of the conductive resin coat layer can be improved.

Formula (1)

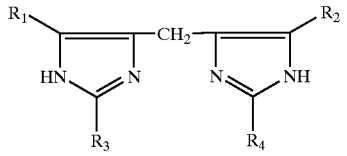

(1)

wherein $R_1$ and $R_2$ each represent a hydrogen atom or a substituent selected from the group consisting of an alkyl group, an aralkyl group and an aryl group, and $R_1$ and $R_2$ may be the same or different; and $R_3$ and $R_4$ each represent a straight-chain alkyl group having 3 to 30 carbon atoms, and $R_3$ and $R_4$ may be the same or different.

Formula (2)

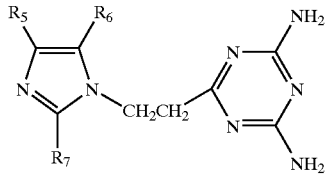

(2)

wherein $R_5$ and $R_6$ each represent a hydrogen atom or a substituent selected from the group consisting of an alkyl group, an aralkyl group and an aryl group, and $R_5$ and $R_6$ may be the same or different; and $R_7$ represents a straight-chain alkyl group having 3 to 30 carbon atoms.

The reason why it is preferable to use the imidazole compound having the above structure is considered as follows: The imidazole compound having the structure represented by Formula (1) or (2) has as a substituent the straight-chain alkyl group having 3 to 30 carbon atoms, and hence it has a good dispersibility in the coat layer binder resin. Thus, it can be well dispersed together with the constituent materials of the conductive resin coat layer of the developing sleeve, and a conductive resin coat layer surface having an especially good state of their dispersion can be formed, so that the developing sleeve can provide the developer with better triboelectric charge characteristics.

In the nitrogen-containing heterocyclic compound having the structure represented by the above Formula (1) or (2), which is preferably usable in the present invention, the nitrogen-containing heterocyclic group that constitutes this compound may be a single ring, or a ring condensed with a different group, or may have a substituent. In addition, in the case when the nitrogen-containing heterocyclic group has a substituent, such a substituent may include, e.g., an alkyl group, an aralkyl group, an alkenyl group, an alkynyl group, an alkoxyl group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, a phosphoric acid amide group, a diacylamino group and an imide group. These substituents may each have a further substituent. As examples of such a further substituent, the substituents enumerated here as the substituents of the nitrogen-containing heterocyclic compound.

The content of the nitrogen-containing heterocyclic compound and conductive fine particles in the conductive resin coat layer is described below. This, however, is a particularly preferred range in the present invention, and the present invention is by no means limited thereto.

First, the nitrogen-containing heterocyclic compound dispersed in the conductive resin coat layer may preferably be in a content of from 0.5 part by weight to 60 parts by weight, and more preferably from 1 part by weight to 50 parts by weight, based on 100 parts by weight of the coat layer binder resin, where especially favorable results are obtainable. More specifically, if the nitrogen-containing heterocyclic compound is in a content of less than 0.5 part by weight, the addition of the nitrogen-containing heterocyclic compound may be less effective. If it is in a content of more than 60 parts by weight, it is difficult to low control the volume resistivity of the conductive resin coat layer, tending to cause a phenomenon of charge-up.

The conductive fine particles dispersedly incorporated in the conductive resin coat layer in combination with the nitrogen-containing heterocyclic compound may preferably be in a content of 40 parts by weight or less, and more preferably within the range of from 2 parts by weight to 35 parts by weight, based on 100 parts by weight of the coat layer binder resin, where especially favorable results are obtainable. More specifically, if the conductive fine particles are in a content of more than 40 parts by weight, the conductive resin coat layer may have a low coating film strength and a decrease in charge quantity of the developer may be seen, undesirably.

(2) In the developer-carrying member in the present invention, it is also preferable for the coat layer to contain a nitrogen-containing compound as the positively chargeable material. Such a compound may include copolymers containing a unit derived from a nitrogen-containing vinyl monomer. As polymers that form such copolymers, polymerizable vinyl monomers are preferred. The binder resin the resin coat layer contains has a copolymer of a polymerizable vinyl monomer having a high mechanical strength and a nitrogen-containing vinyl monomer having a high negative triboelectric charge characteristics to the developer, and hence the developer-carrying member has a resin coat layer having high wear resistance and high resistance to adhesion or melt adhesion of toner, and can have good triboelectric charging performance even after many-sheet running.

Since also this copolymer has the nitrogen-containing vinyl monomer, the dispersion of conductive fine particles, such as carbon black or graphite in the resin coat layer is improved. Hence, the resin coat layer can have a favorably low electrical resistance, and also the uniformity of the triboelectric charging performance on the resin coat layer surface is improved, so that the triboelectric charging performance to the developer can be higher and also the charge quantity distribution of the developer can be sharp and still also, the coating film strength of the resin coat layer itself is improved. Hence, this arrangement promises superior many-sheet running performance.

The reason why the dispersion of conductive fine particles, such as carbon black or graphite, in the resin coat layer is improved is not clearly known. It is presumed that the incorporation of polar groups coming from nitrogen atoms contained in the nitrogen-containing vinyl monomer improves the dispersibility of the resin in a solvent, in particular, a solvent having polarity, and hence the wettability to conductive fine particles in a solution in which the resin stands dissolved is improved, so that, when a fluid dispersion with the conductive fine particles standing dispersed in the solution is coated to form the resin coat layer, the dispersion of the conductive fine particles in the resin coat layer formed is improved. Especially when the conductive fine particles are a material having polar groups on their surfaces, such as carbon black, the affinity is further improved on account of the polar groups coming from nitrogen atoms, and thus this is more effective.

In the present invention, the copolymerization molar ratio of the copolymer having the polymerizable vinyl monomer (M) and the nitrogen-containing vinyl monomer (N) may preferably satisfy M:N=4:1 to 999:1. If the proportion of M is more than 999:1, the addition of the nitrogen-containing vinyl monomer may be little effective, i.e., the effect of improving the triboelectric charging performance is very low, so that the effect expected by copolymerization of these may come to be little seen. If the proportion of M is less than 4:1, the resin coat layer can not be stable because of, e.g., a lowering of Tg, and there is a possibility that the charge-providing properties and wear resistance of the resin coat layer may be damaged as a result of a temperature rise of the main body of an electrophotographic apparatus, or that the developer tends to stick. Also, even if the proportion of the nitrogen-containing vinyl monomer is made higher than the above, the charge-providing effect is saturated, and hence it is not particularly necessary to do so.

In the present invention, the polymerizable vinyl monomer, which can be the chief component of the above copolymer, may include, e.g., styrene, α-methylstyrene; monocarboxylic acids having a double bond, or ester compounds thereof, such as acrylic acid, methyl acrylate, ethyl acrylate, propyl acrylate, n-butyl acrylate, iso-butyl acrylate, dodecyl acrylate, octyl acrylate, 2-ethylhexyl acrylate, phenyl acrylate, cyclohexyl acrylate, hydroxyethyl acrylate, dimethyl(amino)ethyl acrylate, diethyl(amino)ethyl acrylate, methacrylic acid, methyl methacrylate, ethyl methacrylate, propyl methacrylate, n-butyl methacrylate, iso-butyl methacrylate, octyl methacrylate, cyclohexyl methacrylate, hydroxyethyl methacrylate, dimethyl(amino) ethyl methacrylate, diethyl(amino)ethyl methacrylate, acrylonitrile and methacrylonitrile and acryl amide; and dicarboxylic acids having a double bond, and ester compounds thereof, as exemplified by maleic acid, butyl maleate, methyl maleate and dimethyl maleate. Any of these may be used alone or in the form of a mixture of two or more types.

In particular, incorporation of an acid monomer or acid ester monomer having a vinyl group is effective for the charging stability of the developer on the developer-carrying member. In such a case, for the effect of stabilizing triboelectric charge quantity, it is a little better to use the acid monomer than the acid ester monomer.

In the present invention, it is preferable to use methyl methacrylate as the polymerizable vinyl monomer. The methyl methacrylate, when used as a polymer, has superior mechanical strength. Also, when incorporated in the binder resin of the sleeve surface layer, a good triboelectric charging performance to the developer can be obtained. However, when used as a homopolymer, it may often have an insufficient triboelectric charging performance, and the dispersion of pigments, such as carbon black and graphite, is also not so good. Its use as the copolymer containing the nitrogen-containing vinyl monomer as in the present invention enables improvement of the triboelectric charging performance. Also, in the present invention, the methyl methacrylate component is preferably contained in a percentage of 80% or more, and hence, even when compared with the homopolymer of methyl methacrylate, the mechanical strength, e.g., wear resistance is by no means damaged. The nitrogen-containing vinyl monomer component is further contained, and hence, when the pigment component, such as conductive fine particles, is dispersed in the resin coat layer, its dispersion is improved. In this regard, too, this is preferable for wear resistance and so forth.

The copolymer containing a unit derived from the nitrogen-containing vinyl monomer may preferably have a molecular weight within the range of from 3,000 to 50,000 as weight-average molecular weight Mw. If it has a molecular weight Mw of less than 3,000, the low-molecular-weight component is in so excessively large a quantity that the developer tends to adhere or stick to the sleeve, or the resin coat layer may have a low charging performance. If, on the other hand, it has a molecular weight Mw of more than 50,000, it has so high a molecular weight and so high a resin viscosity in the solvent that it may cause faulty coating or, when pigments are added, faulty dispersion, so that the resin coat layer may have non-uniform composition to cause unstable charging of the developer and also the resin coat layer may have no stable surface roughness to cause a decrease in wear resistance.

The copolymer containing a unit derived from the nitrogen-containing vinyl monomer may preferably have Mw/Mn, which expresses the ratio of its weight-average molecular weight to its number-average molecular weight, of not more than 3.5. If the ratio Mw/Mn is more than 3.5, the low-molecular-weight component increases to cause adhesion or melt-adhesion of the developer frequently or to cause a lowering of triboelectric charging performance to the developer.

In the present invention, the molecular weight distribution on a GPC (gel permeation chromatography) chromatogram of the copolymer containing a unit derived from the nitrogen-containing vinyl monomer is measured in the following way: Columns are stabilized in a heat chamber of 40° C. To the columns kept at this temperature, THF (tetrahydrofuran) as a solvent is flowed at a flow rate of 1 ml per minute, and about 100 $\mu$l of THF sample solution is injected thereinto to make measurement. In measuring the molecular weight of the sample, the molecular weight distribution ascribed to the sample is calculated from the relationship between the logarithmic value and the count number of a calibration curve prepared using several kinds of monodisperse polystyrene standard samples. As the standard polystyrene samples used for the preparation of the calibration curve, it is suitable to use samples with molecular weights of from 100 to 10,000,000, which are available from Toso Co., Ltd. or Showa Denko K.K., and to use at least about 10 standard polystyrene samples. An RI (refractive index) detector is used as a detector. Columns should be used in combination of a plurality of commercially available polystyrene gel columns. For example, they may preferably comprise a combination of Shodex GPC KF-801, KF-802, KF-803, KF-804, KF-805, KF-806, KF-807 and KF-800P, available from Showa Denko K.K.; or a combination of TSKgel G1000H($H_{XL}$), G2000H($H_{XL}$), G3000H($H_{XL}$), G4000H($H_{XL}$), G5000H($H_{XL}$), G6000H($H_{XL}$), G7000H ($H_{XL}$) and TSK guard column, available from Toso Co., Ltd.

As typical examples of the nitrogen-containing vinyl monomer, it may include, e.g., p-dimethylaminostyrene, dimethylaminomethyl acrylate, dimethylaminoethyl acrylate, dimethylaminopropyl acrylate, diethylaminomethyl acrylate, diethylaminoethyl acrylate, dimethylaminomethyl methacrylate, diethylaminoethyl methacrylate, dimethylaminopropyl methacrylate, diethylaminomethyl methacrylate and diethylaminoethyl methacrylate. It may further include nitrogen-containing, heterocyclic N-vinyl compounds such as N-vinylimidazole, N-vinylbenzimidazole, N-vinylcarbazole, N-vinylpyrrole, N-vinylpiperidine, N-vinylmorpholine and N-vinylindole.

In particular, it is preferable to use nitrogen-containing vinyl monomers represented by the following Formula (3), such as dimethylaminomethyl acrylate, dimethylaminoethyl acrylate, dimethylaminopropyl acrylate, diethylaminomethyl acrylate, diethylaminoethyl acrylate, dimethylaminomethyl methacrylate, diethylaminomethyl methacrylate, dimethylaminopropyl methacrylate, diethylaminomethyl methacrylate and diethylaminoethyl methacrylate; or quaternary-ammonium-group-containing vinyl monomers.

(3)

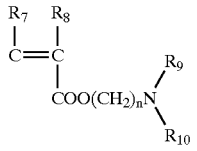

wherein $R_7$, $R_8$, $R_9$ and $R_{10}$ each represents a hydrogen atom or a saturated hydrocarbon group having 1 to 4 carbon atoms; and n represents an integer of 1 to 4.

In particular, it is preferable to use nitrogen-containing vinyl monomers represented by the following Formula (4), such as dimethylaminoethyl methacrylate, diethylaminoethyl methacrylate.

(4)

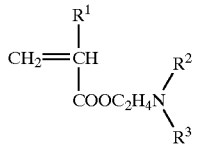

wherein $R^1$, $R^2$ and $R^3$ each represents a hydrogen atom or a saturated hydrocarbon group having 1 to 4 carbon atoms.

As the nitrogen-containing vinyl monomers usable in the present invention, quaternary-ammonium-group-containing vinyl monomers can be used. As the quaternary-ammonium-group-containing vinyl monomer, it may include quaternary ammonium group-containing vinylmonomers represented by the following Formula (8).

(8)

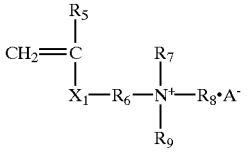

wherein $R_5$ represents a hydrogen atom or a methyl group; $R_6$ represents an alkylene group having 1 to 4 carbon atoms; $R_7$, $R_8$ and $R_9$ each represent a methyl group, an ethyl group or a propyl group; $X_1$ represents —COO or —CONH; and A represents an anion such as $Cl^-$ or $(½)SO_4^{2-}$.

In the present invention, the copolymer containing the nitrogen-containing vinyl monomer may be used as the coat layer binder resin for itself, or may be added to other binder resin. In the case when it is added to another binder resin, commonly known binder resins as described previously may be used. Taking account of the mechanical strength required in the developer-carrying member, thermosetting resins are more preferred. However, thermoplastic resins may also be used as long as they are those having a sufficient mechanical strength.

Such resins may also be used with its blend to thermosetting resins having much higher strength than these when viewed as charge control agents. In such a case, too, the positive charging performance of the sleeve as the developer-carrying member can be good on account of the effect attributable to the nitrogen-containing vinyl monomer.

(3) In the developer-carrying member in the present invention, it is also preferable that, as the positively chargeable material, the resin coat layer at the surface of the developer-carrying member is incorporated therein with at least a copolymer of a polymerizable vinyl monomer with a sulfonic-acid-containing acrylamide monomer, and at the same time a resin containing in its molecular structure at least one of an —$NH_2$ group, an =NH group and an —NH— linkage is used as the coat layer binder resin.

In the present invention, the reason why the resin coat layer shows positive-charge-providing properties is unclear. It is presumed that, where the copolymer of a polymerizable vinyl monomer with a sulfonic-acid-containing acrylamide monomer is dispersed in the coat layer binder resin having in its molecular structure at least one of an —$NH_2$ group, an =NH group and an —NH— linkage, the former stands dispersed uniformly in the latter and, by virtue of structural mutual action of the above copolymer and binder resin, the whole resin composition comes to have uniform and sufficient positive-charge-providing properties.

The above copolymer in the present invention may preferably be a copolymer whose copolymerization ratio of the polymerizable vinyl monomer to the sulfonic-acid-containing acrylamide monomer is 98:2 to 80:2 in weight ratio, and weight-average molecular weight is 2,000 to 50,000. If the sulfonic-acid-containing acrylamide monomer is in a proportion smaller than 2% by weight, the copolymer may have a poor ability to induce positive electric charges to the developer. If it is more than 20% by weight, a lowering of environmental stability, such as moisture resistance, may occur or a lowering of coating film characteristics may occur undesirably. Also, if the copolymer has a weight-average molecular weight of less than 2,000, the low-molecular-weight component is in so excessively large a quantity that the developer tends to adhere or stick to the sleeve, or the resin coat layer may have a low charge-providing performance. If, on the other hand, it has a weight-average molecular weight of more than 50,000, the copolymer may have a poor compatibility with the resin, and any stable charging performance may come not to be achievable because of environmental variations or with time. Also, it may have so high a resin viscosity in the solvent that it may cause faulty coating or, when pigments are added, faulty dispersion, so that the resin coat layer may have a non-uniform composition to cause unstable charging of the developer and also the resin coat layer may have no stable surface roughness to cause a decrease in wear resistance.

The above sulfonic-acid-group-containing acrylamide monomer used in the present invention may preferably be added in an amount of from 1 part by weight to 100 parts by weight based on 100 parts by weight of the binder resin. In an amount of less than 1 part by weight, any improvement in charge-providing properties attributable to its addition may not be seen. In an amount of more than 100 parts by weight, poor dispersion in the binder resin may result to tend to result in a low coating film strength.

The polymerizable vinyl monomer usable in the production of the above copolymer in the present invention may include styrene, α-methylstyrene, methyl acrylate or methacrylate, ethyl acrylate or methacrylate, propyl acrylate or methacrylate, n-butyl acrylate or methacrylate, iso-butyl acrylate or methacrylate, cyclohexyl acrylate or methacrylate, dimethyl(amino)ethyl acrylate or methacrylate, diethyl (amino) ethyl acrylate or methacrylate, hydroxyethyl acrylate or methacrylate, acrylic or methacrylic acid, vinyl acetate and vinyl propionate. Any of these may be used alone or in combination of two or more types. It may preferably include the combination of styrene with acrylate or methacrylate. Also, binder resins for toners or developers commonly have a glass transition temperature of 70° C. or below or 60° C. or below in many cases. Accordingly, when the above polymerizable vinyl monomer is used, in order to avoid adhesion of the developer to the resin coat layer surface, the coat layer binder resin may preferably be made up under appropriate selection so made that a resin coat layer having a glass transition temperature of 65° C. or above, preferably 70° C. or above, and more preferably 90° C. or above, can be formed.

The sulfonic-acid-group-containing acrylamide monomer may include 2-acrylamidopropanesulfonic acid, 2-acrylamido-n-butanesulfonic acid, 2-acrylamido-n-hexanesulfonic acid, 2-acrylamido-n-octanesulfonic acid, 2-acrylamido-n-dodecanesulfonic acid, 2-acrylamido-n-tetradecanesulfonic acid, 2-acrylamido-2-methylpropanesulfonic acid, 2-acrylamido-2-phenylpropanesulfonic acid, 2-acrylamido-2,2,4-trimethylpentanesulfonic acid, 2-acrylamido-2-methylphenylethanesulfonic acid, 2-acrylamido-2-(4-chlorophenyl)propanesulfonic acid, 2-acrylamido-2-carboxymethylpropanesulfonic acid, 2-acrylamido-2-(2-pyridyl)propanesulfonic acid, 2-acrylamido-1-methylpropanesulfonic acid, 3-acrylamido-3-methylbutanesulfonic acid, 2-methacrylamido-n-decanesulfonic acid and 2-methacrylamido-n-tetradecanesulfonic acid. It may preferably include 2-acrylamido-2-methylpropanesulfonic acid.

A polymerization initiator usable when the polymerizable vinyl monomer and the sulfonic-acid-group-containing acrylamide monomer are copolymerized may be a peroxide type initiator or an azo type initiator. Preferred is a peroxide type initiator a decomposition product of which has a carboxyl group and is effective for negative charging performance. The initiator may preferably be used within the range of from 0.5% by weight to 5% by weight based on the weight of the monomer mixture. As a polymerization method therefor, any method of solution polymerization, suspension polymerization, bulk polymerization and so forth may be used, without any particular limitations. It is particularly preferable to employ suspension polymerization in which a mixture of the above monomers is subjected to copolymerization in an organic solvent containing a lower alcohol such as methanol, isopropanol or butanol.

In such a case, as the binder resin for the resin coat layer in the developer-carrying member, the binder resin is used which contains the copolymer of the polymerizable vinyl monomer with the sulfonic-acid-group-containing acrylamide monomer, and, in its part or entirety, contains in its molecular structure at least one of an —$NH_2$ group, an =NH group and an —NH— linkage.

Materials having the —$NH_2$ group may include primary amines represented by R—$NH_2$ or polyamines having these, and primary amides represented by RCO—$NH_2$ or polyamides having these; materials having the =NH group may include secondary amines represented by R=NH or polyamines having these, and secondary amides represented by $(RCO)_2$=NH or polyamides having these; and materials having the —NH— linkage may include, in addition to the above polyamines and polyamides, polyurethanes having an —NHCO— linkage. Resins containing at least one of these materials, or any of these as copolymers, and synthesized industrially may preferably be used. Of these, phenolic resins, polyamide resins and urethane resins formed using ammonia as a catalyst are preferred. As the phenolic resin constituting the binder resin used in the present invention, it has been found as a result of extensive studies made by the present inventors that a phenolic resin making use of a nitrogen-containing compound as a catalyst in its production process may be used and this readily causes structural mutual action with the above copolymer at the time of heat curing to make the whole resin composition come to have uniform and sufficient positive-charge-providing properties.

Accordingly, such a phenolic resin may be used as one of materials constituting the resin coat layer formed on the developer-carrying member in the present invention, to obtain good negative-charge-providing properties. As the nitrogen-containing compound used as a catalyst in its production process may include, as acid catalysts, ammonium or amino salts of acids, such as ammonium sulfate, ammonium phosphate, ammoniumsulfamide, ammoniumcarbonate, ammonium acetate and ammonium maleate. As base catalysts, it may include ammonia, and amino compounds such as dimethylamine, diethylamine, diisopropylamine, diisobutylamine, diamylamine, trimethylamine, triethylamine, tri-n-butylamine, triamylamine, dimethylbenzylamine, diethylbenzylamine, dimethylaniline, diethylaniline, n,n-di-n-butylaniline, n,n-diamylaniline, n,n-di-t-amylaniline, n-methylethanolamine, n-ethylethanolamine, diethanolamine, triethanolamine, dimethylethanolamine, diethylethanolamine, ethyldiethanolamine, n-butyldiethanolamine, di-n-butylethanolamine, triisopropanolamine, ethylenediamine and hexamethylenetetramine; pyridine and derivatives thereof, such as pyridine, α-picoline, β-picoline, γ-picoline, 2,4-lutidine and 2,6-lutidine; and nitrogen-containing heterocyclic compounds such as quinoline compounds, imidazole, 2-methylimidazole, 2,4-dimethylimidazole, 2-ethyl-4-methylimidazole, 2-phenylimidazole, 2-phenyl-4-methylimidazole and 2-heptadecylimidazole.

The polyamide resin constituting the binder resin used in the present invention may include, e.g., nylon 6, nylon 66, nylon 610, nylon 11, nylon 12, nylon 9, nylon 13 and Q2 nylon, or copolymers of nylons having any of these as chief components, as well as N-alkyl-modified nylons and N-alkoxylalkyl-modified nylons, any of which may preferably be used. It may further include various resins modified with polyamide, such as polyamide-modifiedphenolic resins. Also, any resins may preferably be used as long as they are resins containing a polyamide resin component, such as epoxy resins making use of polyamide resin.

As the urethane resin constituting the binder resin used in the present invention, any resins may preferably be used as long as they are resins containing a urethane linkage. This urethane linkage is obtained by a polymerization addition reaction of a polyisocyanate with a polyol.

As the polyisocyanate serving as a chief raw material of this polyurethane resin, usable are diphenylenemethane-4,4'-diisocyanate (MDI), isophorone diisocyanate (IPDI), polymethylene polyphenyl poly isocyanate, tolylene diisocyanate, hexamethylene diisocyanate, 1,5-naphthalene diisocyanate, 4,4'-dicyclohexylmethane diisocyanate, carbodiimide-modified diphenylmethane-4,4'-diisocyanate, trimethylhexamethylene diisocyanate, orthotoluidine diisocyanate, naphthylene diisocyanate, xylene diisocyanate, paraphenylene diisocyanate, lysine diisocyanate methyl ester, and dimethyl diisocyanate.

The polyol serving as a chief raw material of this polyurethane resin includes polyester polyols such as polyethylene adipate ester, polybutylene adipate ester, polydiethylene glycol adipate ester, polyhexene adipate ester and polycaprolactone ester; and polyether polyols such as polytetramethylene glycol and polypropylene glycol.

In the present invention, the volume resistivity of the resin coat layer formed at the developer-carrying member surface using the material described above may preferably be controlled to be $10^3$ Ω·cm or below, and more preferably from $10^3$ Ω·cm to $10^{-2}$ Ω·cm. More specifically, if the resin coat layer has a volume resistivity higher than $10^3$ Ω·cm, the charge-up tends to occur to tend to cause a serious ghost image or a decrease in image density. Accordingly, in the developing assembly of the present invention, as the conductive fine particles, a conductive material is dispersedly incorporated in the binder resin, which is the film-forming material of the resin coat layer, in order to control the volume resistivity of the resin coat layer at the developer-carrying member surface within the above preferable range. As the conductive material used here, it is preferable to use one having a particle diameter of 20 μm or less, and more preferably 10 μm or less, in number-average particle diameter. It is further preferable to use one having a particle diameter of 1 μm or less in order to avoid any unevenness which may be formed at the resin coat layer surface.

The conductive material usable here may include, e.g., carbon black such as furnace black, lamp black, thermal black, acetylene black and channel black; metal oxides such as titanium oxide, tin oxide, zinc oxide, molybdenum oxide, potassium titanate, antimony oxide and indium oxide; metals such as aluminum, copper, silver and nickel; and inorganic fillers such as graphite, metal fiber and carbon fiber. Any of these conductive materials may be added to the interior of the resin coat layer in an amount of 100 parts by weight or less based on 100 parts by weight of the binder resin. Its addition in an amount of more than 100 parts by weight tends to cause a lowering of film strength of the resin coat layer. Also, the addition of the conductive material in a large quantity tends to cause a decrease in the charge quantity of the developer.

In the developing assembly of the present invention, as the construction of the resin coat layer provided at the surface of the developer-carrying member used, the resin coat layer may preferably be so constructed as to further contain, in addition to the positively chargeable material and conductive material described above, spherical particles having a number-average particle diameter of approximately from 0.3 μm to 30 μm. With such construction, the surface roughness of the developer-carrying member can be made stable, and the quantity of the developer coated on the developer-carrying member can be made optimum. Also, the incorporation of spherical particles in the resin coat layer makes the developer carrying member surface retain a uniform surface roughness, and at the same time the surface roughness of the resin coat layer can be made to change less even where the surface of the resin coat layer has worn. Hence, this arrangement can be effective for making it hard to cause any contamination by developer and melt-adhesion of developer on the developer carrying member. Moreover, such spherical particles thus incorporated interact with the nitrogen-containing heterocyclic compound contained in the resin coat layer, to make higher the effect of charge control attributable to the nitrogen-containing heterocyclic compound and to further improve rapid and uniform charge-providing properties. Also, they have the effect of making the charge-providing properties stable.

The spherical particles used in the present invention may preferably have a number-average particle diameter of from 0.3 μm to 30 μm, and more preferably from 2 μm to 20 μm. More specifically, if the spherical particles incorporated in the resin coat layer have a number-average particle diameter of less than 0.3 μm, the effect of imparting uniform roughness to the surface of the developer-carrying member may be small, the effective of improving charging performance may be small, the rapid and uniform charging to the developer may be insufficient, and the charge-up of developer, contamination by developer and melt-adhesion of developer tends to occur as a result of the wear of the resin coat layer to tend to cause a serious ghost image and a decrease in image density. Hence, such particle diameter is not preferable. On the other hand, a case in which the spherical particles have a number-average particle diameter larger than 30 μm is undesirable because the resin coat layer tends to have an excessively large surface roughness to make it difficult for the developer to be well charged and also to cause a decrease in mechanical strength of the resin coat layer.

As the spherical particles used in the present invention, those having a true density of 3 g/cm$^3$ or less, preferably 2.7 g/cm$^3$ or less, and more preferably from 0.9 to 2.3 g/cm$^3$, maybe used. More specifically, a case in which the spherical particles have a true density exceeding 3 g/cm$^3$ is not preferable because the dispersibility of the spherical particles in the resin coat layer may be insufficient to make it difficult to impart uniform roughness to the resin coat layer surface and also to enable no uniform dispersion of the nitrogen-containing heterocyclic compound, resulting in an insufficiently rapid and uniform charge-providing ability to the developer and an insufficient resin coat layer strength. On the other hand, a case in which the spherical particles have a true density smaller than 0.9 g/cm$^3$ is also not preferable because the dispersibility of the spherical particles in the resin coat layer may be insufficient.

The term "spherical" in the phrase "spherical particles", refers to particles having a length/breadth ratio of approximately from 1.0 to 1.5. It is preferable to use spherical particles having a length/breadth ratio of from 1.0 to 1.2, which are more truly spherical. More specifically, a case in which the spherical particles have a length/breadth ratio higher than 1.5 is not preferable in view of the rapid and uniform charging of the developer and the film strength of the resin coat layer, because the dispersibility of the spherical particles in the resin coat layer may decrease, the dispersibility of the positively chargeable material in the coat layer may decrease, and also the surface roughness of the resin coat layer may become non-uniform.

As the spherical particles used in the present invention, known spherical particles may be used. For example, they may include spherical resin particles, spherical metal oxide particles, spherical carbide particles. Also, the spherical resin particles may include, e.g., spherical resin particles obtained directly by suspension polymerization, dispersion polymerization or the like and having a desired particle diameter. In the present invention, among these, spherical resin particles are particularly preferred because a suitable surface roughness can be attained by its addition in a smaller quantity and a uniform surface shape can be attained with ease. Such spherical resin particles may include particles of acrylic resins such as polyacrylate and polymethacrylate, particles of polyamide resins such as nylon, particles of polyolefin resins such as polyethylene and polypropylene, silicone resin particles, phenolic-resin particles, polyurethane resin particles, styrene resin particles and benzoguanamine particles. These resin particles are not limited to those obtained by the above polymerization. Resin particles obtained by a pulverization process maybe subjected to thermal or physical spherical treatment.

In the present invention, an inorganic fine powder may be made to adhere or stick to the surfaces of the above spherical particles. The inorganic fine powder used here may include, e.g., oxides such as $SiO_2$, $SrTiO_3$, $CeO_2$, CrO, $Al_2O_3$, ZnO and MgO; nitrides such as $Si_3N_4$, carbides such as SiC, and sulfates or carbonates such as $CaSO_4$, $BaSO_4$ and $CaCO_3$. In particular, such inorganic fine powders may preferably be those having been treated with a coupling agent for the purposes of improving its adhesion to the binder resin, imparting hydrophobicity to the spherical particles, and so forth.

The coupling agent used here includes, e.g., silane coupling agents, titanium coupling agents and zircoaluminate coupling agents. Stated more specifically, for example the silane coupling agents may include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to each Si in its units positioned at the terminals.

The inorganic fine powder preferably having been thus treated with the coupling agent may be made to adhere or stick to the spherical particle surfaces. Such treatment can improve the dispersibility of the spherical particles in the conductive resin coat layer, the uniformity or anti-stain properties of the resin coat layer surface, the charge-providing properties to the developer and the wear resistance of the conductive resin coat layer.

In the present invention, it is further preferable to use conductive particles as the above spherical particles. More specifically, making the spherical particles have conductivity makes it hard for the charge to accumulate on the spherical particle surfaces because of their own conductivity. Hence, the developer can be made to adhere less to the developer-carrying member and the charge-providing properties to the developer can be improved. The spherical particles used here may preferably be those having as conductivity, a volume resistivity of $10^6$ Ω·cm or below, and more preferably from $10^{-3}$ Ω·cm to $10^6$ Ω·cm. More specifically, if the spherical particles used in the present invention have a volume resistivity higher than $10^6$ Ω·cm, such particles are not preferable because such spherical particles laid bare to the surface of the resin coat layer as a result of wear may serve as nuclei around which developer contamination and melt-adhesion tend to occur and also make it hard to achieve rapid and uniform charging.

As a method for obtaining the conductive conductive spherical particles having such a volume resistivity, it is preferable to use methods as described below, to which, however, the method is not necessarily limited.

More specifically, as a method for obtaining conductive spherical particles preferably usable in the present invention, it may include, e.g., a method in which spherical resin particles or mesocarbon microbeads are fired and thereby carbonized and/or graphitized to obtain spherical carbon particles having a low density and a good conductivity. Resin used here in the spherical resin particles may include, e.g., phenol resins, naphthalene resins, furan resins, xylene resins, divinylbenzene polymers, a styrene-divinylbenzene copolymer, and polyacrylonitrile. Also, the mesocarbon microbeads may usually be produced by subjecting spherical crystals formed in the course of heating and firing a mesopitch, to washing with a large quantity of solvent such as tar, middle oil or quinoline.

As a method for obtaining more preferable conductive spherical particles usable in the present invention, it may include a method in which a bulk-mesophase pitch is coated on the surfaces of spherical particles such as phenol resin, naphthalene resin, furan resin, xylene resin, divinylbenzene polymer, styrene-divinylbenzene copolymer or polyacrylonitrile particles by a mechanochemical method, and the particles thus coated are heated in an oxidative atmosphere, followed by firing in an inert atmosphere or in vacuo so as to be carbonized and/or graphitized to obtain conductive spherical carbon particles. Spherical carbon particles obtained by this method have undergone crystallization at the coated portions of the spherical carbon particles and have been improved in conductivity. Hence, these are more preferred as spherical particles used in the present invention.

In the conductive spherical carbon particles obtained by the above methods, when they are obtained by any of the above methods, the conductivity of the resulting spherical carbon particles can be controlled by changing conditions for firing, and spherical carbon particles preferably usable in the present invention can be obtained with ease. In order to more improve the conductivity, the spherical carbon particles obtained by the above methods may be coated with conductive metal and/or metal oxide to such an extent that the true density of the conductive spherical particles does not exceed 3 g/cm$^3$.

Another method for obtaining the conductive spherical particles used in the present invention may include a method in which core particles comprised of spherical resin particles and conductive fine particles having a smaller particle diameter than the core particles are mechanically mixed in a suitable mixing ratio to cause the conductive fine particles to uniformly adhere to the peripheries of the core particles by the action of the van der Waals force and the electrostatic force, and thereafter the surfaces of the core particles are softened by a local temperature rise caused by, e.g., imparting mechanical impact so that the conductive fine particles cover the core particle surfaces, to obtain conductive-treated spherical resin particles.

As the core particles, it is preferable to use spherical resin particles comprised of an organic compound and having a small true density. The resin therefor may include, e.g., PMMA, acrylic resin, polybutadiene resin, polystyrene resin, polyethylene, polypropylene, polybutadiene, or copolymers of any of these, benzoguanamine resin, phenolic resins, polyamide resins, nylons, fluorine resins, silicone resins, epoxy resins and polyester resins. As the conductive fine particles (coat particles) used when they are caused to cover the surfaces of the core particles (base particles), it is preferable to use coat particles having a particle diameter of ⅛ or less of the base particles so that the coats of conductive fine particles can uniformly be provided.

Still another method for obtaining the conductive spherical particles usable in the present invention may include a method in which the conductive fine particles are uniformly dispersed in spherical resin particles to thereby obtain conductive spherical particles with the conductive fine particles dispersed therein. A method for uniformly dispersing the conductive fine particles in the spherical resin particles may include, e.g., a method in which a binder resin and the conductive fine particles are kneaded to disperse the latter in the former, and thereafter the product is cooled to solidify and then pulverized into particles having a stated particle diameter, followed by mechanical treatment and thermal treatment to make the particles spherical; and a method in which a polymerization initiator, the conductive fine particles and other additives are added into polymerizable monomers and uniformly dispersed therein by means of a dispersion machine to obtain a polymerizable monomer composition, followed by suspension polymerization in an aqueous phase containing a dispersion stabilizer, by means of a stirrer so as to provide a stated particle diameter, to obtain spherical particles with conductive fine particles dispersed therein.

In the case of using the conductive spherical resin particles with the conductive fine particles dispersed in the binder resin, obtained by these methods, as core particles, these may be further mechanically mixed with additional conductive fine particles having smaller particle diameters than the core particles, in a suitable mixing ratio in the same way as discussed above, to cause the additional conductive fine particles to uniformly adhere to the peripheries of the conductive spherical particles by the action of the van der Waals force and the electrostatic force, and thereafter the surfaces of the conductive spherical particles are softened by a local temperature rise caused by imparting mechanical impact so that the additional conductive fine particles stick to the core particle surfaces to cover the core particle surfaces with the additional conductive fine particles, to further improve the conductivity.

The spherical particles dispersed in the conductive resin coat layer may preferably be in a content ranging from 2 parts by weight to 120 parts by weight, and preferably from 2 parts by weight to 80 parts by weight, based on 100 parts by weight of the coat layer binder resin. More specifically, if the spherical particles are in a content less than 2 parts by weight, the addition of the spherical particles may be less effective. If they are in a content more than 120 parts by weight, the charging performance on the developer may become too low.

In the developing assembly of the present invention, in addition to the above construction, a lubricating material may further be dispersed in the resin coat layer provided at the surface of the developer carrying member. This is preferable because the effect of the present invention can be further promoted. Lubricating materials usable here may include, e.g., particles of graphite, molybdenum disulfide, boron nitride, mica, graphite fluoride, silver-niobium selenide, calcium chloride-graphite, talc, and fatty acid metal salts such as zinc stearate. Of these, graphite particles may particularly preferably be used because the conductivity of the conductive resin coat layer is not damaged. Also, as these lubricating materials, those having a number-average particle diameter of approximately preferably from 0.2 μm to 20 μm, and more preferably from 0.3 to 15 μm, may be used.

The lubricating material may preferably be added in an amount ranging from 5 parts by weight to 120 parts by weight, and more preferably from 10 parts by weight to 100 parts by weight, based on 100 parts by weight of the coat layer binder resin. More specifically, if the lubricating particles are in a content of more than 120 parts by weight, the coat strength may lower and the charge quantity of the toner may decrease. If it is in a content of less than 5 parts by weight, the surface of the resin coat layer tends to become easily contaminated by the developer when, e.g., put into long-term service using a developer with small particle diameter of 7 μm or less.

The developer-carrying member used in the present invention is constituted of at least a substrate and the conductive resin coat layer formed of the materials described above. As the substrate, a metallic cylinder may be used. As the metallic cylinder, for example a cylinder made of stainless steel or aluminum may preferably be used.

In the present invention, when the resin coat layer is formed using the constituent materials described above, its surface roughness, when expressed as center-line average roughness (hereinafter "Ra"), may preferably be so controlled as to be from 0.3 μm to 3.5 μm, and more preferably from 0.5 to 3.0 μm. More specifically, if the conductive resin coat layer has an Ra of less than 0.3 μm, the transport performance of the developer may decrease to make it impossible to obtain a sufficient image density. If, on the other hand, the conductive resin coat layer has an Ra of more than 3.5 μm, the transport quantity of the developer may become excessive to make it impossible to well charge the developer.

The resin coat layer constructed as described above may preferably have a layer thickness of 25 μm or less, more preferably 20 μm or less, and still more preferably from 4 μm to 20 μm. Such a thickness is preferable for obtaining a uniform layer thickness. The thickness is not particularly limited to this layer thickness. The resin coat layer with such a layer thickness, which depends on the materials for forming the resin coat layer, maybe formed in a coating weight of about 4,000 to 20,000 mg/m$^2$.

Methods of measuring physical properties concerning the present invention are described below.

(1) Measurement of Charge Polarity of Resin Coat Layer:

Preparation of Sample Sheet:

A resin solution of a resin coat layer whose charge polarity should be measured (one from which carbon and graphite have been removed) is coated on a SUS stainless-steel sheet, and the wet coating formed is dried and heated to make it into a film (drying and heating temperature and time are, in the case of a thermoplastic resin, those for and at which the solution evaporates completely; in the case of a thermosetting resin, those for and at which the resin is completely crosslinked) to prepare a sample sheet. This sample sheet is left overnight in an environment of 23° C. and 60% RH (relative humidity) in the state in which it is ground.

Regulation of Particles:

Iron powder (particle diameter: about 100 μm) is left overnight or more in an environment of 23° C. and 60% RH in the state in which it is ground.

Figure 8:
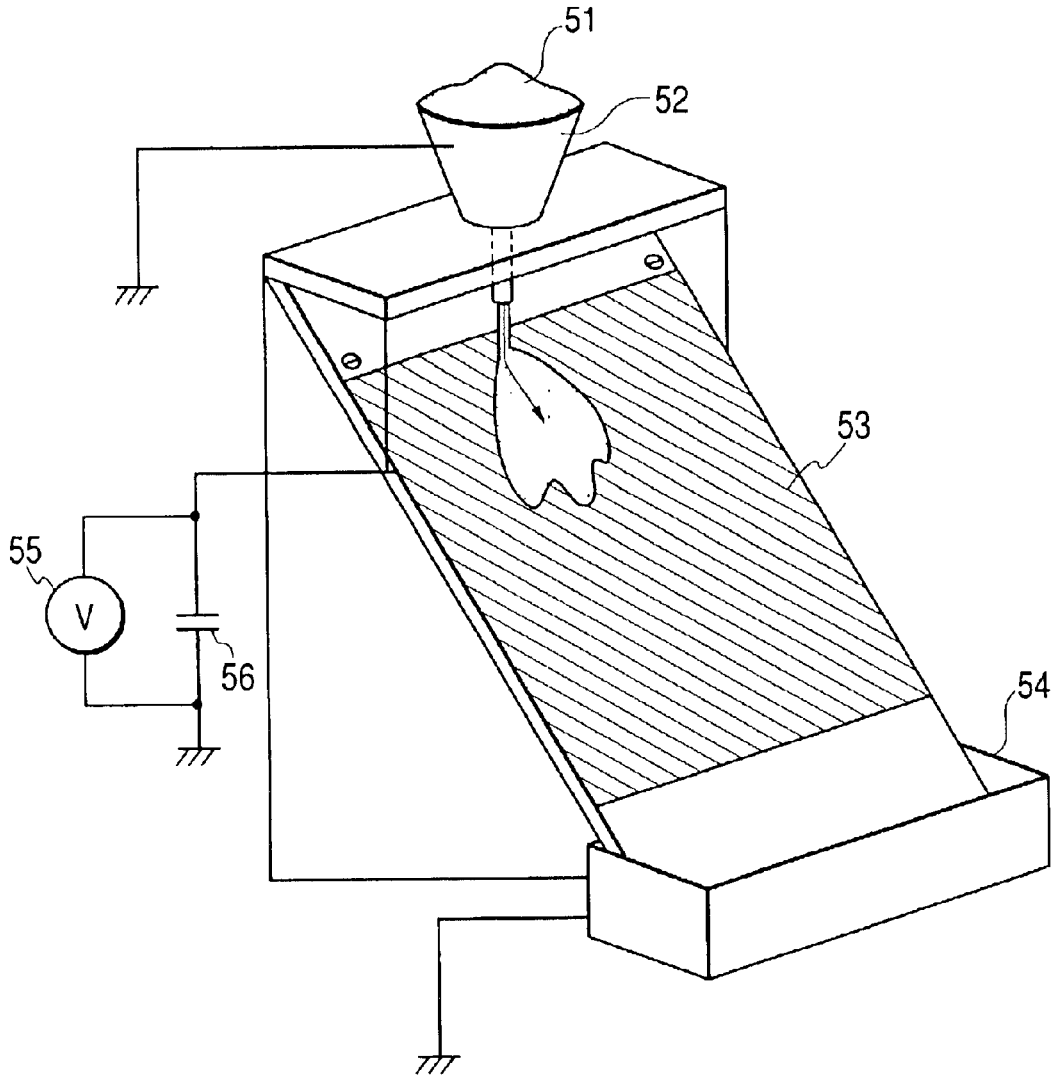
FIG. 8 is an illustration of a surface charge quantity measuring device for measuring the charge polarity of a resin coat layer.

How to Measure:

Measured in an environment of 23° C. and 60% RH. First, the sample sheet prepared as described above is set on a surface charge quantity measuring device TS-10OAS shown in FIG. 8 (manufactured by Toshiba Chemical Corporation). A potentiometer 55 is grounded and its value is set to 0. The iron powder, 51, moisture-conditioned as described above is put in a dropping container 52. A START switch is pushed to drop the iron powder, 51, on the sample sheet, 53, for 20 seconds and receive the dropped sample in a receiver container 54 previously kept grounded. The polarity potentiometer 55 is read, and its output is regarded as the charge polarity. Incidentally, reference numeral 56 denotes a capacitor.

(2) Measurement of Centerline Average Roughness (Ra):

According to the JIS B0601 surface roughness measuring method, values at six points each of (axial-direction three points)×(peripheral-direction two points) are measured with Surfcoader SE-3300, manufactured by Kosaka Laboratory Ltd., and their average value is calculated.

(3) Measurement of Volume Resistivity of Particles:

Sample particles are put in an aluminum ring of 40 mm diameter, and press-molded under 2,500 N to measure the volume resistivity of the molded product by means of a resistivity meter LOW-RESTAR AP or HI-RESTAR IP (both manufactured by Mitsubishi Chemical Corporation), using a four-terminal probe. The measurement is made in an environment of 20 to 25° C. and 50 to 60% RH.

(4) Measurement of Volume Resistivity of Resin Coat Layer:

A resin coat layer of 7 μm to 20 μm thick is formed on a PET sheet of 100 μm thick to prepare a measuring sample. On this sample, its resistivity is measured with a voltage drop type digital ohmmeter (manufactured by Kawaguchi Denki Seisakusho), which is in conformity with the ASTM standard (D-991-82) and the Japan Rubber Association standard SRIS (2301-1969), used for measuring the volume resistivity of conductive rubbers and plastics, and provided with an electrode of a four-terminal structure. The measurement is made in an environment of 20 to 25° C. and 50 to 60% RH.

(5) Measurement of True Density of Spherical Particles:

The true density of the spherical particles used in the present invention is measured with a dry densitometer ACUPIC 1330 (manufactured by Shimadzu Corporation).

(6) Measurement of Particle Diameter of Spherical Particles:

Measurement is made using a Coulter Model LS-130 particle size distribution meter (manufactured by Coulter Electronics Inc.), which is a laser diffraction particle size distribution meter. As a measuring method, an aqueous module is used. As a measuring solvent, pure water is used. The inside of a measuring system of the particle size distribution meter is washed with pure water for about 5 minutes, and 10 to 25 mg of sodium sulfite as an anti-foaming agent is added in the measuring system to carry out a background function. Next, three or four drops of a surface active agent are added into 10 ml of pure water, and 5 to 25 mg of a measuring sample is further added. The aqueous solution in which the sample has been suspended is subjected to dispersion by means of an ultrasonic dispersion machine for about 1 to 3 minutes to obtain a sample fluid. The sample fluid is little by little added into the measuring system of the above measuring instrument to make the measurement. Here, the sample concentration in the measuring system is adjusted so as to be 45 to 55% as PIDS on the screen of the instrument to make the measurement. Then, the number average particle diameter calculated from number distribution is determined.

(7) Measurement of Particle Diameter of Conductive Fine Particles Contained in Developer:

Particle diameters of conductive fine particles are measured using an electron microscope. A photograph is taken at a magnfication of 60,000. If it is difficult to do so, a photograph taken at a lower magnification is enlarged so as to have a magnification of 60,000. On the photograph, particle diameters of primary particles are measured. Here, lengths and breadths of the particles are measured, and a value obtained by averaging the measurements is regarded as the particle diameter. This is measured on 100 samples, and a 50% value of the measurements is regarded as the average particle diameter.

Developing conditions preferable in the present invention are described below.

In the present invention, it is preferable to form a developer layer of from 3 to 30 g/m$^2$ on the developer-carrying member. Inasmuch as the developer layer of from 3 to 30 g/m$^2$ is formed on the developer-carrying member, a uniform developer layer can be formed with ease, and the conductive fine particles can uniformly be fed onto the latent-image-bearing member, whereby the latent-image-bearing member can uniformly be charged with ease. If the developer on the developer-carrying member is present in a quantity too small below the above range, a sufficient image density may be obtained with difficulty, and any minute unevenness of the developer layer on the developer-carrying member tends to appear as an uneven image density and as uneven charging of the latent-image-bearing member due to uneven feed of the conductive fine particles. If the developer on the developer-carrying member is present in a quantity too large beyond the above range, the toner particles tend to be insufficiently triboelectrically charged to tend to cause toner scatter and tend to damage the charging of the latent-image-bearing member because of an increase in fog and a lowering of transfer performance.

It is also more preferable to form a developer layer of from 5 to 25 g/m$^2$ on the developer-carrying member. Inasmuch as the developer layer of from 5 to 25 g/m$^2$ is formed on the developer-carrying member, the developer on the developer-carrying member can more uniformly triboelectrically be charged with ease, and the transfer residual toner particles collected can be made to less affect the triboelectric charging of the toner particles present in the vicinity of the developer-carrying member, so that more stable cleaning-at-development performance can be achieved. If the developer on the developer-carrying member is present in a quantity too small below the above range, the transfer residual toner particles collected tend to affect the triboelectric charging of the toner particles present in the vicinity of the developer-carrying member, to cause developer layer unevenness due to any excess triboelectric charging of some toner particles, resulting in non-uniform collection performance on the transfer residual toner particles in some cases. If the developer on the developer-carrying member is in a quantity too large beyond the above range, the transfer residual toner particles collected may again be transported to the developing zone without again being sufficiently triboelectrically charged, and may participate in the development to tend to cause fog.

In the present invention, the surface of the developer-carrying member that carries the developer may move in the same direction as the direction of movement of the latent-image-bearing member surface, or may move in the opposite direction. In the case when the former's movement direction is the same direction as the latter's, the movement speed of the developer-carrying member surface may preferably be 100% or more in ratio with respect to the movement speed of the latent-image-bearing member surface. If it is less than 100%, a poor image quality may result.

As long as the ratio of the movement speed of the developer-carrying member surface to the movement speed of the latent-image-bearing member surface is 100% or more (i.e., the movement speed of the developer-carrying member surface is equal to or higher than the movement speed of the latent-image-bearing member surface), the toner particles can sufficiently be fed from the developer-carrying member side to the latent-image-bearing member side, and hence a sufficient image density can be achieved with ease and the conductive fine particles can also sufficiently be fed. Thus, good charging performance on the latent-image-bearing member can be achieved.

In addition, the movement speed of the developer-carrying member surface may preferably be 1.05 to 3.0 times the movement speed of the latent-image-bearing member surface. With an increase in the movement speed ratio, the developer is fed to the developing zone in a larger quantity, and the developer is more frequently taken on and off the electrostatic latent image, where it is repeatedly scraped off at the unnecessary part and imparted to the necessary part, so that the collection performance of transfer residual tower particles can be improved and any pattern ghost due to faulty collection can more surely be kept from occurring. Moreover, images faithful to latent images can be obtained. Also, in the contact development process, with an increase in the movement speed ratio, the collection performance of transfer residual toner particles is more improved on account of the friction between the latent-image-bearing member and the developer-carrying member. However, if the movement speed ratio is greatly beyond the above range, fog and image stain tend to occur because of the scattering of developer from the surface of the developer-carrying member. Thus, in the contact development process, the latent-image-bearing member or the developer-carrying member tends to have a short lifetime due to wear or scraping caused by their rubbing friction. Where the developer layer thickness regulation member which regulates the quantity of developer on the developer-carrying member is kept in contact with the developer-carrying member via the developer, the developer layer thickness regulation member or the developer-carrying member tends to have a short lifetime due to wear or scrape caused by their rubbing friction. From the foregoing viewpoint, the movement speed of the developer-carrying member surface may more preferably be 1.1 to 2.5 times the movement speed of the latent-image-bearing member surface.

In the present invention, in order to apply the non-contact type developing system, the developer layer on the developer-carrying member may preferably be formed in a thickness smaller than the preset gap distance at which the developer-carrying member is set apart from the latent-image-bearing member. The present invention has made it possible to achieve at a high image quality level the cleaning-at-development image formation system making use of the non-contact type developing system, which has been difficult in the past. In the developing step, the non-contact type developing system is used in which the developer layer is set in a non-contact state with the latent-image-bearing member and the electrostatic latent image on the latent-image-bearing member is rendered visible as a developer image. Thus, any development fog which may be caused by the development bias injected into the latent-image-bearing member does not occur even when conductive fine particles having a low electrical-resistance value are added into the developer in a large quantity. Hence, good images can be obtained.

In this case, the developer-carrying member may also preferably be set opposingly to the latent-image-bearing member, having a gap distance of from 100 $\mu$m to 1,000 $\mu$m between them. If the gap distance at which the developer-carrying member is set apart from the latent-image-bearing member is too small below the above range, the developing performance of the developer may greatly change with respect to any variations of the gap distance. Hence, this makes it difficult to mass-produce an image-forming apparatus which satisfy stable image characteristics. If the gap distance at which the developer-carrying member is set apart from the latent-image-bearing member is too large beyond the above range, the toner particles may have a low follow-up performance with respect to the latent image on the latent-image-bearing member. Hence, this tends to cause a lowering of image quality, such as a lowering of resolution and a decrease in image density. Also, the performance of feeding the conductive fine particles onto the latent-image-bearing member tends to decrease, and the charging performance on the latent-image-bearing member tends to decrease.

From these viewpoints, the developer-carrying member may more preferably be set opposingly to the latent-image-bearing member, having a gap distance of from 100 $\mu$m to 600 $\mu$m between them. Inasmuch as the gap distance at which the developer-carrying member is set apart from the latent-image-bearing member is 100 $\mu$m to 600 $\mu$m, the collection of transfer residual toner particles in the cleaning-at-development step can more predominantly be performed. If the gap distance is too large beyond this range, the performance of collecting transfer residual toner particles to the developing assembly may decrease to tend to cause fog due to faulty collection.

In the present invention, the development may preferably be performed by the step of development performed by forming an alternating electric field (AC electric field) across the developer-carrying member and the latent-image-bearing member. The alternating electric field can be formed by applying an alternating voltage across the developer-carrying member and the latent-image-bearing member. The development bias applied may be one formed by superimposing an alternating voltage (AC voltage) on DC voltage.

As waveforms of such alternating voltage, any of a sinusoidal waveform, a rectangular waveform and a triangular waveform may appropriately be used. They also may be pulse waves formed by periodic turning on/off of a DC power source. Thus, as the waveform of alternating voltage, a waveform such that its voltage value changes periodically can be used.

At least an AC electric field (alternating electric field) of from $3\times10^6$ to $10\times10^6$V/min peak-to-peak electric field intensity and from 100 to 5,000 Hz in frequency may preferably be formed across the developer-holding developer-carrying member and the latent-image-bearing member by applying the development bias. Forming the alternating electric field within the above range by applying the development bias makes it easy for the conductive fine particles added to the developer to uniformly move to the latent-image-bearing member side. Also, the uniform and dense contact attained between the contact charging member and the latent-image-bearing member at the charging zone via the conductive fine particles can remarkably promote the uniform charging (in particular, the direct-injection charging) of the latent-image-bearing member. Still also, since the alternating electric field is formed by applying the development bias, any injection of electric charges into the latent-image-bearing member does not take place at the developing zone even when a great difference in potential is present between the developer-carrying member and the latent-image-bearing member, and hence any development fog which may be caused when the development bias injects electric charges into the latent-image-bearing member does not occur even when the conductive fine particles are added to the developer in a large quantity. Thus, good images can be obtained.

If the alternating electric field formed by applying the development bias across the developer-carrying member and the latent-image-bearing member is at an intensity too low below the above range, the conductive fine particles fed to the latent-image-bearing member tend to be present in an insufficient quantity to tend to lower the uniform charging of the latent-image-bearing member. Also, because of a weak development power, images with a low image density tend to be formed. If, on the other hand, the alternating electric field is at an intensity too high beyond the above range, the development powder may be so strong as to tend to cause a lowering of resolution due to fine-line crushing, a lowering of image quality due to an increase in fog, and a lowering of charging performance on the latent-image-bearing member, and tend to cause image defects due to a leak of development bias to the latent-image-bearing member.

If the alternating electric field formed by applying the development bias across the developer-carrying member and the latent-image-bearing member has a frequency too low below the above range, it may be hard for the conductive fine particles to be uniformly fed to the latent-image-bearing member, to tend to cause unevenness in the uniform charging of the latent-image-bearing member. If the alternating electric field has a frequency too high beyond the above range, the conductive fine particles fed to the latent-image-bearing member tend to be in an insufficient quantity to tend to lower the uniform charging of the latent-image-bearing member.

At least an AC electric field (alternating electric field) of from $4\times10^6$ to $10\times10^6$V/min peak-to-peak electric field intensity and from 500 to 4,000 Hz in frequency may more preferably be formed across the developer-holding developer-carrying member and the latent-image-bearing member by applying the development bias. Forming the alternating electric field within the above range by applying the development bias makes it easy for the conductive fine particles added to the developer to uniformly move to the latent-image-bearing member side, enables the conductive fine particles to be uniformly coated on the latent-image-bearing member after transfer, and enables the maintainenance of high performance of collecting transfer residual toner particles also when the non-contact type developing system is applied.

If the alternating electric field formed by applying the development bias across the developer-carrying member and the latent-image-bearing member is at an intensity too low below the above range, the performance of collecting transfer residual toner particles to the developing assembly may decrease to tend to cause fog due to faulty collection. Also, if the alternating electric field formed by applying the development bias across the developer-carrying member and the latent-image-bearing member is at a frequency too low below the above range, the developer may less frequently be taken on and off the electrostatic latent image to tend to lower the performance of collecting transfer residual toner particles to the developing assembly, and tend to lower image quality, too. If the alternating electric field has a frequency too high beyond the above range, toner particles which can follow up any changes of the electric field may be in a small quantity to lower the collection performance on transfer residual toner particles to tend to cause positive ghost due to faulty collection performance on the transfer residual toner particles.

In the present invention, the transfer step may be the step of transferring to an intermediate transfer member the developer (toner) image formed through the developing step, and thereafter again transferring the developer image to the recording medium such as paper. More specifically, the transfer material to which the developer image is transferred may also be an intermediate transfer member such as a transfer drum. In the case when the transfer material serves as the intermediate transfer member, the developer image is obtained by again transferring it from the intermediate transfer member to the recording medium such as paper. The use of such an intermediate transfer member can make smaller the quantity of transfer residual toner particles on the latent-image-bearing member without regard to recording media of various types, such as cardboard.

In the present invention, the intermediate transfer member may also preferably be in contact with the latent-image-bearing member via the transfer material (as the recording medium) at the time of transfer.

In the step of contact transfer in which the developer image on the latent-image-bearing member is transferred to the transfer material while a transfer means is kept in contact with the latent-image-bearing member via the transfer material, the transfer means may preferably be at a contact pressure of from 2.94 to 980 N/m, and more preferably from 19.6 to 490 N/m, in linear pressure. If the transfer means is at a contact pressure too low below the above range, transport aberration of transfer materials and faulty transfer tend to occur, undesirably. A contact pressure which is too high beyond the above range may cause deterioration of or developer adhesion to the latent-image-bearing member surface to consequently cause the melt adhesion of developer to the latent-image-bearing member surface.

As the transfer means in the transfer step, an assembly having a transfer roller or a transfer belt may preferably be used. The transfer roller may have at least a mandrel and a conductive elastic layer covering the mandrel, and the conductive elastic layer may preferably be an elastic member comprised of a solid or foamed-material layer made of an elastic material such as polyurethane rubber or ethylene-propylene-diene polyethylene (EPDM) in which a conductivity-providing agent such as carbon black, zinc oxide, tin oxide or silicon carbide has been mixed and dispersed to adjust electrical resistance (volume resistivity) to a medium resistance of from $10^6$ to $10^{10}$ Ω·cm.

As preferable transfer process conditions in the transfer roller, the contact pressure of the transfer roller may be from 2.94 to 490 N/m, and more preferably from 19.6 to 294 N/m. If the linear pressure as the contact pressure is too low below the above range, the transfer residual toner particles may increase to tend to damage the charging performance on the latent-image-bearing member. If the contact pressure is too high beyond the above range, the transfer residual toner particles tend to be transferred because of the pressing force, so that the feed of the transfer residual toner particles to the latent-image-bearing member or contact charging member may decrease to lower the effect of promoting the charging of the latent-image-bearing member and lower the collection performance of transfer residual toner particles in the cleaning-at-development step. Also, developer spots around line images may also greatly occur.

In the contact transfer step in which the developer image is transferred to the transfer material while the transfer means is kept in contact with the latent-image-bearing member via the transfer material, the DC voltage may preferably be from ±0.2 to ±10 kV.

The developing assembly of the present invention is also especially effectively usable in image-forming apparatus having a small-diameter drum type photosensitive member having a diameter of 30 mm or less. More specifically, since any independent cleaning step is not provided after the transfer step and before the charging step, the charging, exposure, developing and transfer steps can be provided at a higher degree of freedom, and, in combination with the small-diameter photosensitive member having a diameter of 30 mm or less, the image-forming apparatus can be made compact and space-saving. In beltlike photosensitive members, too, the respective steps can likewise be provided at a higher degree of freedom. Accordingly, the developing assembly of the present invention is effective also for an image-forming apparatus to make use of a photosensitive belt, which forms a curvature radius of 25 mm or less at the contact portion.

In the present invention, a process cartridge having at least the latent-image-bearing member and the developing assembly described above may detachably be mounted to the main body of the image-forming apparatus. Also, this process cartridge may further have the charging means described above.

EXAMPLES

The present invention is described below in greater detail by giving Examples. The present invention is by no means limited to these Examples.

First, a production example of a photosensitive member as the latent-image-bearing member used in the present invention is given below.

Photosensitive Member

Production Example

A photosensitive member making use of an organic photoconductive material (hereinafter often "OPC photosensitive member") for negative charging was produced. As a substrate of the photosensitive member, a cylinder made of aluminum, having a diameter of 24 mm, was used. On this cylinder, the following first to fifth layers were superposingly formed by dip coating in order. Thus, a photosensitive member with the layer construction as shown in FIG. 5 was produced.

The first layer is a conductive layer 12, which is a conductive-particle-dispersed resin layer (comprised chiefly of phenol resin in which tin oxide and titanium oxide powders have been dispersed) of about 20 μm thick, provided in order to level any surface defects and so forth of an aluminum substrate 11 and also to prevent moirés from being caused by the reflection of laser exposure light.

The second layer is a positive-charge injection blocking layer 13, which is a medium-resistance layer of about 1 μm thick, having the function that the positive electric charges injected from the aluminum substrate 11 can be prevented from cancelling the negative electric charges produced by charging on the photosensitive member surface, and resistance-controlled to about $10^6$ Ω·cm by methoxymethylated nylon.

The third layer is a charge generation layer 14, which is a layer of about 0.3 μm thick, formed of butyral resin in which a disazo pigment has been dispersed, and generates positive-negative electric-charge pairs when subjected to laser exposure.

The fourth layer is a charge transport layer 15, which is a layer of about 25 μm thick, formed of polycarbonate resin in which a hydrazone compound has been dispersed, and is a p-type semiconductor. Hence, the negative electric charges produced by charging on the photosensitive member surface can not move through this layer. Only the positive electric charges generated in the charge generation layer can be transported to the photosensitive member surface.

The fifth layer is a charge injection layer 16, which is a layer formed of a photocurable acrylic resin in which conductive ultrafine tin oxide and tetrafluoroethylene resin of about 0.25 μm in particle diameter have been dispersed. Stated specifically, a coating fluid prepared by dispersing 100% by weight of tin oxide particles of about 0.03 μm in particle diameter, having been doped with antimony to have a low resistance, 20% by weight of polytetrafluoroethylene resin particles and 1.2% by weight of a dispersant in the resin is applied by spray coating in a thickness of about 2.5 μm to form the charge injection layer 16.

The volume resistivity at the outermost surface layer of the photosensitive member thus obtained was $5\times10^{12}$ Ω·cm, and the contact angle to water of the photosensitive member surface was 102 degrees.

Next, a production example of a charging member used in Examples of the present invention is given below.

Charging Member

Production Example

Using as a mandrel a SUS stainless-steel roller of 6 mm in diameter and 264 mm in length, a medium-resistance foamed urethane layer formulated with carbon black as conductive particles, a curing agent, a blowing agent and so forth was formed on the mandrel in the form of a roller, further followed by cutting and polishing to adjust its shape and surface properties. Thus, a charging roller of 12 mm in diameter and 234 mm in length, having a foamed urethane roller having a flexibility was produced.

In the charging roller obtained, the resistivity of its foamed urethane roller was $10^5$ Ω·cm and the hardness thereof was 30 degrees as Asker-C hardness.

Toner Particles

Production Example Ts-1

| | |
|---|---|
| Styrene-butyl acrylate-butyl maleate half ester copolymer (Tg: 63° C.; molecular weight: Mp 12,000, Mn 6,500, Mw 230,000) | 100 parts |
| Magnetic iron oxide (average particle diameter: 0.22 μm; coercive force Hc of 5.2 kA/m, saturation magnetization σs of 85 $Am^2$/kg and residual magnetization σr of 5.0 $Am^2$/kg under magnetic field of 795.5 kA/m) | 90 parts |

-continued

| | |
|---|---|
| Monoazo iron complex (negative charge control agent) | 2 parts |
| Low-molecular-weight ethylene-propylene copolymer | 4 parts (by weight) |

The above materials were mixed by means of a blender, and the mixture obtained was melt-kneaded using an extruder heated to a temperature of 130° C., the melt-kneaded product obtained was cooled, the cooled product obtained was crushed, and the crushed product obtained was pulverized by means of a fine grinding mill making use of jet streams. The pulverized product obtained was further classified using a multi-division classifier utilizing the Coanda effect to obtain toner particles Ts-1 having a weight-average particle diameter of 7.9 μm determined from the number-based particle size distribution in the range of particle diameter of from 0.60 μm to less than 159.21 μm. The resistivity of the toner particles Ts-1 was $10^{14}$ Ω·cm or more.

The circularity distribution was, as describe it in the embodiments of the invention, measured with the flow type particle image analyzer FPIA-1000 (manufactured by Toa Iyou Denshi K.K.). To describe it in greater detail, 10 ml of water from which fine dust had been removed through a filter (preferably so made that the number of particles ranging in particle diameter from 1.00 μm to less than 2.00 μm as circle-equivalent diameter was estimated to be 20 or less particles in $10^{-3}$ $cm^3$) and few drops of a diluted surface-active agent (preferably one prepared by diluting an alkylbenzenesulfonate with water from which fine dust had been removed to be about 1/10 times the concentration) were added into a screw-mouthed bottle of 30 mm in inner diameter and 65 mm in height and made of hard glass (e.g., a screw-mouthed bottle for 30 ml, SV-30, available from Nichiden Rikagarasu K.K.). To this, a measurement sample was added in an appropriate quantity (e.g., 0.5 to 20 mg) so that the particle concentration of the measuring sample came 7,000 to 10,000 particles/$10^{-3}$ $cm^3$ with respect to particles in the range of the circle-equivalent diameters measured, and dispersed by means of an ultrasonic homogenizer for 3 minutes (a step-type chip of 6 mm in diameter was applied to Ultrasonic Homogenizer UH-50, manufactured by K.K. SMT, with an output of 50 W and a frequency of 20 kHz, and treatment was conducted setting the scale of the power control volume to 7, i.e., at a dispersion power of about a half of the maximum output obtained when the same chip was used) to prepare a sample dispersion. Using this sample dispersion, the particle size distribution and circularity distribution of particles having circle-equivalent diameters of from 0.60 μm to less than 159.21 μm were measured.

The content (% by number) and circularity of the particles in the particle diameter range from 1.00 μm to less than 2.00 μm were determined from the particle size distribution thus obtained. These physical properties of the toner particles Ts-1 are shown in Table 2.

Toner Particles

Production Example Ts-2

The crushed product obtained in Toner Particles Production Example Ts-1 was pulverized by means of a mechanical grinding mill. The pulverized product obtained was classified using the multi-division classifier to obtain toner particles Ts-2 having a weight-average particle diameter of 6.8

μm determined from the number-based particle size distribution in the range of particle diameter of from 0.60 μm to less than 159.21 μm. The resistivity of the toner particles Ts-2 was $10^{14}$ Ω·cm or more.

Toner Particles

Production Example Ts-3

Figure 7:
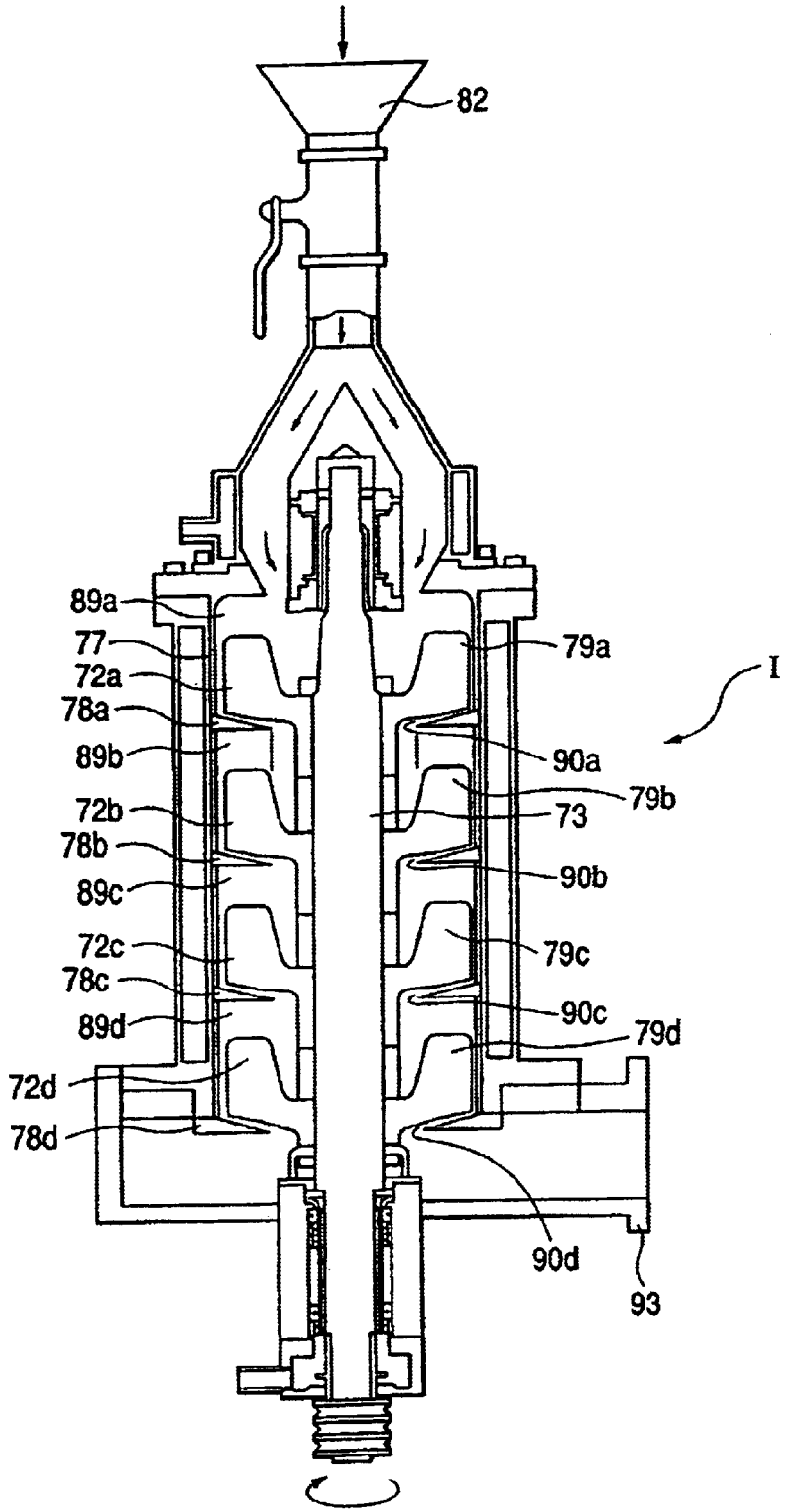
FIG. 7 is a diagrammatic view of a treatment section of the apparatus for making toner particle spherical, used in examples of the present invention.

The classified product obtained in Toner Particles Production Example Ts-2 was subjected to spherical treatment by applying thermomechanical impact force repeatedly to the particles by means of the treatment apparatus for making toner particle spherical, shown in FIGS. 6 and 7, to obtain toner particles Ts-3 having a weight-average particle diameter of 6.5 μm determined from the number-based particle size distribution in the range of particle diameter of from 0.60 μm to less than 159.21 μm.

Toner Particles

Production Example Ts-4

The classified product obtained in Toner Particles Production Example Ts-2 was subjected to spherical treatment by making the particles pass instantaneously through 300° C. hot air, to obtain toner particles Ts-4 having a weight-average particle diameter of 6.9 μm. The resistivity of the toner particles Ts-4 was $10^{14}$ Ω·cm or more.

Toner Particles

Production Example Tp-1

| | |
|---|---|
| Polyester resin (Tg: 60° C.; acid value: 20 mg · KOH/g; hydroxyl value: 30 mg · KOH/g; molecular weight: Mp 7,000, Mn 3,000, Mw 55,000) | 100 parts |
| Magnetic iron oxide (average particle diameter: 0.20 μm; Hc of 9.2 kA/m, σs of 82 $Am^2$/kg and σr of 11.5 $Am^2$/kg under magnetic field of 795.5 kA/m) | 90 parts |
| Monoazo iron complex (negative charge control agent) | 2 parts |
| Low-molecular-weight ethylene-propylene copolymer | 4 parts (by weight) |

The above materials were subjected to melt kneading, crushing and pulverization by means of a fine grinding mill making use of jet streams, in the same manner as in Toner Particles Production Example Tp-1, to obtain toner particles Tp-1 having a weight-average particle diameter of 8.1 determined from the number-based particle size distribution in the range of particle diameter of from 0.60 μm to less than 159.21 μm. The resistivity of the toner particles Tp-1 was $10^{14}$ Ω·cm or more.

Toner Particles

Production Example Tp-2

The crushed product obtained in Toner Particles Production Example Tp-1 was pulverized by means of a mechanical grinding mill. The pulverized product obtained was classified using the multi-division classifier to obtain toner particles Tp-2 having a weight-average particle diameter of 7.0 μm determined from the number-based particle size distribution in the range of particle diameter of from 0.60 μm to less than 159.21 μm. The resistivity of the toner particles Tp-2 was $10^{14}$ Ω·cm or more.

Toner Particles

Production Example Tp-3

The classified product obtained in Toner Particles Production Example Tp-2 was subjected to spherical treatment by applying thermomechanical impact force repeatedly to the particles by means of the treatment apparatus for making toner particle spherical, shown in FIGS. 6 and 7, to obtain toner particles Tp-3 having a weight-average particle diameter of 6.7 μm determined from the number-based particle size distribution in the range of particle diameter of from 0.60 μm to less than 159.21 μm.

Toner Particles

Production Example Tp-4

The classified product obtained in Toner Particles Production Example Tp-2 was subjected to spherical treatment by making the particles pass instantaneously through 300° C. hot air, to obtain toner particles Tp-4 having a weight-average particle diameter of 7.2 μm. The resistivity of the toner particles Tp-4 was 10 Ω·cm or more.

The values of typical physical properties of the above toner particles Ts-1 to Ts-4 and Tp-1 to Tp-4 are shown in Table 2.

Inorganic Fine Powder

Production Example I-1

Hydrophobic dry-process fine silica powder treated with hexamethyldisilazane and thereafter treated with dimethylsilicone oil was designated as an inorganic fine powder I-1. The number-average particle diameter of primary particles of this inorganic fine powder I-1 was 12 nm, and the BET specific surface area was 120 $m^2$/g.

Inorganic Fine Powder

Production Example I-2

Dry-process fine silica powder treated with hexamethyldisilazane was designated as an inorganic fine powder I-2. The number-average particle diameter of primary particles of this inorganic fine powder I-2 was 16 nm, and the BET specific surface area was 170 $m^2$/g.

The values of typical physical properties of the above inorganic fine powders I-1 and I-2 are shown in Table 3.

Conductive Fine Particles

Production Examples C-1 to 3

Zinc oxides with volume-average particle diameters of 0.07 μm, 1.52 μm and 2.03 μm were designated as conductive fine particles C-1, C-2 and C-3, respectively. The resistivity of these conductive fine particles as measured by the tablet method described in the embodiments of the invention was $1.2\times10^3$ Ω·cm, $8.9\times10^3$ Ω·cm and $2.7\times10^4$ Ω·cm, respectively.

Conductive Fine Particles

Production Examples C-4 to 6

Zinc oxides with volume-average particle diameters of 0.50 μm, 1.15 μm and 5.22 μm were designated as conductive fine particles C-4, C-5 and C-6, respectively. The resistivity of these conductive fine particles as measured by the tablet method described in the embodiments of the invention was $7.3\times10^4$ Ω·cm, $1.2\times10^5$ Ω·cm and $1.8\times10^7$ Ω·cm, respectively.

Conductive Fine Particles

Production Example C-7

Conductive fine particles comprised of titanium oxide powder of about 0.1 μm in particle diameter to which tin oxide was made to adhere in a proportion of 50% in weight ratio was designated as conductive fine particles C-7. The resistivity of the conductive fine particles as measured by the tablet method described in the embodiments of the invention was $3.1\times10^2$ Ω·cm.

The values of typical physical properties of the above conductive fine particles C-1 to C-7 are shown in Table 4.

Developer Production Example Rs-0

To 100 parts by weight of the magnetic toner particles Ts-1, obtained in Toner Particles Production Example Ts-1, 1.23 parts by weight of the inorganic fine powder I-1 was added, followed by uniform mixing by means of a mixer to obtain a developer Rs-0.

The number-based particle size distribution in the range of particle diameter of from 0.60 μm to less than 159.21 μm of the magnetic developer Rs-0 was, as described above in Toner Particles Production Examples, measured with the flow type particle image analyzer FPIA-1000 (manufactured by Toa Iyou Denshi K.K.).

Developer Production Example Rs-1

To 100 parts by weight of the magnetic toner particles Ts-1, obtained in Toner Particles Production Example Ts-1, 1.23 parts by weight of the inorganic fine powder I-1 and 1.03 parts by weight of the conductive fine particles C-4 were added, followed by uniform mixing by means of a mixer to obtain a developer Rs-1.

Developer Production Examples Rs-2 to 7

Developers Rs-2, Rs-3, Rs-4, Rs-5, Rs-6 and Rs-7 were obtained in the same manner as in Developer Production Example Rs-1 except that, in Developer Production Example Rs-1, the conductive fine particles C-1 were changed to the conductive fine particles C-5, C-2, C-3, C-7, C-6 and C-1, respectively.

Developer Production Examples Rs-8 to 10

Developers Rs-8, Rs-9 and Rs-10 were obtained in the same manner as in Developer Production Example Rs-i except that, in place of the toner particles Ts-1 used therein, the toner particles Ts-2, Ts-3 and Ts-4, respectively, were used.

Developer Production Example Rp-0

To 100 parts by weight of the magnetic toner particles Tp-1, obtained in Toner Particles Production Example Tp-1, 1.23 parts by weight of the inorganic fine powder I-2 was added, followed by uniform mixing by means of a mixer to obtain a developer Rp-0.

Developer Production Example Rp-1

To 100 parts by weight of the magnetic toner particles Tp-1, obtained in Toner Particles Production Example Tp-1, 1.23 parts by weight of the inorganic fine powder I-2 and 1.03 parts by weight of the conductive fine particles C-4 were added, followed by uniform mixing by means of a mixer to obtain a developer Rp-1.

Developer Production Examples Rp-2 to 7

Developers Rp-2, Rp-3, Rp-4, Rp-5, Rp-6 and Rp-7 were obtained in the same manner as in Developer Production Example Rp-1 except that, in Developer Production Example Rp-1, the conductive fine particles C-4 were changed to the conductive fine particles C-5, C-2, C-3, C-7, C-6 and C-1, respectively.

Developer Production Examples Rp-8 to 10

Developers Rp-8, Rp-9 and Rp-10 were obtained in the same manner as in Developer Production Example Rp-1 except that, in place of the toner particles Tp-1 used therein, the toner particles Tp-2, Tp-3 and Tp-4, respectively, were used.

With respect to the above developers Rs-0 to Rs-10 and Rp-0 to Rp-10, their weight-average particle diameter and content (% by number) of the particles in the particle diameter range from 1.00 μm to less than 2.00 μm and from 3.00 μm to less than 8.96 μm are shown in Table 5.

Developer-Carrying Member

Production Example Dp-l-1

As the positively chargeable material nitrogen-containing heterocyclic compound, particles of an imidazole compound represented by Formula B-1, having a number-average particle diameter of 3 μm, were used.

(B-1)

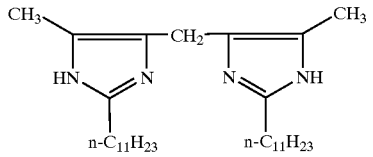

| | |
|---|---|
| Resol type phenol resin solution (containing 50% of methanol) | 400 parts |
| Nitrogen-containing heterocyclic compound B-1 (imidazole compound) | 15 parts |
| Isopropyl alcohol | 335 parts (by weight) |

The above materials were dispersed for 1 hour by means of a sand mill, using glass particles of 2 mm in diameter, and thereafter the glass particles were separated by sieving. This resin solution was applied on a SUS stainless steel sheet by means of a bar coater (#60), followed by heating to cure at 150° C. for 30 minutes to prepare a sample sheet (with a resin coat layer). In a state that this sample sheet was grounded, this was left standing overnight in an environment of 23° C. and 60% RH. Then, the triboelectric charge polarity to iron powder of the resin coat layer of the sample sheet was measured in the manner described previously, to find that it showed positive chargeability.

As the conductive spherical particles, 100 parts of spherical phenol resin particles with a number-average particle diameter of 7.8 μm were uniformly coated with 14 parts of coal bulk-mesophase pitch powder with a number-average particle diameter of 2 μm or less by means of an automated mortar (manufactured by Ishikawa Kogyo). Then, the coated particles were subjected to thermal stabilization treatment at 280° C. in air, followed by firing at 2,000° C. in an atmosphere of nitrogen to graphitize them, and further followed by classification to obtain spherical conductive carbon particles with a number-average particle diameter of 7.2 μm.

| | |
|---|---|
| Conductive carbon black | 20 parts |
| Graphite with number-average particle diameter of 3.4 μm | 80 parts |
| Resol type phenol resin solution (containing 50% of methanol) | 400 parts |
| Nitrogen-containing heterocyclic compound B-1 (imidazole compound) | 15 parts |
| Spherical carbon particles (number-average particle diameter: 7.2 μm) | 10 parts |
| Isopropyl alcohol | 125 parts (by weight) |

The above materials were dispersed for 3 hours by means of a sand mill, using zirconia particles of 2 mm in diameter as media particles. Thereafter, the zirconia particles were separated by sieving. The solid content of the dispersion obtained was adjusted with isopropyl alcohol to 40% to obtain a coating fluid c(carbon)/GF(graphite)/B(phenol resin)/CA(nitrogen-containing heterocyclic compound B-1)/R(spherical particles)=0.2/0.8/2.0/0.15/0.1. This coating fluid was applied on an insulating sheet by means of a bar coater, followed by drying. The sample obtained was cut in a standard form and its volume resistivity was measured with a low-resistivity meter LOW-RESTAR (manufactured by Mitsubishi Chemical Corporation) to find that it was 3.52 Ω·cm.

Using this coating fluid, a coating film was formed by spraying on an aluminum cylinder of 16 mm diameter. Subsequently, the coating film formed was heated to cure at 150° C. for 30 minutes by means of a hot air drying oven. Thus, a developer carrying member Dp-l-1 was produced. The Ra (centerline average roughness) of the conductive coat layer surface of this developer-carrying member was measured with Surfcoader SE-3300 (manufactured by Kosaka Laboratory Ltd.) over an evaluation length of 4 mm and at the six points, and their average value was calculated to find that Ra was 1.21 μm.

Developer-Carrying Member

Production Examples Dp-l-2 to l-4

As the nitrogen-containing heterocyclic compound, particles of imidazole compounds represented by Formulas B-2 to B-4, respectively, having a number-average particle diameter of 3 μm, were used.

(B-2)

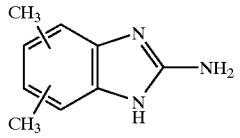

(B-3)

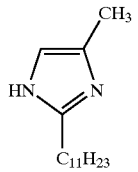

-continued (B-4)

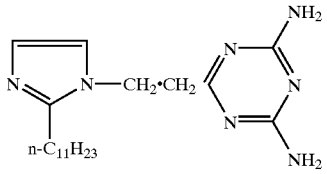

In the same manner as in Developer-Carrying Member Production Example Dp-l-1, the resin coat layers containing these compounds were formed and their triboelectric charge polarity to iron powder was measured to find that all showed positive chargeability.

Using these, the dispersion and coating were carried out in the same manner as in Developer-Carrying Member Production Example Dp-l-1 to produce developer-carrying members Dp-l-2 to Dp-l-4, and their physical properties were measured in the same way.

Developer-Carrying Member

Production Example Dp-n-1

| | |
|---|---|
| Resol type phenol resin solution (containing 50% of methanol) | 600 parts |
| Nitrogen-containing heterocyclic compound B-1 (imidazole compound) | 20 parts |
| Isopropyl alcohol | 447 parts (by weight) |

The above materials were dispersed for 1 hour by means of a sand mill, using glass particles of 2 mm in diameter, and thereafter the glass particles were separated by sieving. This resin solution was applied to a SUS stainless steel sheet by means of a bar coater (#60), followed by heating to cure at 150° C. for 30 minutes to prepare a sample sheet (with a resin coat layer). In a state that this sample sheet was grounded, this was left standing overnight in an environment of 23° C. and 60% RH. Then, the triboelectric charge polarity to iron powder of the resin coat layer of the sample sheet was measured in the manner described previously, to find that it showed positive chargeability.

| | |
|---|---|
| Conductive carbon black | 20 parts |
| Graphite with number-average particle diameter of 3.4 μm | 80 parts |
| Resol type phenol resin solution (containing 50% of methanol) | 600 parts |
| Nitrogen-containing heterocyclic compound B-1 (imidazole compound) | 20 parts |
| Spherical carbon particles (number-average particle diameter: 3.7 μm) | 10 parts |
| Isopropyl alcohol | 700 parts (by weight) |

The above materials were dispersed for 2 hours by means of a sand mill after adding thereto as media particles zirconia beads of 2 mm in diameter, and then the beads were separated by sieving. The solid content of the dispersion obtained was adjusted with isopropyl alcohol to 40% to obtain a coating fluid [c(carbon)/GF(graphite)/B(binder resin)/CA(nitrogen-containing heterocyclic compound B-1)/R(spherical particles)=0.2/0.8/3.0/0.2/0.1].

This was applied in the same manner as in Developer-Carrying Member Production Example Dp-l-1 to produce a developer-carrying member Dp-n-1, and its physical properties were measured in the same way.

Developer-Carrying Member

Production Examples Dp-n-2 to n-4

Developer-carrying members Dp-n-2 to n-4 were produced in the same manner as in Developer-Carrying Member Production Example Dp-n-1 except that, in Developer-Carrying Member Production Example Dp-n-1, the nitrogen-containing heterocyclic compound was changed t B-2 to B-4, respectively. Their physical properties were measured in the same way.

The results of measurement are shown in Table 6.

Developer-Carrying Member

Production Example Dm-l-1

| | |
|---|---|
| Resol type phenol resin (solid content: 50%) | 320 parts |
| Methyl methacrylate-dimethylaminoethyl methacrylate copolymer P-1 (solid content: 50%) (molar ratio: 90:10; Mw: 10,200; Mn: 4,500; Mw/Mn: 2.3) | 80 parts |
| MEK (methyl ethyl ketone) | 400 parts (by weight) |

The above materials were dispersed for 1 hour by means of a sand mill, using glass particles of 2 mm in diameter, and thereafter the glass particles were separated by sieving. This resin solution was applied to a SUS stainless steel sheet by means of a bar coater (#60), followed by heating to cure at 150° C. for 30 minutes to prepare a sample sheet (with a resin coat layer). In a state that this sample sheet was grounded, this was left standing overnight in an environment of 23° C. and 60% RH. Then, the triboelectric charge polarity to iron powder of the resin coat layer of the sample sheet was measured in the manner described in the embodiments of the invention, to find that it showed positive chargeability.

As the spherical particles, 100 parts of spherical phenol resin particles with a number-average particle diameter of 7.8 μm were uniformly coated with 14 parts of coal bulk-mesophase pitch powder with a number-average particle diameter of 2 μm or less by means of an automated mortar (manufactured by Ishikawa Kogyo). Then, the coated particles were subjected to thermal stabilization treatment at 280° C. in air, followed by firing at 2,000° C. in an atmosphere of nitrogen to graphitize them, and further followed by classification to obtain spherical conductive carbon particles with a number-average particle diameter of 11.7 μm.

| | |
|---|---|
| Carbon black | 20 parts |
| Crystalline graphite with number-average particle diameter of 4.8 μm | 80 parts |
| Resol type phenol resin (solid content: 50%) | 320 parts |
| Methyl methacrylate-dimethylaminoethyl methacrylate copolymer P-1 (solid content: 50%) (molar ratio: 90:10; Mw: 10,200; Mn: 4,500; Mw/Mn: 2.3) | 80 parts |
| Spherical carbon particles (number-average particle diameter: 11.7 μm) | 30 parts |
| MEK | 130 parts (by weight) |

The above materials were dispersed for 3 hours by means of a sand mill, using zirconia particles of 2 mm in diameter. Thereafter, the zirconia particles were separated by sieving. The solid content of the dispersion obtained was adjusted with MEK to 40% to obtain a coating fluid [c(carbon)/GF (graphite)/B(phenol resin)/D(copolymer P-1)/R(spherical particles)=0.2/0.8/1.6/0.4/0.3]. This coating fluid was applied to an insulating sheet by means of a bar coater, followed by drying. The sample obtained was cut in a standard form and its volume resistivity was measured with a low-resistivity meter LOW-RESTAR (manufactured by Mitsubishi Chemical Corporation) to find that it was 5.03 Ω·cm.

Using this coating fluid, a coating film was formed by spraying on an aluminum cylinder of 16 mm diameter. Subsequently, the coating film formed was heated to cure at 150° C. for 30 minutes by means of a hot air drying oven. Thus, a developer carrying member Dm-l-1 was produced. The Ra of the conductive coat layer surface of this developer-carrying member was measured with Surfcoader SE-3300 (manufactured by Kosaka Laboratory Ltd.) over an evaluation length of 4 mm and at the six points, and their average value was calculated to find that Ra was 1.27 μm.

Developer-Carrying Member

Production Examples Dm-l-2 to l-4

Developer-carrying members Dm-l-2 to l-4 were produced in the same manner as in Developer-Carrying Member Production Example Dm-l-1 except that, in place of the copolymer P-1 used in Developer-Carrying Member Production Example Dm-l-1, copolymers P-2 to P-4 were used in which the molecular weight of the copolymer and/or the molar ratio of the methacrylate to the dimethylaminoethyl methacrylate were changed as shown below. Their physical properties were measured in the same way.

Copolymer used in developer-carrying member Dm-1-2:

Methyl methacrylate-dimethylaminoethyl methacrylate copolymer P-2 (solid content: 40%) (molar ratio: 90:10; Mw: 40,000; Mn: 19,000; Mw/Mn: 2.1)

Copolymer used in developer-carrying member Dm-1-3:

Methyl methacrylate-dimethylaminoethyl methacrylate copolymer P-3 (solid content: 40%) (molar ratio: 90:10; Mw: 3,700; Mn: 2,300; Mw/Mn: 1.6)

Copolymer used in developer-carrying member Dm-1-4:

Methyl methacrylate-dimethylaminoethyl methacrylate copolymer P-4 (solid content: 40%) (molar ratio: 70:30; Mw: 8,500; Mn: 2,900; Mw/Mn: 2.9)

Developer-Carrying Member

Production Example Dm-n-1

| | |
|---|---|
| Resol type phenol resin (solid content: 50%) | 460 parts |
| Methyl methacrylate-dimethylaminoethyl methacrylate copolymer P-1 (solid content: 50%) | 140 parts |
| MEK | 400 parts (by weight) |

The above materials were dispersed for 1 hour by means of a sand mill, using glass particles of 2 mm in diameter, and thereafter the glass particles were separated by sieving. This resin solution was applied to a SUS stainless steel sheet by means of a bar coater (#60), followed by heating to cure at 150° C. for 30 minutes to prepare a sample sheet (with a resin coat layer). In a state that this sample sheet was grounded, this was left standing overnight in an environment of 23° C. and 60% RH. Then, the triboelectric charge polarity to iron powder of the resin coat layer of the sample sheet was measured in the manner described in the embodiments of the invention, to find that it showed positive chargeability.

| | |
|---|---|
| Carbon black | 20 parts |
| Crystalline graphite with number-average particle diameter of 4.8 μm | 80 parts |
| Resol type phenol resin (solid content: 50%) | 460 parts |
| Methyl methacrylate-dimethylaminoethyl methacrylate copolymer P-1 (solid content: 50%) | 140 parts |
| Spherical carbon particles (number-average particle diameter: 7.2 μm) | 30 parts |
| MEK | 130 parts (by weight) |

The above materials were dispersed for 2 hours by means of a sand mill after adding thereto as media particles zirconia beads of 2 mm in diameter, and then the beads were separated by sieving. The solid content of the dispersion obtained was adjusted with MEK to 40% to obtain a coating fluid [c(carbon)/GF(graphite)/B(binder resin)/D(copolymer P-1)/R(spherical particles)=0.2/0.8/2.3/0.7/0.3).

This was coated in the same manner as in Developer-Carrying Member Production Example Dm-l-1 to produce a developer-carrying member Dm-n-1, and its physical properties were measured in the same way.

Developer-Carrying Member

Production Examples Dm-n-2 to n-4

Developer-carrying members Dm-n-2 to n-4 were produced in the same manner as in Developer-Carrying Member Production Example Dm-n-1 except that, in Developer-Carrying Member Production Example Dm-n-1, the copolymer was changed to P-2 to P-4, respectively. Their physical properties were measured in the same way.

The results of measurement are shown in Table 7.

Developer-Carrying Member

Production Example Df-l-1

(Production of Charge Control Resin)

| | |
|---|---|
| Methanol | 300 parts |
| Toluene | 100 parts |
| Styrene | 468 parts |
| 2-Ethylhexyl acrylate | 90 parts |
| 2-Acrylamido-2-methylpropanesulfonic acid | 42 parts |
| Lauroyl peroxide | 6 parts (by weight) |

The above materials were charged into a flask, and a stirrer, a thermometer and a nitrogen feeder were attached thereto. Solution polymerization was carried out at 65° C. in an atmosphere of nitrogen, which was maintained for 10 hours, where the polymerization reaction was completed. The polymer obtained was dried under reduced pressure, followed by pulverization to obtain a charge control resin F-1 with a weight-average particle diameter of 10,000.

Subsequently, charge control resins F-2 and F-3 were obtained by changing compositional ratios as shown in Table 8.

50 parts by weight of the charge control resin F-1 was dissolved in 50 parts by weight of methyl ethyl ketone to prepare a charge control resin solution F-1.

| | |
|---|---|
| Phenol resin (containing 50% of methanol) | 340 parts |
| Charge control resin solution F-1 (containing 50% of MEK) | 60 parts |
| Isopropyl alcohol | 267 parts |

The above materials were dispersed for 1 hour by means of a sand mill, using glass particles of 2 mm in diameter, and thereafter the glass particles were separated by sieving. This resin solution was applied to a SUS stainless steel sheet by means of a bar coater (#60), followed by heating to cure at 150° C. for 30 minutes to prepare a sample sheet (with a resin coat layer). In a state that this sample sheet was grounded, this was left standing overnight in an environment of 23° C. and 60% RH. Then, the triboelectric charge polarity to iron powder of the resin coat layer of the sample sheet was measured in the manner described in the embodiments of the invention, to find that it showed positive chargeability.

| | |
|---|---|
| Carbon black | 20 parts |
| Graphite with number-average particle diameter of 5.5 μm | 80 parts |
| Phenol resin produced using ammonia as a catalyst (containing 50% of methanol) | 340 parts |
| Charge control resin solution F-1 (containing 50% of MEK) | 60 parts |
| Spherical carbon particles (number-average particle diameter: 11.7 μm) | 20 parts |
| Isopropyl alcohol | 120 parts (by weight) |

The above materials were dispersed for 2 hours by means of a sand mill after dding thereto as media particles zirconia beads of 2 mm in diameter, and then the beads were separated by sieving. The solid content of the dispersion obtained was adjusted with isopropyl alcohol to 40% to obtain a coating fluid [c(carbon)/GF(graphite)/B(binder resin)/CA(charge control resin F-1)/R(spherical particles)= 0.2/0.8/1.7/0.3/0.2). This coating fluid was coated on an insulating sheet by means of a bar coater, followed by drying. The sample obtained was cut in a standard form and its volume resistivity was measured with a low-resistivity meter LOW-RESTAR (manufactured by Mitsubishi Chemical Corporation) to find that it was 2.13 Ω·cm.

Using this coating fluid, a coating film of 15 μm thick was formed by spraying on an aluminum cylinder of 16 mm diameter. Subsequently, the coating film formed was heated to cure at 150° C. for 30 minutes by means of a hot air drying oven. Thus, a developer carrying member Df-l-1 was produced.

The Ra of the conductive coat layer surface of this developer-carrying member was measured with Surfcoader SE-3300 (manufactured by Kosaka Laboratory Ltd.) over an evaluation length of 4 mm and at six points, and their average value was calculated to find that Ra was 1.07 μm.

Developer-Carrying Member

Production Example Df-l-2

A developer-carrying member Df-l-2 was produced in the same manner as in Developer-Carrying Member Production Example Df-l-1 except that, in Developer-Carrying Member Production Example Df-l-1, the phenol resin produced using ammonia as a catalyst was changed to a phenol resin produced using hexamethylenetetramine as a catalyst. Its physical properties were measured in the same manner as in Developer-Carrying Member Production Example Df-l-1.

Developer-Carrying Member

Production Example Df-l-3

A developer-carrying member Df-l-3 was produced in the same manner as in Developer-Carrying Member Production Example Df-l-1 except that, in place of the charge control resin F-1 used in Developer-Carrying Member Production Example Df-l-1, a charge control resin F-2 obtained by changing the compositional ratio as shown in Table 8 was used and the phenol resin produced using ammonia as a catalyst was changed to polyamide resin. Its physical properties were measured in the same manner as in Developer-Carrying Member Production Example Df-l-1.

Developer-Carrying Member

Production Example Df-l-4

A developer-carrying member Df-l-4 was produced in the same manner as in Developer-Carrying Member Production Example Df-l-1 except that, in place of the charge control resin F-1 used in Developer-Carrying Member Production Example Df-l-1, a charge control resin F-3 obtained by changing the compositional ratio as shown in Table 8 was used and the phenol resin produced using ammonia as a catalyst was changed to polyurethane resin. Its physical properties were measured in the same manner as in Developer-Carrying Member Production Example Df-l-1.

Developer-Carrying Member

Production Example Df-n-1

| | |
|---|---|
| Phenol resin (containing 50% of methanol) | 500 parts |
| Charge control resin solution F-1 (containing 50% of MEK) | 100 parts |
| Isopropyl alcohol | 400 parts (by weight) |

The above materials were dispersed for 1 hour by means of a sand mill, using glass particles of 2 mm in diameter, and thereafter the glass particles were separated by sieving. This resin solution was applied to a SUS stainless steel sheet by means of a bar coater (#60), followed by heating to cure at 150° C. for 30 minutes to prepare a sample sheet (with a resin coat layer). In the state this sample sheet was grounded, this was left standing overnight in an environment of 23° C. and 60% RH. Then, the triboelectric charge polarity to iron powder of the resin coat layer of the sample sheet was measured in the manner described in the embodiments of the invention, to find that it showed positive chargeability.

| | |
|---|---|
| Carbon black | 20 parts |
| Graphite with number-average particle diameter of 5.5 μm | 80 parts |
| Phenol resin produced using ammonia as a catalyst (containing 50% of methanol) | 500 parts |
| Charge control resin solution F-1 (containing 50% of MEK) | 100 parts |
| Spherical carbon particles (number-average particle diameter: 7.2 μm) | 20 parts |

-continued

| | |
|---|---|
| Isopropyl alcohol | 120 parts (by weight) |

The above materials were dispersed for 2 hours by means of a sand mill after adding thereto as media particles zirconia beads of 2 mm in diameter, and then the beads were separated by sieving. The solid content of the dispersion obtained was adjusted with isopropyl alcohol to 40% to obtain a coating fluid [c(carbon)/GF(graphite)/B(binder resin)/CA(charge control resin F-1)/R(spherical particles)= 0.2/0.8/2.5/0.5/0.2).

This was coated in the same manner as in Developer-Carrying Member Production Example Df-l-1 to produce a developer-carrying member Df-n-1, and its physical properties were measured in the same manner as in Developer-Carrying Member Production Example Df-l-1.

Developer-Carrying Member

Production Example Df-n-2

A developer-carrying member Df-n-2 was produced in the same manner as in Developer-Carrying Member Production Example Df-n-1 except that, in Developer-Carrying Member Production Example Df-n-1, the phenol resin produced using ammonia as a catalyst was changed to a phenol resin produced using hexamethylenetetramine as a catalyst. Its physical properties were measured in the same manner as in Developer-Carrying Member Production Example Df-n-1.

Developer-Carrying Member

Production Example Df-n-3

A developer-carrying member Df-n-3 was produced in the same manner as in Developer-Carrying Member Production Example Df-n-1 except that, in place of the charge control resin F-1 used in Developer-Carrying Member Production Example Df-n-1, a charge control resin F-2 obtained by changing the compositional ratio as shown in Table 8 was used and the phenol resin produced using ammonia as a catalyst was changed to polyamide resin. Its physical properties were measured in the same manner as in Developer-Carrying Member Production Example Df-n-1.

Developer-Carrying Member

Production Example Df-n-4

A developer-carrying member Df-n-4 was produced in the same manner as in Developer-Carrying Member Production Example Df-n-1 except that, in place of the charge control resin F-1 used in Developer-Carrying Member Production Example Df-n-1, a charge control resin F-3 obtained by changing the compositional ratio as shown in Table 8 was used and the phenol resin produced using ammonia as a catalyst was changed to polyurethane resin. Its physical properties were measured in the same manner as in Developer-Carrying Member Production Example Df-n-1.

The results of measurement are shown in Table 8.

(Image-Forming Apparatus)

FIG. 1 is a schematic view showing an example of the construction of an image-forming apparatus used in the present invention. This image-forming apparatus is a laser beam printer (recording apparatus) of the cleaning-at-development system (cleanerless system), utilizing a transfer-system electrophotographic process. This is an example of an image-forming apparatus which has a process cartridge from which a cleaning unit having a cleaning member such as a cleaning blade has been removed, makes use of a magnetic one-component developer (i.e., a magnetic toner having magnetic toner particles and an external additive) as the developer, and performs non-contact development where the developer-carrying member and the latent-image-bearing member are so disposed that the developer layer on the former is in non-contact with the latter's surface.

(1) Construction of Image-Forming Apparatus:

Reference numeral 1 denotes a rotating-drum type OPC photosensitive member of Photosensitive Member Production Example, serving as the latent-image-bearing member, and is rotatably driven in the clockwise direction (in the direction of an arrow) at a peripheral speed (process speed) of 100 mm/sec.

Reference numeral 2 denotes a charging roller of Charging Member Production Example, serving as the contact charging member, and consists basically of a mandrel 2*a* and an elastic layer 2*b*. The charging roller 2 is so provided as to be kept in pressure contact with the photosensitive member 1 against an elasticity and at a preset pressing force. Symbol n denotes a contact zone between the photosensitive member 1 and the charging roller. In the present Examples, the charging roller 2 is rotatably driven in the counter direction (the direction opposite to the movement direction of the photosensitive member 1) at the contact zone n, the contact part with the photosensitive member 1, at a peripheral speed of 141 mm/sec. (relative movement speed ratio: 250%). Also, the same conductive fine particles m as conductive fine particles m having been externally added to toner particles t are previously applied to the surface of the charging roller 2.

To the mandrel 2*a* of the charging roller 2, a DC voltage of −700 V is applied as charging bias from a charging bias application power source S1. In the present Examples, the surface of the photosensitive member 1 is uniformly charged by the direct-injection charging system, to a potential (−680 V) substantially equal to the voltage applied to the charging roller 2. This will be detailed later.

Reference numeral 3 denotes a laser beam scanner (exposure assembly) having a laser diode, a polygon mirror and so forth. This laser beam scanner outputs laser beams (wavelength: 740 nm) intensity-modulated correspondingly to time-sequential electrical digital pixel signals of intended image information, and the laser light effects scanning exposure of the uniformly charged surface of the photosensitive member 1. As a result of this scanning exposure, an electrostatic latent images corresponding to the intended image information is formed.

Reference numeral 4 denotes a developing assembly. The electrostatic latent image on the surface of the photosensitive member 1 is developed as a developer image by this developing assembly. The developing assembly 4 of the present Examples is a non-contact type reverse developing assembly making use of, as the developer, a developer 4*d* which is a negatively chargeable one-component insulating developer. The developer 4*d* has toner particles t and conductive fine particles m.

Reference numeral 4*s* denotes a non-magnetic developing sleeve of 16 mm in diameter provided internally with a magnet roll 4*b*, serving as the developer-carrying/transporting member. This developing sleeve 4*a* is provided opposite to the photosensitive member 1, leaving a gap distance of 300 μm between them, and is rotated at a peripheral speed of 120% (peripheral speed: 120 mm/sec.) of the peripheral speed of the photosensitive member 1, in the same direction as the direction of rotation of the photosensitive member 1 at a developing zone (developing region) a which is the part where it stands opposite to the photosensitive member 1.

On this developing sleeve 4*a*, the developer 4*d* is applied as a thin layer by an elastic blade 4*c*. The elastic blade 4*c* regulates the layer thickness of the developer 4*d* on the developing sleeve 4*a*, and also imparts electric charges to the developer.

The developer 4*d* applied to the developing sleeve 4*a* is, as the developing sleeve 4*a* is rotated, transported to the developing zone, the part where it stands opposite to the photosensitive member 1. Also, to the developing sleeve 4*a*, a development bias voltage is applied from a development bias application power source S2. Here, as the development bias voltage, a voltage formed by superimposing on a DC voltage of −420 V a rectangular-waveform AC voltage with a frequency of 1,600 Hz and a peak-to-peak voltage of 1,500 V (electric-field intensity: $5\times10^6$ V/m) was used, and one-component jumping development (toner projection development) was performed between the developing sleeve 4*a* and the photosensitive member 1.

Reference numeral 5 denotes a medium-resistance transfer roller as the contact transfer member, and is kept in contact with the photosensitive member 1 at a linear pressure of 98 N/m to form a transfer contact zone b. To this transfer contact zone b, a transfer material P as the recording medium is fed at a stated timing from a paper feed section (not shown), and also a stated transfer bias voltage is applied thereto from a transfer bias application power source S3. Thus, the developer image held on the side of the photosensitive member 1 is successively transferred onto the surface of the transfer material P fed to the transfer contact zone b.

In the present examples, a roller with a resistivity of $5\times10^8$ Ω·cm was used as the transfer roller 5 to perform transfer under application of a DC voltage of +3,000 V. More specifically, the transfer material P guided to the transfer contact zone b is sandwich-transported through this transfer contact zone b, and the developer image formed and held on the surface of the photosensitive member 1 is successively transferred on by the aid of electrostatic force and pressing force.

Reference numeral 6 denotes a fixing assembly of a heat fixing system or the like. The transfer material P which has been fed to the transfer contact zone (transfer nip) and to which the developer image on the side of the photosensitive member 1 has been transferred is separated from the surface of the photosensitive member 1 and guided into this fixing assembly, where the developer image is fixed thereto, and then delivered out of the apparatus as an image-formed matter (a print or a copy).

From the image-forming apparatus used in the present examples, any cleaning unit has been removed. The developer left after transfer (the transfer residual toner particles), having remained on the surface of the photosensitive member 1 after the developer image has been transferred to the transfer material P, is not removed by a cleaning means. Instead, as the photosensitive member 1 is rotated, it reaches the developing zone a through the charging zone n and is removed (collected) by a cleaning-at-development process in the developing assembly 4.

The image-forming apparatus in the present examples is constructed as a process cartridge 7 detachably mountable on the main body of the image-forming apparatus, having three process machineries, the photosensitive member 1, the charging roller 2 and the developing assembly 4, as one unit. In the present invention, the combination of process machineries to be put into one process cartridge is by no means limited to the above, and any desired combination may be employed. In the drawing, reference numeral 8 denotes a process cartridge detaching/attaching guide and holding member.

(2) Behavior of Conductive Fine Particles:

The conductive fine particles m contained in the developer 4*d* of the developing assembly 4 move to the photosensitive member 1 side in an appropriate quantity together with the toner particles t.

The developer images (i.e., toner particles) on the photosensitive member 1 are attracted to the recording medium transfer material P side at the transfer zone b by the influence of the transfer bias to move actively. However, the conductive fine particles m on the photosensitive member 1 do not actively move to the transfer material P side because they are conductive, and substantially stay attached and held on the photosensitive member 1 to remain there.

In the present examples, since the image-forming apparatus does not have any independent cleaning means, the transfer residual toner particles and conductive fine particles having remained on the surface of the photosensitive member 1 after transfer are carried to the charging zone n, the contact zone between the photosensitive member 1 and the contact charging member charging roller 2, as the photosensitive member 1 is rotated, and come to adhere to the charging roller 2. Hence, the direct-injection charging of the photosensitive member 1 is performed in a state that the conductive fine particles m are present at the contact zone n between the photosensitive member 1 and the charging roller 2.

Because of the presence of the conductive fine particles, the close contact performance and contact resistance of the charging roller 2 on the photosensitive member 1 can be maintained even where the transfer residual toner particles have adhered to the charging roller 2, and hence the charging roller 2 can be made to perform the direct-injection charging of the photosensitive member 1.

Namely, the charging roller 2 comes into close contact with the photosensitive member 1 via the conductive fine particles m, and the conductive fine particles m rub the photosensitive member 1 surface closely. Thus, the charging of the photosensitive member 1 by the charging roller 2 can predominantly be governed by the stable and safe direct-injection charging, which does not make use of any phenomenon of discharge, and hence a high charging efficiency that has not been achievable by any conventional roller charging and so forth can be achieved. Hence, a potential substantially equal to the voltage applied to the charging roller 2 can be imparted to the photosensitive member 1.

The transfer residual toner particles adhering to the charging roller 2 are gradually sent out from the charging roller 2 onto the photosensitive member 1 to come to reach the developing zone a with movement of the photosensitive member 1 surface, and then removed (collected) by a cleaning-at-development system in the developing assembly 4.

The cleaning-at-development system is a system in which the toner particles having remained on the photosensitive member 1 after transfer are collected by a fog take-off bias of the developing assembly (i.e., fog take-off potential difference Vback, which is the potential difference between the DC voltage applied to the developing assembly and the surface potential of the photosensitive member) at the time of next and later development in the image-forming step (i.e., at the time of the development of latent images which is performed again after development through the charging step and exposure step). In the case of the reverse development as in the image-forming apparatus used in the present examples, this cleaning-at-development process is performed by the action of an electric field with which the toner particles are collected by a development bias from the part of dark-area potential to the developing sleeve and an electric field with which the toner particles are made to adhere to the part of light-area potential from the developing sleeve (i.e., development).

As the image-forming apparatus is operated, the conductive fine particles contained in the developer of the developing assembly also move to the photosensitive member 1 surface at the developing zone and are carried to the charging zone n through the transfer zone b with the movement of the photosensitive member 1 surface. Thus, the conductive fine particles continue being anew fed successively to the charging zone n, and hence any lowering of the charging performance can be prevented from occurring and good charging performance on the photosensitive member 1 can stably be maintained even where the conductive fine particles m have decreased at the charging zone as a result of fall-off or the like or when the conductive fine particles at the charging zone have deteriorated.

Thus, in the image-forming apparatus of the contact charging system, the transfer system and the toner recycling system, the photosensitive member 1 as the latent-image-bearing member can uniformly be charged at a low applied voltage by the use of the charging roller 2, which is simple as the contact charging member. Moreover, even where the transfer residual toner particles have reached the charging zone, the ozoneless direct-injection charging can stably be maintained over a long period of time. Therefore, a simple-construction and low-cost image-forming apparatus free of any problems due to ozone products and problems due to faulty charging can be obtained.

As described previously, the conductive fine particles must have a resistivity of $1\times10^9$ Ω·cm or less in order not to lower the charging performance. If the conductive fine particles have a resistivity higher than $1\times10^9$ Ω·cm, electric charges can not sufficiently be injected into the photosensitive member 1 even if the charging roller 2 comes into close contact with the photosensitive member 1 via the conductive fine particles, and the conductive fine particles rub the photosensitive member 1 surface closely. This makes it difficult for the photosensitive member 1 to be charged to the desired potential. Also, where the contact developing assembly is used, in which the developer comes into direct contact with the photosensitive member 1, electric charges may be injected into the photosensitive member 1 by a development bias through the conductive fine particles present in the developer at the developing zone a.

Since in the present examples the developing assembly is the non-contact type developing assembly, the development bias is by no means injected into the photosensitive member 1, and good images can be obtained. Also, any injection of electric charges into the photosensitive member 1 does not take place at the developing zone a, and hence a large potential difference can be provided between the developing sleeve 4*a* and the photosensitive member 1 by, e.g., applying AC bias. This makes it ready for the conductive fine particles m to be uniformly developed. Hence, the conductive fine particles m can uniformly be applied to the photosensitive member 1 surface to achieve uniform contact at the charging zone and realize good charging performance, and good images can be obtained.

Due to the lubricating effect (friction reduction effect) attributable to the conductive fine particles interposed at the contact face between the charging roller 2 and the photosensitive member 1, the difference in speed can readily and effectively be provided between the charging roller 2 and the photosensitive member 1. Because of this lubricating effect, the friction between the charging roller 2 and the photosensitive member 1 can be reduced to lessen the driving torque, and the surface of the charging roller 2 or photosensitive member 1 can be prevented from wearing or being scratched. Also, by providing this difference in speed, the opportunities of contact of the conductive fine particles with the photosensitive member 1 can remarkably be added at the mutual contact zone (charging zone) between the charging roller 2 and the photosensitive member 1 to achieve a high contact performance. Hence, this makes it possible to perform good direct-injection charging.

In the present examples, the charging roller 2 is rotatably driven, and is so constructed as to be rotated in the direction opposite to the movement direction of the photosensitive member 1, to obtain the effect that the transfer residual toner particles on the photosensitive member 1, which are carried to the charging zone n, are temporarily collected in the charging roller 2 to level the amount of the transfer residual toner particles intervening at the charging zone n. Hence, any faulty charging due to localization of transfer residual toner particles at the charging zone can be prevented from occurring, and more stable charging performance can be achieved.

In addition, rotating the charging roller 2 in the opposite direction makes it possible to perform the charging in a state that the transfer residual toner particles left on the latent-image-bearing member are first drawn apart by such rotation in the opposite direction, and this makes it possible to perform the direct-injection charging mechanism predominantly. Also, this does not cause any lowering of charging performance which may be caused when the conductive fine particles fall off in excess from the charging roller 2.

Example L-1

A combination of the developer Rs-1 with the developer-carrying member Dp-l-1 was used in the above image-forming apparatus shown in FIG. 1, to make a print test. Into the developer cartridge thus made, 120 g of the developer Rs-1 was filled, and was used until the developer became a small quantity as a result of the continuous printing of a 5%-coverage image on 3,500 sheets in an evaluation environment of 23° C./60% RH. As the transfer material, A4-size copying paper of 90 g/m$^2$ was used. As the result, image density was sufficiently high, fog was minimal and also any lowering of developing performance was not seen even after the continuous printing on 3,500 sheets.

After the continuous printing on 3,500 sheets, the charging roller was also observed on its part corresponding to the contact zone n between it and the photosensitive member 1 to find that, though a very small quantity of transfer residual toner particles was seen, the contact zone was substantially full-covered with the conductive fine particles C-4.

Any image defects due to faulty charging also did not occur from the beginning (initial stage) and even after the continuous printing on 3,500 sheets and good direct-injection charging performance was achieved, because the conductive fine particles C-4 had stood present at the contact zone n between the photosensitive member and the charging roller and also the conductive fine particles C-4 had a sufficiently high resistivity.

Since a photosensitive member, whose outermost surface layer had a volume resistivity of $5\times10^{12}$ Ω·cm, was used as the latent-image-bearing member, it was able to achieve direct-injection charging by which electrostatic latent images were stably maintainable, character images with sharp contours were obtained, and sufficient charging performance was achievable even after the continuous printing on 3,500 sheets. After the direct-injection charging after the continuous printing on 3,500 sheets, the surface potential of the photosensitive member was −690 V with respect to the applied charging bias of −700 V, where any lowering of charging performance from the beginning (initial stage) was not seen, and any lowering of image quality due to deterioration in charging performance was not seen.

In addition, conjointly with the fact that a photosensitive member whose surface had a contact angle to water of 102 degrees was used as the latent-image-bearing member, the transfer efficiency was good both at the initial stage and also after the continuous printing on 3,500 sheets. Also taking account of the fact that the transfer residual toner particles were in a small quantity on the photosensitive member after transfer, the collection performance of transfer residual toner particles at development proved to have been good, from the fact that the transfer residual toner particles on the charging roller after transfer were present in a very small quantity and that fog is minimal at the non-image areas.

Printed images were evaluated in the manner described below.

(a) Image Density:

Evaluated by the density of images printed at the initial stage, and on the first sheet after the continuous printing on 3,500 sheets was completed and, after left for 2 days, the power source was again turned on. Here, the image density was measured with "Macbeth Reflection Densitometer" (manufactured by Macbeth Co.) as a relative density with respect to an image printed on a white background area with a density of 0.00 of an original. The results of evaluation are shown in Table 11. In Table 11, letter symbols on this item indicate the following evaluation.

A: Very good; image density which is high enough even for graphic images to be presented in a high grade (1.40 or more).

B: Good; image density which is high enough for non-graphic images to have a high-grade image quality (1.35 or more)

C: Average; image density which is tolerable as being high enough to recognize characters or letters (1.20 to less than 1.35).

D: Poor; very low image density (less than 1.20).

(b) Image Fog:

Printed images were sampled at the initial stage and after the continuous printing on 3,500 sheets. Fog density (%) was calculated from a difference between the whiteness at white background areas of printed images and the whiteness of a transfer paper. The whiteness was measured with "Reflectometer" (manufactured by Tokyo Denshoku K.K.). The results of evaluation are shown in Table 11. In Table 11, letter symbols on this item indicate the following evaluation.

A: Very good; fog which is commonly not recognizable to the naked eye (less than 1.5%).

B: Good; fog which is not recognizable unless searched for carefully (1.5% to less than 2.5%).

C: Average; fog which is recognizable with ease but at a tolerable level (2.5% to less than 4.0%).

D: Poor; fog which is recognized as an image stain (4.0% or more).

(c) Ghost:

A latent image in which solid white areas and solid black areas adjoin one another was developed and thereafter a halftone latent image was developed. The light-and-shade difference caused at the boundaries between solid white areas and solid black areas appearing on the developed halftone image was visually observed to make evaluation according to the following criteria.

A: Any light-and-shade difference is not seen at all.

B: Slight light-and-shade difference is seen.

C: Light-and-shade difference is a little seen, but tolerable in practical use.

D: Light-and-shade difference is conspicuously seen.

(d) Transfer Performance:

Transfer performance was evaluated at the initial stage and after the continuous printing on 3,500 sheets. To evaluate the transfer performance, transfer residual toner particles left on the photosensitive member when a solid black image was formed were taken off with Myler tape by taping. The Myler tape with the toner particles thus taken off was stuck on white paper. From the Macbeth density measured thereon, the Macbeth density measured on Myler tape alone (without toner) stuck on white paper was subtracted to obtain numerical values on which the evaluation was made. The results of evaluation are shown in Table 11. In Table 11, letter symbols on this item indicate the following evaluation.

A: Very good (less than 0.05).

B: Good (0.05 to less than 0.10).

C: Average (0.10 to less than 0.20).

D: Poor (0.20 or more).

(e) Charging Performance on Photosensitive Member:

The photosensitive member was charged as usual after the printing on about 40 to 50 sheets and after the continuous printing on 3,500 sheets, where the surface potential of the photosensitive member was measured disposing a sensor at the position of the developing assembly. The charging performance on the photosensitive member was evaluated on the difference in potential between both occasions. The results of evaluation are shown in Table 11. It indicates that, the larger the difference is toward the minus values, the more greatly the charging performance of the photosensitive member decreases.

(f) Pattern Faulty Recovery (Pattern Ghost):

(Due to Faulty Collection of Transfer Residual Toner Particles)

A vertical-line identical pattern (repeated vertical lines of 2 dots and 98 spaces) was continuously printed, and thereafter a halftone image print test was made to visually evaluate whether or not any light and shade (ghost) corresponding to the pattern of vertical lines appeared. The results of evaluation are shown in Table 11. In Table 11, letter symbols on this item indicate the following evaluation.

A: Very good; any light and shade do not appear.

B: Good; light and shade is seen to have slightly appeared.

C: Average; light and shade slightly appear, but within the range of a level tolerable in practical use.

D: Poor; light and shade appear conspicuously.

(g) Image Stain:

To evaluate image stain, images after fixing were visually observed to make an evaluation according to the following evaluation criteria. The results of evaluation are shown in Table 11.

A: Any image stains do not occur.

B: Image stains occur slightly, but affect images only very slightly.

C: Image stains occur to a certain extent, but at a level tolerable in practical use.

D: Image stains occur greatly.

The above results are shown in Table 11 as evaluation on Example L-1.

Examples L-2 to 60 and 85 to 108

In combination of the developers with the developer-carrying members as shown in Tables 9 and 10, an evaluation was made in the same manner as in Example L-1. The results are shown in Tables 11 to 15.

Examples L-61 to 72

In combination of the developers with the developer-carrying members as shown in Table 10, an evaluation was made in the same manner as in Example L-1. The results are shown in Table 13. In these Examples, the fog little greatly occurred from the beginning (initial stage), and the pattern ghost was a little seen. The charging performance on the photosensitive member after the continuous printing on 3,500 sheets also little greatly lowered, but within a range tolerable in practical use.

Examples L-73 to 84

In combination of the developers with the developer-carrying members as shown in Table 10, an evaluation was made in the same manner as in Example L-1. The results are shown in Table 14. In these Examples, the image density was a little low from the beginning (initial stage), and also the pattern ghost was seen to occur, but within the range tolerable in practical use.

Comparative Example L-0

An evaluation was made in combination of the developer Rs-0, in which any conductive fine particles were externally added, with the developer-carrying member Dp-l-1. As a result, as shown in Table 11, the charging performance on the photosensitive member lowered greatly and the fog occurred greatly.

Comparative Examples L-1 to 9 and 22

Developer-carrying members composed of an aluminum cylinder 16 mm in diameter, having been blasted with #80 amorphous alumina particles to have an Ra of 0.32, were used. In the combination with the developers as shown in Tables 9 and 10, an evaluation was made in the same manner as in Example L-1. The results are shown in Tables 11 to 15. Image density was low.

Comparative Examples L-10 to 21

In combination of the developers with the developer-carrying members as shown in Table 10, an evaluation was made in the same manner as in Example L-1. The results are shown in Table 15. The conductive fine particles on the toner particle surfaces tended to fall off, and thereby the charging performance of the photosensitive member was greatly lowered. Fog and image stain were also conspicuous.

Examples N-1 to 60 and 85 to 108

In combination of the developers with the developer-carrying members as shown in Tables 16 and 17, an evaluation was made in the same manner as in Example L-1. The results are shown in Tables 18 to 21.

Examples N-61 to 72

In combination of the developers with the developer-carrying members as shown in Table 17, an evaluation was made in the same manner as in Example L-1. The results are shown in Table 20. In these Examples, the fog little greatly occurred from the beginning (initial stage), and the pattern ghost was little seen. The charging performance of the photosensitive member after the continuous printing on 3,500 sheets also little greatly lowered, but within a range tolerable in practical use.

Examples N-73 to 84

In combination of the developers with the developer-carrying members as shown in Table 17, an evaluation was made in the same manner as in Example L-1. The results are shown in Table 21. In these Examples, the image density was a little low from the beginning (initial stage), and also the pattern ghost was seen to occur, but within a range tolerable in practical use.

Comparative Example N-0

An evaluation was made in combination of the developer Rp-0, in which any conductive fine particles were externally added, with the developer-carrying member Dp-n-1. As a result, as shown in Table 18, the charging performance on the photosensitive member lowered greatly and the fog occurred greatly.

Comparative Examples N-1 to 9 and 22

The same aluminum blast developer-carrying members as those in Comparative Examples L-1 to L-9 and L-22, were used. In the combination with the developers as shown in Tables 16 and 17, an evaluation was made in the same manner as in Example L-1. The results are shown in Tables 18 to 22. Image density was low.

Comparative Examples N-10 to 21

In combination of the developers with the developer-carrying members as shown in Table 17, an evaluation was made in the same manner as in Example L-1. The results are shown in Table 22. The conductive fine particles on the toner particle surfaces tended to fall off, and thereby the charging performance of the photosensitive member was greatly lowered. Fog and image stain were also conspicuous.

As having been described above, according to the present invention, the developer has been obtained which can establish the cleaning-at-development, image-forming method promising superior collection performance on transfer residual toner particles, in particular, the cleaning-at-development, image-forming method promising superior collection performance of transfer residual toner particles even when the non-contact type development system is used, which has been hard to use up to now.

In the image-forming apparatus of the contact charging system, the transfer system and the toner recycling system, it has been made possible to provide the cleaning-at-development, image-forming apparatus which keeps the formation of latent images from being obstructed, promises superior collection performance of transfer residual toner particles, and can keep the pattern ghost from occurring.

A developer has also been obtained which can control the performance of feeding the conductive fine particles to the contact charging member and can make the latent-image-bearing member to be well charged, resisting any charging obstruction due to transfer residual toner particles adhering to or laced with the contact charging member. A process cartridge has also been made which can show good cleaning-at-development performance, can sharply reduce the quantity of waste toner, and is advantageous also for low cost and miniaturization.

A simple member may also be used as the contact charging member, and the ozoneless direct-injection charging can stably be maintained over a long period of time without regard to any contamination of the contact charging member by the transfer residual toner particles, and also the uniform charging performance of the latent-image-bearing member can be provided. Hence, the process cartridge is obtainable which can be free from any problems due to ozone products and any problems due to faulty charging, has simple construction and can enjoy low cost.

In addition, when the latent-image-bearing member is repeatedly used over a long period of time while making the conductive fine particles be interposed at the contact zone between the contact charging member and the latent-image-bearing member, scratches of its surface rarely occurs, and image defects can be kept from occurring on images.

According to the present invention, the uniform and rapid charge-imparting ability to the developer can be improved more than any developer-carrying members conventionally used, and running performance can also be more improved. Hence, it is possible to retain the state that good images can be formed for a long term.

Thus, according to the present invention, by virtue of the developer-carrying member that has high running performance and good charge-providing ability, and does not cause any wear or contamination by developer of the resin coat layer at the surface of the developer-carrying member as a result of repeated copying or printing, images having good a character line sharpness, a high image density and a high image quality level can be formed over a long period of time without causing any decrease in image density, any sleeve ghost and any serious fog even in different environments.

Moreover, according to the present invention, by virtue of the developer-carrying member that can stabilize negative-charge-providing properties to the developer over a long period of time even under different environmental conditions, also can cause uniform coating of developer, and does not cause any wear of the conductive resin coat layer at the developer-carrying member surface and any contamination of the sleeve by developer and melt adhesion of developer to the sleeve, high-grade images free of any decrease in image density, any occurrence of ghost, and any serious fog, can be formed over a long period of time.

TABLE 2

| Toner particles | Particle Size Distribution: Weight-av. particle diameter (μm) | Particle Size Distribution: 1.00 to <2.00 μm particles % by number | Circularity | Surface modification conditions: Peripheral speed (m/s) | Surface modification conditions: Modification time (min.) | Surface modification conditions: In-machine maximum temperature (° C.) |
|---|---|---|---|---|---|---|
| Ts-1 | 7.9 | 8.9 | 0.951 | | Untreated | |
| Ts-2 | 6.8 | 15.7 | 0.954 | | Untreated | |
| Ts-3 | 6.5 | 3.0 | 0.965 | 80 | 3 | 62 |
| Ts-4 | 6.9 | 3.2 | 0.991 | | 300° C. hot-air treated | |
| Tp-1 | 8.1 | 9.2 | 0.948 | | Untreated | |
| Tp-2 | 7.0 | 16.1 | 0.951 | | Untreated | |
| Tp-3 | 6.7 | 3.3 | 0.960 | 80 | 3 | 62 |
| Tp-4 | 7.2 | 3.4 | 0.983 | | 300° C. hot-air treated | |

TABLE 3

| Inorganic fine powder | Material | Primary particle diameter (nm) | BET ($m^2/g$) | Treatment |
|---|---|---|---|---|
| I-1 | Dry-process Silica | 12 | 120 | After treatment with HMD, treated with silicone oil |
| I-2 | Dry-process Silica | 16 | 170 | Treated with HMD |

HMD: hexamethyldisilazane

TABLE 4

| Conductive fine particles | Material | Volume-average particle diameter (μm) | Volume resistivity (Ω · cm) |
|---|---|---|---|
| C-1 | Zinc oxide | 0.07 | $1.2 \times 10^3$ |
| C-2 | Zinc oxide | 1.52 | $8.9 \times 10^3$ |
| C-3 | Zinc oxide | 2.03 | $2.7 \times 10^4$ |
| C-4 | Tin oxide | 0.50 | $7.3 \times 10^4$ |
| C-5 | Tin oxide | 1.15 | $1.2 \times 10^5$ |
| C-6 | Tin oxide | 5.22 | $1.8 \times 10^7$ |
| C-7 | Conductive-treated Titanium oxide | 0.32 | $3.1 \times 10^2$ |

TABLE 5

| Developer Production Example | Toner particles | Inorganic Fine powder | Conductive Fine particles | Developer Weight-av. Particle Diameter (μm) | Particle size Distribution: 1.00 to <2.00 μm particles % by number | Particle size Distribution: 3.00 to <8.96 μm particles % by number |
|---|---|---|---|---|---|---|
| Rs-0 | Ts-1 | I-1 | | 7.6 | 24.5 | 45.2 |
| Rs-1 | Ts-1 | I-1 | C-4 | 7.2 | 22.0 | 42.0 |
| Rs-2 | Ts-1 | I-1 | C-5 | 7.7 | 28.9 | 39.8 |
| Rs-3 | Ts-1 | I-1 | C-2 | 7.8 | 31.0 | 37.7 |
| Rs-4 | Ts-1 | I-1 | C-3 | 7.9 | 17.2 | 40.1 |
| Rs-5 | Ts-1 | I-1 | C-7 | 6.9 | 16.5 | 29.7 |
| Rs-6 | Ts-1 | I-1 | C-6 | 8.2 | 15.9 | 55.2 |
| Rs-7 | Ts-1 | I-1 | C-1 | 6.7 | 15.5 | 29.2 |
| Rs-8 | Ts-2 | I-1 | C-4 | 7.0 | 36.5 | 46.5 |

TABLE 5-continued

| Developer Production Example | Toner particles | Inorganic Fine powder | Conductive Fine particles | Developer Weight-av. Particle Diameter (μm) | Particle size Distribution 1.00 to <2.00 μm particles % by number | Particle size Distribution 3.00 to <8.96 μm particles % by number |
|---|---|---|---|---|---|---|
| Rs-9 | Ts-3 | I-1 | C-4 | 6.9 | 25.2 | 51.2 |
| Rs-10 | Ts-4 | I-1 | C-4 | 7.0 | 32.5 | 41.2 |
| Rp-0 | Tp-1 | I-2 | | 7.9 | 23.4 | 47.2 |
| Rp-1 | Tp-1 | I-2 | C-4 | 7.6 | 20.9 | 44.1 |
| Rp-2 | Tp-1 | I-2 | C-5 | 8.1 | 27.5 | 41.8 |
| Rp-3 | Tp-1 | I-2 | C-2 | 8.2 | 29.5 | 39.6 |
| Rp-4 | Tp-1 | I-2 | C-3 | 8.3 | 16.3 | 42.1 |
| Rp-5 | Tp-1 | I-2 | C-7 | 7.2 | 15.9 | 31.2 |
| Rp-6 | Tp-1 | I-2 | C-6 | 8.6 | 15.3 | 58.0 |
| Rp-7 | Tp-1 | I-2 | C-1 | 7.0 | 15.1 | 30.7 |
| Rp-8 | Tp-2 | I-2 | C-4 | 7.4 | 34.7 | 48.8 |
| Rp-9 | Tp-3 | I-2 | C-4 | 7.2 | 23.9 | 53.8 |
| Rp-10 | Tp-4 | I-2 | C-4 | 7.4 | 30.9 | 43.3 |

TABLE 6

| Developer-carrying member | Nitrogen-containing hetero-cyclic compound (CA) | Spherical particles (R) Material | Spherical particles (R) Number-av. particle diameter (μm) | C/GF/B/CA/R ratio | Volume Resistivity (Ω · cm) | Ra (μm) |
|---|---|---|---|---|---|---|
| Dp-1-1 | B-1 | Carbon particles | 7.2 | 0.2/0.8/2/0.15/0.1 | 3.52 | 1.21 |
| Dp-1-2 | B-2 | | | | 4.62 | 1.18 |
| Dp-1-3 | B-3 | | | | 5.72 | 1.11 |
| Dp-1-4 | B-4 | | | | 7.23 | 1.26 |
| Dp-n-1 | B-1 | Carbon particles | 3.7 | 0.2/0.8/3/0.2/0.1 | 9.22 | 0.87 |
| Dp-n-2 | B-2 | | | | 10.50 | 0.80 |
| Dp-n-3 | B-3 | | | | 11.20 | 0.76 |
| Dp-n-4 | B-4 | | | | 13.50 | 0.92 |

TABLE 7

| Developer-carrying member | Copolymer (D) | Monomer 1 | Monomer 2 | Proportion | Mw | Mn | Mw/Mn | Spherical particles (R) Material | Number-av. Particle Diameter (μm) | C/GF/B/CA/R Ratio | Volume Resistivity (Ω · cm) | Ra (μm) |
|---|---|---|---|---|---|---|---|---|---|---|---|---|
| Dm-1-1 | P-1 | MMA | DM | 90:10 | 10,200 | 4,500 | 2.3 | Carbon particles | 11.7 | 0.2/0.8/1.6/0.4/0.3 | 5.03 | 1.27 |
| Dm-1-2 | P-2 | | | ↑ | 40,000 | 19,000 | 2.1 | | | | 5.89 | 1.33 |
| Dm-1-3 | P-3 | | | ↑ | 3,700 | 2,300 | 1.6 | | | | 6.55 | 1.37 |
| Dm-1-4 | P-4 | | | 70:30 | 8,500 | 2,900 | 2.9 | | | | 7.20 | 1.41 |
| Dm-n-1 | P-1 | MMA | DM | 90:10 | 10,200 | 4,500 | 2.3 | Carbon particles | 7.2 | 0.2/0.8/2.3/0.7/0.3 | 11.20 | 0.89 |
| Dm-n-2 | P-2 | | | ↑ | 40,000 | 19,000 | 2.1 | | | | 12.30 | 0.94 |
| Dm-n-3 | P-3 | | | ↑ | 3,700 | 2,300 | 1.6 | | | | 12.50 | 0.91 |
| Dm-n-4 | P-4 | | | 70:30 | 8,500 | 2,900 | 2.9 | | | | 13.10 | 1.01 |

MMA: Methyl methacrylate monomer
DM: Dimethylaminoethyl methacrylate monomer

TABLE 8

| Developer-carrying member | Charge control resin (CA) Styrene-acrylic monomer* | 2-Acrylamide-2-methylpropanesulfonic acid | Polymerization initiator** | Mw | Spherical particles (R) Material | Number-av. particle diameter (μm) | Binder resin (B) | Catalyst used in producing phenolic Resin | C/GF/B/CA/R ratio | Volume resistivity (Ω · cm) | Ra (μm) |
|---|---|---|---|---|---|---|---|---|---|---|---|
| Df-1-1 | F-1 93 wt. % | 7 wt. % | 1 wt. % | 10,000 | Carbon particles | 11.7 | Phenol | Ammonia | 0.2/0.8/ | 2.13 | 1.07 |
| Df-1-2 | | | | | | | | Hexamethylene-tetramine | 1.7/ 0.3/0.2 | 2.76 | 1.15 |
| Df-1-3 | F-2 82 wt. % | 18 wt. % | 3 wt. % | 3,000 | | | Polyamide | — | | 3.14 | 1.19 |
| Df-1-4 | F-3 96 wt. % | 4 wt. % | 0.3 wt. % | 40,000 | | | polyurethane | — | | 3.57 | 1.24 |
| Df-n-1 | F-1 93 wt. % | 7 wt. % | 1 wt. % | 10,000 | Carbon | 7.2 | Phenol | Ammonia | 0.2/0.8/ | 8.23 | 0.78 |
| Df-n-2 | | | | | particles | | | Hexamethylene-tetramine | 2.5/ 0.5/0.2 | 8.55 | 0.81 |
| Df-n-3 | F-2 82 wt. % | 18 wt. % | 3 wt. % | 3,000 | | | Polyamide | — | | 8.96 | 0.85 |
| Df-n-4 | F-3 96 wt. % | 4 wt. % | 0.3 wt. % | 40,000 | | | polyurethane | — | | 9.27 | 0.88 |

*Styrene monomer: styrene
Acrylic monomer: 2-ethylhexyl acrylate
**Lauroyl peroxide

TABLE 9

| | Developer | Developer-carrying member |
|---|---|---|
| Example L-1 | Rs-1 | Dp-1-1 |
| Example L-2 | | Dp-1-2 |
| Example L-3 | | Dp-1-3 |
| Example L-4 | | Dp-1-4 |
| Example L-5 | | Dm-1-1 |
| Example L-6 | | Dm-1-2 |
| Example L-7 | | Dm-1-3 |
| Example L-8 | | Dm-1-4 |
| Example L-9 | | Df-1-1 |
| Example L-10 | | Df-1-2 |
| Example L-11 | | Df-1-3 |
| Example L-12 | | Df-1-4 |
| Comp. Example L-0 | Rs-0 | Dp-1-1 |
| Comp. Example L-1 | Rs-1 | Al blasting |
| Example L-13 | Rs-2 | Dp-1-1 |
| Example L-14 | | Dp-1-2 |
| Example L-15 | | Dp-1-3 |
| Example L-16 | | Dp-1-4 |
| Example L-17 | | Dm-1-1 |
| Example L-18 | | Dm-1-2 |
| Example L-19 | | Dm-1-3 |
| Example L-20 | | Dm-1-4 |
| Example L-21 | | Df-1-1 |
| Example L-22 | | Df-1-2 |
| Example L-23 | | Df-1-3 |
| Example L-24 | | Df-1-4 |
| Comp. Example L-2 | | Al blasting |
| Example L-25 | Rs-3 | Dp-1-1 |
| Example L-26 | | Dp-1-2 |
| Example L-27 | | Dp-1-3 |
| Example L-28 | | Dp-1-4 |
| Example L-29 | | Dm-1-1 |
| Example L-30 | | Dm-1-2 |
| Example L-31 | | Dm-1-3 |
| Example L-32 | | Dm-1-4 |
| Example L-33 | | Df-1-1 |
| Example L-34 | | Df-1-2 |
| Example L-35 | | Df-1-3 |
| Example L-36 | | Df-1-4 |
| Comp. Example L-3 | | Al blasting |

TABLE 9-continued

| | Developer | Developer-carrying member |
|---|---|---|
| Example L-37 | Rs-4 | Dp-1-1 |
| Example L-38 | | Dp-1-2 |
| Example L-39 | | Dp-1-3 |
| Example L-40 | | Dp-1-4 |
| Example L-41 | | Dm-1-1 |
| Example L-42 | | Dm-1-2 |
| Example L-43 | | Dm-1-3 |
| Example L-44 | | Dm-1-4 |
| Example L-45 | | Df-1-1 |
| Example L-46 | | Df-1-2 |
| Example L-47 | | Df-1-3 |
| Example L-48 | | Df-1-4 |
| Comp. Example L-4 | | Al blasting |
| Example L-49 | Rs-5 | Dp-1-1 |
| Example L-50 | | Dp-1-2 |
| Example L-51 | | Dp-1-3 |
| Example L-52 | | Dp-1-4 |
| Example L-53 | | Dm-1-1 |
| Example L-54 | | Dm-1-2 |
| Example L-55 | | Dm-1-3 |
| Example L-56 | | Dm-1-4 |
| Example L-57 | | Df-1-1 |
| Example L-58 | | Df-1-2 |
| Example L-59 | | Df-1-3 |
| Example L-60 | | Df-1-4 |
| Comp. Example L-5 | | Al blasting |

TABLE 10

| | Developer | Developer-carrying member |
|---|---|---|
| Example L-61 | Rs-6 | Dp-1-1 |
| Example L-62 | | Dp-1-2 |
| Example L-63 | | Dp-1-3 |
| Example L-64 | | Dp-1-4 |
| Example L-65 | | Dm-1-1 |
| Example L-66 | | Dm-1-2 |
| Example L-67 | | Dm-1-3 |
| Example L-68 | | Dm-1-4 |
| Example L-69 | | Df-1-1 |
| Example L-70 | | Df-1-2 |
| Example L-71 | | Df-1-3 |
| Example L-72 | | Df-1-4 |
| Comp. Example L-6 | | Al blasting |
| Example L-73 | Rs-7 | Dp-1-1 |
| Example L-74 | | Dp-1-2 |
| Example L-75 | | Dp-1-3 |
| Example L-76 | | Dp-1-4 |
| Example L-77 | | Dm-1-1 |
| Example L-78 | | Dm-1-2 |
| Example L-79 | | Dm-1-3 |
| Example L-80 | | Dm-1-4 |
| Example L-81 | | Df-1-1 |
| Example L-82 | | Df-1-2 |
| Example L-83 | | Df-1-3 |
| Example L-84 | | Df-1-4 |
| Comp. Example L-7 | | Al blasting |
| Example L-85 | Rs-8 | Dp-1-1 |
| Example L-86 | | Dp-1-2 |
| Example L-87 | | Dp-1-3 |
| Example L-88 | | Dp-1-4 |
| Example L-89 | | Dm-1-1 |
| Example L-90 | | Dm-1-2 |
| Example L-91 | | Dm-1-3 |
| Example L-92 | | Dm-1-4 |
| Example L-93 | | Df-1-1 |
| Example L-94 | | Df-1-2 |
| Example L-95 | | Df-1-3 |
| Example L-96 | | Df-1-4 |
| Comp. Example L-8 | | Al blasting |

TABLE 10-continued

| | Developer | Developer-carrying member |
|---|---|---|
| Example L-97 | Rs-9 | Dp-1-1 |
| Example L-98 | | Dp-1-2 |
| Example L-99 | | Dp-1-3 |
| Example L-100 | | Dp-1-4 |
| Example L-101 | | Dm-1-1 |
| Example L-102 | | Dm-1-2 |
| Example L-103 | | Dm-1-3 |
| Example L-104 | | Dm-1-4 |
| Example L-105 | | Df-1-1 |
| Example L-106 | | Df-1-2 |
| Example L-107 | | Df-1-3 |
| Example L-108 | | Df-1-4 |
| Comp. Example L-9 | | Al blasting |
| Comp. Example L-10 | Rs-10 | Dp-1-1 |
| Comp. Example L-11 | | Dp-1-2 |
| Comp. Example L-12 | | Dp-1-3 |
| Comp. Example L-13 | | Dp-1-4 |
| Comp. Example L-14 | | Dm-1-1 |
| Comp. Example L-15 | | Dm-1-2 |
| Comp. Example L-16 | | Dm-1-3 |
| Comp. Example L-17 | | Dm-1-4 |
| Comp. Example L-18 | | Df-1-1 |
| Comp. Example L-19 | | Df-1-2 |
| Comp. Example L-20 | | Df-1-3 |
| Comp. Example L-21 | | Df-1-4 |
| Comp. Example L-22 | | Al blasting |

TABLE 11

| | | | Image density | | Fog | | Sleeve ghost | | Transfer efficiency | | Charging performance Δ V | Faulty pattern recovery | Image stain |
|---|---|---|---|---|---|---|---|---|---|---|---|---|---|
| | Developer | Developer-carrying member | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-1 | Rs-1 | Dp-1-1 | A | A | A | A | A | A | B | B | −10 | A | B |
| Example L-2 | | Dp-1-2 | B | A | A | A | A | A | B | B | −10 | A | B |
| Example L-3 | | Dp-1-3 | B | A | A | A | A | A | B | B | −20 | A | B |
| Example L-4 | | Dp-1-4 | A | A | A | A | A | A | B | B | −10 | A | B |
| Example L-5 | | Dm-1-1 | A | A | A | A | A | A | B | B | −20 | A | B |
| Example L-6 | | Dm-1-2 | A | A | A | A | A | A | B | B | −20 | A | B |
| Example L-7 | | Dm-1-3 | A | A | A | A | A | A | B | B | −10 | A | B |
| Example L-8 | | Dm-1-4 | A | A | A | A | A | A | B | B | −10 | A | B |
| Example L-9 | | Df-1-1 | A | A | A | A | A | A | B | B | −20 | A | B |
| Example L-10 | | Df-1-2 | A | A | A | A | A | A | B | B | −20 | A | B |
| Example L-11 | | Df-1-3 | A | A | A | A | A | A | B | B | −10 | A | B |
| Example L-12 | | Df-1-4 | A | A | A | A | A | A | B | B | −20 | A | B |
| Comparative Example L-0 | Rs-0 | Dp-1-1 | A | C | A | D | B | C | B | C | −130 | C | D |
| Comparative Example L-1 | Rs-1 | A1 blasting | B | D | B | D | C | D | B | C | −30 | C | C |
| Example L-13 | Rs-2 | Dp-1-1 | A | A | A | A | A | A | B | B | −20 | A | B |
| Example L-14 | | Dp-1-2 | B | A | A | A | A | A | B | B | −10 | A | B |
| Example L-15 | | Dp-l-3 | B | A | A | A | A | A | B | B | −10 | A | B |
| Example L-16 | | Dp-1-4 | A | A | A | A | A | A | B | B | −20 | A | B |
| Example L-17 | | Dm-1-1 | A | A | A | A | A | A | B | B | −20 | A | B |
| Example L-18 | | Dm-1-2 | A | A | A | A | A | A | B | B | −10 | A | B |
| Example L-19 | | Dm-1-3 | A | A | A | A | A | A | B | B | −10 | A | B |
| Example L-20 | | Dm-1-4 | A | A | A | A | A | A | B | B | −10 | A | B |

TABLE 11-continued

| | Developer | Developer-carrying member | Image density | | Fog | | Sleeve ghost | | Transfer efficiency | | Charging performance Δ V | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-21 | | Df-1-1 | A | A | A | A | A | A | B | B | −20 | A | B |
| Example L-22 | | Df-1-2 | A | A | A | A | A | A | B | B | −10 | A | B |
| Example L-23 | | Df-1-3 | A | A | A | A | A | A | B | B | −10 | A | B |
| Example L-24 | | Df-1-4 | A | A | A | A | A | A | B | B | −10 | A | B |
| Comparative Example L-2 | | A1 blasting | B | D | B | D | C | D | B | C | −30 | C | C |

TABLE 12

| | Developer | Developer-carrying member | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-25 | Rs-3 | Dp-1-1 | A | A | A | A | A | A | B | B | −20 | A | B |
| Example L-26 | | Dp-1-2 | B | A | A | A | A | A | B | B | −10 | A | B |
| Example L-27 | | Dp-1-3 | B | A | A | A | A | A | B | B | −10 | A | B |
| Example L-28 | | Dp-1-4 | A | A | A | A | A | A | B | B | −10 | A | B |
| Example L-29 | | Dm-1-1 | A | A | A | A | A | A | B | B | −20 | A | B |
| Example L-30 | | Dm-1-2 | A | A | A | A | A | A | B | B | −20 | A | B |
| Example L-31 | | Dm-1-3 | A | A | A | A | A | A | B | B | −10 | A | B |
| Example L-32 | | Dm-1-4 | A | A | A | A | A | A | B | B | −10 | A | B |
| Example L-33 | | Df-1-1 | A | A | A | A | A | A | B | B | −10 | A | B |
| Example L-34 | | Df-1-2 | A | A | A | A | A | A | B | B | −10 | A | B |
| Example L-35 | | Df-1-3 | A | A | A | A | A | A | B | B | −20 | A | B |
| Example L-36 | | Df-1-4 | A | A | A | A | A | A | B | B | −20 | A | B |
| Comparative Example L-3 | | A1 blasting | B | D | B | D | C | D | B | C | −30 | C | C |
| Example L-37 | Rs-4 | Dp-1-1 | A | A | A | A | A | A | B | B | −10 | A | B |
| Example L-38 | | Dp-1-2 | B | A | A | A | A | A | B | B | −10 | A | B |
| Example L-39 | | Dp-1-3 | B | A | A | A | A | A | B | B | −10 | A | B |
| Example L-40 | | Dp-1-4 | A | A | A | A | A | A | B | B | −20 | A | B |
| Example L-41 | | Dm-1-1 | A | A | A | A | A | A | B | B | −10 | A | B |
| Example L-42 | | Dm-1-2 | A | A | A | A | A | A | B | B | −10 | A | B |
| Example L-43 | | Dm-1-3 | A | A | A | A | A | A | B | B | −10 | A | B |
| Example L-44 | | Dm-1-4 | A | A | A | A | A | A | B | B | −20 | A | B |
| Example L-45 | | Df-1-1 | A | A | A | A | A | A | B | B | −20 | A | B |
| Example L-46 | | Df-1-2 | A | A | A | A | A | A | B | B | −10 | A | B |
| Example L-47 | | Df-1-3 | A | A | A | A | A | A | B | B | −10 | A | B |
| Example L-48 | | Df-1-4 | A | A | A | A | A | A | B | B | −10 | A | B |
| Comparative Example L-4 | | A1 blasting | B | D | B | D | C | D | B | C | −30 | C | C |

TABLE 13

| | Developer | Developer-carrying member | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-49 | Rs-5 | Dp-1-1 | A | A | A | A | A | A | B | B | −20 | A | B |
| Example L-50 | | Dp-1-2 | B | A | A | A | A | A | B | B | −20 | A | B |
| Example L-51 | | Dp-1-3 | B | A | A | A | A | A | B | B | −20 | A | B |
| Example L-52 | | Dp-1-4 | A | A | A | A | A | A | B | B | −20 | A | B |
| Example L-53 | | Dm-1-1 | A | A | A | A | A | A | B | B | −20 | A | B |
| Example L-54 | | Dm-1-2 | A | A | A | A | A | A | B | B | −20 | A | B |
| Example L-55 | | Dm-1-3 | A | A | A | A | A | A | B | B | −20 | A | B |
| Example L-56 | | Dm-1-4 | A | A | A | A | A | A | B | B | −20 | A | B |
| Example L-57 | | Df-1-1 | A | A | A | A | A | A | B | B | −20 | A | B |
| Example L-58 | | Df-1-2 | A | A | A | A | A | A | B | B | −20 | A | B |

TABLE 13-continued

| | Developer | Developer-carrying member | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-59 | | Df-1-3 | A | A | A | A | A | A | B | B | −20 | A | B |
| Example L-60 | | Df-1-4 | A | A | A | A | A | A | B | B | −20 | A | B |
| Comparative Example L-5 | | A1 blasting | B | D | B | D | C | D | B | C | −40 | C | C |
| Example L-61 | Rs-6 | Dp-1-1 | A | B | B | C | A | A | B | B | −30 | B | B |
| Example L-62 | | Dp-1-2 | B | B | B | C | A | A | B | B | −50 | B | B |
| Example L-63 | | Dp-1-3 | B | B | B | C | A | A | B | B | −40 | B | B |
| Example L-64 | | Dp-1-4 | A | B | B | C | A | A | B | B | −30 | B | B |
| Example L-65 | | Dm-1-1 | A | B | B | C | A | A | B | B | −40 | B | B |
| Example L-66 | | Dm-1-2 | A | B | B | C | A | A | B | B | −50 | B | B |
| Example L-67 | | Dm-1-3 | A | B | B | C | A | A | B | B | −30 | B | B |
| Example L-68 | | Dm-1-4 | A | B | B | C | A | A | B | B | −30 | B | B |
| Example L-69 | | Df-1-1 | A | B | B | C | A | A | B | B | −40 | B | B |
| Example L-70 | | Df-1-2 | A | B | B | C | A | A | B | B | −40 | B | B |
| Example L-71 | | Df-1-3 | A | B | B | C | A | A | B | B | −50 | B | B |
| Example L-72 | | Df-1-4 | A | B | B | C | A | A | B | B | −40 | B | B |
| Comparative Example L-6 | | A1 blasting | B | D | C | D | C | D | B | B | −50 | C | C |

TABLE 14

| | Developer | Developer-carrying member | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-73 | Rs-7 | Dp-1-1 | B | C | A | B | A | A | B | B | −20 | B | B |
| Example L-74 | | Dp-1-2 | C | C | A | B | A | A | B | B | −30 | B | B |
| Example L-75 | | Dp-1-3 | C | C | A | B | A | A | B | B | −20 | B | B |
| Example L-76 | | Dp-1-4 | B | C | A | B | A | A | B | B | −10 | B | B |
| Example L-77 | | Dm-1-1 | B | C | A | B | A | A | B | B | −20 | B | B |
| Example L-78 | | Dm-1-2 | B | C | A | B | A | A | B | B | −30 | B | B |
| Example L-79 | | Dm-1-3 | B | C | A | B | A | A | B | B | −20 | B | B |
| Example L-80 | | Dm-1-4 | B | C | A | B | A | A | B | B | −30 | B | B |
| Example L-81 | | Df-1-1 | B | C | A | B | A | A | B | B | −30 | B | B |
| Example L-82 | | Df-1-2 | B | C | A | B | A | A | B | B | −20 | B | B |
| Example L-83 | | Df-1-3 | B | C | A | B | A | A | B | B | −20 | B | B |
| Example L-84 | | Df-1-4 | B | C | A | B | A | A | B | B | −20 | B | B |
| Comparative Example L-7 | | A1 blasting | C | D | B | D | C | D | B | B | −30 | C | C |
| Example L-85 | Rs-8 | Dp-1-1 | A | A | A | A | A | A | B | B | −10 | A | B |
| Example L-86 | | Dp-1-2 | B | A | A | A | A | A | B | B | 0 | A | B |
| Example L-87 | | Dp-1-3 | B | A | A | A | A | A | B | B | −10 | A | B |
| Example L-88 | | Dp-1-4 | A | A | A | A | A | A | B | B | −10 | A | B |
| Example L-89 | | Dm-1-1 | A | A | A | A | A | A | B | B | 0 | A | B |
| Example L-90 | | Dm-1-2 | A | A | A | A | A | A | B | B | −10 | A | B |
| Example L-91 | | Dm-1-3 | A | A | A | A | A | A | B | B | −10 | A | B |
| Example L-92 | | Dm-1-4 | A | A | A | A | A | A | B | B | 0 | A | B |
| Example L-93 | | Df-1-1 | A | A | A | A | A | A | B | B | −10 | A | B |
| Example L-94 | | Df-1-2 | A | A | A | A | A | A | B | B | 0 | A | B |
| Example L-95 | | Df-1-3 | A | A | A | A | A | A | B | B | −10 | A | B |
| Example L-96 | | Df-1-4 | A | A | A | A | A | A | B | B | −10 | A | B |
| Comparative Example L-8 | | A1 blasting | B | D | B | D | C | D | B | C | −30 | C | C |

TABLE 15

| | Developer | Developer-carrying member | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example L-97 | Rs-9 | Dp-1-1 | A | A | A | B | B | B | A | A | 0 | A | B |
| Example L-98 | | Dp-1-2 | B | A | A | B | B | B | A | A | 0 | A | B |
| Example L-99 | | Dp-1-3 | B | A | A | B | B | B | A | A | −10 | A | B |
| Example L-100 | | Dp-1-4 | A | A | A | B | B | B | A | A | −10 | A | B |
| Example L-101 | | Dm-1-1 | A | A | A | B | B | B | A | A | 0 | A | B |
| Example L-102 | | Dm-1-2 | A | A | A | B | B | B | A | A | −10 | A | B |
| Example L-103 | | Dm-1-3 | A | A | A | B | B | B | A | A | 0 | A | B |
| Example L-104 | | Dm-1-4 | A | A | A | B | B | B | A | A | 0 | A | B |
| Example L-105 | | Df-1-1 | A | A | A | B | B | B | A | A | −10 | A | B |
| Example L-106 | | Df-1-2 | A | A | A | B | B | B | A | A | 0 | A | B |
| Example L-107 | | Df-1-3 | A | A | A | B | B | B | A | A | −10 | A | B |
| Example L-108 | | Df-1-4 | A | A | A | B | B | B | A | A | 0 | A | B |
| Comparative Example L-9 | | A1 blasting | B | D | B | D | C | D | B | C | −30 | C | D |
| Comparative Example L-10 | Rs-10 | Dp-1-1 | A | B | C | D | C | C | A | B | −80 | D | D |
| Comparative Example L-11 | | Dp-1-2 | B | B | C | D | C | C | A | B | −70 | D | D |
| Comparative Example L-12 | | Dp-1-3 | B | B | C | D | C | C | A | B | −90 | D | D |
| Comparative Example L-13 | | Dp-1-4 | A | B | C | D | C | C | A | B | −100 | D | D |
| Comparative Example L-14 | | Dm-1-1 | A | B | C | D | C | C | A | B | −80 | D | D |
| Comparative Example L-15 | | Dm-1-2 | A | B | C | D | C | C | A | B | −90 | D | D |
| Comparative Example L-16 | | Dm-1-3 | A | B | C | D | C | C | A | B | −100 | D | D |
| Comparative Example L-17 | | Dm-1-4 | A | B | C | D | C | C | A | B | −110 | D | D |
| Comparative Example L-18 | | Df-1-1 | A | B | C | D | C | C | A | B | −120 | D | D |
| Comparative Example L-19 | | Df-1-2 | A | B | C | D | C | C | A | B | −100 | D | D |
| Comparative Example L-20 | | Df-1-3 | A | B | C | D | C | C | A | B | −90 | D | D |
| Comparative Example L-21 | | Df-1-4 | A | B | C | D | C | C | A | B | −80 | D | D |
| Comparative Example L-22 | | A1 blasting | B | C | C | D | D | D | B | C | −130 | D | D |

TABLE 16

| | Developer | Developer-carrying member |
|---|---|---|
| Example N-1 | Rp-1 | Dp-n-1 |
| Example N-2 | | Dp-n-2 |
| Example N-3 | | Dp-n-3 |
| Example N-4 | | Dp-n-4 |
| Example N-5 | | Dm-n-1 |
| Example N-6 | | Dm-n-2 |
| Example N-7 | | Dm-n-3 |
| Example N-8 | | Dm-n-4 |
| Example N-9 | | Df-n-1 |
| Example N-10 | | Df-n-2 |
| Example N-11 | | Df-n-3 |
| Example N-12 | | Df-n-4 |
| Comp. Example N-0 | Rp-0 | Dp-n-1 |
| Comp. Example N-1 | Rp-1 | Al blasting |
| Example N-13 | Rp-2 | Dp-n-1 |
| Example N-14 | | Dp-n-2 |
| Example N-15 | | Dp-n-3 |
| Example N-16 | | Dp-n-4 |
| Example N-17 | | Dm-n-1 |
| Example N-18 | | Dm-n-2 |
| Example N-19 | | Dm-n-3 |
| Example N-20 | | Dm-n-4 |

TABLE 16-continued

| | Developer | Developer-carrying member |
|---|---|---|
| Example N-21 | | Df-n-1 |
| Example N-22 | | Df-n-2 |
| Example N-23 | | Df-n-3 |
| Example N-24 | | Df-n-4 |
| Comp. Example N-2 | | Al blasting |
| Example N-25 | Rp-3 | Dp-n-1 |
| Example N-26 | | Dp-n-2 |
| Example N-27 | | Dp-n-3 |
| Example N-28 | | Dp-n-4 |
| Example N-29 | | Dm-n-1 |
| Example N-30 | | Dm-n-2 |
| Example N-31 | | Dm-n-3 |
| Example N-32 | | Dm-n-4 |
| Example N-33 | | Df-n-1 |
| Example N-34 | | Df-n-2 |
| Example N-35 | | Df-n-1 |
| Example N-36 | | Df-n-4 |
| Comp. Example N-3 | | Al blasting |
| Example N-37 | Rp-4 | Dp-n-1 |
| Example N-38 | | Dp-n-2 |
| Example N-39 | | Dp-n-3 |
| Example N-40 | | Dp-n-4 |

TABLE 16-continued

| | Developer | Developer-carrying member |
|---|---|---|
| Example N-41 | | Dm-n-1 |
| Example N-42 | | Dm-n-2 |
| Example N-43 | | Dm-n-3 |
| Example N-44 | | Dm-n-4 |
| Example N-45 | | Df-n-1 |
| Example N-46 | | Df-n-2 |
| Example N-47 | | Df-n-3 |
| Example N-48 | | Df-n-4 |
| Comp. Example N-4 | | Al blasting |
| Example N-49 | Rp-5 | Dp-n-1 |
| Example N-50 | | Dp-n-2 |
| Example N-51 | | Dp-n-3 |
| Example N-52 | | Dp-n-4 |
| Example N-53 | | Dm-n-1 |
| Example N-54 | | Dm-n-2 |
| Example N-55 | | Dm-n-3 |
| Example N-56 | | Dm-n-4 |
| Example N-57 | | Df-n-1 |
| Example N-58 | | Df-n-2 |
| Example N-59 | | Df-n-3 |
| Example N-60 | | Df-n-4 |
| Comp. Example N-5 | | Al blasting |

TABLE 17

| | Developer | Developer-carrying member |
|---|---|---|
| Example N-61 | Rp-6 | Dp-n-1 |
| Example N-62 | | Dp-n-2 |
| Example N-63 | | Dp-n-3 |
| Example N-64 | | Dp-n-4 |
| Example N-65 | | Dm-n-1 |
| Example N-66 | | Dm-n-2 |
| Example N-67 | | Dm-n-3 |
| Example N-68 | | Dm-n-4 |
| Example N-69 | | Df-n-1 |
| Example N-70 | | Df-n-2 |
| Example N-71 | | Df-n-3 |
| Example N-72 | | Df-n-4 |
| Comp. Example N-6 | | Al blasting |
| Example N-73 | Rp-7 | Dp-n-1 |
| Example N-74 | | Dp-n-2 |
| Example N-75 | | Dp-n-3 |
| Example N-76 | | Dp-n-4 |
| Example N-77 | | Dm-n-1 |
| Example N-78 | | Dm-n-2 |
| Example N-79 | | Dm-n-3 |
| Example N-80 | | Dm-n-4 |
| Example N-81 | | Df-n-1 |
| Example N-82 | | Df-n-2 |
| Example N-83 | | Df-n-3 |
| Example N-84 | | Df-n-4 |

TABLE 17-continued

| | Developer | Developer-carrying member |
|---|---|---|
| Comp. Example N-7 | | Al blasting |
| Example N-85 | Rp-8 | Dp-n-1 |
| Example N-86 | | Dp-n-2 |
| Example N-87 | | Dp-n-3 |
| Example N-88 | | Dp-n-4 |
| Example N-89 | | Dm-n-1 |
| Example N-90 | | Dm-n-2 |
| Example N-91 | | Dm-n-3 |
| Example N-92 | | Dm-n-4 |
| Example N-93 | | Df-n-1 |
| Example N-94 | | Df-n-2 |
| Example N-95 | | Df-n-3 |
| Example N-96 | | Df-n-4 |
| Comp. Example N-8 | | Al blasting |
| Example N-97 | Rp-9 | Dp-n-1 |
| Example N-98 | | Dp-n-2 |
| Example N-99 | | Dp-n-3 |
| Example N-100 | | Dp-n-4 |
| Example N-101 | | Dm-n-1 |
| Example N-102 | | Dm-n-2 |
| Example N-103 | | Dm-n-3 |
| Example N-104 | | Dm-n-4 |
| Example N-105 | | Df-n-1 |
| Example N-106 | | Df-n-2 |
| Example N-107 | | Df-n-3 |
| Example N-108 | | Df-n-4 |
| Comp. Example N-9 | | Al blasting |
| Comp. Example N-10 | Rp-10 | Dp-n-1 |
| Comp. Example N-11 | | Dp-n-2 |
| Comp. Example N-12 | | Dp-n-3 |
| Comp. Example N-13 | | Dp-n-4 |
| Comp. Example N-14 | | Dm-n-1 |
| Comp. Example N-15 | | Dm-n-2 |
| Comp. Example N-16 | | Dm-n-3 |
| Comp. Example N-17 | | Dm-n-4 |
| Comp. Example N-18 | | Df-n-1 |
| Comp. Example N-19 | | Df-n-2 |
| Comp. Example N-20 | | Df-n-3 |
| Comp. Example N-21 | | Df-n-4 |
| Comp. Example N-22 | | Al blasting |

TABLE 18

| | | | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | Developer | Developer-carrying member | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example N-1 | Rp-1 | Dp-n-1 | A | A | A | A | A | A | B | B | −20 | A | A |
| Example N-2 | | Dp-n-2 | B | A | A | A | A | A | B | B | −10 | A | A |
| Example N-3 | | Dp-n-3 | B | A | A | A | A | A | B | B | −20 | A | A |
| Example N-4 | | Dp-n-4 | A | A | A | A | A | A | B | B | −20 | A | A |
| Example N-5 | | Dm-n-1 | A | A | A | A | A | A | B | B | −10 | A | A |
| Example N-6 | | Dm-n-2 | A | A | A | A | A | A | B | B | −10 | A | A |
| Example N-7 | | Dm-n-3 | A | A | A | A | A | A | B | B | −10 | A | A |
| Example N-8 | | Dm-n-4 | A | A | A | A | A | A | B | B | −20 | A | A |
| Example N-9 | | Df-n-1 | A | A | A | A | A | A | B | B | −10 | A | A |

TABLE 18-continued

| | Developer | Developer-carrying member | Image density | | Fog | | Sleeve ghost | | Transfer Efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example N-10 | | Df-n-2 | A | A | A | A | A | A | B | B | −20 | A | A |
| Example N-11 | | Df-n-3 | A | A | A | A | A | A | B | B | −20 | A | A |
| Example N-12 | | Df-n-4 | A | A | A | A | A | A | B | B | −10 | A | A |
| Comparative Example N-0 | Rp-0 | Dp-n-1 | A | C | A | D | B | C | B | C | −130 | C | C |
| Comparative Example N-1 | Rp-1 | A1 blasting | B | D | B | D | C | D | B | C | −30 | C | C |
| Example N-13 | Rp-2 | Dp-n-1 | A | A | A | A | A | A | B | B | −10 | A | A |
| Example N-14 | | Dp-n-2 | B | A | A | A | A | A | B | B | −20 | A | A |
| Example N-15 | | Dp-n-3 | B | A | A | A | A | A | B | B | −20 | A | A |
| Example N-16 | | Dp-n-4 | A | A | A | A | A | A | B | B | −10 | A | A |
| Example N-17 | | Dm-n-1 | A | A | A | A | A | A | B | B | −10 | A | A |
| Example N-18 | | Dm-n-2 | A | A | A | A | A | A | B | B | −10 | A | A |
| Example N-19 | | Dm-n-3 | A | A | A | A | A | A | B | B | −10 | A | A |
| Example N-20 | | Dm-n-4 | A | A | A | A | A | A | B | B | −20 | A | A |
| Example N-21 | | Df-n-1 | A | A | A | A | A | A | B | B | −10 | A | A |
| Example N-22 | | Df-n-2 | A | A | A | A | A | A | B | B | −20 | A | A |
| Example N-23 | | Df-n-3 | A | A | A | A | A | A | B | B | −20 | A | A |
| Example N-24 | | Df-n-4 | A | A | A | A | A | A | B | B | −10 | A | A |
| Comparative Example N-2 | | A1 blasting | B | D | B | D | C | D | B | C | −30 | C | C |

TABLE 19

| | Developer | Developer-carrying member | Image density | | Fog | | Sleeve ghost | | Transfer efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example N-25 | Rp-3 | Dp-n-1 | A | A | A | A | A | A | B | B | −10 | A | A |
| Example N-26 | | Dp-n-2 | B | A | A | A | A | A | B | B | −20 | A | A |
| Example N-27 | | Dp-n-3 | B | A | A | A | A | A | B | B | −10 | A | A |
| Example N-28 | | Dp-n-4 | A | A | A | A | A | A | B | B | −20 | A | A |
| Example N-29 | | Dm-n-1 | A | A | A | A | A | A | B | B | −20 | A | A |
| Example N-30 | | Dm-n-2 | A | A | A | A | A | A | B | B | −10 | A | A |
| Example N-31 | | Dm-n-3 | A | A | A | A | A | A | B | B | −10 | A | A |
| Example N-32 | | Dm-n-4 | A | A | A | A | A | A | B | B | −10 | A | A |
| Example N-33 | | Df-n-1 | A | A | A | A | A | A | B | B | −10 | A | A |
| Example N-34 | | Df-n-2 | A | A | A | A | A | A | B | B | −10 | A | A |
| Example N-35 | | Df-n-3 | A | A | A | A | A | A | B | B | −20 | A | A |
| Example N-36 | | Df-n-4 | A | A | A | A | A | A | B | B | −20 | A | A |
| Comparative Example N-3 | | A1 blasting | B | D | B | D | C | D | B | C | −30 | C | C |
| Example N-37 | Rp-4 | Dp-n-1 | A | A | A | A | A | A | B | B | −10 | A | A |
| Example N-38 | | Dp-n-2 | B | A | A | A | A | A | B | B | −10 | A | A |
| Example N-39 | | Dp-n-3 | B | A | A | A | A | A | B | B | −10 | A | A |
| Example N-40 | | Dp-n-4 | A | A | A | A | A | A | B | B | −10 | A | A |
| Example N-41 | | Dm-n-1 | A | A | A | A | A | A | B | B | −20 | A | A |
| Example N-42 | | Dm-n-2 | A | A | A | A | A | A | B | B | −20 | A | A |
| Example N-43 | | Dm-n-3 | A | A | A | A | A | A | B | B | −10 | A | A |
| Example N-44 | | Dm-n-4 | A | A | A | A | A | A | B | B | −20 | A | A |
| Example N-45 | | Df-n-1 | A | A | A | A | A | A | B | B | −10 | A | A |
| Example N-46 | | Df-n-2 | A | A | A | A | A | A | B | B | −20 | A | A |
| Example N-47 | | Df-n-3 | A | A | A | A | A | A | B | B | −20 | A | A |
| Example N-48 | | Df-n-4 | A | A | A | A | A | A | B | B | −20 | A | A |
| Comparative Example N-4 | | A1 blasting | B | D | B | D | C | D | B | C | −30 | C | C |

TABLE 20

| | Developer | Developer-carrying member | Image density | | Fog | | Sleeve ghost | | Transfer efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example N-49 | Rp-5 | Dp-n-1 | A | A | A | A | A | A | B | B | −20 | A | A |
| Example N-50 | | Dp-n-2 | B | A | A | A | A | A | B | B | −20 | A | A |
| Example N-51 | | Dp-n-3 | B | A | A | A | A | A | B | B | −20 | A | A |
| Example N-52 | | Dp-n-4 | A | A | A | A | A | A | B | B | −20 | A | A |
| Example N-53 | | Dm-n-1 | A | A | A | A | A | A | B | B | −20 | A | A |
| Example N-54 | | Dm-n-2 | A | A | A | A | A | A | B | B | −20 | A | A |
| Example N-55 | | Dm-n-3 | A | A | A | A | A | A | B | B | −20 | A | A |
| Example N-56 | | Dm-n-4 | A | A | A | A | A | A | B | B | −10 | A | A |
| Example N-57 | | Df-n-1 | A | A | A | A | A | A | B | B | −20 | A | A |
| Example N-58 | | Df-n-2 | A | A | A | A | A | A | B | B | −20 | A | A |
| Example N-59 | | Df-n-3 | A | A | A | A | A | A | B | B | −20 | A | A |
| Example N-60 | | Df-n-4 | A | A | A | A | A | A | B | B | −10 | A | A |
| Comparative Example N-5 | | A1 blasting | B | D | B | D | C | D | B | C | −30 | C | C |
| Example N-61 | Rp-6 | Dp-n-1 | A | B | B | C | A | A | B | B | −40 | B | B |
| Example N-62 | | Dp-n-2 | B | B | B | C | A | A | B | B | −40 | B | B |
| Example N-63 | | Dp-n-3 | B | B | B | C | A | A | B | B | −50 | B | B |
| Example N-64 | | Dp-n-4 | A | B | B | C | A | A | B | B | −30 | B | B |
| Example N-65 | | Dm-n-1 | A | B | B | C | A | A | B | B | −50 | B | B |
| Example N-66 | | Dm-n-2 | A | B | B | C | A | A | B | B | −40 | B | B |
| Example N-67 | | Dm-n-3 | A | B | B | C | A | A | B | B | −50 | B | B |
| Example N-68 | | Dm-n-4 | A | B | B | C | A | A | B | B | −40 | B | B |
| Example N-69 | | Df-n-1 | A | B | B | C | A | A | B | B | −40 | B | B |
| Example N-70 | | Df-n-2 | A | B | B | C | A | A | B | B | −30 | B | B |
| Example N-71 | | Df-n-3 | A | B | B | C | A | A | B | B | −50 | B | B |
| Example N-72 | | Df-n-4 | A | B | B | C | A | A | B | B | −40 | B | B |
| Comparative Example N-6 | | A1 blasting | B | D | C | D | C | D | B | B | −60 | C | C |

TABLE 21

| | Developer | Developer-carrying member | Image density | | Fog | | Sleeve ghost | | Transfer efficiency | | Charging performance ΔV | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example N-73 | Rp-7 | Dp-n-1 | B | C | A | B | A | A | B | B | −10 | B | B |
| Example N-74 | | Dp-n-2 | C | C | A | B | A | A | B | B | −20 | B | B |
| Example N-75 | | Dp-n-3 | C | C | A | B | A | A | B | B | −20 | B | B |
| Example N-76 | | Dp-n-4 | B | C | A | B | A | A | B | B | −10 | B | B |
| Example N-77 | | Dm-n-1 | B | C | A | B | A | A | B | B | −20 | B | B |
| Example N-78 | | Dm-n-2 | B | C | A | B | A | A | B | B | −20 | B | B |
| Example N-79 | | Dm-n-3 | B | C | A | B | A | A | B | B | −10 | B | B |
| Example N-80 | | Dm-n-4 | B | C | A | B | A | A | B | B | −10 | B | B |
| Example N-81 | | Df-n-1 | B | C | A | B | A | A | B | B | −20 | B | B |
| Example N-82 | | Df-n-2 | B | C | A | B | A | A | B | B | −20 | B | B |
| Example N-83 | | Df-n-3 | B | C | A | B | A | A | B | B | −20 | B | B |
| Example N-84 | | Df-n-4 | B | C | A | B | A | A | B | B | −20 | B | B |
| Comparative Example N-7 | | A1 blasting | C | D | B | D | C | D | B | B | −40 | C | C |
| Example N-85 | Rp-8 | Dp-n-1 | A | A | A | A | A | A | B | B | −10 | A | A |
| Example N-86 | | Dp-n-2 | B | A | A | A | A | A | B | B | −20 | A | A |
| Example N-87 | | Dp-n-3 | B | A | A | A | A | A | B | B | −10 | A | A |
| Example N-88 | | Dp-n-4 | A | A | A | A | A | A | B | B | −10 | A | A |
| Example N-89 | | Dm-n-1 | A | A | A | A | A | A | B | B | −10 | A | A |
| Example N-90 | | Dm-n-2 | A | A | A | A | A | A | B | B | −20 | A | A |
| Example N-91 | | Dm-n-3 | A | A | A | A | A | A | B | B | −10 | A | A |
| Example N-92 | | Dm-n-4 | A | A | A | A | A | A | B | B | −10 | A | A |
| Example N-93 | | Df-n-1 | A | A | A | A | A | A | B | B | 0 | A | A |
| Example N-94 | | Df-n-2 | A | A | A | A | A | A | B | B | −10 | A | A |
| Example N-95 | | Df-n-3 | A | A | A | A | A | A | B | B | −10 | A | A |
| Example N-96 | | Df-n-4 | A | A | A | A | A | A | B | B | 0 | A | A |
| Comparative Example N-8 | | A1 blasting | B | D | B | D | C | D | B | C | −30 | C | C |

TABLE 22

| | Developer | Developer-carrying member | Image density | | Fog | | Sleeve ghost | | Transfer efficiency | | Charging performance Δ V | Faulty pattern recovery | Image stain |
|---|---|---|---|---|---|---|---|---|---|---|---|---|---|
| | | | Initial stage | After 3500 sheets | Initial stage | After 3500 sheets | Initial stage | After 3500 sheets | Initial stage | After 3500 sheets | After 3500 sheets | After 3500 sheets | After 3500 sheets |
| Example N-97 | Rp-9 | Dp-n-1 | A | A | A | A | B | B | A | A | 0 | A | A |
| Example N-98 | | Dp-n-2 | B | A | A | A | B | B | A | A | −10 | A | A |
| Example N-99 | | Dp-n-3 | B | A | A | A | B | B | A | A | −10 | A | A |
| Example N-100 | | Dp-n-4 | A | A | A | A | B | B | A | A | 0 | A | A |
| Example N-101 | | Dm-n-1 | A | A | A | A | B | B | A | A | −10 | A | A |
| Example N-102 | | Dm-n-2 | A | A | A | A | B | B | A | A | 0 | A | A |
| Example N-103 | | Dm-n-3 | A | A | A | A | B | B | A | A | −10 | A | A |
| Example N-104 | | Dm-n-4 | A | A | A | A | B | B | A | A | 0 | A | A |
| Example N-105 | | Df-n-1 | A | A | A | A | B | B | A | A | 0 | A | A |
| Example N-106 | | Df-n-2 | A | A | A | A | B | B | A | A | −10 | A | A |
| Example N-107 | | Df-n-3 | A | A | A | A | B | B | A | A | −10 | A | A |
| Example N-108 | | Df-n-4 | A | A | A | A | B | B | A | A | 0 | A | A |
| Comparative Example N-9 | | A1 blasting | B | D | B | D | C | D | B | C | −30 | C | C |
| Comparative Example N-10 | Rp-10 | Dp-n-1 | A | B | C | D | C | C | A | B | −90 | D | C |
| Comparative Example N-11 | | Dp-n-2 | B | B | C | D | C | C | A | B | −100 | D | C |
| Comparative Example N-12 | | Dp-n-3 | B | B | C | D | C | C | A | B | −80 | D | C |
| Comparative Example N-13 | | Dp-n-4 | A | B | C | D | C | C | A | B | −90 | D | C |
| Comparative Example N-14 | | Dm-n-1 | A | B | C | D | C | C | A | B | −110 | D | C |
| Comparative Example N-15 | | Dm-n-2 | A | B | C | D | C | C | A | B | −100 | D | C |
| Comparative Example N-16 | | Dm-n-3 | A | B | C | D | C | C | A | B | 90 | D | C |
| Comparative Example N-17 | | Dm-n-4 | A | B | C | D | C | C | A | B | −100 | D | C |
| Comparative Example N-18 | | Df-n-1 | A | B | C | D | C | C | A | B | −90 | D | C |
| Comparative Example N-19 | | Df-n-2 | A | B | C | D | C | C | A | B | −90 | D | C |
| Comparative Example N-20 | | Df-n-3 | A | B | C | D | C | C | A | B | −100 | D | C |
| Comparative Example N-21 | | Df-n-4 | A | B | C | D | C | C | A | B | −110 | D | C |
| Comparative Example N-22 | | A1 blasting | B | C | C | D | D | D | B | C | −140 | D | C |

What is claimed is:

1. A process cartridge comprising:

a latent-image-bearing member configured to hold thereon an electrostatic latent image;

charging means for charging said latent-image-bearing member electrostatically; and a developing assembly configured and positioned to develop the electrostatic latent image formed on said latent-image-bearing member, by the use of a developer to form a developer image, said developing assembly and said latent-image-bearing member being set to be integral as one unit and being so constructed as to be detachably mountable to a main body of an image forming apparatus, said developer comprising:

toner particles containing at least a binder resin and a colorant; and conductive fine particles, said toner particles having a Circularity a of less than 0.970 as found from the following expression:

$$\text{Circularity } a = L_0/L,$$

where $L_0$ represents the circumferential length of a circle having the same projected area as a toner particle image, and L represents the circumferential length of a projected image of a toner particle, said developing assembly comprising at least:

a developing container configured to hold therein the developer;

a developer-carrying member configured and positioned to hold thereon the developer held in said developing container and to transport the developer to a developing zone, said developer-carrying member comprising at least:

a substrate; and a resin coat layer formed on said substrate, said resin coat layer containing at least a coat layer binder resin and a positively chargeable material; and a developer layer thickness regulation member configured and positioned to regulate the layer thickness of the developer to be held on said developer-carrying member, wherein said developing assembly performs development of the electrostatic latent image formed on said latent-image-bearing member, by the use of the developer to render the electrostatic latent image visible as the developer image, and at the same time collects the developer having remained on said latent-image-bearing member after the developer image has been transferred to a recording medium transfer sheet, and wherein said charging means is kept in contact with said latent-image-bearing member at a contact part thereof, and charges said latent-image-bearing member electrostatically upon application of a voltage to the contact part in the state where said conductive fine particles of said developer are interposed between said charging means and said latent-image-bearing member at least at the contact part.

2. The process cartridge according to claim 1, wherein said resin coat layer contains a conductive material.

3. An image forming method comprising:

a charging step of charging a latent-image-bearing member electrostatically;

a latent-image-forming step of writing image information as an electrostatic latent image on the charged surface of the latent-image-bearing member having been charged in said charging step;

a developing step of developing the electrostatic latent image to render the electrostatic latent image visible as a developer image by means of a developing assembly having a developer-carrying member which, holding thereon a developer, transports the developer to a developing zone facing the latent-image-bearing member;

a transfer step of transferring the developer image to a transfer sheet; and a fixing step of fixing by a fixing means the developer image having been transferred to the transfer sheet, wherein said charging step, said latent-image-forming step, said developing step, said transfer step, and said fixing step are repeated to form images, the developer comprising:

toner particles containing at least a binder resin and a colorant; and conductive fine particles, the toner particles having a Circularity a of less than 0.970 as found from the following expression:

Circularity $a=L_0/L$, where $L_0$ represents the circumferential length of a circle having the same projected area as a toner particle image, and L represents the circumferential length of a projected image of a toner particle, the developing assembly comprising at least:

a developing container configured to hold therein the developer;

a developer-carrying member configured and positioned to hold thereon the developer held in the developing container and to transport the developer to the developing zone, the developer-carrying member comprising:

substrate; and a resin coat layer formed on the substrate, the resin coat layer containing at least a coat layer binder resin and a positively chargeable material, and a developer layer thickness regulation member configured and positioned to regulate the layer thickness of the developer to be held on the developer-carrying member, wherein said developing step comprises the step of rendering the electrostatic latent image visible, and at the same time collecting the developer having remained on the latent-image-bearing member after the developer image has been transferred to a recording medium transfer sheet, wherein said charging step is the step of charging the latent-image-bearing member electrostatically, and keeping a charging member in contact with the latent-image-bearing member, and the latent-image-bearing member being charged by applying a voltage to the charging member in the state in which the conductive fine particles of the developer stand interposed at least at a contact zone between the charging member and the latent-image-bearing member.

4. The image forming method according to claim 3, wherein the resin coat layer contains a lubricating material.

5. The process cartridge according to claim 1, wherein said resin coat layer contains a lubricating material.

6. The process cartridge according to claim 1, wherein said resin coat layer contains a conductive material and a lubricating material.

7. The process cartridge according to claim 1, wherein said positively chargeable material is a nitrogen-containing heterocyclic compound.

8. The process cartridge according to claim 7, wherein said nitrogen-containing heterocyclic compound is an imidazole compound.

9. The process cartridge according to claim 8, wherein said imidazole compound is a compound represented by the following Formula (1) or (2);

Formula (1)

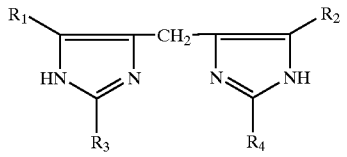

(1)

wherein $R_1$ and $R_2$ each represent a hydrogen atom or a substituent selected from the group consisting of an alkyl group, an aralkyl group and an aryl group, and $R_1$ and $R_2$ may be the same or different; and $R_3$ and $R_4$ each represent a straight chain alkyl group having 3 to 30 carbon atoms, and $R_3$ and $R_4$ may be the same or different; or Formula (2)

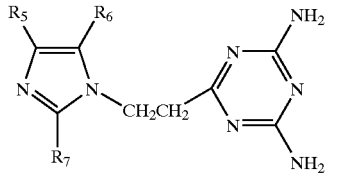

(2)

wherein $R_5$ and $R_6$ each represent a hydrogen atom or a substituent selected from the group consisting of an alkyl group, an aralkyl group and an aryl group, and $R_5$ and $R_6$ may be the same or different; and $R_7$ represents a straight chain alkyl group having 3 to 30 carbon atoms.

10. The process cartridge according to claim 1, wherein said resin coat layer contains as said positively chargeable material a nitrogen-containing heterocyclic compound, and also contains a conductive material and spherical particles having a number average particle diameter of from 0.3 μm to 30 μm.

11. The process cartridge according to claim 10, wherein said spherical particles are resin particles.

12. The process cartridge according to claim 10, wherein said spherical particles are conductive spherical particles having a true density of 3 g/cm$^3$ or less.

13. The process cartridge according to claim 1, wherein said positively chargeable material is a copolymer containing at least a unit derived from a nitrogen containing vinyl monomer.

14. The process cartridge according to claim 13, wherein said copolymer has a weight-average molecular weight Mw of from 3,000 to 50,000.

15. The process cartridge according to claim 13, wherein said copolymer has a ratio of weight-average molecular weight Mw to number average molecular weight Mn, Mw/Mn, of 3.5 or less.

16. The process cartridge according to claim 13, wherein said nitrogen containing vinyl monomer contains at least one monomer selected from the group consisting of an acrylic or methacrylic acid derivative having a nitrogen-containing group and a nitrogen containing heterocyclic N-vinyl compound.

17. The process cartridge according to claim 13, wherein said nitrogen containing vinyl monomer is a monomer represented by the following Formula (3)

Formula (3)

(3)

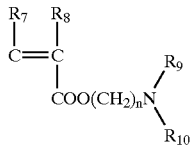

wherein $R_7$, $R_8$, $R_9$ and $R_{10}$ each represent a hydrogen atom or a saturated hydrocarbon group having 1 to 4 carbon atoms; and n represents an integer of 1 to 4.

18. The process cartridge according to claim 1, wherein said positively chargeable material is a copolymer of a polymerizable vinyl monomer with a sulfonic-acid-containing acrylamide monomer, and said coat layer binder resin has, in its molecular structure, at least one of an —NH2 group, an =NH group and an —NH— linkage.

19. The process cartridge according to claim 18, wherein said copolymer contains the polymerizable vinyl monomer and the sulfonic-acid-containing acrylamide monomer in a copolymerization ratio, in terms of % by weight, of from 98:2 to 80:20, and has a weight average molecular weight Mw of from 2,000 to 50,000.

20. The process cartridge according to claim 18, wherein said copolymer is a copolymer of a polymerizable vinyl monomer with 2-acrylamido-2-methylpropanesulfonic acid.

21. The process cartridge according to claim 18, wherein said coat layer binder resin contains at least a phenolic resin.

22. The process cartridge according to claim 21, wherein said phenolic resin is a phenolic resin produced using a nitrogen-containing compound as a catalyst, and have any of an —NH2 group, an =NH group and an —NH— linkage in its structure.

23. The process cartridge according to claim 18, wherein said coat layer binder resin contains at least a polyamide resin.

24. The process cartridge according to claim 18, wherein said coat layer binder resin contains at least a polyurethane resin.

25. The process cartridge according to claim 1, wherein said resin coat layer contains conductive spherical particles.

26. The process cartridge according to claim 25, wherein said particles of said resin coat layer have a number average particle diameter of from 0.3 μm to 30 μm.

27. The process cartridge according to claim 26, wherein said particles of said resin coat layer have a true density of 3 g/cm$^3$ or less.

28. The process cartridge according to claim 1, wherein 15% to 60% of the number particles of said developer range in particle diameter from 1.00 μm to less than 2.00 μm and from 15% to 70% of the number of particles of said developer range in particle diameter from 3.00 μm to less than 8.96 μm, in the number-based particle size distribution of particles of said developer having a particle diameter of from 0.60 μm to less than 159.21 μm.

29. The process cartridge according to claim 1, wherein said conductive fine particles have a volume average particle diameter of from 0.1 μm to 10 μm.

30. The process cartridge according to claim 29, wherein said conductive fine particles have a volume resistivity of from $10^0$ Ω·cm to $10^9$ Ω·cm.

31. The process cartridge according to claim 1, wherein said conductive fine particles are non magnetic.

32. The process cartridge according to claim 1, wherein said conductive fine particles contain at least one oxide selected from zinc oxide, tin oxide and titanium oxide.

33. The image-forming method according to claim 3, wherein said resin coat layer contains a lubricating material.

34. The image-forming method according to claim 3, wherein said resin coat layer contains a conductive material and a lubricating material.

35. The image-forming method according to claim 3, wherein said positively chargeable material is a nitrogen-containing heterocyclic compound.

36. The image-forming method according to claim 35, wherein said nitrogen-containing heterocyclic compound is an imidazole compound.

37. The image-forming method according to claim 36, wherein said imidazole compound is a compound represented by the following Formula (1) or (2);

Formula (1)

(1)

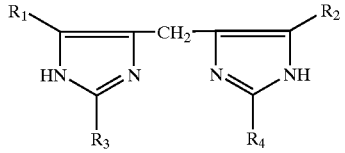

wherein $R_1$ and $R_2$ each represent a hydrogen atom or a substituent selected from the group consisting of an alkyl group, an aralkyl group and an aryl group, and $R_1$ and $R_2$ may be the same or different; and $R_3$ and $R_4$ each represent a straight chain alkyl group having 3 to 30 carbon atoms, and $R_3$ and $R_4$ may be the same or different; or Formula (2)

(2)

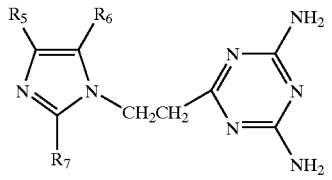

wherein $R_5$ and $R_6$ each represent a hydrogen atom or a substituent selected from the group consisting of an alkyl group, an aralkyl group and an aryl group, and $R_5$ and $R_6$ may be the same or different; and $R_7$ represents a straight chain alkyl group having 3 to 30 carbon atoms.

38. The image-forming method according to claim 3, wherein said resin coat layer contains as said positively chargeable material a nitrogen-containing heterocyclic compound, and also contains a conductive material and spherical particles having a number average particle diameter of from 0.3 μm to 30 μm.

39. The image-forming method according to claim 38, wherein said spherical particles are resin particles.

40. The image-forming method according to claim 38, wherein said spherical particles are conductive spherical particles having a true density of 3 g/cm$^3$ or less.

41. The image-forming method according to claim 3, wherein said positively chargeable material is a copolymer containing at least a unit derived from a nitrogen containing vinyl monomer.

42. The image-forming method according to claim 41, wherein said copolymer has a weight-average molecular weight Mw of from 3,000 to 50,000.

43. The image-forming method according to claim 41, wherein said copolymer has a ratio of weight-average molecular weight Mw to number average molecular weight Mn, Mw/Mn, of 3.5 or less.

44. The image-forming method according to claim 41, wherein said nitrogen containing vinyl monomer contains at least one monomer selected from the group consisting of an acrylic or methacrylic acid derivative having a nitrogen-containing group and a nitrogen containing heterocyclic N-vinyl compound.

45. The image-forming method according to claim 41, wherein said nitrogen containing vinyl monomer is a monomer represented by the following Formula (3), Formula (3)

(3)

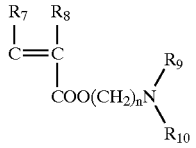

wherein $R_7$, $R_8$, $R_9$ and $R_{10}$ each represent a hydrogen atom or a saturated hydrocarbon group having 1 to 4 carbon atoms; and n represents an integer of 1 to 4.

46. The image-forming method according to claim 3, wherein said positively chargeable material is a copolymer of a polymerizable vinyl monomer with a sulfonic-acid-containing acrylamide monomer, and said coat layer binder resin has, in its molecular structure, at least one of an —NH2 group, an =NH group and an —NH— linkage.

47. The image-forming method according to claim 46, wherein said copolymer contains the polymerizable vinyl monomer and the sulfonic-acid-containing acrylamide monomer in a copolymerization ratios in terms of % by weight, of from 98:2 to 80:20, and has a weight average molecular weight Mw of from 2,000 to 50,000.

48. The image-forming method according to claim 46, wherein said copolymer is a copolymer of a polymerizable vinyl monomer with 2-acrylamido-2-methylpropanesulfonic acid.

49. The image-forming method according to claim 46, wherein said coat layer binder resin contains at least a phenolic resin.

50. The image-forming method according to claim 49, wherein said phenolic resin is a phenolic resin produced using a nitrogen-containing compound as a catalyst, and have any of an —NH2 group, an =NH group and an —NH— linkage in its structure.

51. The image-forming method according to claim 46, wherein said coat layer binder resin contains at least a polyamide resin.

52. The image-forming method according to claim 46, wherein said coat layer binder resin contains at least a polyurethane resin.

53. The image-forming method according to claim 3, wherein said resin coat layer contains conductive spherical particles.

54. The image-forming method according to claim 53, wherein said particles of said resin coat layer have a number average particle diameter of from 0.3 μm to 30 μm.

55. The image-forming method according to claim 54, wherein said particles of said resin coat layer have a true density of 3 g/cm$^3$ or less.

56. The image-forming method according to claim 3, wherein 15% to 60% of the particles of said developer range in particle diameter from 1.00 μm to less than 2.00 μm and from 15% to 70% of the number of particles of said developer range in particle diameter from 3.00 μm to less than 8.96 μm, in the number-based particle size distribution of particles of said developer having a particle diameter of from 0.60 μm to less than 159.21 μm.

57. The image-forming method according to claim 3, wherein said conductive fine particles have a volume average particle diameter of from 0.1 μm to 10 μm.

58. The image-forming method according to claim 57, wherein said conductive fine particles have a volume resistivity of from $10^0$ Ω·cm to $10^9$ Ωcm.

59. The image-forming method according to claim 3, wherein said conductive fine particles are non magnetic.

60. The image-forming method according to claim 3, wherein said conductive fine particles contain at least one oxide selected from zinc oxide, tin oxide and titanium oxide.

61. The process cartridge according to claim 28, wherein the developer contains an inorganic fine powder having an average primary particle diameter of 4 nm to 80 nm.

62. The process cartridge according to claim 1, wherein the developer is a negatively chargeable developer.

63. The image forming method according to claim 56, wherein the developer contains an inorganic fine powder having an average primary particle diameter of 4 nm to 80 nm.

64. The image forming method according to claim 18, wherein the developer is a negatively chargeable developer.

* * * * *

UNITED STATES PATENT AND TRADEMARK OFFICE

CERTIFICATE OF CORRECTION

PATENT NO. : 6,924,076 B2
APPLICATION NO. : 10/218464
DATED : August 2, 2005
INVENTOR(S) : Kazunori Saiki et al.

It is certified that error appears in the above-identified patent and that said Letters Patent is hereby corrected as shown below:

Title page,
Item [56], References Cited, FOREIGN PATENT DOCUMENTS, "0982 636" should read -- 0 982 636 --.

Column 5,
Line 54, "no" should read -- any --.

Column 11,
Line 13, "preferably" should read -- preferably be --.

Column 21,
Line 57, "2.00 νm" should read -- 2.00 μm --.

Column 25,
Lines 10 and 20, "can not" should read -- cannot be --.
Line 51, "developer the" should read -- developer --.
Line 57, "A%" should read -- A%, --.

Column 34,
Line 62, "be" should be deleted.

Column 35,
Line 58, "2.26 cm" should read -- 2.26 $cm^2$ --.

Column 38,
Line 40, "homogenizer)" should read -- homogenizer). --.

Column 39,
Line 31, "also" should read -- also be --.

Column 40,
Line 36, "oxide." should read -- oxides. --.

Column 42,
Line 28, "furanresins," should read -- furan resins, --.

Column 43,
Line 51, "BenzidineYellow, RoseBengale" should read -- Benzidine Yellow, Rose Bengale, --.

UNITED STATES PATENT AND TRADEMARK OFFICE

CERTIFICATE OF CORRECTION

PATENT NO. : 6,924,076 B2
APPLICATION NO. : 10/218464
DATED : August 2, 2005
INVENTOR(S) : Kazunori Saiki et al.

It is certified that error appears in the above-identified patent and that said Letters Patent is hereby corrected as shown below:

Column 45,
Line 29, “developer” should read -- developer, --.
Line 30, “measured” should read -- measured, --.

Column 46,
Line 50, “$R_2$,” should read -- $R^2$, --.

Column 47,
Line 38, “invention” should read -- invention: --.

Column 49,
Line 3, “optionally” should read -- optional --.

Column 51,
Line 46, “Sparator” should read -- Separator --.

Column 52,
Line 41, “electrostalically” should read -- electrostatically --.

Column 54,
Line 58, “descried” should read -- described --.

Column 56,
Line 16, “not come” should read -- not to come --.

Column 60,
Line 19, “maybe” should read -- may be --.

Column 64,
Line 30, “affect” should read -- effect --.
Line 61, “particles and (4).” should read -- particles. --.

Column 68,
Line 24, “fluorideandcarbon” should read -- fluoride and carbon --.

Column 69,
Line 39, “polyesterresin” should read -- polyester resin --.
Line 67, “disperse” should read -- dispersed --.

UNITED STATES PATENT AND TRADEMARK OFFICE

CERTIFICATE OF CORRECTION

PATENT NO. : 6,924,076 B2
APPLICATION NO. : 10/218464
DATED : August 2, 2005
INVENTOR(S) : Kazunori Saiki et al.

It is certified that error appears in the above-identified patent and that said Letters Patent is hereby corrected as shown below:

Column 70,
Line 19, “thereonby” should read -- thereon by --.
Line 53, “maybe” should read -- may be --.

Column 71,
Line 33, “use.” should read -- used. --.

Column 72,
Line 11, “polyazaine” should read -- polyazine --.

Column 73,
Line 62, “characteristics” should read -- characteristic --.

Column 76,
Line 65, “quaternary” should read -- quaternary- --.
Line 66, “ammonium group-containing” should read -- ammonium-group-containing --; and “vinylmonomers” should read -- vinyl monomers --.

Column 77,
Line 17, “other” should read -- another --.

Column 79,
Line 45, “ammoniumsulfamide,” should read -- ammonium sulfamide, --.
Line 46, “ammoniumcarbonate” should read -- ammonium carbonate, --.

Column 80,
Line 5, “modifiedphenolic” should read -- modified phenolic --.

Column 81,
Line 32, “effective” should read -- effect --.
Line 49, “maybe” should read -- may be --.

Column 83,
Line 17, “conductive” (first occurrence) should be deleted.

Column 88,
Line 34, “tower” should read -- toner --.

Column 89,
Line 62, “$10X10^6$V/min” should read -- $10X10^6$V/m in --.

UNITED STATES PATENT AND TRADEMARK OFFICE

CERTIFICATE OF CORRECTION

PATENT NO. : 6,924,076 B2
APPLICATION NO. : 10/218464
DATED : August 2, 2005
INVENTOR(S) : Kazunori Saiki et al.

It is certified that error appears in the above-identified patent and that said Letters Patent is hereby corrected as shown below:

Column 90,
Line 30, "powder" should read -- power --.
Line 49, "$10X10^6$V/min" should read -- $10X10^6$V/m in --.

Column 94,
Line 22, "describe it" should read -- described --.

Column 95,
Line 12, "particle" should read -- particles --.
Line 45, "8.1" should read -- 8.1μm --.

Column 96,
Line 16, "10 Ω.cm" should read -- $10^{14}$ Ω.cm --.

Column 97,
Line 42, "RS-i" should read -- Rs-l --.

Column 101,
Line 10, "changed t" should read -- changed to --.

Column 103,
Line 24, "=0.2/0.8/2.3/0.7/0.3)." should read -- =0.2/0.8/2.3/0.7/0.3]. --.

Column 104,
Line 36, "dding" should read -- adding --.
Line 42, "0.2/0.8/1.7/0.3/0.2)." should read -- 0.2/0.8/1.7/0.3/0.2]. --.

Column 106,
Line 14, "0.2/0.8/2.5/0.5/0.2)." should read -- 0.2/0.8/2.5/0.5/0.2]. --.

Column 107,
Line 52, "images" should read -- image --.

Column 112,
Line 50, "more)" should read -- more). --.

Column 130,
Line 61, in Example N-35, "Df-n-l" should read -- Df-n-3 --.

UNITED STATES PATENT AND TRADEMARK OFFICE

CERTIFICATE OF CORRECTION

PATENT NO. : 6,924,076 B2
APPLICATION NO. : 10/218464
DATED : August 2, 2005
INVENTOR(S) : Kazunori Saiki et al.

It is certified that error appears in the above-identified patent and that said Letters Patent is hereby corrected as shown below:

Column 139,
Line 15, “image forming” should read -- image-forming --.
Line 57, “substrate;” should read -- a substrate; --.

Column 140,
Line 15, “image forming” should read -- image-forming --.

Column 141,
Line 29, “(3)” should read -- (3), --.

Column 142,
Line 13, “number” should read -- number of --.

Column 144,
Line 6, “ratios” should read -- ratio, --.
Line 37, “of the” should read -- of the number of --.
Line 60, “image forming” should read -- image-forming --.
Line 64, “image forming method” should read -- process cartridge --.

Signed and Sealed this

Twenty-seventh Day of June, 2006

JON W. DUDAS
*Director of the United States Patent and Trademark Office*